US010807403B2

(12) United States Patent
Kishi et al.

(10) Patent No.: US 10,807,403 B2
(45) Date of Patent: Oct. 20, 2020

(54) BOOKBINDING APPARATUS

(71) Applicant: MAX CO., LTD., Chuo-ku, Tokyo (JP)

(72) Inventors: Kazuhiko Kishi, Tokyo (JP); Kazuya Igata, Tokyo (JP); Katsuya Hakozaki, Tokyo (JP)

(73) Assignee: MAX CO., LTD., Tokyo (JP)

( * ) Notice: Subject to any disclaimer, the term of this patent is extended or adjusted under 35 U.S.C. 154(b) by 154 days.

(21) Appl. No.: 15/769,207

(22) PCT Filed: Oct. 19, 2016

(86) PCT No.: PCT/JP2016/080974

§ 371 (c)(1),
(2) Date: Apr. 18, 2018

(87) PCT Pub. No.: WO2017/073432

PCT Pub. Date: May 4, 2017

(65) Prior Publication Data

US 2018/0297389 A1 Oct. 18, 2018

(30) Foreign Application Priority Data

Oct. 30, 2015 (JP) ..... 2015-214636

(51) Int. Cl.
*B42B 5/12* (2006.01)
*B65H 37/04* (2006.01)
*B65D 73/00* (2006.01)

(52) U.S. Cl.
CPC ..... *B42B 5/123* (2013.01); *B65D 73/0028* (2013.01); *B65D 73/0035* (2013.01); *B65D 73/0042* (2013.01); *B65H 37/04* (2013.01)

(58) Field of Classification Search
CPC ..... B42B 5/12; B42B 5/123; B42B 5/126; B65D 73/0035; B65D 73/0042;
(Continued)

(56) References Cited

U.S. PATENT DOCUMENTS 2,166,519 A 7/1939 Catini
2,177,054 A * 10/1939 Catini ..... B42B 5/123 140/92.93
(Continued)

FOREIGN PATENT DOCUMENTS

JP 2002-337474 A 11/2002
JP 2008-213169 A 9/2008
(Continued)

OTHER PUBLICATIONS

International Search Report/Written Opinion dated Nov. 22, 2016 for PCT/JP2016/080974, including English translation of search report.

*Primary Examiner* — Edward T Tolan
(74) *Attorney, Agent, or Firm* — Rothwell, Figg, Ernst & Manbeck, P.C.

(57) ABSTRACT

A bookbinding apparatus includes a sheet aligning unit which stacks and aligns plural sheets having holes formed therein, a binding mechanism which binds the sheets aligned in the sheet aligning unit by conveying a binding component in an axial direction while rotating the binding component in a circumferential direction, a binding component storing unit which stores therein plural binding components; a binding component conveyance path which conveys the binding component from the binding component storing unit to the binding mechanism. The binding component conveyance path forms a curved conveyance path for conveying the binding component with being curved with respect to the axial direction to an end portion of a side of the aligned sheets at which the binding mechanism starts inserting the binding component, at a position that is distant from the end portion by a distance smaller than a length of one binding component.

8 Claims, 137 Drawing Sheets

CONFIGURATION EXAMPLE OF BOOKBINDING APPARATUS OF FIRST EMBODIMENT

(58) Field of Classification Search
CPC ..... B65D 73/0028; B21F 3/04; B21F 33/04; B21F 45/16; B42F 13/04; B42F 13/165; B42C 13/00
See application file for complete search history.

(56) References Cited

U.S. PATENT DOCUMENTS 5,527,141 A * 6/1996 Malmstrom ..... B42B 5/123 412/38
5,584,633 A 12/1996 Scharer
5,669,747 A 9/1997 Scharer
5,695,308 A 12/1997 Hastings et al.
5,785,479 A 7/1998 Battisti et al.
5,890,862 A 4/1999 Spiel et al.
5,934,340 A 8/1999 Anthony, III et al.
5,955,183 A 9/1999 Braun
6,036,423 A * 3/2000 Westra ..... B42B 5/123 412/38
6,527,016 B2 3/2003 Todaro
6,868,872 B2 * 3/2005 Fuchs ..... B42C 5/02 140/92.93
7,766,595 B2 * 8/2010 Lehmann ..... B42B 5/123 140/92.93
8,727,689 B2 * 5/2014 Yoshie ..... B42B 5/123 412/1
9,649,869 B2 * 5/2017 Klassen ..... B42B 5/123
10,377,164 B2 * 8/2019 Hakozaki ..... B42F 13/165
2008/0075560 A1 3/2008 Kurabayashi et al.
2008/0246205 A1 * 10/2008 Fujii ..... B41L 43/12 270/58.08
2010/0043909 A1 2/2010 Yoshie et al.
2013/0272819 A1 10/2013 Kimura et al.

FOREIGN PATENT DOCUMENTS

JP 4300984 B2 7/2009
JP 2013-220548 A 10/2013

* cited by examiner

CONFIGURATION EXAMPLE OF COIL HOLDING SHEET
OF FIRST EMBODIMENT

CONFIGURATION EXAMPLE OF MAIN PARTS OF COIL HOLDING SHEET OF FIRST EMBODIMENT

EXAMPLE OF COIL HOLDING SHEET OF FIRST EMBODIMENT, TO WHICH COILS ARE HELD

EXAMPLE OF COIL HOLDING SHEET OF FIRST EMBODIMENT, TO WHICH COILS ARE HELD

EXAMPLE OF COIL HOLDING SHEET OF FIRST EMBODIMENT,
TO WHICH COILS ARE HELD

EXAMPLE OF COIL HOLDING SHEET OF FIRST EMBODIMENT,
TO WHICH COILS ARE HELD

EXAMPLE OF COIL HOLDING SHEET OF FIRST EMBODIMENT, TO WHICH COILS ARE HELD

EXAMPLE OF COIL HOLDING SHEET OF FIRST EMBODIMENT, TO WHICH COILS ARE HELD

EXAMPLE OF COIL HOLDING SHEET OF FIRST EMBODIMENT, TO WHICH COILS ARE HELD

CONFIGURATION EXAMPLE OF COIL

MODIFIED EMBODIMENT OF COIL HOLDING SHEET
OF FIRST EMBODIMENT

EXAMPLE OF COIL HOLDING SHEET OF MODIFIED EMBODIMENT, TO WHICH COILS ARE HELD

EXAMPLE OF COIL HOLDING SHEET OF MODIFIED EMBODIMENT, TO WHICH COILS ARE HELD

EXAMPLE OF COIL HOLDING SHEET OF MODIFIED EMBODIMENT, TO WHICH COILS ARE HELD

EXAMPLE OF COIL HOLDING SHEET OF MODIFIED EMBODIMENT, TO WHICH COILS ARE HELD

EXAMPLE OF COIL HOLDING SHEET OF MODIFIED EMBODIMENT, TO WHICH COILS ARE HELD

ANOTHER MODIFIED EMBODIMENT OF COIL HOLDING SHEET OF FIRST EMBODIMENT

EXAMPLE OF COIL HOLDING SHEET OF ANOTHER MODIFIED EMBODIMENT, TO WHICH COILS ARE HELD

EXAMPLE OF COIL HOLDING SHEET OF ANOTHER MODIFIED EMBODIMENT, TO WHICH COILS ARE HELD

EXAMPLE OF COIL HOLDING SHEET OF ANOTHER MODIFIED EMBODIMENT, TO WHICH COILS ARE HELD

EXAMPLE OF COIL HOLDING SHEET OF ANOTHER MODIFIED EMBODIMENT, TO WHICH COILS ARE HELD

EXAMPLE OF COIL HOLDING SHEET OF ANOTHER MODIFIED EMBODIMENT, TO WHICH COILS ARE HELD

ANOTHER MODIFIED EMBODIMENT OF COIL HOLDING SHEET OF FIRST EMBODIMENT

EXAMPLE OF COIL HOLDING SHEET OF ANOTHER MODIFIED EMBODIMENT, TO WHICH COILS ARE HELD

EXAMPLE OF COIL HOLDING SHEET OF ANOTHER MODIFIED EMBODIMENT, TO WHICH COILS ARE HELD

EXAMPLE OF COIL HOLDING SHEET OF ANOTHER MODIFIED EMBODIMENT, TO WHICH COILS ARE HELD

EXAMPLE OF COIL HOLDING SHEET OF ANOTHER MODIFIED EMBODIMENT, TO WHICH COILS ARE HELD

EXAMPLE OF COIL HOLDING SHEET OF ANOTHER MODIFIED EMBODIMENT, TO WHICH COILS ARE HELD

ANOTHER MODIFIED EMBODIMENT OF COIL HOLDING SHEET OF FIRST EMBODIMENT

EXAMPLE OF COIL HOLDING SHEET OF ANOTHER MODIFIED EMBODIMENT, TO WHICH COILS ARE HELD

EXAMPLE OF COIL HOLDING SHEET OF ANOTHER MODIFIED EMBODIMENT, TO WHICH COILS ARE HELD

EXAMPLE OF COIL HOLDING SHEET OF ANOTHER MODIFIED EMBODIMENT, TO WHICH COILS ARE HELD

EXAMPLE OF COIL HOLDING SHEET OF ANOTHER MODIFIED EMBODIMENT, TO WHICH COILS ARE HELD

EXAMPLE OF COIL HOLDING SHEET OF ANOTHER MODIFIED EMBODIMENT, TO WHICH COILS ARE HELD

CONFIGURATION EXAMPLE OF COIL HOLDING SHEET
OF SECOND EMBODIMENT

CONFIGURATION EXAMPLE OF MAIN PARTS OF COIL HOLDING SHEET OF SECOND EMBODIMENT

EXAMPLE OF COIL HOLDING SHEET OF SECOND EMBODIMENT, TO WHICH COILS ARE HELD

EXAMPLE OF COIL HOLDING SHEET OF SECOND EMBODIMENT, TO WHICH COILS ARE HELD

EXAMPLE OF COIL HOLDING SHEET OF SECOND EMBODIMENT, TO WHICH COILS ARE HELD

EXAMPLE OF COIL HOLDING SHEET OF SECOND EMBODIMENT, TO WHICH COILS ARE HELD

EXAMPLE OF COIL HOLDING SHEET OF SECOND EMBODIMENT, TO WHICH COILS ARE HELD

MODIFIED EMBODIMENT OF COIL HOLDING SHEET OF THE SECOND EMBODIMENT

EXAMPLE OF COIL HOLDING SHEET OF MODIFIED EMBODIMENT, TO WHICH COILS ARE HELD

EXAMPLE OF COIL HOLDING SHEET OF MODIFIED EMBODIMENT, TO WHICH COILS ARE HELD

EXAMPLE OF COIL HOLDING SHEET OF MODIFIED EMBODIMENT, TO WHICH COILS ARE HELD

EXAMPLE OF COIL HOLDING SHEET OF MODIFIED EMBODIMENT, TO WHICH COILS ARE HELD

EXAMPLE OF COIL HOLDING SHEET OF MODIFIED EMBODIMENT, TO WHICH COILS ARE HELD

ANOTHER MODIFIED EMBODIMENT OF COIL HOLDING SHEET OF SECOND EMBODIMENT

EXAMPLE OF COIL HOLDING SHEET OF ANOTHER MODIFIED EMBODIMENT, TO WHICH COILS ARE HELD

EXAMPLE OF COIL HOLDING SHEET OF ANOTHER MODIFIED EMBODIMENT, TO WHICH COILS ARE HELD

EXAMPLE OF COIL HOLDING SHEET OF ANOTHER MODIFIED EMBODIMENT, TO WHICH COILS ARE HELD

EXAMPLE OF COIL HOLDING SHEET OF ANOTHER MODIFIED EMBODIMENT, TO WHICH COILS ARE HELD

EXAMPLE OF COIL HOLDING SHEET OF MODIFIED EMBODIMENT, TO WHICH COILS ARE HELD

MODIFIED EMBODIMENT OF COIL HOLDING SHEET
OF SECOND EMBODIMENT

EXAMPLE OF COIL HOLDING SHEET OF MODIFIED EMBODIMENT, TO WHICH COILS ARE HELD

EXAMPLE OF COIL HOLDING SHEET OF MODIFIED EMBODIMENT, TO WHICH COILS ARE HELD

EXAMPLE OF COIL HOLDING SHEET OF MODIFIED EMBODIMENT, TO WHICH COILS ARE HELD

EXAMPLE OF COIL HOLDING SHEET OF MODIFIED EMBODIMENT, TO WHICH COILS ARE HELD

EXAMPLE OF COIL HOLDING SHEET OF MODIFIED EMBODIMENT, TO WHICH COILS ARE HELD

CONFIGURATION EXAMPLE OF COIL HOLDING SHEET
OF THIRD EMBODIMENT

CONFIGURATION EXAMPLE OF MAIN PARTS OF COIL HOLDING SHEET OF THIRD EMBODIMENT

EXAMPLE OF COIL HOLDING SHEET OF THIRD EMBODIMENT, TO WHICH COILS ARE HELD

EXAMPLE OF COIL HOLDING SHEET OF THIRD EMBODIMENT, TO WHICH COILS ARE HELD

EXAMPLE OF COIL HOLDING SHEET OF THIRD EMBODIMENT,
TO WHICH COILS ARE HELD

EXAMPLE OF COIL HOLDING SHEET OF THIRD EMBODIMENT, TO WHICH COILS ARE HELD

EXAMPLE OF COIL HOLDING SHEET OF THIRD EMBODIMENT, TO WHICH COILS ARE HELD

MODIFIED EMBODIMENT OF COIL HOLDING SHEET
OF THIRD EMBODIMENT

EXAMPLE OF COIL HOLDING SHEET OF MODIFIED EMBODIMENT, TO WHICH COILS ARE HELD

EXAMPLE OF COIL HOLDING SHEET OF MODIFIED EMBODIMENT, TO WHICH COILS ARE HELD

EXAMPLE OF COIL HOLDING SHEET OF MODIFIED EMBODIMENT, TO WHICH COILS ARE HELD

EXAMPLE OF COIL HOLDING SHEET OF MODIFIED EMBODIMENT, TO WHICH COILS ARE HELD

EXAMPLE OF COIL HOLDING SHEET OF MODIFIED EMBODIMENT, TO WHICH COILS ARE HELD

ANOTHER MODIFIED EMBODIMENT OF COIL HOLDING SHEET OF THIRD EMBODIMENT

EXAMPLE OF COIL HOLDING SHEET OF ANOTHER MODIFIED EMBODIMENT, TO WHICH COILS ARE HELD

EXAMPLE OF COIL HOLDING SHEET OF ANOTHER MODIFIED EMBODIMENT, TO WHICH COILS ARE HELD

EXAMPLE OF COIL HOLDING SHEET OF ANOTHER MODIFIED EMBODIMENT, TO WHICH COILS ARE HELD

EXAMPLE OF COIL HOLDING SHEET OF ANOTHER MODIFIED EMBODIMENT, TO WHICH COILS ARE HELD

EXAMPLE OF COIL HOLDING SHEET OF ANOTHER MODIFIED EMBODIMENT, TO WHICH COILS ARE HELD

ANOTHER MODIFIED EMBODIMENT OF COIL HOLDING SHEET OF THIRD EMBODIMENT

EXAMPLE OF COIL HOLDING SHEET OF ANOTHER MODIFIED EMBODIMENT, TO WHICH COILS ARE HELD

EXAMPLE OF COIL HOLDING SHEET OF ANOTHER MODIFIED EMBODIMENT, TO WHICH COILS ARE HELD

EXAMPLE OF COIL HOLDING SHEET OF ANOTHER MODIFIED EMBODIMENT, TO WHICH COILS ARE HELD

EXAMPLE OF COIL HOLDING SHEET OF ANOTHER MODIFIED EMBODIMENT, TO WHICH COILS ARE HELD

EXAMPLE OF COIL HOLDING SHEET OF ANOTHER MODIFIED EMBODIMENT, TO WHICH COILS ARE HELD

CONFIGURATION EXAMPLE OF COIL HOLDING SHEET
OF FOURTH EMBODIMENT

EXAMPLE OF COIL HOLDING SHEET OF FOURTH EMBODIMENT, TO WHICH COILS ARE HELD

EXAMPLE OF COIL HOLDING SHEET OF FOURTH EMBODIMENT, TO WHICH COILS ARE HELD

EXAMPLE OF COIL HOLDING SHEET OF FOURTH EMBODIMENT, TO WHICH COILS ARE HELD

EXAMPLE OF COIL HOLDING SHEET OF FOURTH EMBODIMENT, TO WHICH COILS ARE HELD

EXAMPLE OF COIL HOLDING SHEET OF FOURTH EMBODIMENT, TO WHICH COILS ARE HELD

CONFIGURATION EXAMPLE OF COIL HOLDING SHEET
OF FIFTH EMBODIMENT

EXAMPLE OF COIL HOLDING SHEET OF FIFTH EMBODIMENT, TO WHICH COILS ARE HELD

EXAMPLE OF COIL HOLDING SHEET OF FIFTH EMBODIMENT, TO WHICH COILS ARE HELD

EXAMPLE OF COIL HOLDING SHEET OF FIFTH EMBODIMENT,
TO WHICH COILS ARE HELD

EXAMPLE OF COIL HOLDING SHEET OF FIFTH EMBODIMENT,
TO WHICH COILS ARE HELD

EXAMPLE OF COIL HOLDING SHEET OF FIFTH EMBODIMENT, TO WHICH COILS ARE HELD

CONFIGURATION EXAMPLE OF COIL HOLDING SHEET
OF SIXTH EMBODIMENT

EXAMPLE OF COIL HOLDING SHEET OF SIXTH EMBODIMENT, TO WHICH COILS ARE HELD

EXAMPLE OF COIL HOLDING SHEET OF SIXTH EMBODIMENT, TO WHICH COILS ARE HELD

EXAMPLE OF COIL HOLDING SHEET OF SIXTH EMBODIMENT, TO WHICH COILS ARE HELD

EXAMPLE OF COIL HOLDING SHEET OF SIXTH EMBODIMENT, TO WHICH COILS ARE HELD

EXAMPLE OF COIL HOLDING SHEET OF SIXTH EMBODIMENT, TO WHICH COILS ARE HELD

CONFIGURATION EXAMPLE OF COIL HOLDING SHEET
CORRESPONDING TO DIFFERENCE IN COIL DIAMETER

CONFIGURATION EXAMPLE OF COIL HOLDING SHEET
CORRESPONDING TO DIFFERENCE IN COIL DIAMETER

EXAMPLE WHERE COILS ARE HELD TO COIL HOLDING SHEET CORRESPONDING TO DIFFERENCE IN COIL DIAMETER

EXAMPLE WHERE COILS ARE HELD TO COIL HOLDING SHEET CORRESPONDING TO DIFFERENCE IN COIL DIAMETER

CONFIGURATION EXAMPLE OF BOOKBINDING APPARATUS
OF FIRST EMBODIMENT

CONFIGURATION EXAMPLE OF BOOKBINDING APPARATUS OF FIRST EMBODIMENT

CONFIGURATION EXAMPLE OF BOOKBINDING APPARATUS OF FIRST EMBODIMENT

OUTLINE OF BOOKBINDING PROCESS BY BOOKBINDING APPARATUS

OUTLINE OF BOOKBINDING PROCESS BY BOOKBINDING APPARATUS

OUTLINE OF BOOKBINDING PROCESS BY BOOKBINDING APPARATUS

EXAMPLE OF USING ASPECT OF BOOKBINDING APPARATUS OF EMBODIMENT

CONFIGURATION EXAMPLE OF BOOKBINDING APPARATUS OF SECOND EMBODIMENT

CONFIGURATION EXAMPLE OF BOOKBINDING APPARATUS OF SECOND EMBODIMENT

CONFIGURATION EXAMPLE OF BOOKBINDING APPARATUS OF THIRD EMBODIMENT

CONFIGURATION EXAMPLE OF BOOKBINDING APPARATUS OF THIRD EMBODIMENT

CONFIGURATION EXAMPLE OF BOOKBINDING APPARATUS OF FOURTH EMBODIMENT

CONFIGURATION EXAMPLE OF BOOKBINDING APPARATUS OF FOURTH EMBODIMENT

CONFIGURATION EXAMPLE OF BOOKBINDING APPARATUS OF FIFTH EMBODIMENT

CONFIGURATION EXAMPLE OF BOOKBINDING APPARATUS OF FIFTH EMBODIMENT

CONFIGURATION EXAMPLE OF BOOKBINDING APPARATUS OF SIXTH EMBODIMENT

BOOKBINDING EXAMPLE OF BOOKLETS HAVING DIFFERENT THICKNESSES

CONFIGURATION EXAMPLE OF COIL SEPARATING UNIT OF FIRST EMBODIMENT

CONFIGURATION EXAMPLE OF COIL SEPARATING UNIT
OF FIRST EMBODIMENT

CONFIGURATION EXAMPLE OF COIL SEPARATING UNIT
OF FIRST EMBODIMENT

MODIFIED EMBODIMENT OF COIL SEPARATING UNIT
OF FIRST EMBODIMENT

MODIFIED EMBODIMENT OF COIL SEPARATING UNIT OF FIRST EMBODIMENT

MODIFIED EMBODIMENT OF COIL SEPARATING UNIT OF FIRST EMBODIMENT

OPERATION EXAMPLE OF COIL SEPARATING UNIT
OF FIRST EMBODIMENT

OPERATION EXAMPLE OF COIL SEPARATING UNIT
OF FIRST EMBODIMENT

OPERATION EXAMPLE OF COIL SEPARATING UNIT
OF FIRST EMBODIMENT

CONFIGURATION EXAMPLE OF COIL SEPARATING UNIT
OF SECOND EMBODIMENT

CONFIGURATION EXAMPLE OF COIL SEPARATING UNIT
OF SECOND EMBODIMENT

OPERATION EXAMPLE OF COIL SEPARATING UNIT
OF SECOND EMBODIMENT

OPERATION EXAMPLE OF COIL SEPARATING UNIT
OF SECOND EMBODIMENT

OPERATION EXAMPLE OF COIL SEPARATING UNIT
OF SECOND EMBODIMENT

CONFIGURATION EXAMPLE OF COIL SEPARATING UNIT
OF THIRD EMBODIMENT

CONFIGURATION EXAMPLE OF COIL SEPARATING UNIT
OF THIRD EMBODIMENT

OPERATION EXAMPLE OF COIL SEPARATING UNIT
OF THIRD EMBODIMENT

OPERATION EXAMPLE OF COIL SEPARATING UNIT
OF THIRD EMBODIMENT

OPERATION EXAMPLE OF COIL SEPARATING UNIT
OF THIRD EMBODIMENT

MODIFIED EMBODIMENT OF COIL SEPARATING UNIT OF EMBODIMENT

ANOTHER MODIFIED EMBODIMENT OF COIL SEPARATING UNIT OF EMBODIMENT

ANOTHER MODIFIED EMBODIMENT OF COIL SEPARATING UNIT OF EMBODIMENT

FUNCTIONAL CONFIGURATION EXAMPLE OF BOOKBINDING APPARATUS OF EMBODIMENT

BOOKBINDING APPARATUS

TECHNICAL FIELD

The present invention relates to a bookbinding apparatus configured to bind a plurality of sheets formed with holes by a binding component and to thereby make a booklet.

BACKGROUND ART

As a binder configured to bind a plurality of sheets, a binding component, which is referred to as a coil obtained by spirally winding a wire rod of resin, metal or the like, has been suggested. In a bookbinding operation of using the coil, the coil is manually inserted into the holes formed in sheets from side surfaces of the sheets.

In contrast, a bookbinding apparatus, which includes a sheet platen and a coil insertion mechanism configured to axially convey the coil while rotating the coil in a circumferential direction and to insert the coil into holes of the sheets placed on the sheet platen, has been suggested.

For example, a bookbinding apparatus has been suggested which includes a sheet platen, a coil platen on which one coil is to be placed, a coil conveying mechanism configured to axially convey the coil placed on the coil platen while rotating the coil in a circumferential direction and to insert the coil into holes of the sheets placed on the sheet platen from side surfaces of the sheets, and a discharging mechanism configured to discharge the sheets bound with the coil (for example, refer to Patent Document 1).

In the conventional bookbinding apparatus, the coil is axially conveyed to the sheets placed on the sheet platen from sides of the sheets. For this reason, the coil platen protrudes laterally from an apparatus main body.

Also, a technology has been suggested in which the coil platen is configured as an independent component in a bookbinding apparatus made to be small with no discharging mechanism (for example, refer to Patent Document 2).

In the meantime, a bookbinding apparatus has been suggested in which a size of an apparatus main body is increased in a coil conveying direction and a coil platen is stored in the apparatus main body (for example, refer to Patent Document 3).

Also, a bookbinding apparatus has been suggested which includes a coil conveyance path configured to bend a coil conveyance route so as to set a coil placing direction from a front side of the apparatus main body (for example, refer to Patent Document 4).

Also, a technology has been suggested which provides a coil conveyance path configured to bend a coil conveyance route to a bookbinding apparatus configured to cut a long coil in conformity to a width of a sheet, too (for example, refer to Patent Document 5).

In any of the above-described bookbinding apparatus, since an operator places the sheet on the sheet platen and the coil on the coil platen by a hand, it is not possible to consecutively perform a bookbinding operation.

Also, a binding component having a configuration where a plurality of annular ring parts are coupled by a back part and each of the ring parts divided into multiple pieces is coupled by a flexible hinge part so that the ring part can be opened and closed has been suggested.

A bookbinding apparatus configured to use the above binding component and to be used with being connected to an image forming apparatus and the like has been suggested. For example, a bookbinding apparatus has been suggested which includes a binding component storing unit configured to feedably store therein a plurality of above binding components, a sheet aligning mechanism configured to form holes in sheets fed from the image forming apparatus or the like and to align the sheets, and a binding mechanism configured to feed the binding component from the binding component storing unit and to bind the sheets aligned with the sheet aligning mechanism by the binding component (for example, refer to Patent Document 6).

Also, a bookbinding apparatus has been suggested which includes a binding component storing unit configured to feedably store therein a plurality of binding components, each of which having a flexible and openable/closable annular ring, a sheet aligning mechanism configured to form holes in sheets fed from an image forming apparatus or the like and to align the sheets, and a binding mechanism configured to feed the binding component from the binding component storing unit and to bind the sheets aligned with the sheet aligning mechanism by the binding component (for example, refer to Patent Document 7).

In the meantime, a technology of supplying a plurality of coils with being held to a sheet has been suggested. For example, a technology of providing openings, in which a spiral coil can be inserted one turn by one turn, in conformity to a pitch of the coil and holding a substantial center position of the coil in a radial direction with a sheet has been suggested (for example, refer to Patent Document 8).

Patent Document 8 discloses a technology of pressing portions, which protrude from a back surface side of a sheet, of a coil held to the sheet from the back surface side of the sheet, thereby separating the coil from the sheet.

Also, a technology of supplying a plurality of coils with being bonded to a front surface of a sheet by an adhesive or the like has been suggested (for example, refer to Patent Document 9).

Also, a technology of supplying a plurality of coils with being stored in a cartridge and a technology of feeding the coil from the cartridge have been suggested (for example, refer to Patent Document 10).

Also, a bookbinding apparatus having the cartridge disclosed in Patent Document 10 mounted thereto and configured to bind sheets with the coil supplied from the cartridge has been suggested (for example, refer to Patent Document 11).

PRIOR ART DOCUMENTS

Patent Documents

Patent Document 1: U.S. Pat. No. 6,527,016B
Patent Document 2: U.S. Pat. No. 5,695,308B
Patent Document 3: U.S. Pat. No. 5,890,862B
Patent Document 4: U.S. Pat. No. 5,934,340B
Patent Document 5: U.S. Pat. No. 2,166,519B
Patent Document 6: Japanese Patent No. 4,300,984B
Patent Document 7: JP-A-2013-220548
Patent Document 8: U.S. Pat. No. 5,955,183B
Patent Document 9: U.S. Pat. No. 5,584,633B
Patent Document 10: U.S. Pat. No. 5,669,747B
Patent Document 11: U.S. Pat. No. 5,785,479B

SUMMARY OF THE INVENTION

Problems to be Solved

In the bookbinding apparatus where the coil obtained by spirally winding the wire rod is used as the binding component, the coil is axially conveyed along a direction in which the holes formed in the sheet are aligned and is inserted into the holes of the sheet while the coil is rotated in the circumferential direction. Therefore, it is necessary to provide a space, which corresponds to an entire length of one coil having a length conforming to the sheet to be bound, at one side of the sheet with respect to the direction in which the holes are aligned.

As disclosed in Patent Document 1 and the like, in the configuration where the coil platen protrudes from the apparatus main body, a wide operation space is required. Also, as disclosed in Patent Document 3, in the configuration where the coil platen is accommodated in the apparatus main body, the apparatus becomes enlarged.

Even in the configuration where the coil is supplied with being held to the sheet, it is necessary to provide a side of the apparatus main body with the coil platen configured to place thereon the coil separated from the sheet. Also in the configuration where the coil is supplied by the cartridge, it is necessary to mount the cartridge to a side of the apparatus main body.

In Patent Document 6, the consecutive bookbinding operation can be performed. However, since the binding component having a moveable part is used, the cost of the binding component is high. Also, a mechanism configured to close the binding component is required.

Also in Patent Document 7, the consecutive bookbinding operation can be performed but a mechanism configured to open and close the binding component is required.

The present invention has been made in view of the above situations, and an object thereof is to provide a bookbinding apparatus capable of performing consecutive bookbinding processing by using a binding component obtained by spirally winding a wire rod.

Means for Solving the Problems

In order to achieve the above object, the present invention provides a bookbinding apparatus configured to bind sheets having a plurality of holes formed therein in one row with a binding component obtained by spirally winding a wire rod. The bookbinding apparatus may include a sheet conveyance path configured to convey a sheet processed in an image forming apparatus, a hole forming unit configured to form a plurality of holes in one row at an end portion of the sheet to be conveyed on the sheet conveyance path, a sheet aligning unit configured to stack and align a plurality of sheets having holes formed in the hole forming unit, a binding mechanism configured to bind the sheets aligned in the sheet aligning unit by conveying the binding component in an axial direction while rotating the binding component in a circumferential direction, a binding component storing unit configured to store therein a plurality of binding components, a binding component conveyance path configured to convey the binding component, which is to be supplied from the binding component storing unit, to the binding mechanism, and a booklet discharging unit configured to discharge a booklet bound with the binding component. The binding component conveyance path may form a curved conveyance path for conveying the binding component with being curved with respect to the axial direction to an end portion of a side, at which the binding mechanism starts insertion of the binding component, of the sheets aligned in the sheet aligning unit, at a position that is distant from the end portion by a distance smaller than a length of one binding component.

Also, the present invention provides a bookbinding apparatus configured to bind sheets having a plurality of holes formed therein in one row with a binding component obtained by spirally winding a wire rod. The bookbinding apparatus may include a sheet aligning unit configured to stack and align a plurality of sheets, a binding component storing unit configured to store therein a plurality of binding components, a binding mechanism configured to bind the sheets aligned in the sheet aligning unit by conveying the binding component in an axial direction while rotating the same in a circumferential direction, and a binding component conveyance path configured to convey the binding component, which is to be supplied from the binding component storing unit, to the binding mechanism. The binding component conveyance path may form a curved conveyance path for conveying the binding component with being curved with respect to the axial direction to an end portion of a side, at which the binding mechanism starts insertion of the binding component, of the sheets aligned in the sheet aligning unit, at a position that is distant from the end portion by a distance smaller than a length of one binding component.

Effects of the Invention

According to the present invention, it is possible to perform processing of conveying the sheet, processing of forming holes in the sheet, processing of aligning a plurality of sheets having holes formed therein, processing of supplying the binding component, and processing of binding the aligned sheets with the binding component. Therefore, it is possible to perform the consecutive bookbinding processing by using the binding component obtained by spirally winding the wire rod.

Also, the curved conveyance route configured to convey the binding component with being curved in the axial direction to the end portion of the side, at which the binding mechanism starts insertion of the binding component, of the sheets aligned in the sheet aligning unit is provided at the position that is distant from the end portion by the distance smaller than the length of one binding component. Thereby, it is not necessary to provide a space, which corresponds to an entire length of one binding component having a length conforming to the sheet to be bound, at one side of the sheet with respect to the direction in which the holes are aligned. Accordingly, it is possible to make the apparatus smaller.

BRIEF DESCRIPTION OF THE DRAWINGS

FIG. 120 is a front view depicting an outline of the internal configuration of the bookbinding apparatus of a fifth embodiment.

FIG. 121 is a plan view of main parts depicting an outline of the internal configuration of the bookbinding apparatus of the fifth embodiment.

FIG. 122 is a front view depicting an outline of the internal configuration of the bookbinding apparatus of a sixth embodiment.

FIG. 123 illustrates a bookbinding example of booklets having different thicknesses.

FIG. 124 is a perspective view depicting an example of a coil separating unit of a first embodiment.

FIG. 125 is a perspective view depicting an example of the coil separating unit of the first embodiment.

FIG. 126 is a side view depicting an example of the coil separating unit of the first embodiment.

FIG. 127 is a perspective view depicting a modified embodiment of the coil separating unit of the first embodiment.

FIG. 128 is a perspective view depicting another modified embodiment of the coil separating unit of the first embodiment.

FIG. 129 is a perspective view depicting another modified embodiment of the coil separating unit of the first embodiment.

FIG. 130 is a side view depicting an example of an operation of the coil separating unit of the first embodiment.

FIG. 131 is a side view depicting an example of the operation of the coil separating unit of the first embodiment.

Figure 132:
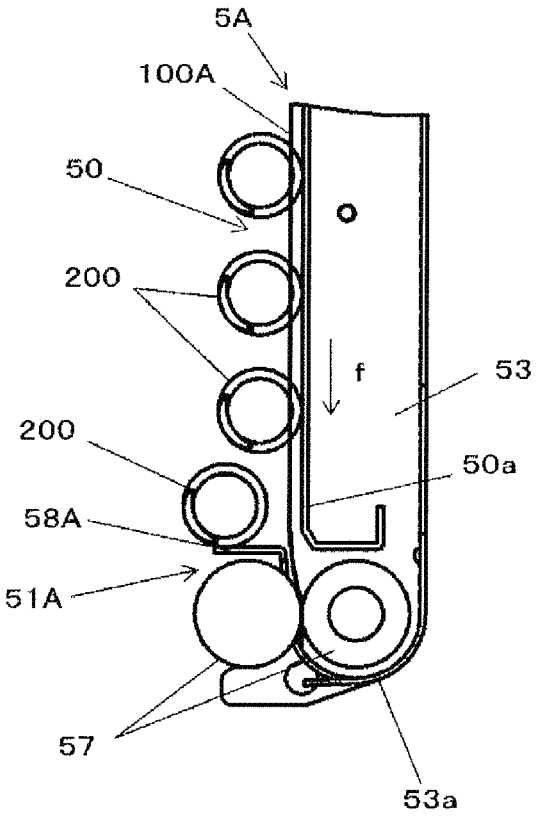

FIG. 132 is a side view depicting an example of the operation of the coil separating unit of the first embodiment.

Figure 133:
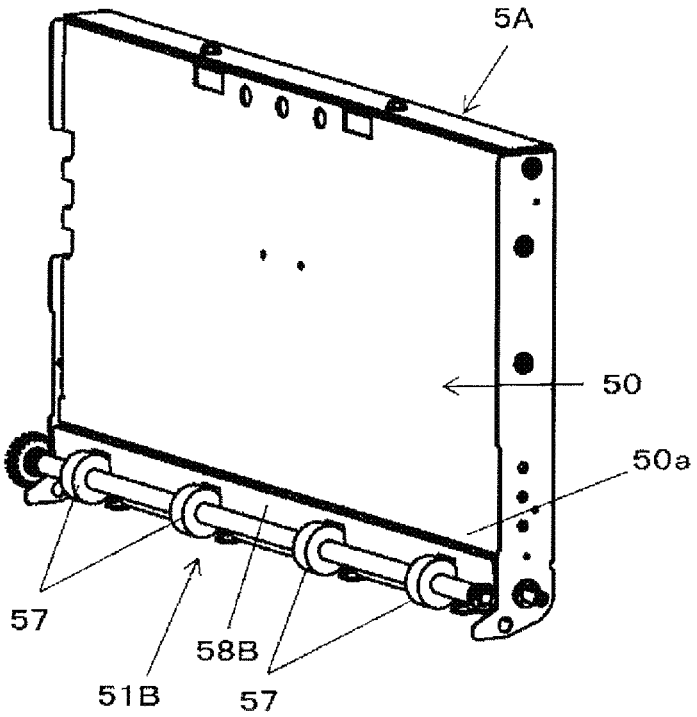

FIG. 133 is a perspective view depicting an example of the coil separating unit of a second embodiment.

Figure 134:
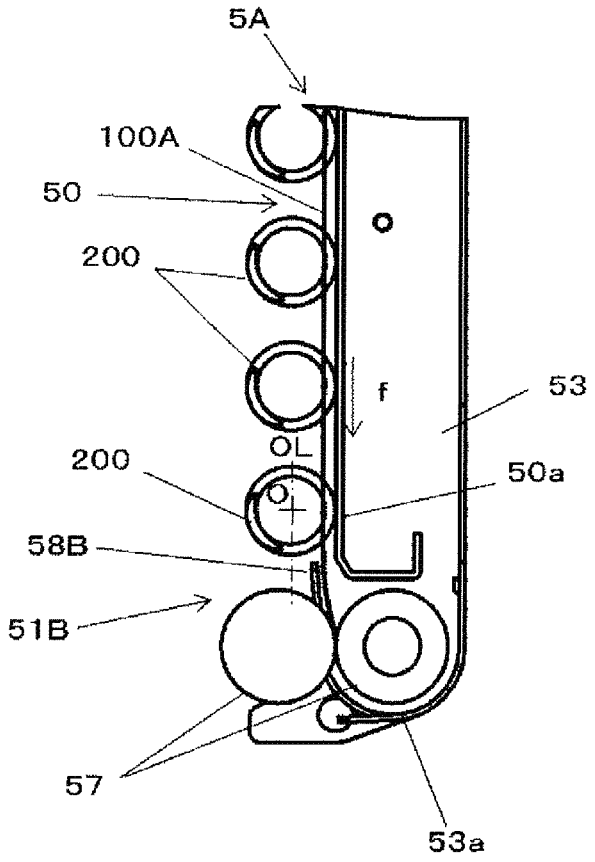

FIG. 134 is a side view depicting an example of the coil separating unit of the second embodiment.

Figure 135:
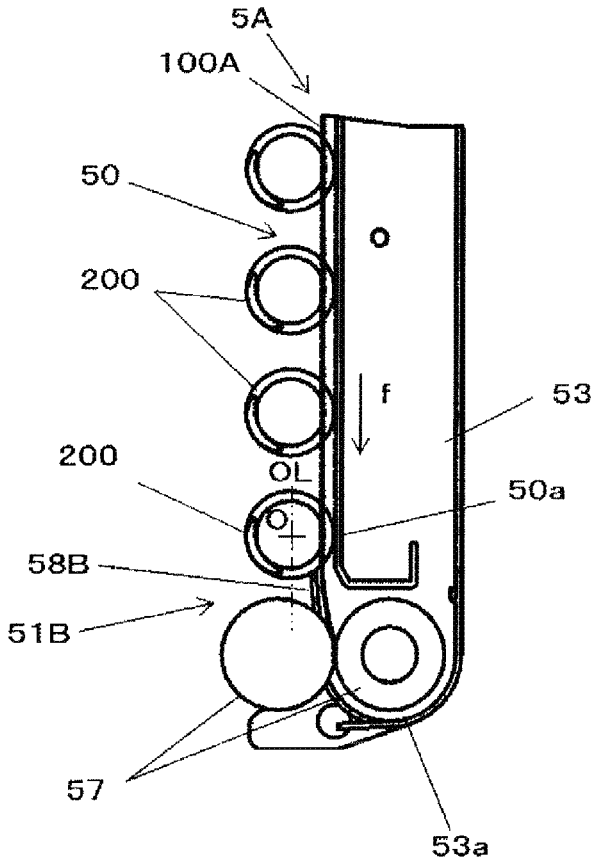

FIG. 135 is a side view depicting an example of the operation of the coil separating unit of the second embodiment.

Figure 136:
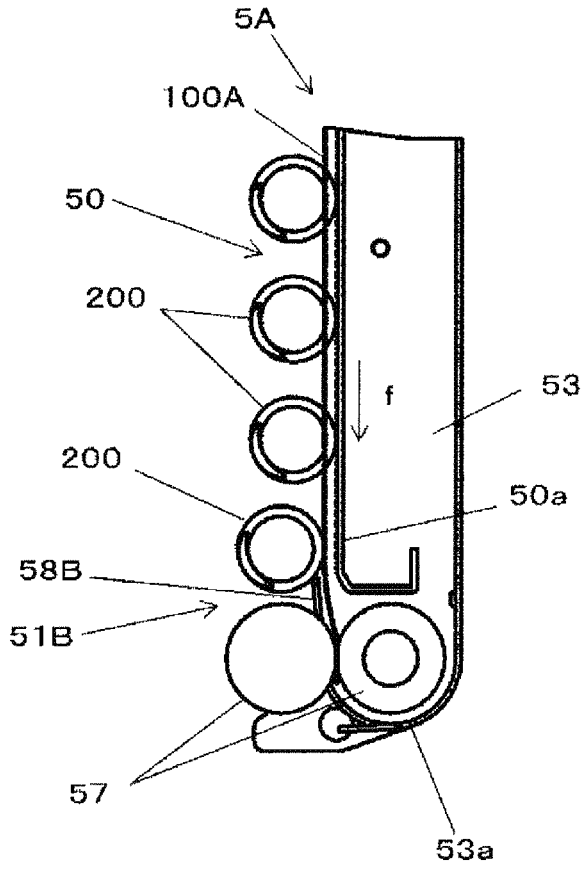

FIG. 136 is a side view depicting an example of the operation of the coil separating unit of the second embodiment.

Figure 137:
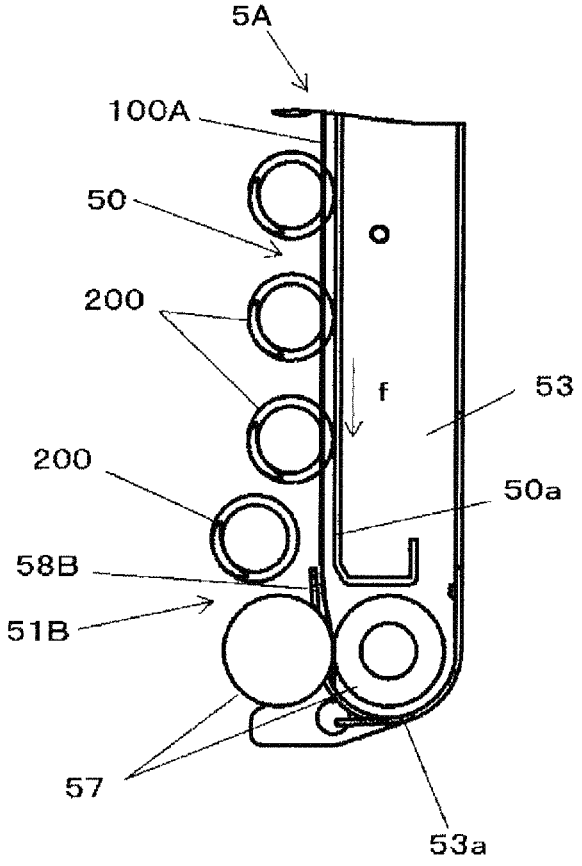

FIG. 137 is a side view depicting an example of the operation of the coil separating unit of the second embodiment.

Figure 138:
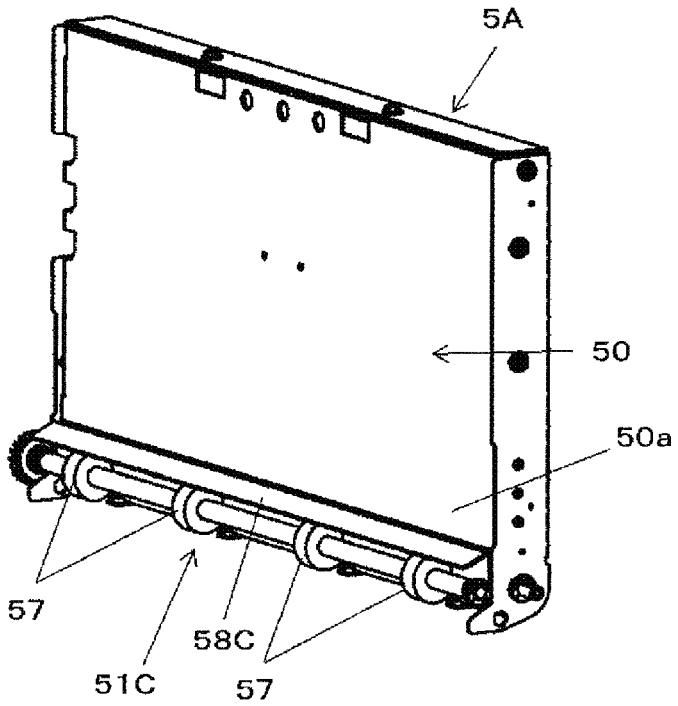

FIG. 138 is a perspective view depicting an example of the coil separating unit of a third embodiment.

Figure 139:
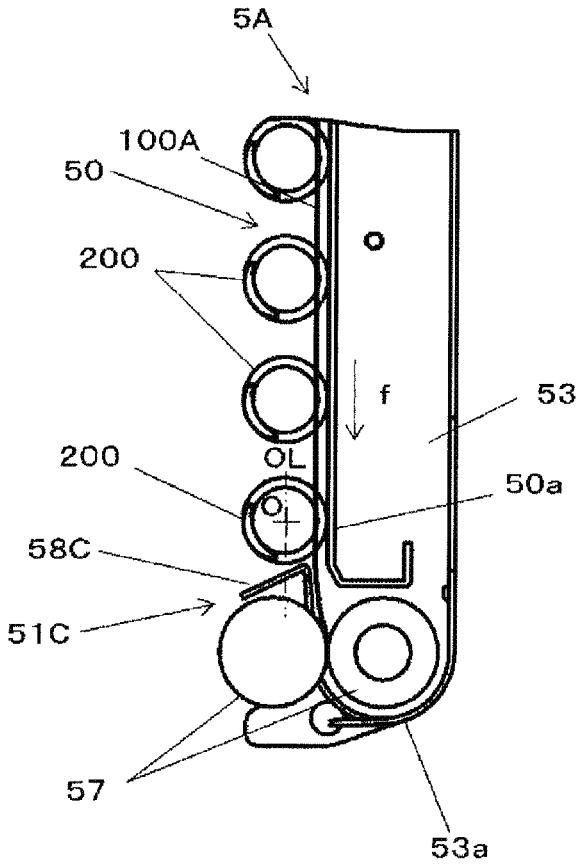

FIG. 139 is a side view depicting an example of the coil separating unit of the third embodiment.

Figure 140:
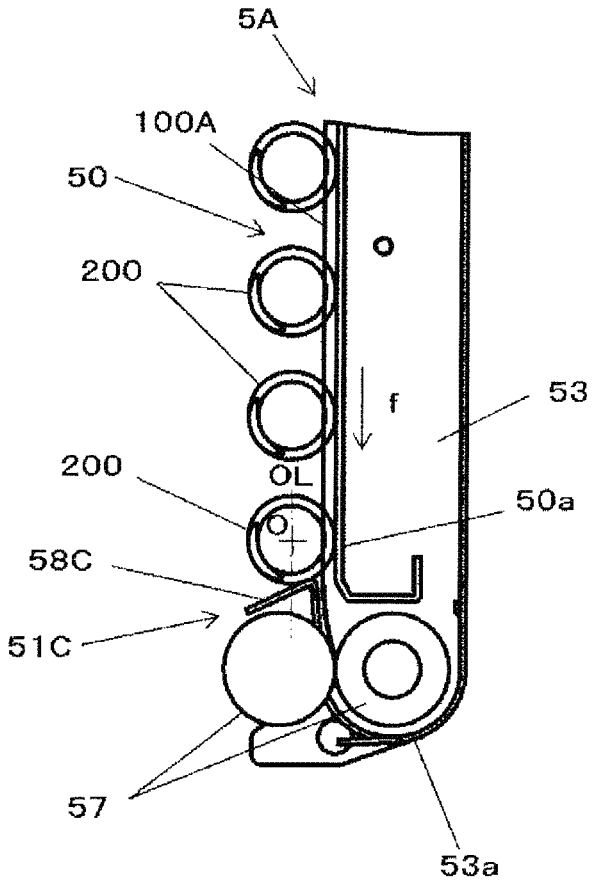

FIG. 140 a side view depicting an example of the operation of the coil separating unit of the third embodiment.

Figure 141:
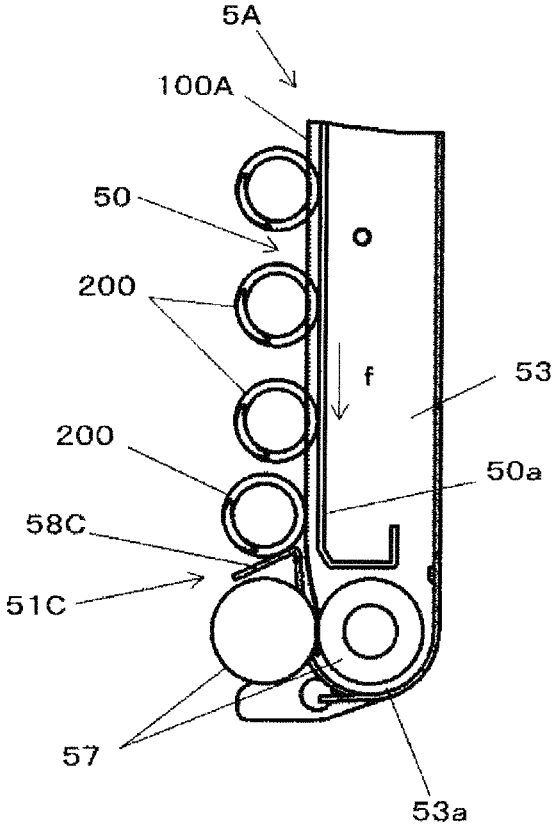

FIG. 141 is a side view depicting an example of the operation of the coil separating unit of the third embodiment.

Figure 142:
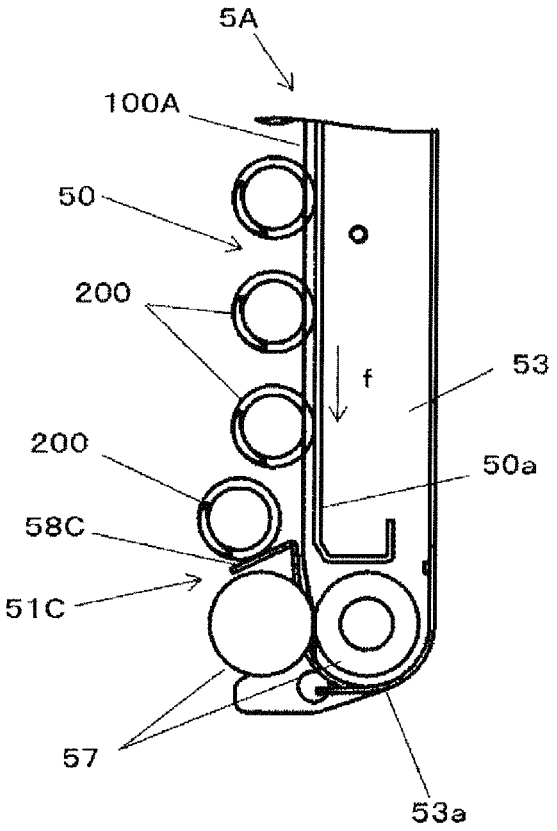

FIG. 142 is a side view depicting an example of the operation of the coil separating unit of the third embodiment.

Figure 143:
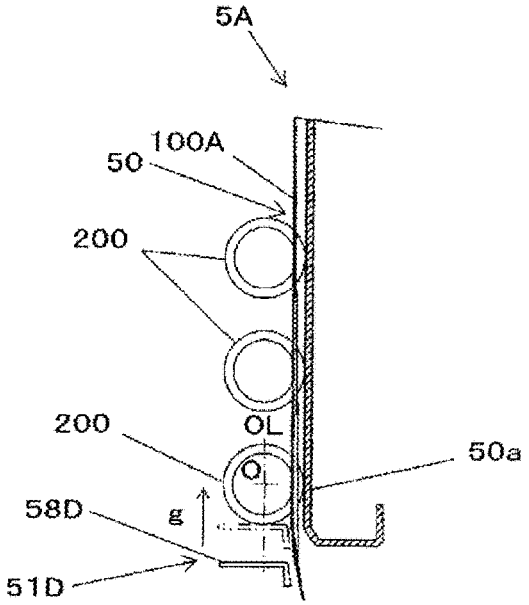

FIG. 143 is a side view depicting a modified embodiment of the coil separating unit of the embodiment.

Figure 144:
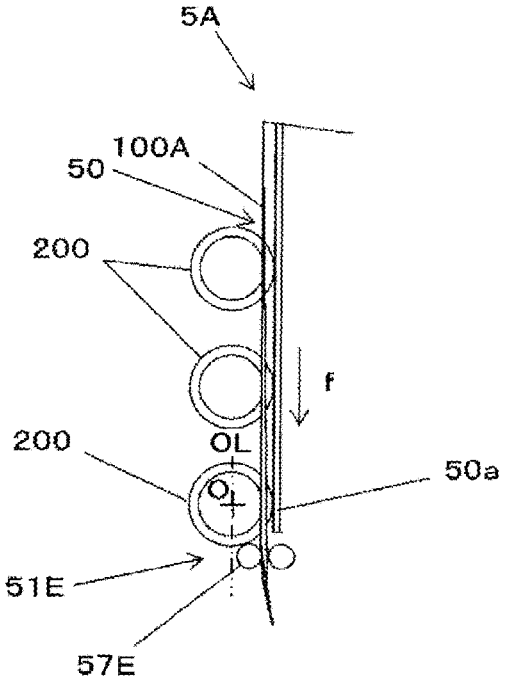

FIG. 144 is a side view depicting another modified embodiment of the coil separating unit of the embodiment.

Figure 145:
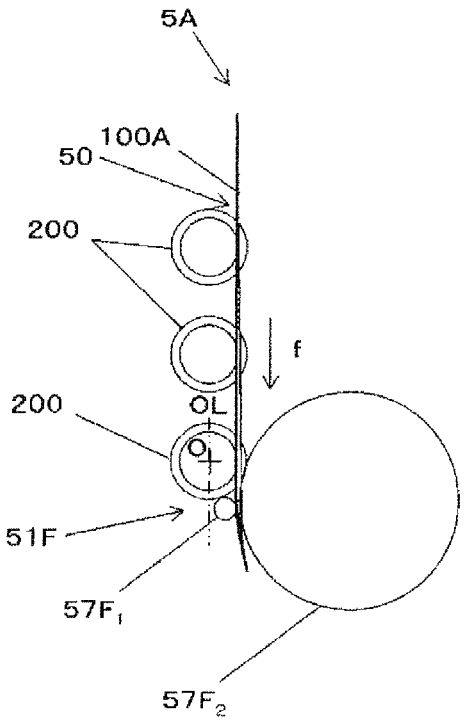

FIG. 145 is a side view depicting another modified embodiment of the coil separating unit of the embodiment.

Figure 146:
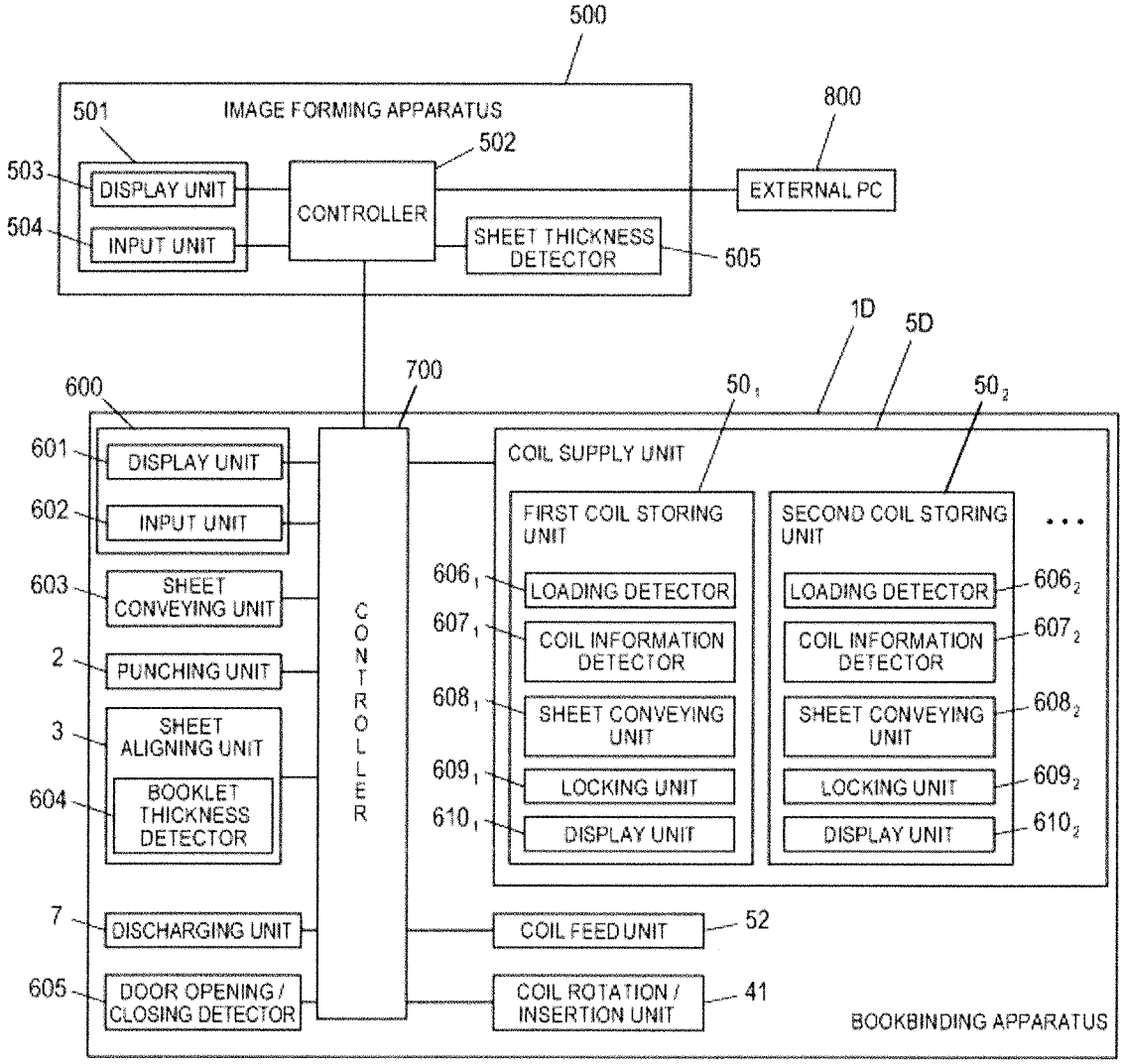

FIG. 146 is a block diagram depicting an example of a control function of the bookbinding apparatus of each embodiment.

DETAILED DESCRIPTION OF EMBODIMENTS

Hereinafter, embodiments of the coil holding sheet (an example of the holding sheet and the binding component holding sheet), the bookbinding apparatus configured to bind sheets by a coil supplied from the coil holding sheet, and a binding component separation mechanism configured to separate the coil (binding component) from the coil holding sheet (an example of the binding component holding sheet) of the present invention will be described with reference to the drawings.

Configuration Example of Coil Holding Sheet of First Embodiment

Figure 1:
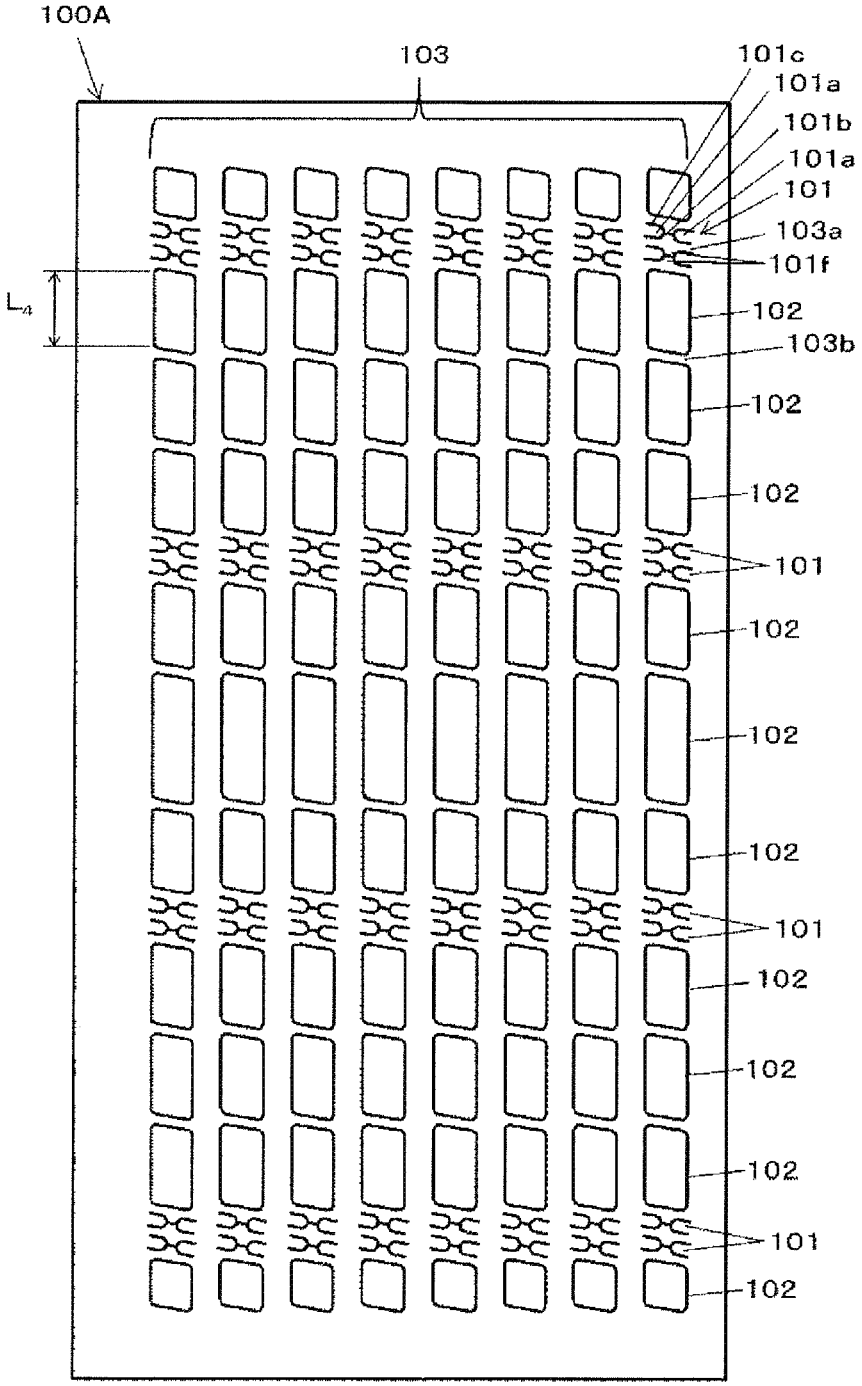
FIG. 1 is a front view depicting an example of a coil holding sheet of a first embodiment.
Figure 2:
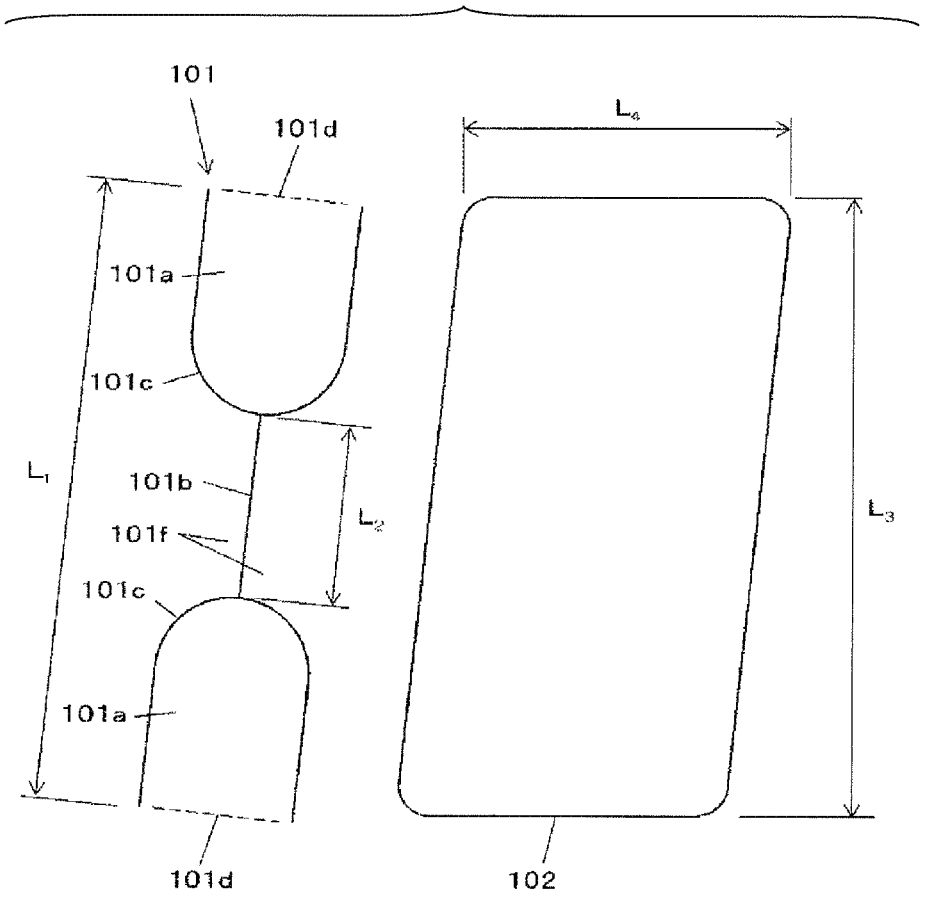
FIG. 2 is a front view depicting a configuration of main parts of the coil holding sheet of the first embodiment.
Figure 3:
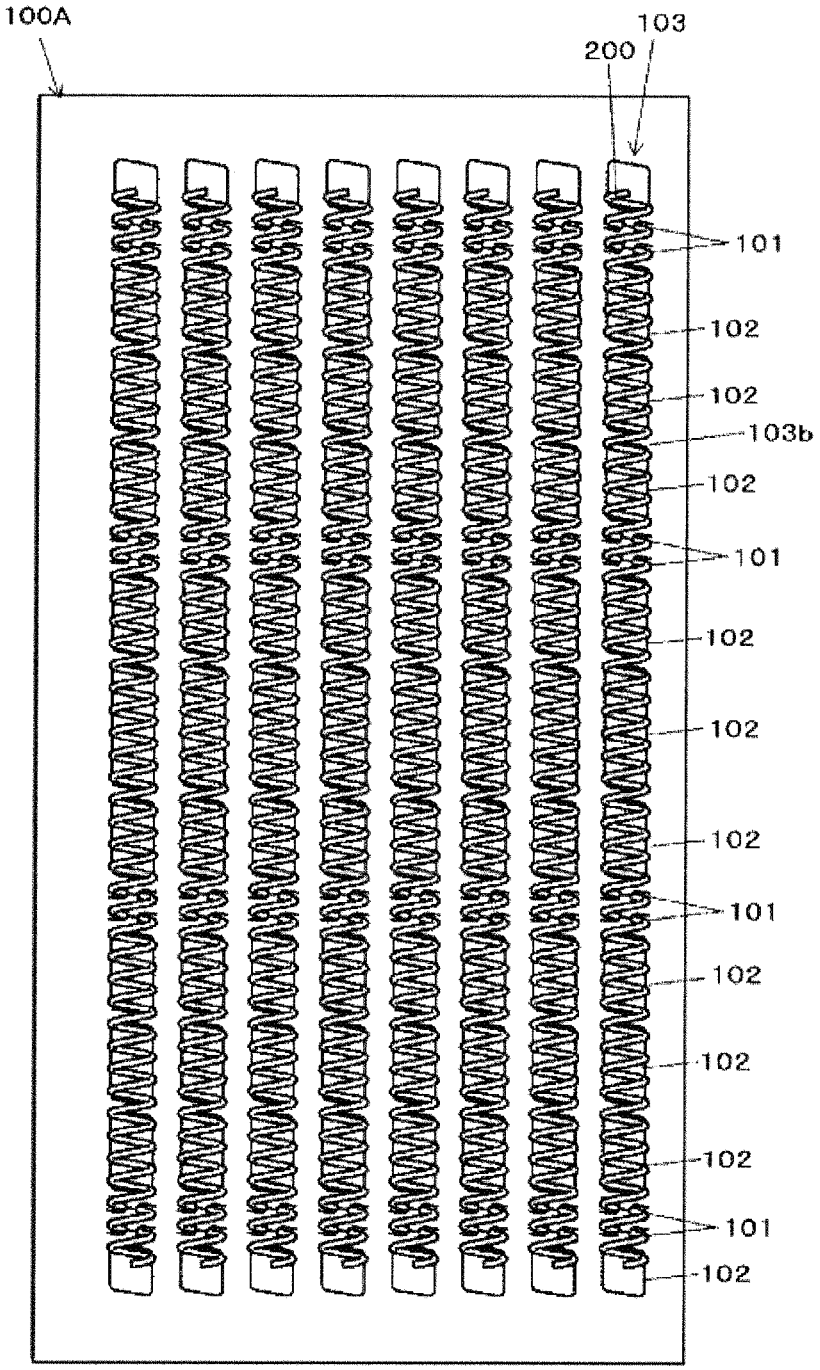
FIG. 3 is a front view of the coil holding sheet of the first embodiment, to which coils are held.
Figure 4:
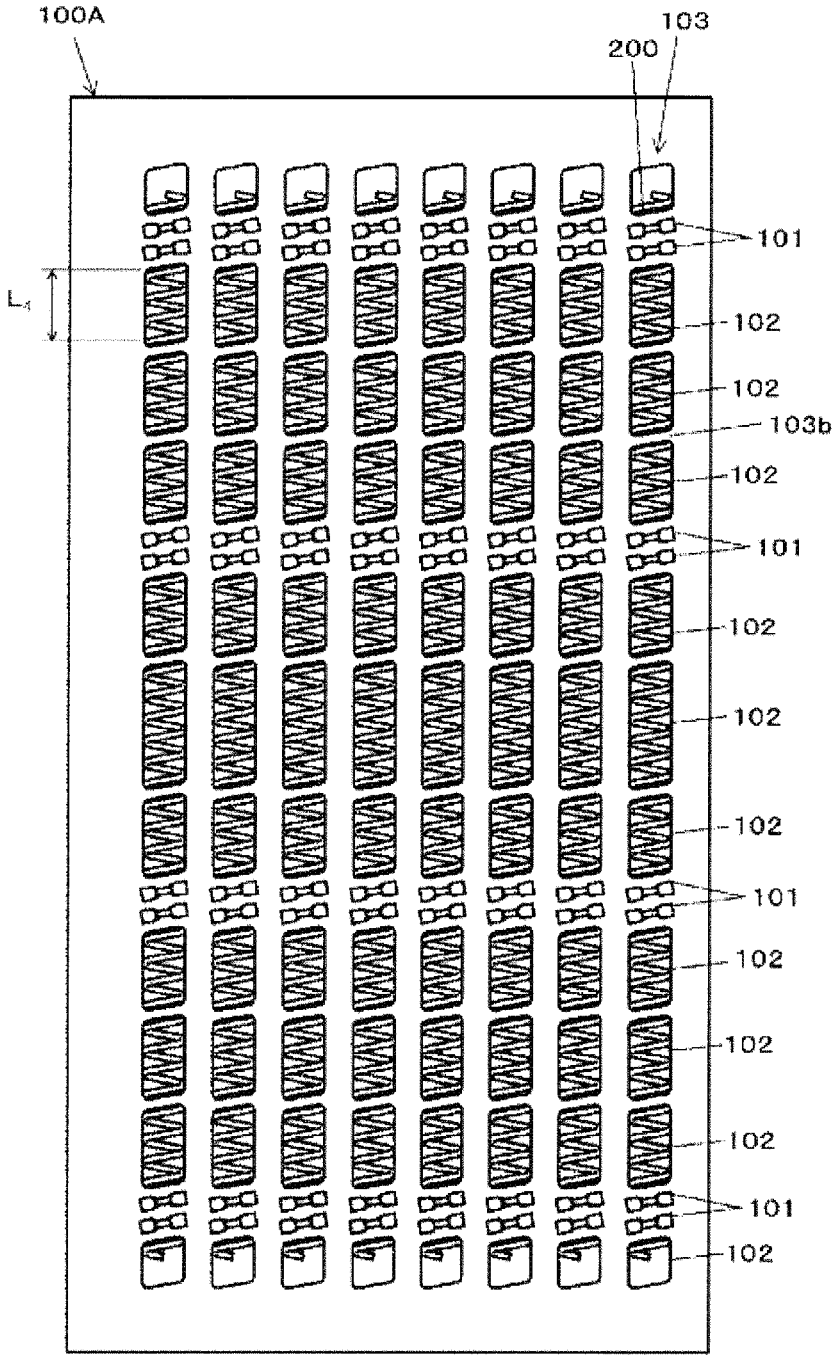
FIG. 4 is a rear view of the coil holding sheet of the first embodiment, to which coils are held.
Figure 5:
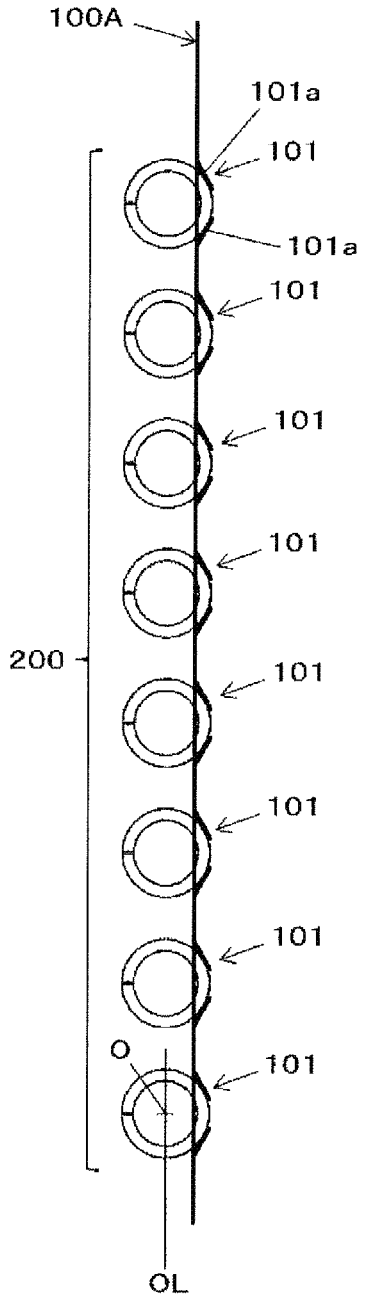
FIG. 5 is a side view of the coil holding sheet of the first embodiment, to which coils are held.
Figure 6:
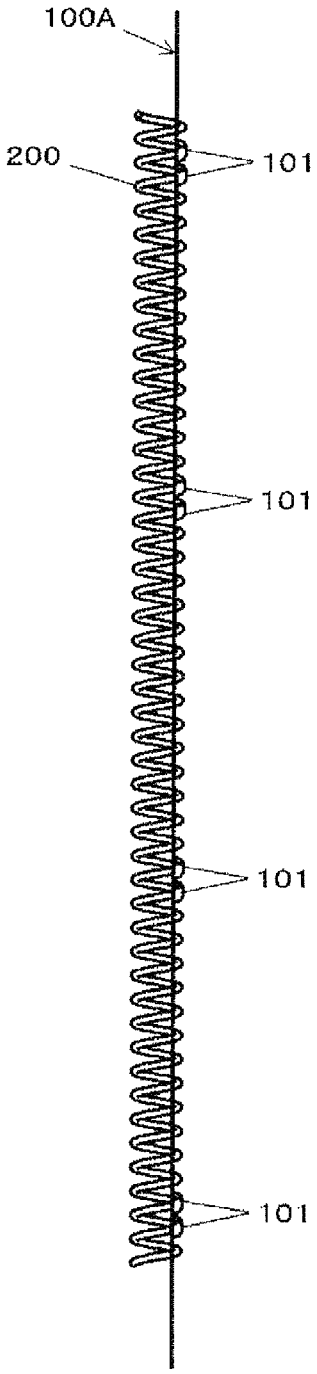
FIG. 6 is a plan view of the coil holding sheet of the first embodiment, to which coils are held.
Figure 7:
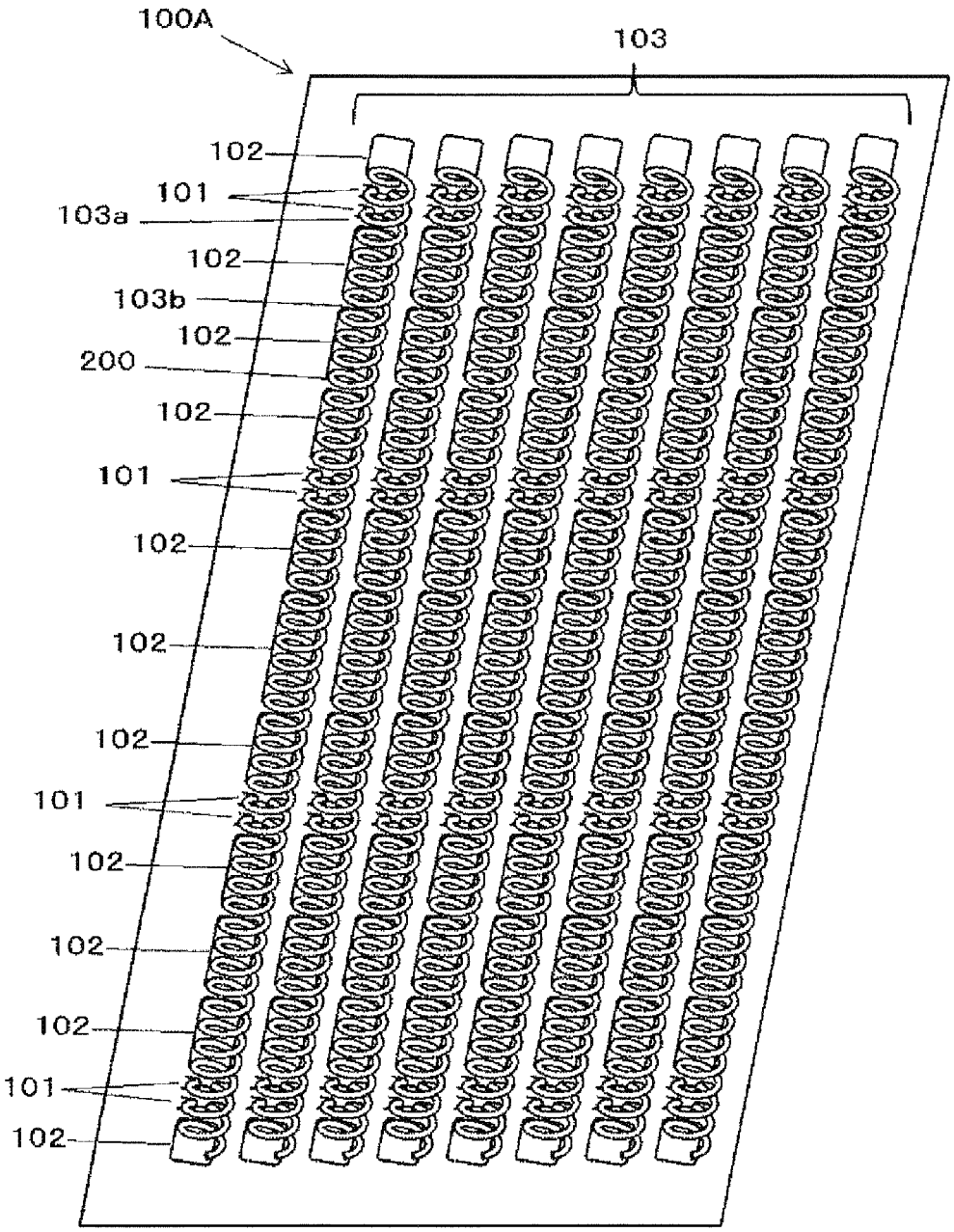
FIG. 7 is a perspective view of the coil holding sheet of the first embodiment, to which coils are held.

FIG. 1 is a front view depicting an example of a coil holding sheet of a first embodiment, and FIG. 2 is a front view depicting a configuration of main parts of the coil holding sheet of the first embodiment. FIGS. 3 to 7 depict the coil holding sheet of the first embodiment, to which coils are held. FIG. 3 is a front view of the coil holding sheet of the first embodiment, to which coils are held. FIG. 4 is a rear view of the coil holding sheet of the first embodiment, to which coils are held. FIG. 5 is a side view of the coil holding sheet of the first embodiment, to which coils are held. FIG. 6 is a plan view of the coil holding sheet of the first embodiment, to which coils are held. FIG. 7 is a perspective view of the coil holding sheet of the first embodiment, to which coils are held.

Figure 8:
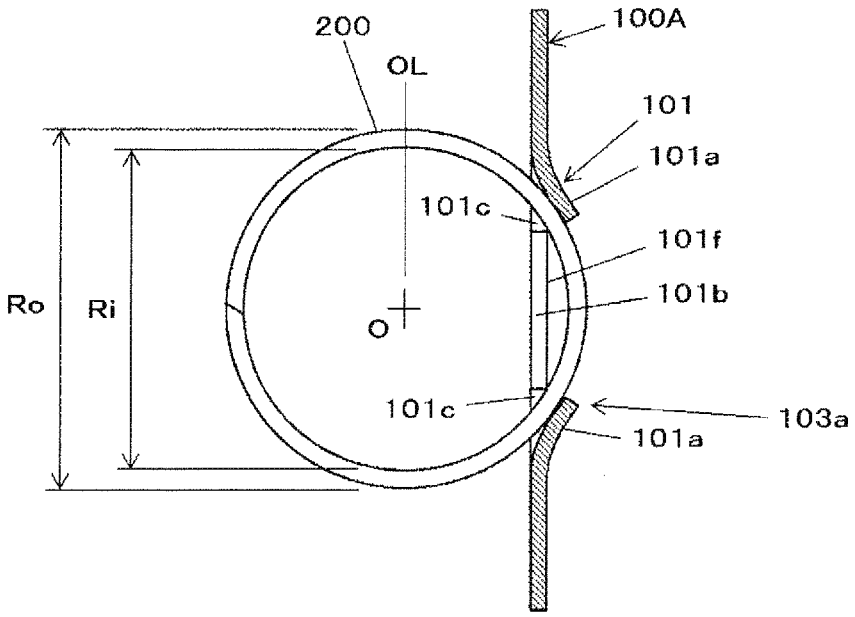
FIG. 8 is a side view depicting a configuration of main parts of the coil holding sheet of the first embodiment, to which coils are held.
Figure 9:
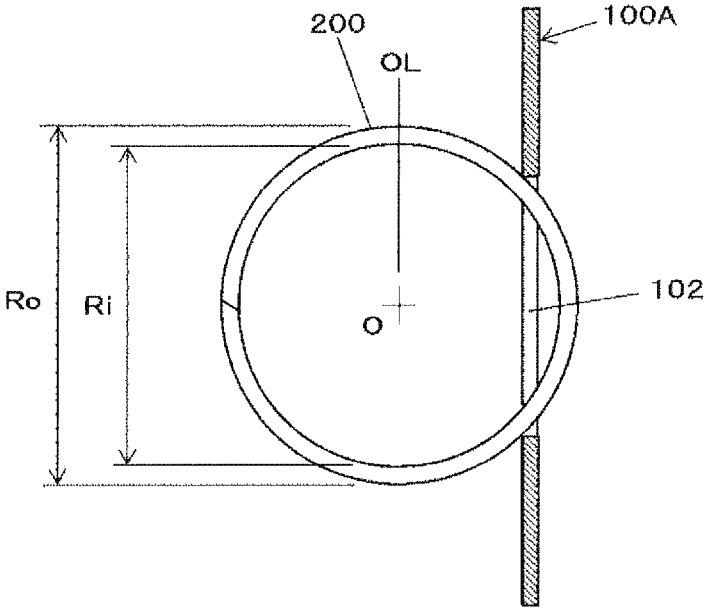
FIG. 9 is a side view depicting a configuration of main parts of the coil holding sheet of the first embodiment, to which coils are held.
Figure 10:
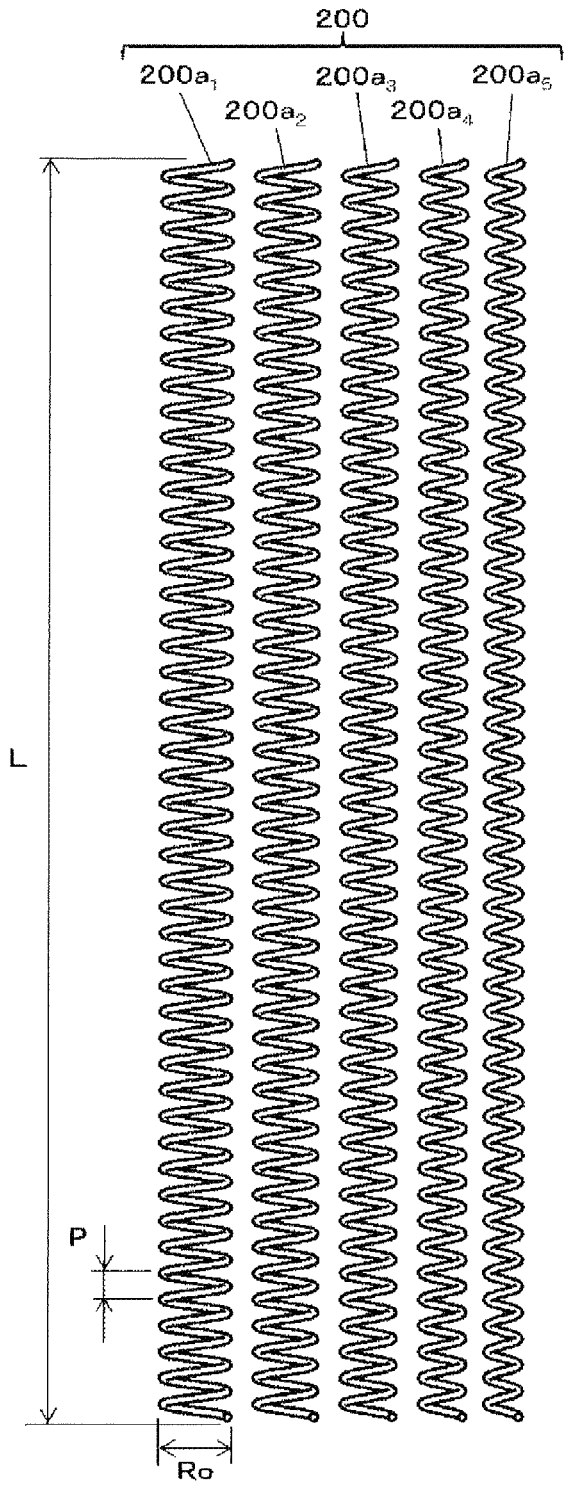
FIG. 10 is a front view depicting examples of the coil that is to be held by the coil holding sheet.

Also, FIGS. 8 and 9 are side views depicting a configuration of main parts of the coil holding sheet of the first embodiment, to which coils are held, and FIG. 10 is a front view depicting examples of the coil that is to be held by the coil holding sheet.

First, a coil 200 that is to be held by a coil holding sheet 100A is described with reference to FIG. 10 and the like. The coil 200 is an example of the binder and the binding component and is configured by spirally winding a wire rod such as resin, metal or the like with predetermined pitches. The coil 200 is flexible and can be deformed. For example, the coil 200 can be bent from an axially extending shape and can be returned from the bent shape to the axially extending shape.

An axial length L of the coil 200 is tailored to a size of a sheet, which is a binding target (which will be described later). Also, a pitch P of the coil 200 is tailored to an interval of holes that are to be formed in the sheet by a bookbinding apparatus, which will be described later. Also, an outer diameter Ro, which is a diameter of an outer periphery of the coil 200, is prepared to have a plurality of different sizes in correspondence to a thickness of a sheet bundle, which changes depending on the number of sheets to be bound, a sheet thickness, and the like. In the first embodiment, five types of a coil 200$a_1$, a coil 200$a_2$, a coil 200$a_3$, a coil 200$a_4$ and a coil 200$a_5$ in order from the larger outer diameter Ro can be used.

Subsequently, a coil holding sheet 100A of the first embodiment is described. The coil holding sheet 100A has holders 101 configured to hold the coil 200, and escape holes 102 configured to escape circumferential portions of the coil 200 from a front surface, which is one surface of the coil holding sheet 100A, to a back surface, which is the other surface.

The coil holding sheet 100A configures a coil holding row 103 for holding one coil 200 by a combination of the holders 101 and the escape holes 102. In order to hold a plurality of coils 200 by one coil holding sheet 100A, the coil holding sheet 100A is formed with a plurality of coil holding rows 103 with predetermined intervals in a direction perpendicular to an axial direction of the coil 200.

The holder 101 has a pair of push-up pieces 101*a* facing each other in a circumferential direction of the coil 200 and a slit 101*b* provided between the pair of push-up pieces 101*a*. The push-up piece 101*a* is formed by a cut 101*c* penetrating the front and back of the coil holding sheet 100A and having a shape of coupling a side, which is opposite to a side at which the slit 101*b* is provided, to the coil holding sheet 100A. The push-up piece 101*a* is formed at a portion coupling to the coil holding sheet 100A with a bent portion 101*d*. The push-up piece 101*a* has a U-shape as shown in FIGS. 1 and 2, a C-shape or a rectangular or triangular shape of which one side couples to the coil holding sheet 100A, which are not shown.

The pair of push-up pieces 101*a* is configured so that an interval $L_1$ between the bent portion 101*d* of one push-up piece 101*a* and the bent portion 101*d* of the other push-up piece 101*a* is smaller than the outer diameter Ro of the coil 200. However, in a configuration where a radial position of the coil 200 is determined by the escape hole 102, the interval $L_1$ between the pair of bent portions 101*d* may be equal to the outer diameter Ro of the coil 200 or larger than the outer diameter Ro of the coil 200.

The slit 101*b* is formed by linearly cutting the front and back of the coil holding sheet 100A between the cut 101*c* of one push-up piece 101*a* and the cut 101*c* of the other push-up piece 101*a*. The pair of cuts 101*c* is coupled by the slit 101*b*.

The coil holding sheet 100A has holding pieces 101*f* provided at both sides of the slit 101*b* and protruding in a direction of the slit 101*b* along the axial direction of the coil 200. The holding pieces 101*f* are configured to openably and closably close a space, which may be configured by the cuts 101*c* and the slit 101*b*, and to detachably hold the coil 200.

A length $L_2$ of the slit 101*b* is smaller than an inner diameter Ri, which is a diameter of an inner periphery of the coil 200. When the coil 200 is attached to the coil holding sheet 100A, a part of an area greater than a half of a circumference of the coil 200 protrudes to a front surface side, which is one side of the coil holding sheet 100A, and a part of an area less than the half of the circumference of the coil 200 protrudes to a back surface side, which is the other side of the coil holding sheet 100A, as shown in FIGS. 5, 8 and 9 and the like, in the first embodiment.

That is, the coil 200 is held to the coil holding sheet 100A with a radial center O of the coil 200 being offset to the front surface side, which is one side with respect to the coil holding sheet 100A. For this reason, the slit 101*b* has a length tailored to an interval of an inner periphery-side of the coil 200 at a position at which the coil 200 is held by the coil holding sheet 100A.

The coil holding sheet 100A has holder forming places 103*a*, at which the holders 101 are formed, at a plurality of places of the coil holding row 103 along the axial direction of the coil 200. In the first embodiment, the holder forming places 103*a* are formed at four places spaced with predetermined intervals along the axial direction of the coil 200.

Also, the coil holding sheet 100A has at least the pair of push-up pieces 101*a* provided at each of the holder forming places 103*a*. In the first embodiment, two sets of the pairs of push-up pieces 101*a* are provided at each of the holder forming places 103*a* in conformity to the pitch P of the coil 200.

The escape hole 102 has a shape by which a circumferential portion of the coil 200 can be inserted and pulled out. The escape hole 102 is configured by an opening penetrating the front and back of the coil holding sheet 100A. The escape holes 102 are provided in parallel with the holder forming places 103*a* along the axial direction of the coil 200 held to the coil holding sheet 100A by the holders 101.

A length $L_3$ of the escape hole 102 in the radial direction of the coil 200 is smaller than the outer diameter Ro of the coil 200. Thereby, the coil 200 cannot enter the escape hole 102 to a position at which the radial center O becomes flush with the coil holding sheet 100A.

Therefore, the coil 200 is held to the coil holding sheet 100A in a state where the coil is offset with respect to the coil holding sheet 100A so that a protrusion height to the front surface side is greater than a protrusion height to the back surface side. An offset amount is determined with the length $L_3$ of the escape hole 102 in the radial direction of the coil 200.

The escape hole 102 is configured so that a length $L_4$ in the axial direction of the coil 200 is a length within which the coil 200 of two or more turns in the axial direction is to enter the escape hole. In the first embodiment, the escape hole 102 having a length within which the coil 200 of two turns is to enter the escape hole, the escape hole 102 having a length within which the coil 200 of four turns is to enter the escape hole, and the escape hole 102 having a length within which the coil 200 of six turns is to enter the escape hole are provided in correspondence to the number of turns of the coil 200.

The coil holding row 103 is provided with coupling portions 103*b* each of which is formed between the escape holes 102 arranged in parallel in the axial direction of the coil 200 and is provided to couple one side and the other side of the escape holes 102 in the radial direction of the coil 200 therebetween.

Modified Embodiments of Coil Holding Sheet of First Embodiment

Figure 11:
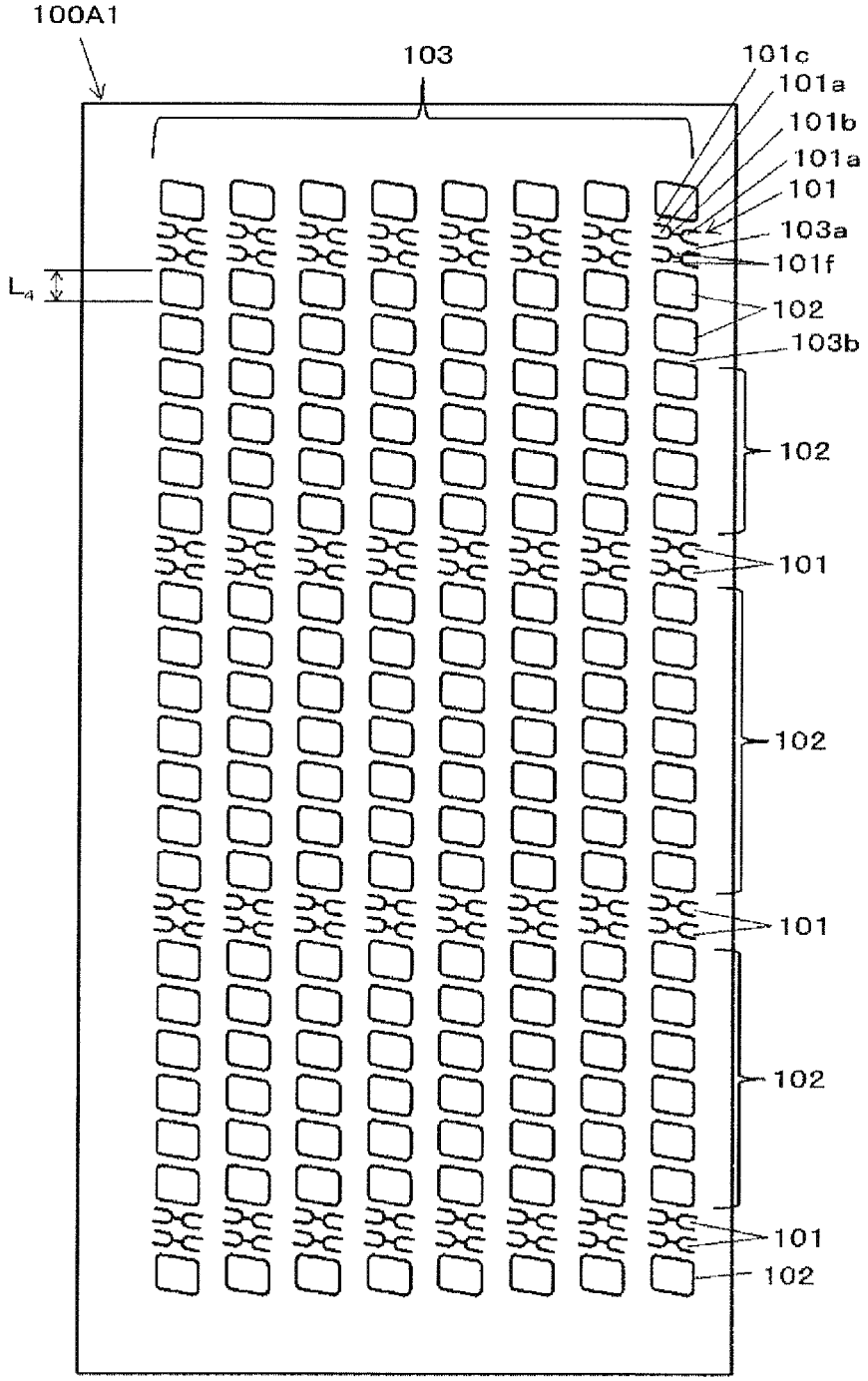
FIG. 11 is a front view depicting a modified embodiment of the coil holding sheet of the first embodiment.
Figure 12:
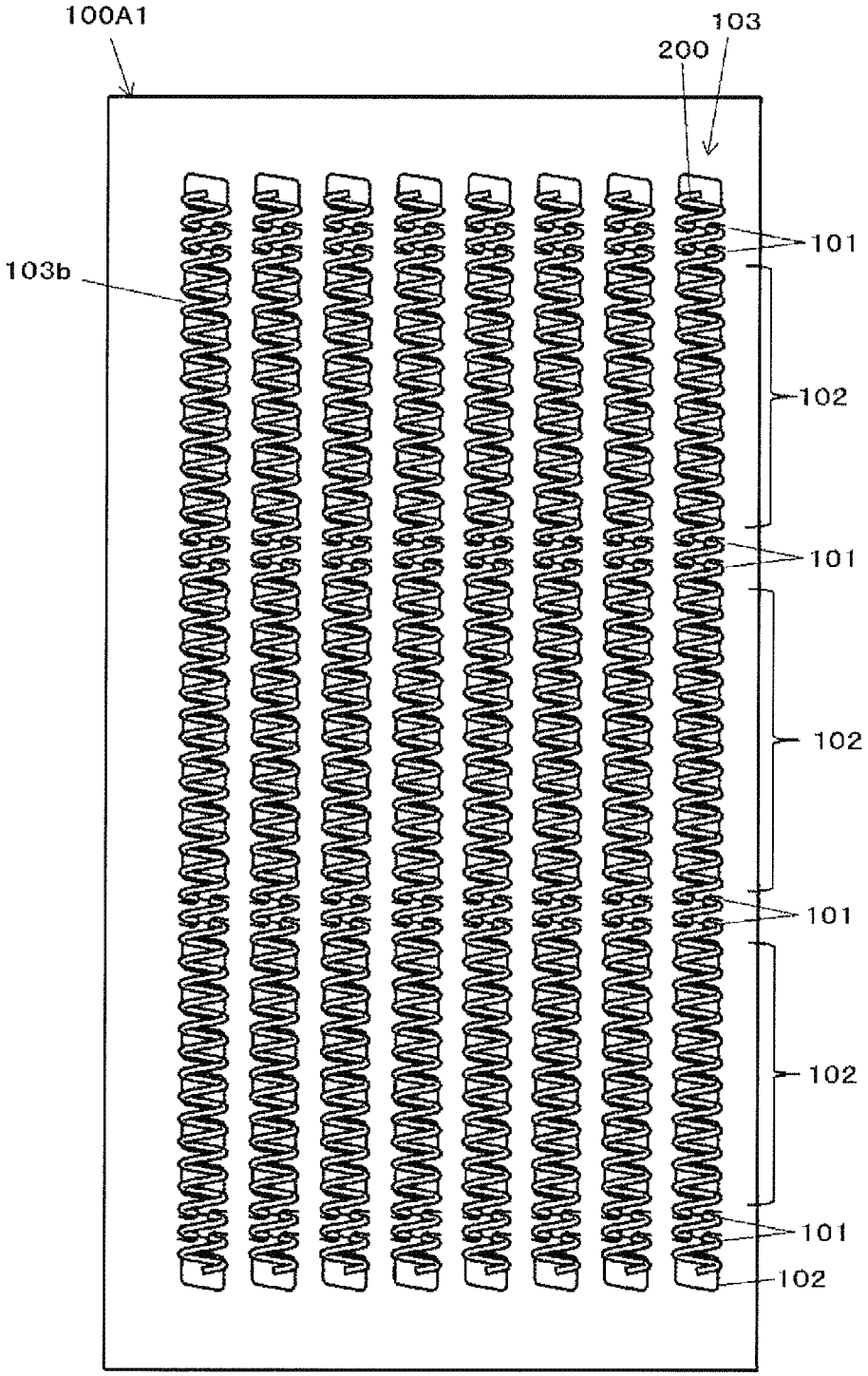
FIG. 12 is a front view of the coil holding sheet of the modified embodiment of the first embodiment, to which coils are held.
Figure 13:
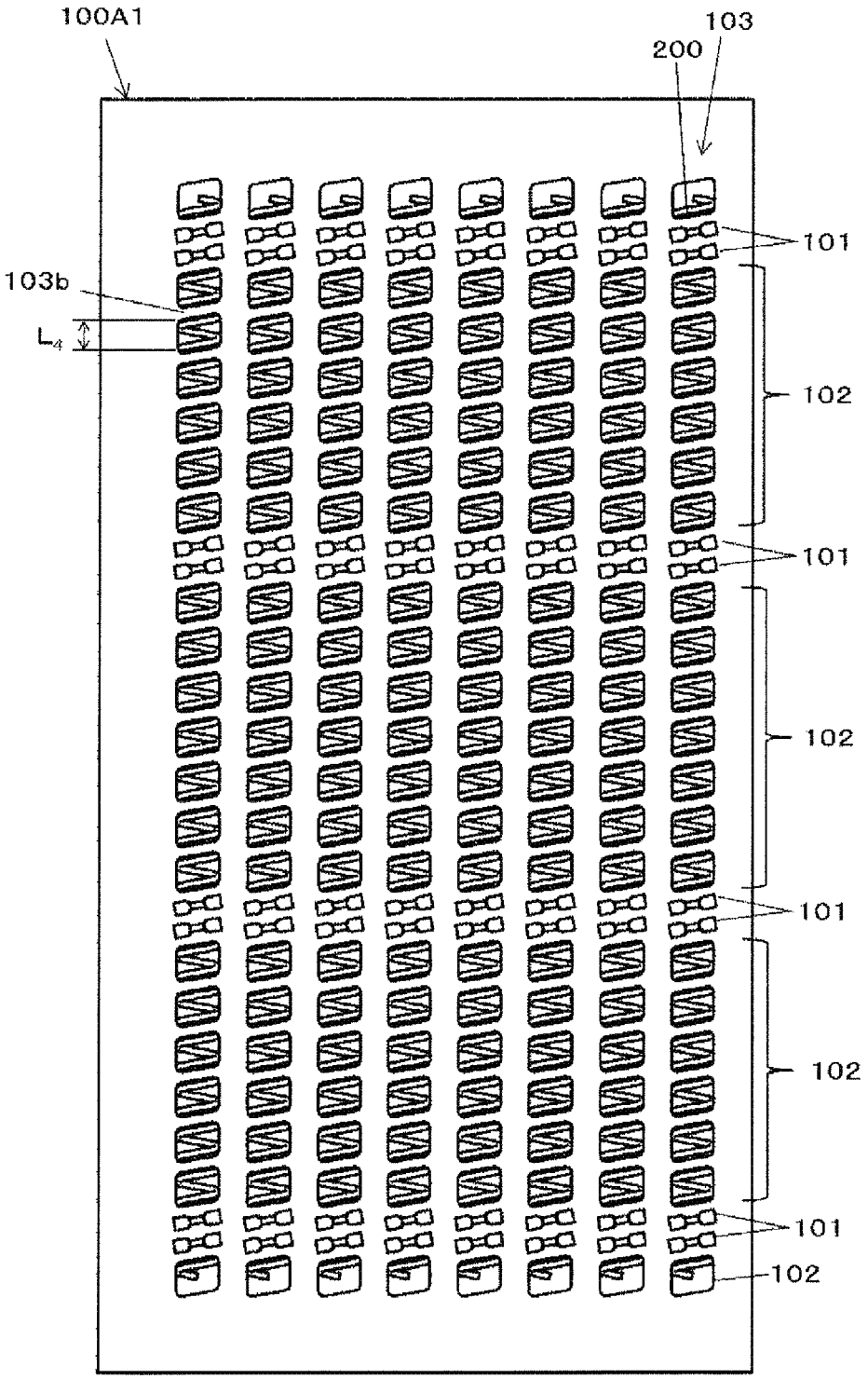
FIG. 13 is a rear view of the coil holding sheet of the modified embodiment of the first embodiment, to which coils are held.
Figure 14:
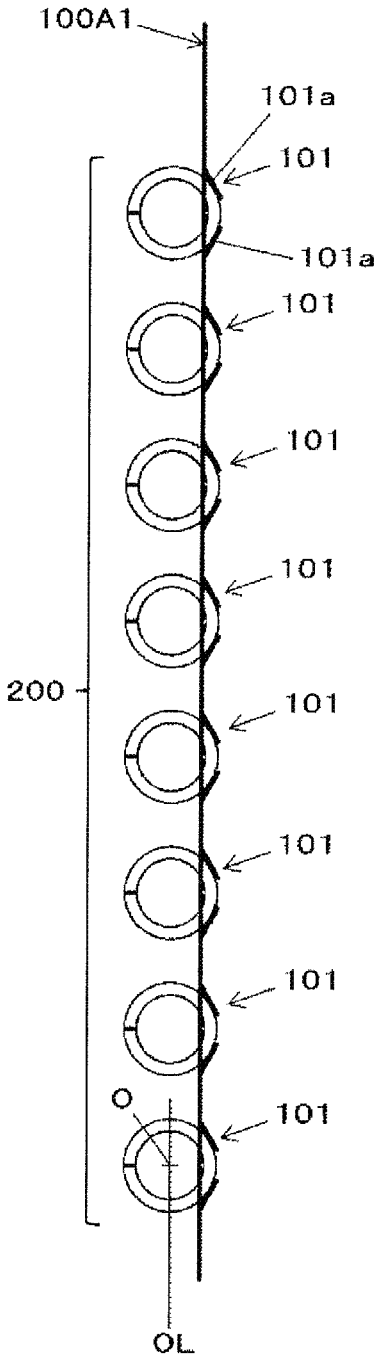
FIG. 14 is a side view of the coil holding sheet of the modified embodiment of the first embodiment, to which coils are held.
Figure 15:
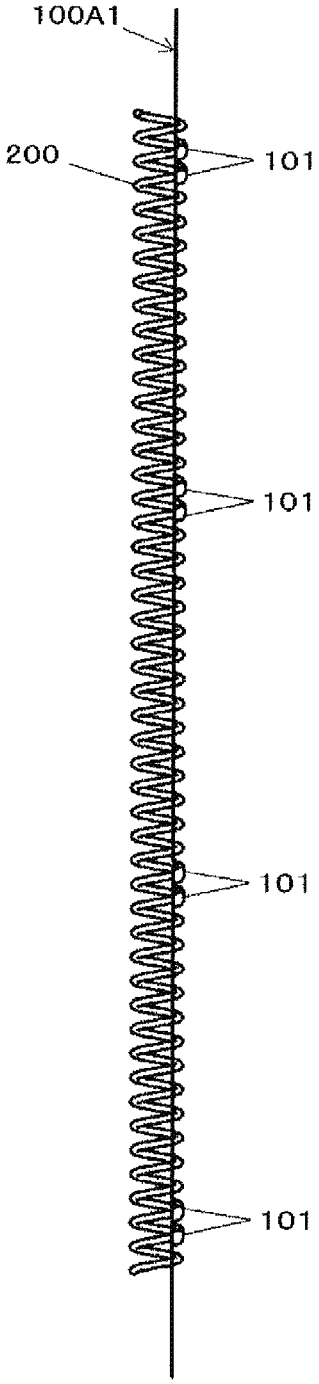
FIG. 15 is a plan view of the coil holding sheet of the modified embodiment of the first embodiment, to which coils are held.
Figure 16:
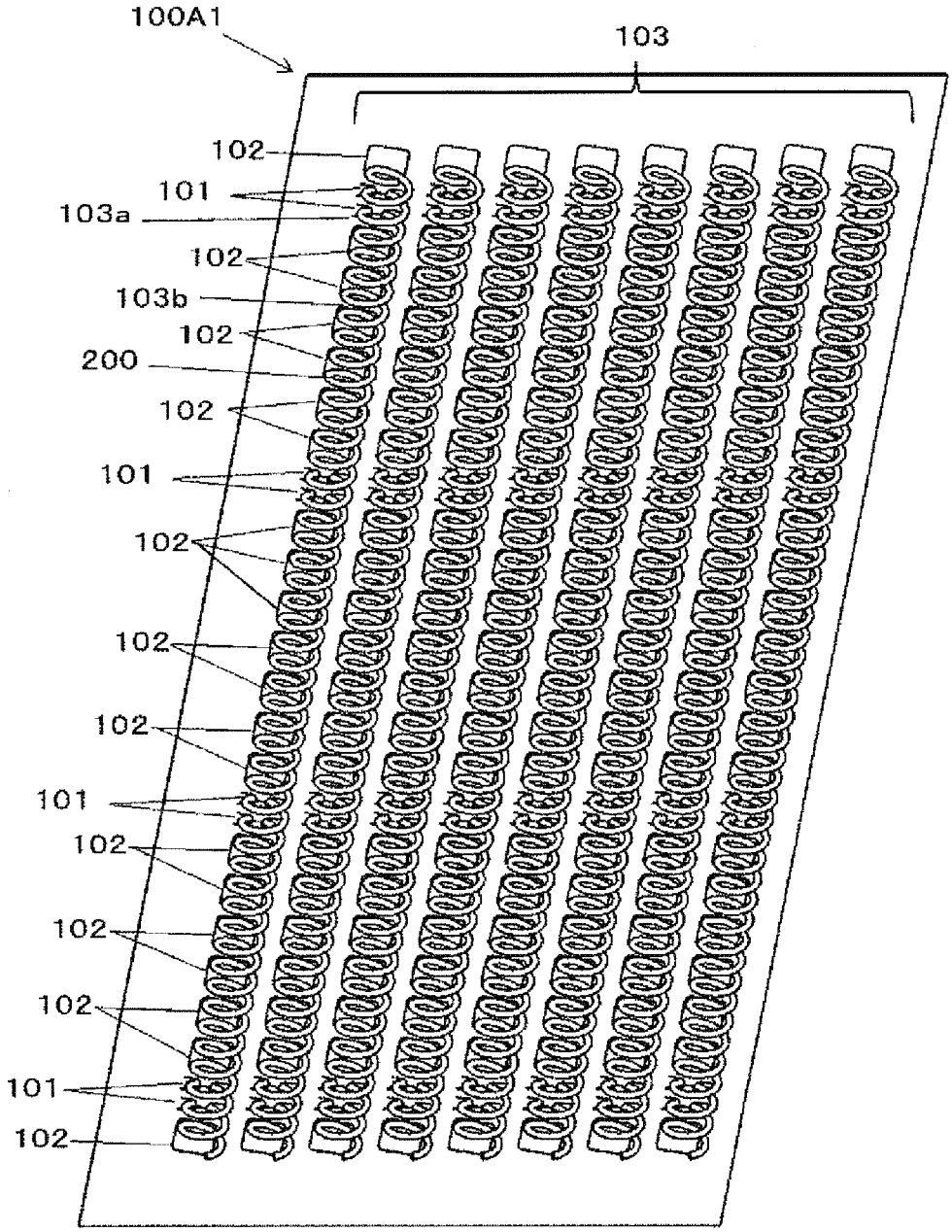
FIG. 16 is a perspective view of the coil holding sheet of the modified embodiment of the first embodiment, to which coils are held.

FIG. 11 is a front view depicting a modified embodiment of the coil holding sheet of the first embodiment. FIGS. 12 to 16 depict the coil holding sheet of the modified embodiment of the first embodiment, to which coils are held. FIG. 12 is a front view of the coil holding sheet of the modified embodiment of the first embodiment, to which coils are held. FIG. 13 is a rear view of the coil holding sheet of the modified embodiment of the first embodiment, to which coils are held. FIG. 14 is a side view of the coil holding sheet of the modified embodiment of the first embodiment, to which coils are held. FIG. 15 is a plan view of the coil holding sheet of the modified embodiment of the first embodiment, to which coils are held. FIG. 16 is a perspective view of the coil holding sheet of the modified embodiment of the first embodiment, to which coils are held.

A coil holding sheet 100A1 of the modified embodiment of the first embodiment has the holders 101 configured to hold the coil 200, and the escape holes 102 configured to escape circumferential portions of the coil 200 from a front surface, which is one surface of the coil holding sheet 100A1, to a back surface, which is the other surface. The coil holding sheet 100A 1 is configured so that the length $L_4$ of each escape hole 102 in the axial direction of the coil 200 is a length within which the coil 200 of two turns is to enter the escape hole. The other configurations are the same as the coil holding sheet 100A of the first embodiment.

That is, the coil holding sheet 100A1 configures the coil holding row 103 for holding one coil 200 by a combination of the holders 101 and the escape holes 102. In order to hold the plurality of coils 200 by one coil holding sheet 100A1, the coil holding sheet 100A1 is formed with the plurality of coil holding rows 103 with predetermined intervals in the direction perpendicular to the axial direction of the coil 200.

The holder 101 has the pair of push-up pieces 101*a* facing each other in the circumferential direction of the coil 200 and the slit 101*b* provided between the pair of push-up pieces 101*a*. The push-up piece 101*a* is formed by the cut 101*c* penetrating the front and back of the coil holding sheet 100A1 and having a shape of coupling a side, which is opposite to a side at which the slit 101*b* is provided, to the coil holding sheet 100A1. The push-up piece 101*a* is formed at a portion coupling to the coil holding sheet 100A1 with the bent portion 101*d*. The push-up piece 101*a* has a U-shape as shown in FIGS. 2 and 11, a C-shape or a rectangular or triangular shape of which one side couples to the coil holding sheet 100A1, which are not shown.

As shown in FIG. 2, the pair of push-up pieces 101*a* is configured so that the interval $L_1$ between the bent portion 101*d* of one push-up piece 101*a* and the bent portion 101*d* of the other push-up piece 101*a* is smaller than the outer diameter Ro of the coil 200. However, in a configuration where a radial position of the coil 200 is determined by the escape hole 102, the interval $L_1$ between the pair of bent portions 101*d* may be equal to the outer diameter Ro of the coil 200 or larger than the outer diameter Ro of the coil 200.

The slit 101*b* is formed by linearly cutting the front and back of the coil holding sheet 100A1 between the cut 101*c* of one push-up piece 101*a* and the cut 101*c* of the other push-up piece 101*a*. The pair of cuts 101*c* is coupled by the slit 101*b*.

The coil holding sheet 100A1 has the holding pieces 101*f* provided at both sides of the slit 101*b* and protruding in the direction of the slit 101*b* along the axial direction of the coil 200. The holding pieces 101*f* are configured to openably and closably close a space, which may be configured by the cuts 101*c* and the slit 101*b*, and to detachably hold the coil 200.

The length $L_2$ of the slit 101*b* is smaller than the inner diameter Ri, which is the diameter of the inner periphery of the coil 200. When the coil 200 is attached to the coil holding sheet 100A1, a part of an area greater than a half of a circumference of the coil 200 protrudes to a front surface side, which is one side of the coil holding sheet 100A1, and a part of an area less than the half of the circumference of the coil 200 protrudes to a back surface side, which is the other side of the coil holding sheet 100A1, as shown in FIGS. 14 and 15 and the like, in this modified embodiment.

That is, the coil 200 is held to the coil holding sheet 100A1 with the radial center O of the coil 200 being offset to the front surface side, which is one side with respect to the coil holding sheet 100A1. For this reason, the slit 101*b* has a length tailored to the interval of the inner periphery-side of the coil 200 at a position at which the coil 200 is held by the coil holding sheet 100A1.

The coil holding sheet 100A1 has the holder forming places 103*a*, at which the holders 101 are formed, at the plurality of places of the coil holding row 103 along the axial direction of the coil 200. In this modified embodiment, the holder forming places 103*a* are formed at four places spaced with predetermined intervals along the axial direction of the coil 200.

Also, the coil holding sheet 100A1 has at least the pair of push-up pieces 101*a* provided at each of the holder forming places 103*a*. In this modified embodiment, two sets of the pairs of push-up pieces 101*a* are provided at each of the holder forming places 103*a* in conformity to the pitch P of the coil 200.

The escape hole 102 has a shape by which a circumferential portion of the coil 200 can be inserted and pulled out, and is configured by an opening penetrating the front and back of the coil holding sheet 100A 1. The escape holes 102 are provided in parallel with the holder forming places 103*a* along the axial direction of the coil 200 held to the coil holding sheet 100A1 by the holders 101.

The escape hole 102 is configured so that the length $L_3$ in the radial direction of the coil 200 is smaller than the outer diameter Ro of the coil 200. Thereby, the coil 200 cannot enter the escape hole 102 to a position at which the radial center O becomes flush with the coil holding sheet 100A1.

Therefore, the coil 200 is held to the coil holding sheet 100A 1 in a state where the coil is offset with respect to the coil holding sheet 100A1 so that a protrusion height to the front surface side is greater than a protrusion height to the back surface side. An offset amount is determined with the length $L_3$ of the escape hole 102 in the radial direction of the coil 200.

The escape hole 102 is configured so that the length $L_4$ in the axial direction of the coil 200 is a length within which the coil 200 of two turns in the axial direction is to enter the escape hole.

The coil holding row 103 is provided with the coupling portions 103*b* each of which is formed between the escape holes 102 arranged in parallel in the axial direction of the coil 200 and is provided to couple one side and the other side of the escape holes 102 in the radial direction of the coil 200 therebetween.

Figure 17:
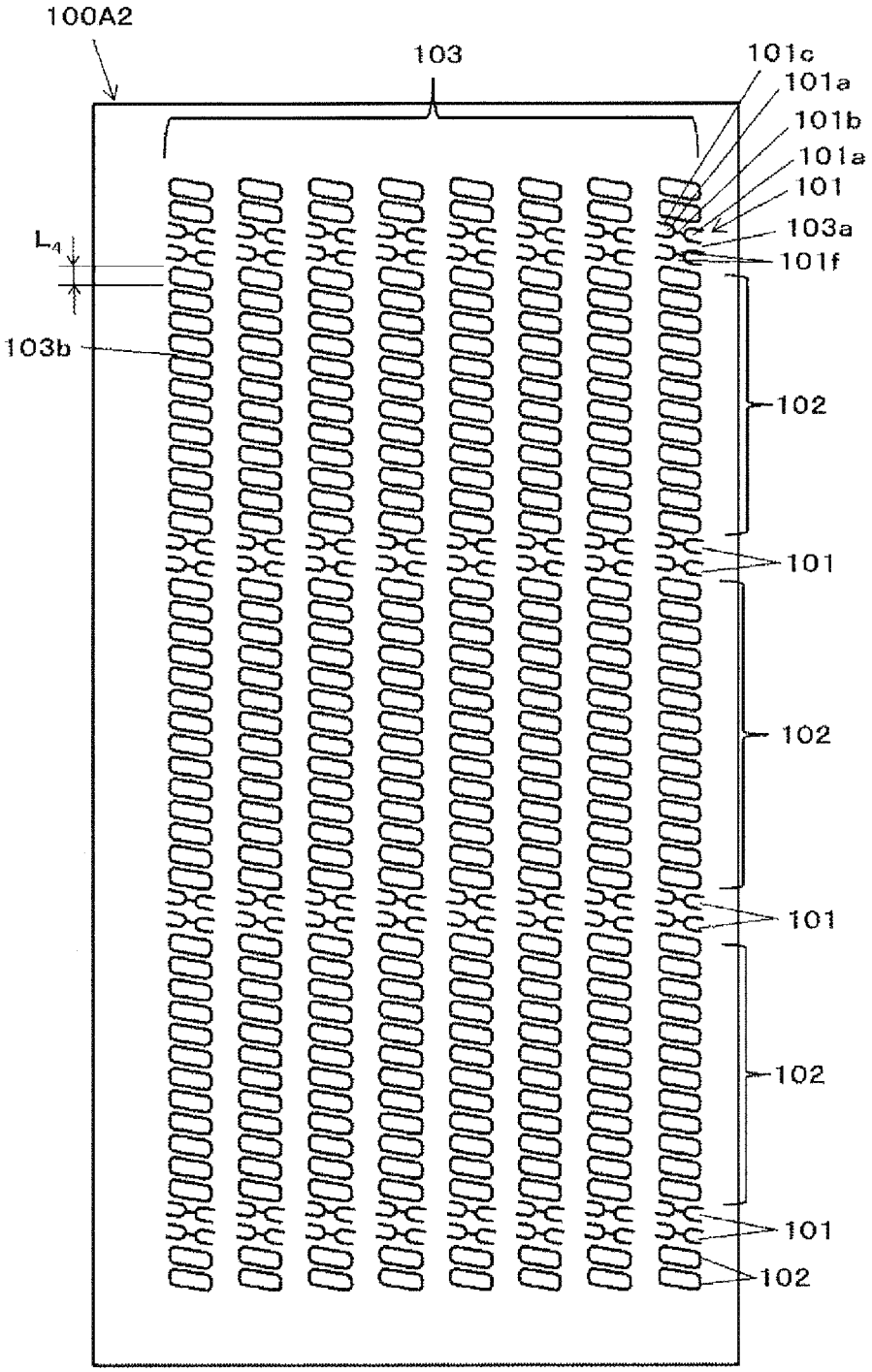
FIG. 17 is a front view depicting another modified embodiment of the coil holding sheet of the first embodiment.
Figure 18:
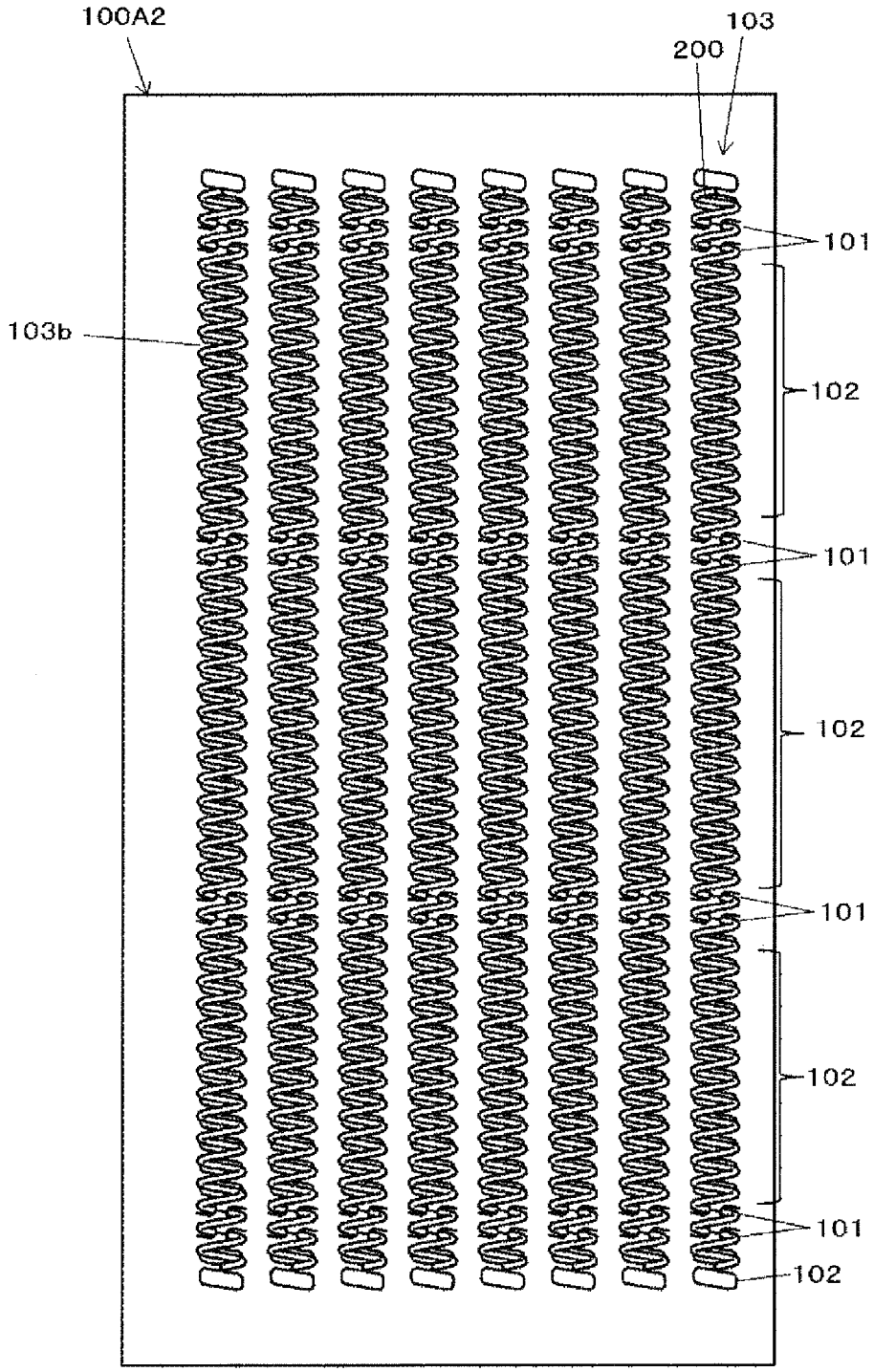
FIG. 18 is a front view of the coil holding sheet of another modified embodiment of the first embodiment, to which coils are held.
Figure 19:
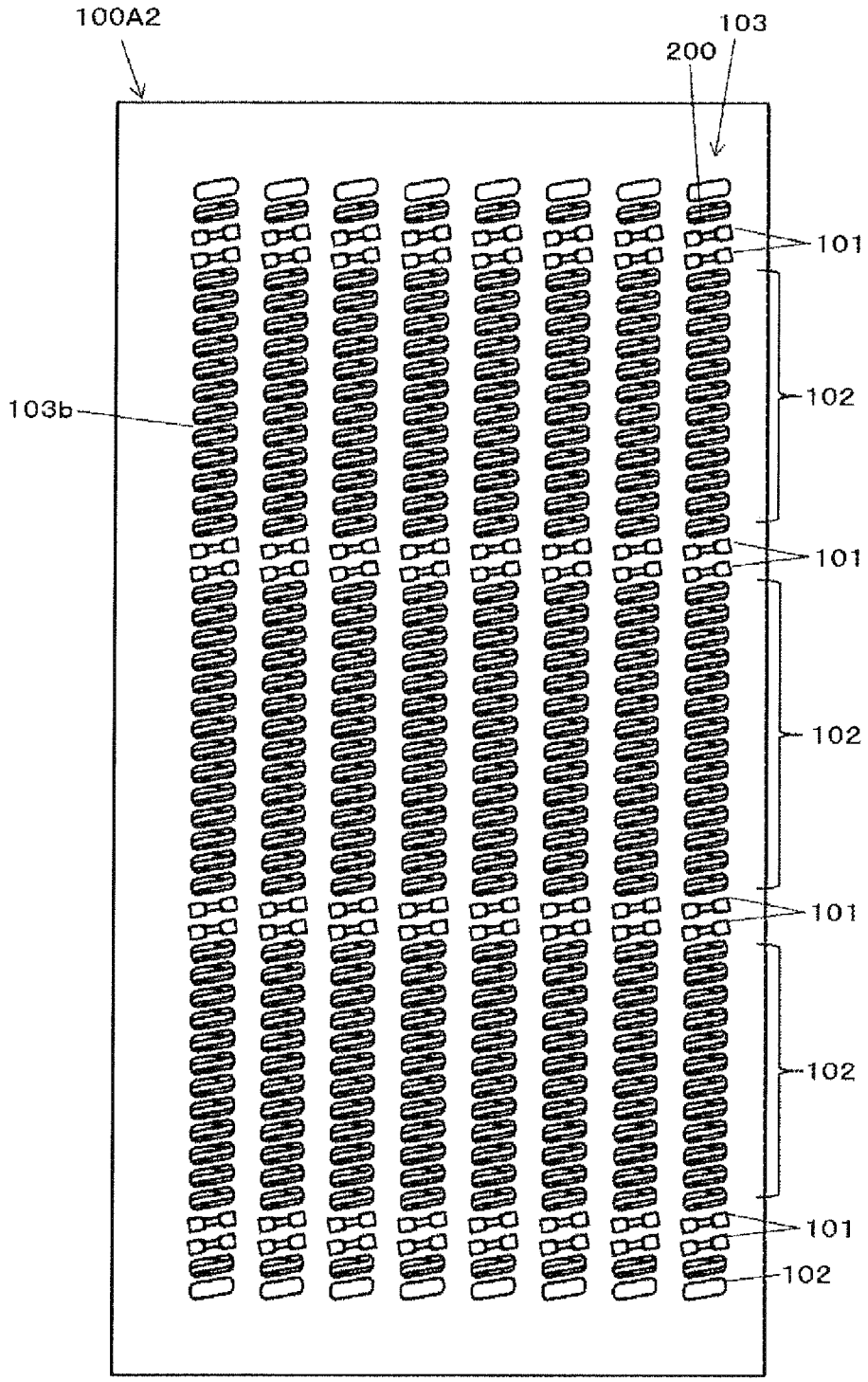
FIG. 19 is a rear view of the coil holding sheet of another modified embodiment of the first embodiment, to which coils are held.
Figure 20:
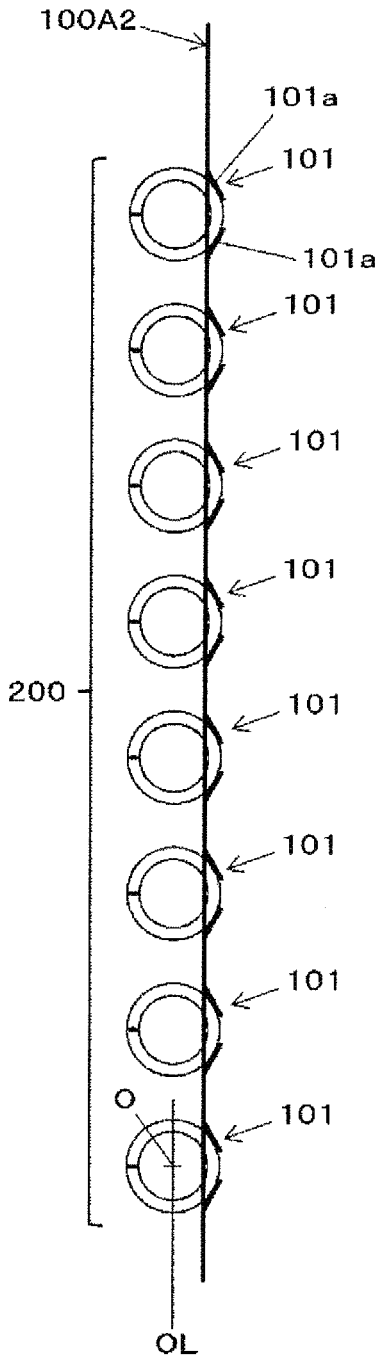
FIG. 20 is a side view of the coil holding sheet of another modified embodiment of the first embodiment, to which coils are held.
Figure 21:
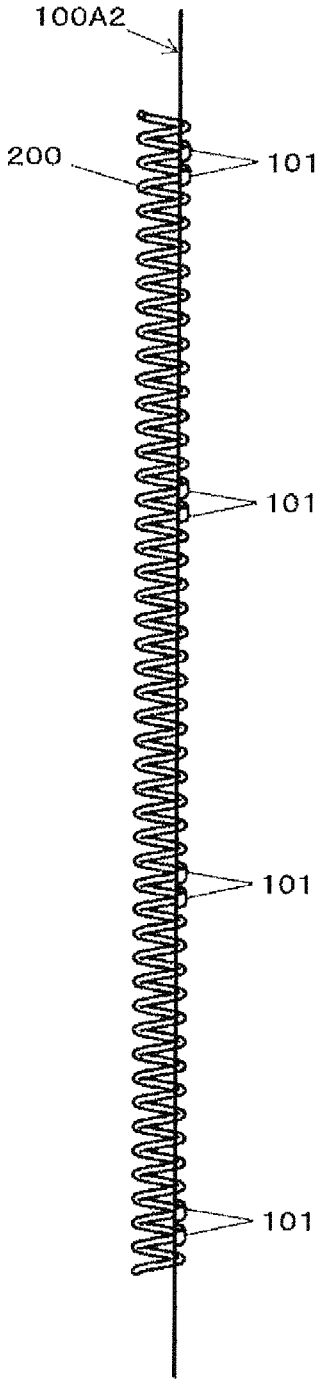
FIG. 21 is a plan view of the coil holding sheet of another modified embodiment of the first embodiment, to which coils are held.
Figure 22:
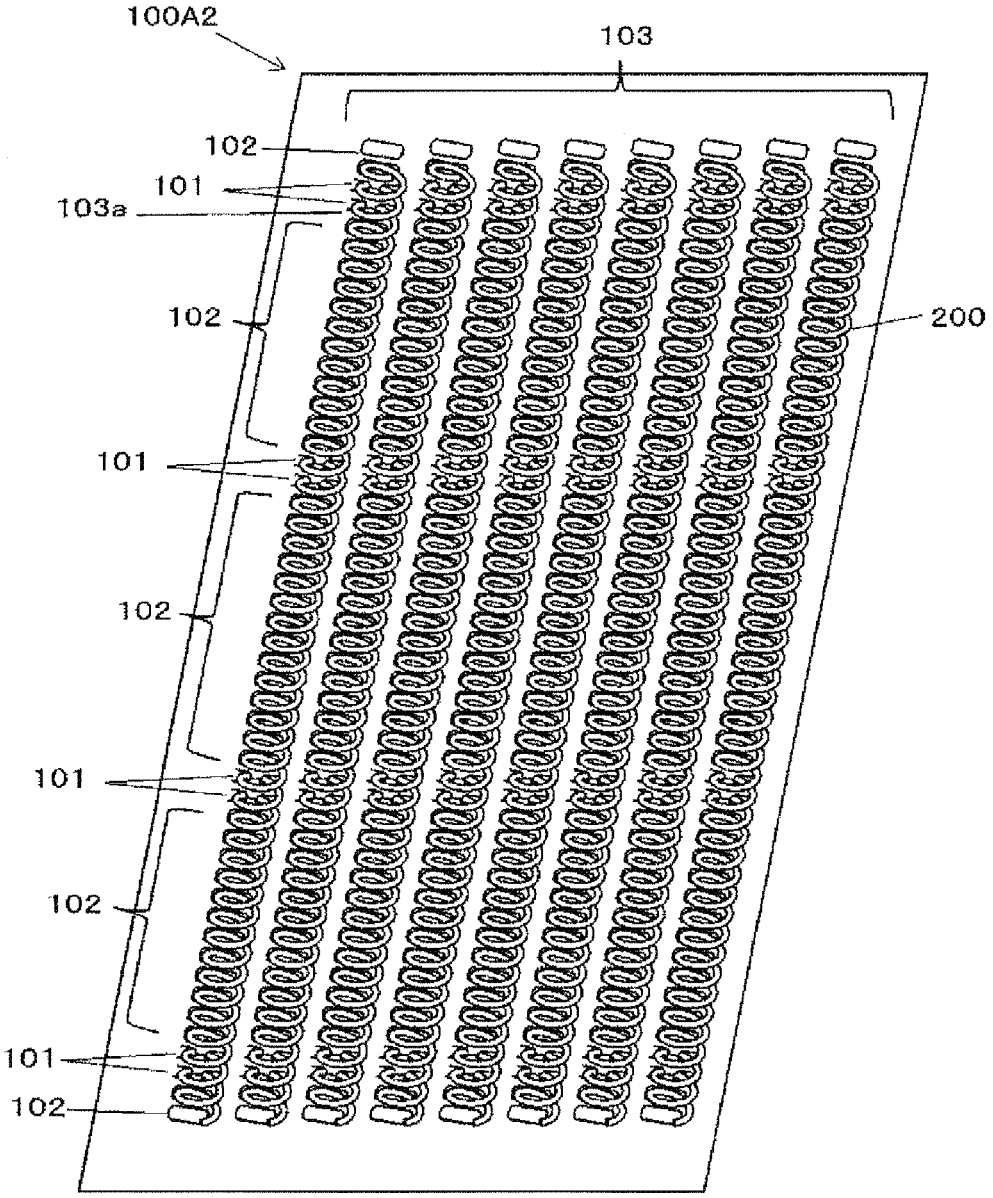
FIG. 22 is a perspective view of the coil holding sheet of another modified embodiment of the first embodiment, to which coils are held.

FIG. 17 is a front view depicting another modified embodiment of the coil holding sheet of the first embodiment. FIGS. 18 to 22 depict the coil holding sheet of another modified embodiment of the first embodiment. FIG. 18 is a front view of the coil holding sheet of another modified embodiment of the first embodiment, to which coils are held. FIG. 19 is a rear view of the coil holding sheet of another modified embodiment of the first embodiment, to which coils are held. FIG. 20 is a side view of the coil holding sheet of another modified embodiment of the first embodiment, to which coils are held. FIG. 21 is a plan view of the coil holding sheet of another modified embodiment of the first embodiment, to which coils are held. FIG. 22 is a perspective view of the coil holding sheet of another modified embodiment of the first embodiment, to which coils are held.

A coil holding sheet 100A2 of another modified embodiment of the first embodiment has the holders 101 configured to hold the coil 200, and the escape holes 102 configured to escape circumferential portions of the coil 200 from a front surface, which is one surface of the coil holding sheet

100A2, to a back surface, which is the other surface. The coil holding sheet 100A2 is configured so that the length $L_4$ of each escape hole 102 in the axial direction of the coil 200 is a length within which the coil 200 of one turn is to enter the escape hole. The other configurations are the same as the coil holding sheet 100A of the first embodiment.

That is, the coil holding sheet 100A2 configures the coil holding row 103 for holding one coil 200 by a combination of the holders 101 and the escape holes 102. In order to hold the plurality of coils 200 by one coil holding sheet 100A2, the coil holding sheet 100A2 is formed with the plurality of coil holding rows 103 with predetermined intervals in the direction perpendicular to the axial direction of the coil 200.

The holder 101 has the pair of push-up pieces 101*a* facing each other in the circumferential direction of the coil 200 and the slit 101*b* provided between the pair of push-up pieces 101*a*. The push-up piece 101*a* is formed by the cut 101*c* penetrating the front and back of the coil holding sheet 100A2 and having a shape of coupling a side, which is opposite to a side at which the slit 101*b* is provided, to the coil holding sheet 100A2. The push-up piece 101*a* is formed at a portion coupling to the coil holding sheet 100A2 with the bent portion 101*d*. The push-up piece 101*a* has a U-shape as shown in FIGS. 2 and 17, a C-shape or a rectangular or triangular shape of which one side couples to the coil holding sheet 100A2, which are not shown.

As shown in FIG. 2, the pair of push-up pieces 101*a* is configured so that the interval $L_1$ between the bent portion 101*d* of one push-up piece 101*a* and the bent portion 101*d* of the other push-up piece 101*a* is smaller than the outer diameter Ro of the coil 200. However, in a configuration where a radial position of the coil 200 is determined by the escape hole 102, the interval $L_1$ between the pair of bent portions 101*d* may be equal to the outer diameter Ro of the coil 200 or larger than the outer diameter Ro of the coil 200.

The slit 101*b* is formed by linearly cutting the front and back of the coil holding sheet 100A2 between the cut 101*c* of one push-up piece 101*a* and the cut 101*c* of the other push-up piece 101*a*. The pair of cuts 101*c* is coupled by the slit 101*b*.

The coil holding sheet 100A2 has the holding pieces 101*f* provided at both sides of the slit 101*b* and protruding in the direction of the slit 101*b* along the axial direction of the coil 200. The holding pieces 101*f* are configured to openably and closably close a space, which may be configured by the cuts 101*c* and the slit 101*b*, and to detachably hold the coil 200.

The length $L_2$ of the slit 101*b* is smaller than the inner diameter Ri, which is the diameter of the inner periphery of the coil 200. When the coil 200 is attached to the coil holding sheet 100A2, a part of an area greater than a half of a circumference of the coil 200 protrudes to a front surface side, which is one side of the coil holding sheet 100A2, and a part of an area less than the half of the circumference of the coil 200 protrudes to a back surface side, which is the other side of the coil holding sheet 100A2, as shown in FIGS. 20 and 21 and the like, in this modified embodiment.

That is, the coil 200 is held to the coil holding sheet 100A2 with the radial center O of the coil 200 being offset to the front surface side, which is one side with respect to the coil holding sheet 100A2. For this reason, the slit 101*b* has a length tailored to the interval of the inner periphery-side of the coil 200 at a position at which the coil 200 is held by the coil holding sheet 100A2.

The coil holding sheet 100A2 has the holder forming places 103*a*, at which the holders 101 are formed, at the plurality of places of the coil holding row 103 along the axial direction of the coil 200. In this modified embodiment, the holder forming places 103*a* are formed at four places spaced with predetermined intervals along the axial direction of the coil 200.

Also, the coil holding sheet 100A2 has at least the pair of push-up pieces 101*a* provided at each of the holder forming places 103*a*. In this modified embodiment, two sets of the pairs of push-up pieces 101*a* are provided at each of the holder forming places 103*a* in conformity to the pitch P of the coil 200. The escape hole 102 has a shape by which a circumferential portion of the coil 200 can be inserted and pulled out, and is configured by an opening penetrating the front and back of the coil holding sheet 100A2. The escape holes 102 are provided in parallel with the holder forming places 103*a* along the axial direction of the coil 200 held to the coil holding sheet 100A2 by the holders 101.

The escape hole 102 is configured so that the length $L_3$ in the radial direction of the coil 200 is smaller than the outer diameter Ro of the coil 200. Thereby, the coil 200 cannot enter the escape hole 102 to a position at which the radial center O becomes flush with the coil holding sheet 100A2.

Therefore, the coil 200 is held to the coil holding sheet 100A2 in a state where the coil is offset with respect to the coil holding sheet 100A2 so that a protrusion height to the front surface side is greater than a protrusion height to the back surface side. An offset amount is determined with the length $L_3$ of the escape hole 102 in the radial direction of the coil 200.

The escape hole 102 is configured so that the length $L_4$ in the axial direction of the coil 200 is a length within which the coil 200 of one turn in the axial direction is to enter the escape hole.

The coil holding row 103 is provided with the coupling portions 103*b* each of which is formed between the escape holes 102 arranged in parallel in the axial direction of the coil 200 and is provided to couple one side and the other side of the escape holes 102 in the radial direction of the coil 200 therebetween.

Figure 23:
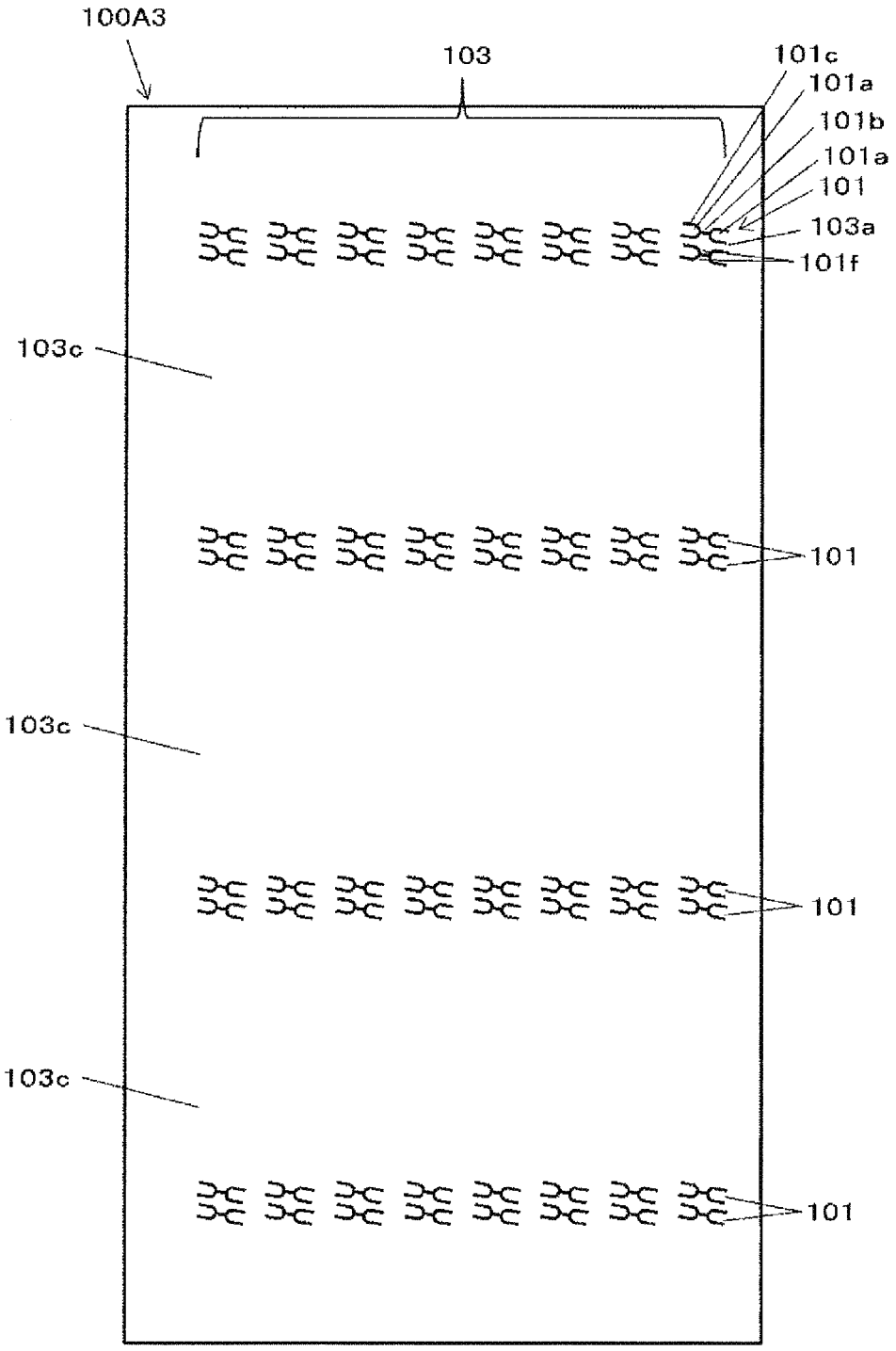
FIG. 23 is a front view depicting another modified embodiment of the coil holding sheet of the first embodiment.
Figure 24:
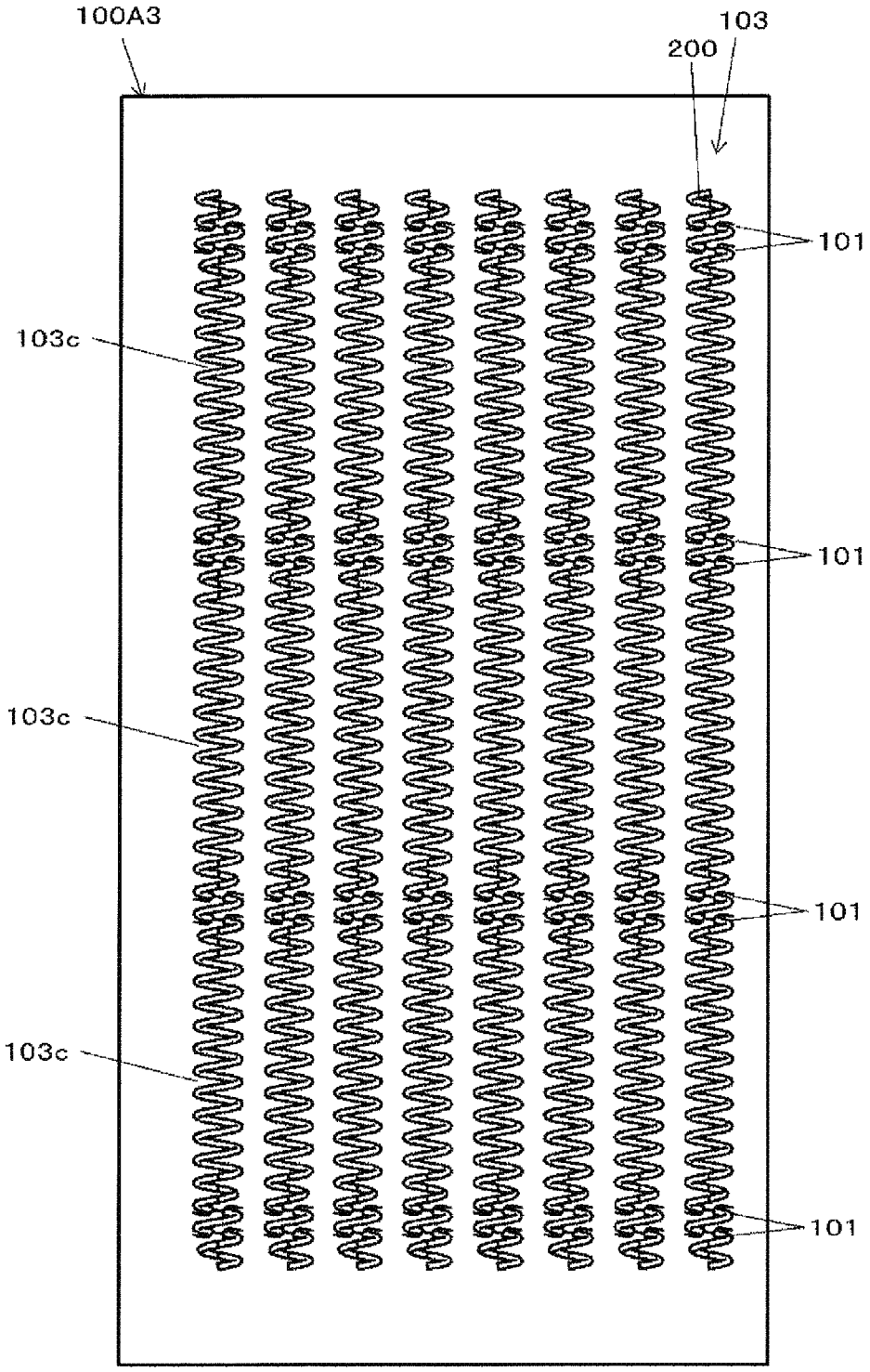
FIG. 24 is a front view of the coil holding sheet of another modified embodiment of the first embodiment, to which coils are held.
Figure 25:
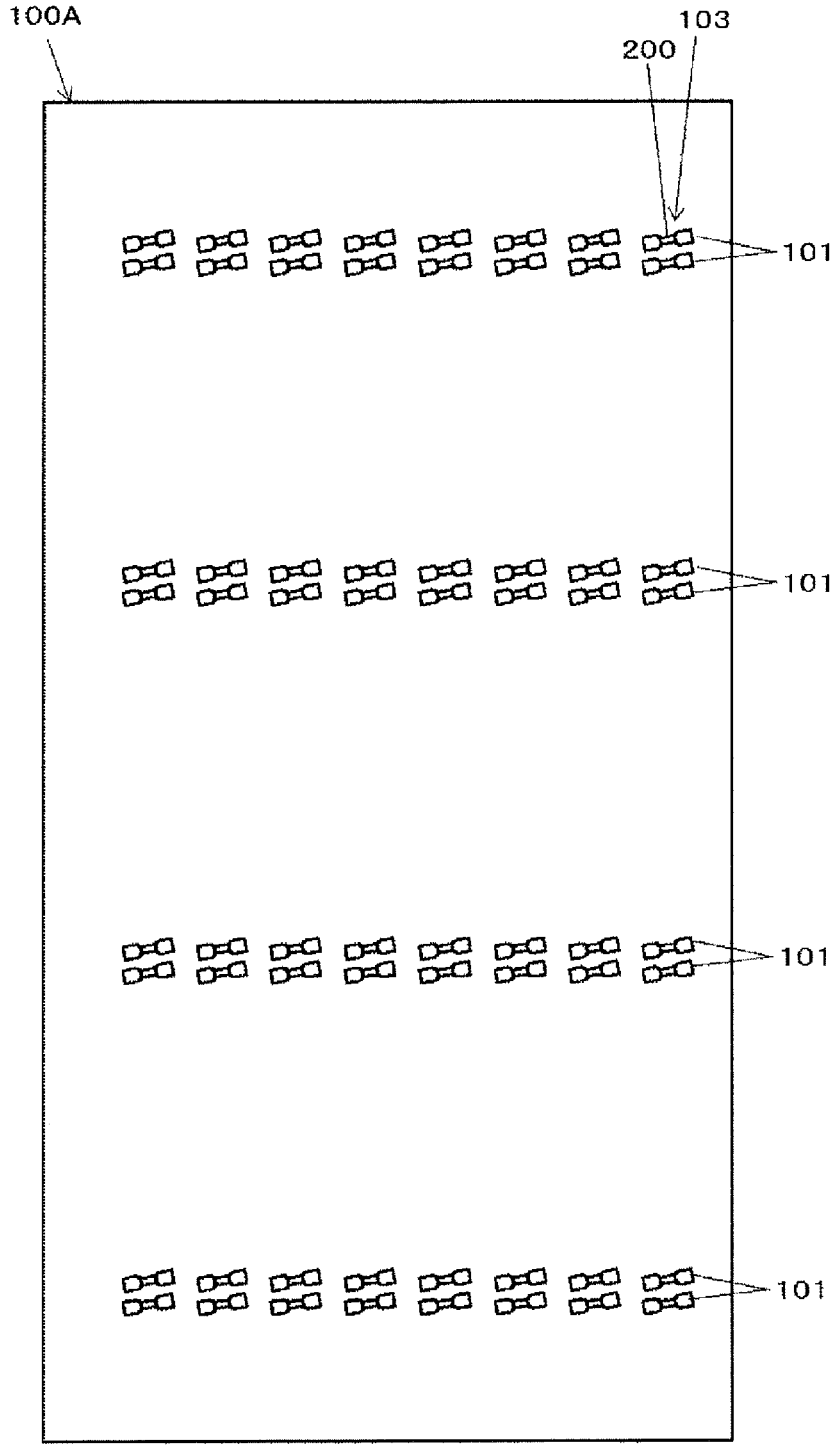
FIG. 25 is a rear view of the coil holding sheet of another modified embodiment of the first embodiment, to which coils are held.
Figure 26:
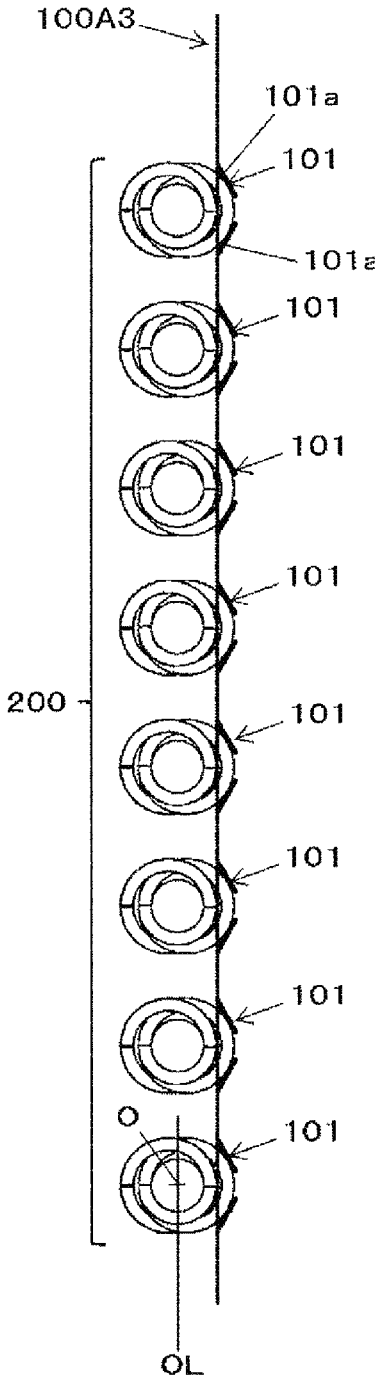
FIG. 26 is a side view of the coil holding sheet of another modified embodiment of the first embodiment, to which coils are held.
Figure 27:
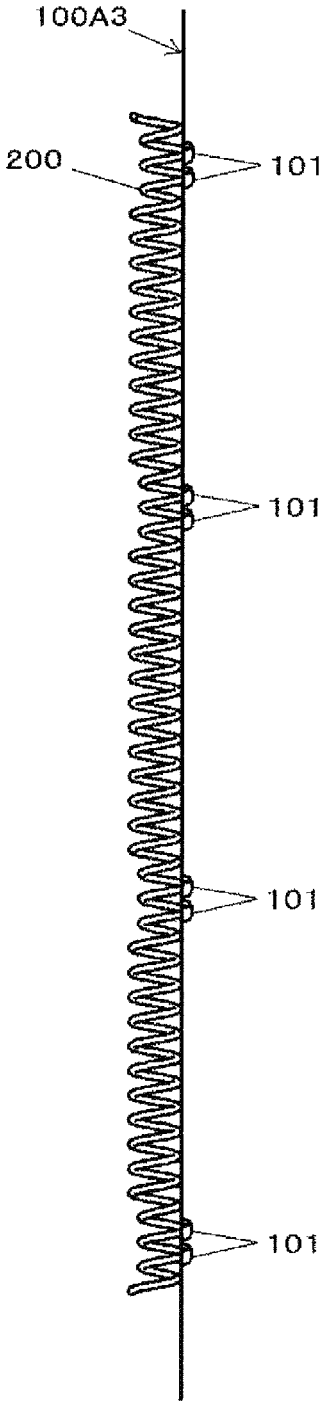
FIG. 27 is a plan view of the coil holding sheet of another modified embodiment of the first embodiment, to which coils are held.
Figure 28:
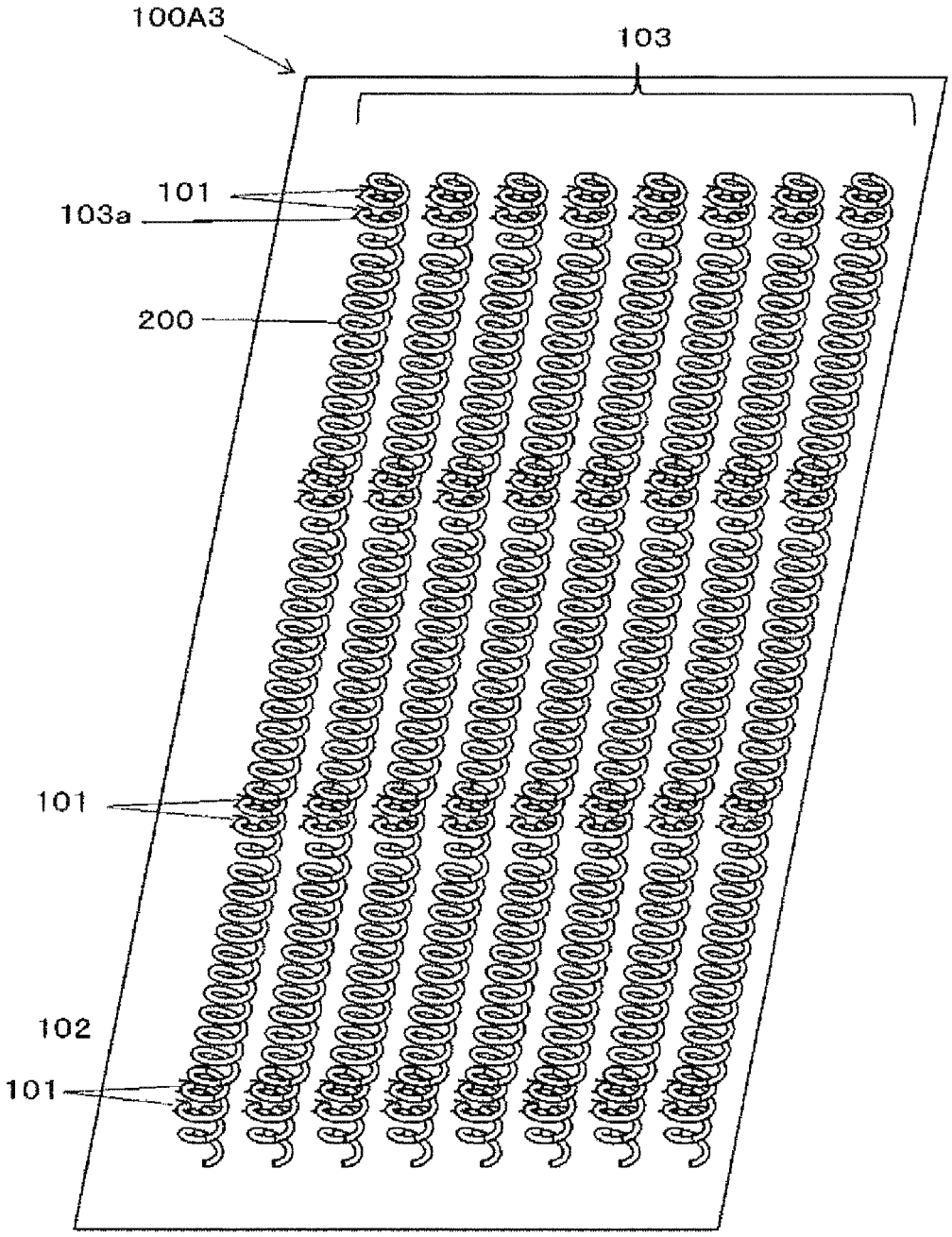
FIG. 28 is a perspective view of the coil holding sheet of another modified embodiment of the first embodiment, to which coils are held.

FIG. 23 is a front view depicting another modified embodiment of the coil holding sheet of the first embodiment. FIGS. 24 to 28 depict the coil holding sheet of another modified embodiment of the first embodiment. FIG. 24 is a front view of the coil holding sheet of another modified embodiment of the first embodiment, to which coils are held. FIG. 25 is a rear view of the coil holding sheet of another modified embodiment of the first embodiment, to which coils are held. FIG. 26 is a side view of the coil holding sheet of another modified embodiment of the first embodiment, to which coils are held. FIG. 27 is a plan view of the coil holding sheet of another modified embodiment of the first embodiment, to which coils are held. FIG. 28 is a perspective view of the coil holding sheet of another modified embodiment of the first embodiment, to which coils are held.

A coil holding sheet 100A3 of another modified embodiment of the first embodiment has the holders 101 configured to hold the coil 200. The coil holding sheet 100A3 is not provided with the escape holes 102 configured to escape circumferential portions of the coil 200 to the back surface of the coil holding sheet 100A (refer to FIG. 1 and the like).

That is, the coil holding sheet 100A3 configures the coil holding row 103 for holding one coil 200 by the holders 101. In order to hold the plurality of coils 200 by one coil holding sheet 100A3, the coil holding sheet 100A3 is formed with the plurality of coil holding rows 103 with predetermined intervals in the direction perpendicular to the axial direction of the coil 200.

The holder 101 has the pair of push-up pieces 101*a* facing each other in the circumferential direction of the coil 200 and the slit 101*b* provided between the pair of push-up pieces 101*a*. The push-up piece 101*a* is formed by the cut 101*c* penetrating the front and back of the coil holding sheet 100A3 and having a shape of coupling a side, which is opposite to a side at which the slit 101*b* is provided, to the coil holding sheet 100A3. The push-up piece 101*a* is formed at a portion coupling to the coil holding sheet 100A2 with the bent portion 101*d*. The push-up piece 101*a* has a U-shape as shown in FIGS. 2 and 23, a C-shape or a rectangular or triangular shape of which one side couples to the coil holding sheet 100A3, which are not shown.

As shown in FIG. 2, the pair of push-up pieces 101*a* is configured so that the interval $L_1$ between the bent portion 101*d* of one push-up piece 101*a* and the bent portion 101*d* of the other push-up piece 101*a* is smaller than the outer diameter Ro of the coil 200. However, the interval $L_1$ between the pair of bent portions 101*d* may be equal to the outer diameter Ro of the coil 200 or larger than the outer diameter Ro of the coil 200.

The slit 101*b* is formed by linearly cutting the front and back of the coil holding sheet 100A3 between the cut 101*c* of one push-up piece 101*a* and the cut 101*c* of the other push-up piece 101*a*. The pair of cuts 101*c* is coupled by the slit 101*b*.

The coil holding sheet 100A3 has the holding pieces 101*f* provided at both sides of the slit 101*b* and protruding in the direction of the slit 101*b* along the axial direction of the coil 200. The holding pieces 101*f* are configured to openably and closably close a space, which may be configured by the cuts 101*c* and the slit 101*b*, and to detachably hold the coil 200.

The length $L_2$ of the slit 101*b* is smaller than the inner diameter Ri, which is the diameter of the inner periphery of the coil 200. When the coil 200 is attached to the coil holding sheet 100A3, a part of an area greater than a half of a circumference of the coil 200 protrudes to a front surface side, which is one side of the coil holding sheet 100A3, and a part of an area less than the half of the circumference of the coil 200 protrudes to a back surface side, which is the other side of the coil holding sheet 100A3, as shown in FIGS. 26 and 27 and the like, in this modified embodiment. At positions at which the holder 101 is not provided, the entire coil 200 in the circumferential direction protrudes to the front surface side of the coil holding sheet 100A3.

That is, the coil 200 is held to the coil holding sheet 100A3 with the radial center O of the coil 200 being offset to the front surface side, which is one side with respect to the coil holding sheet 100A3. For this reason, the slit 101*b* has a length tailored to the interval of the inner periphery-side of the coil 200 at a position at which the coil 200 is held by the coil holding sheet 100A3.

The coil holding sheet 100A3 has the holder forming places 103*a*, at which the holders 101 are formed, at the plurality of places of the coil holding row 103 along the axial direction of the coil 200. In this modified embodiment, the holder forming places 103*a* are formed at four places spaced with predetermined intervals along the axial direction of the coil 200.

Also, the coil holding sheet 100A3 has at least the pair of push-up pieces 101*a* provided at each of the holder forming places 103*a*. In this modified embodiment, two sets of the pairs of push-up pieces 101*a* are provided at each of the holder forming places 103*a* in conformity to the pitch P of the coil 200.

The coil holding sheet 100A3 is not provided with an opening penetrating the front and back thereof between the holder forming places 103*a*, and is formed with coil support parts 103*c* configured to surface-support the outer peripheries of the coils 200.

Figure 29:
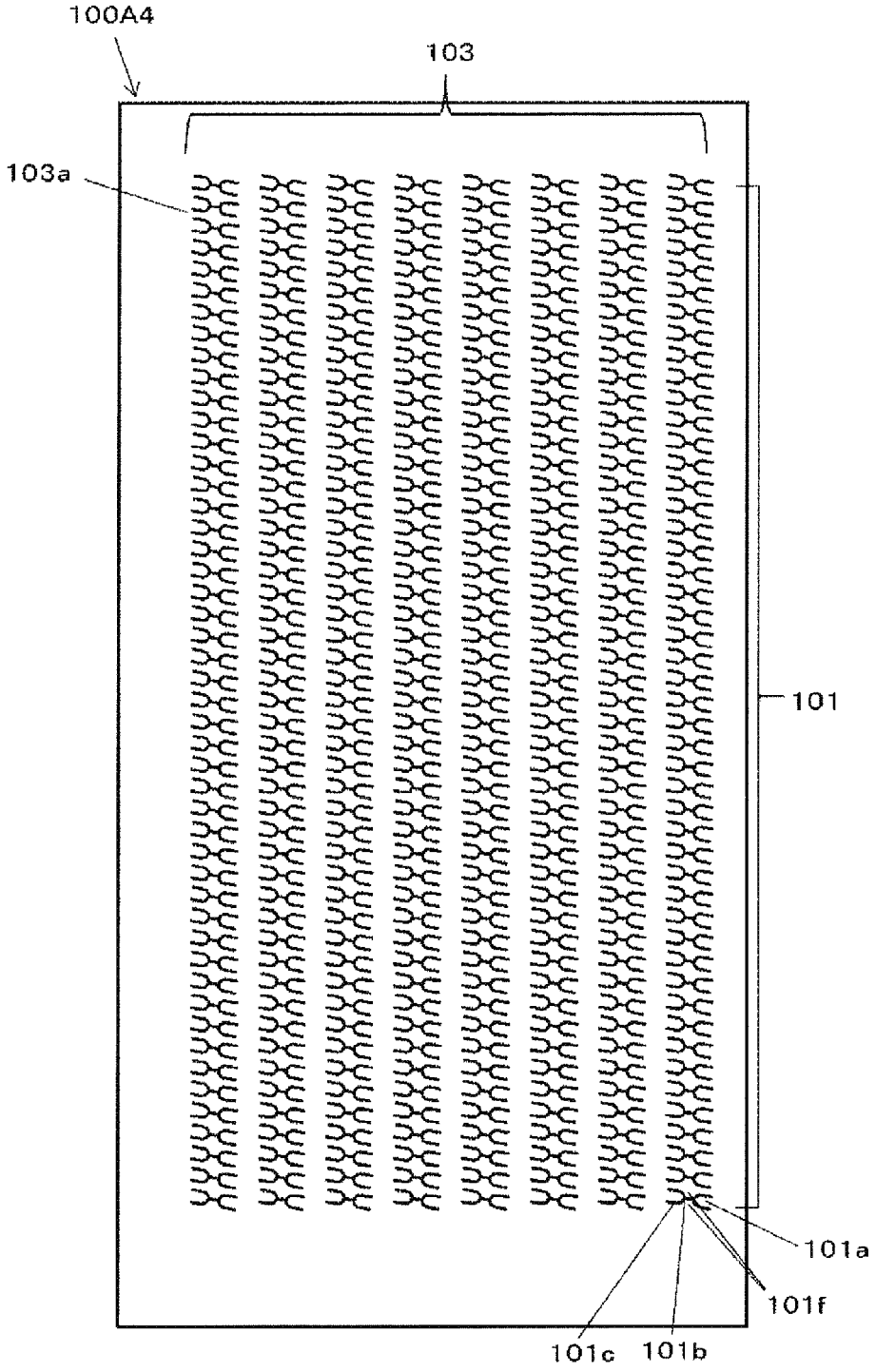
FIG. 29 is a front view depicting another modified embodiment of the coil holding sheet of the first embodiment.
Figure 30:
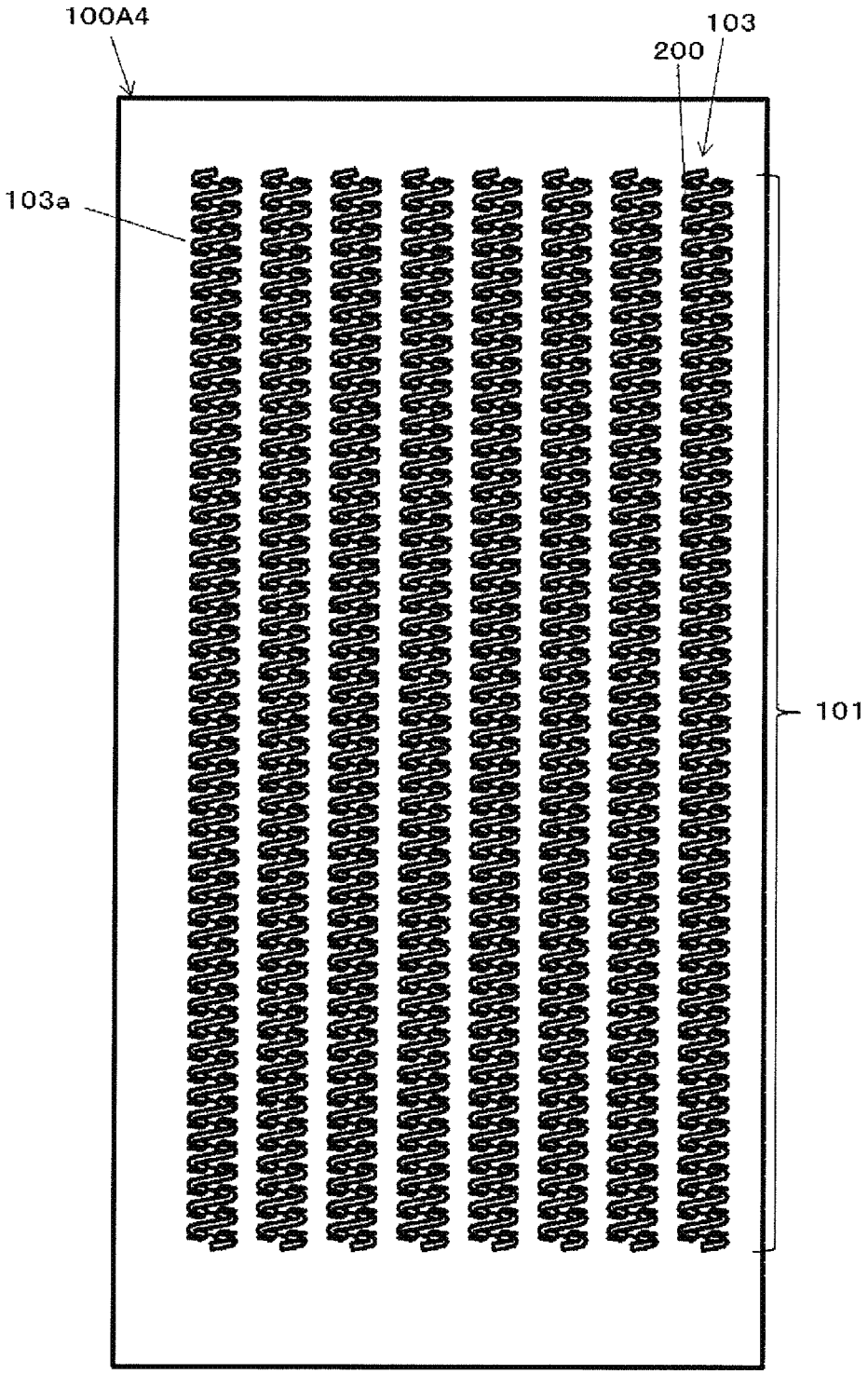
FIG. 30 is a front view of the coil holding sheet of another modified embodiment of the first embodiment, to which coils are held.
Figure 31:
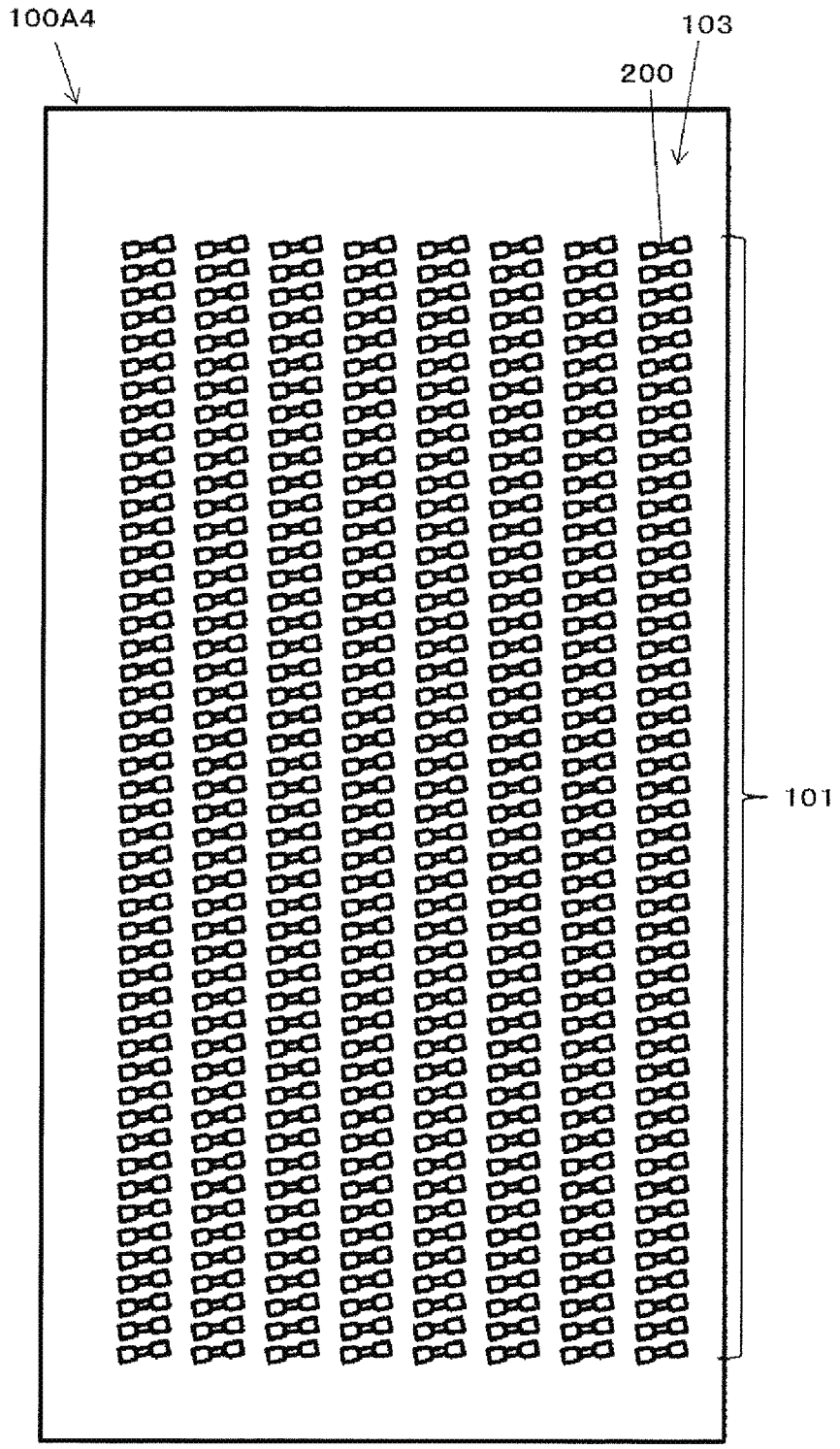
FIG. 31 is a rear view of the coil holding sheet of another modified embodiment of the first embodiment, to which coils are held.
Figure 32:
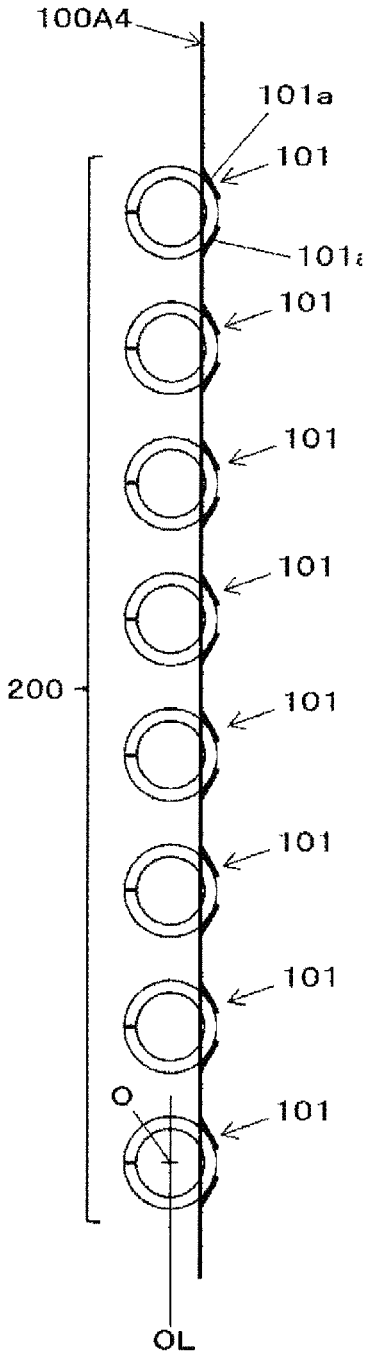
FIG. 32 is a side view of the coil holding sheet of another modified embodiment of the first embodiment, to which coils are held.
Figure 33:
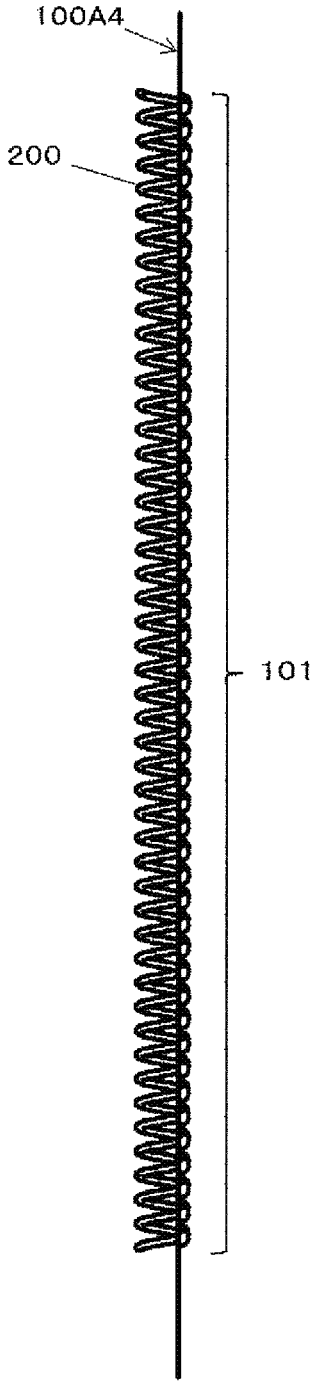
FIG. 33 is a plan view of the coil holding sheet of another modified embodiment of the first embodiment, to which coils are held.
Figure 34:
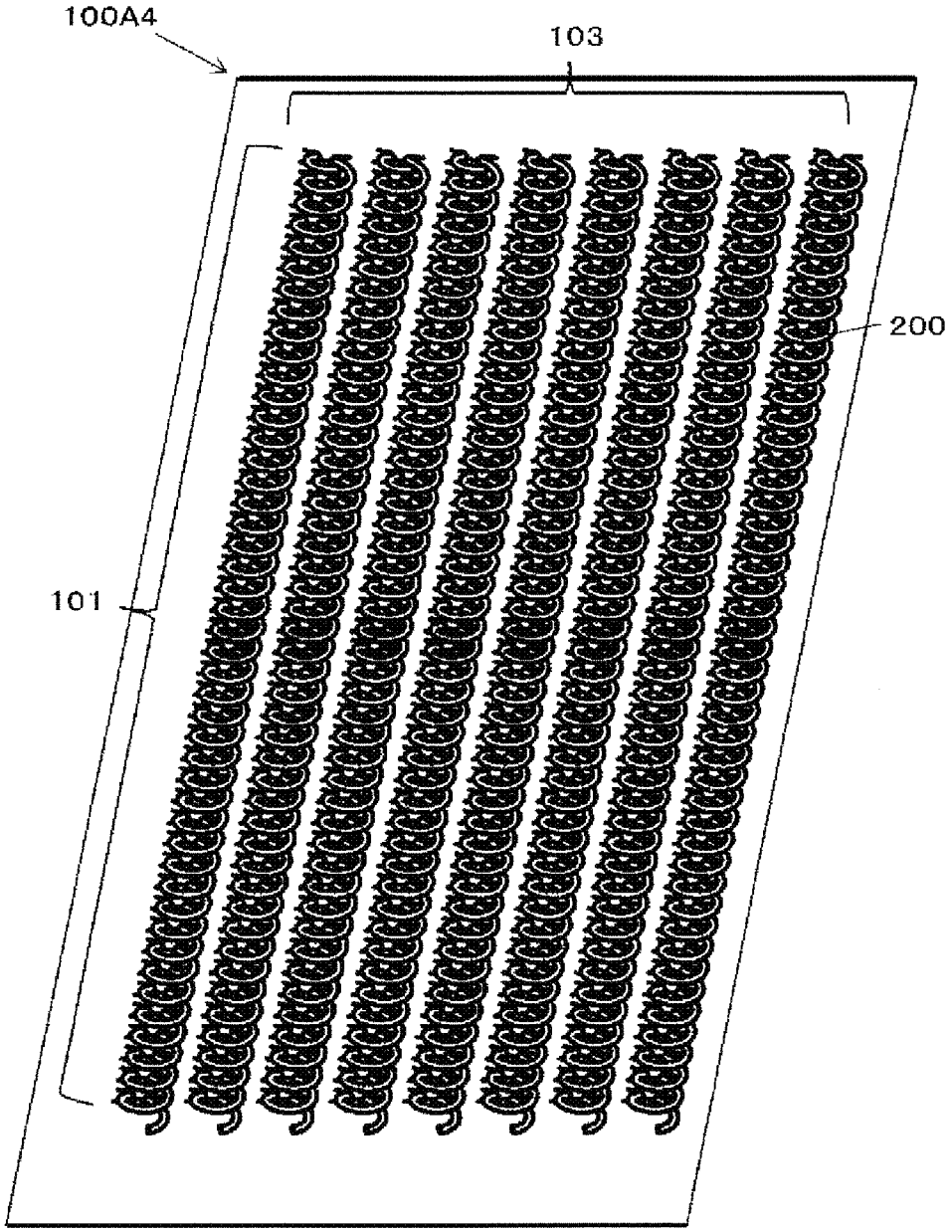
FIG. 34 is a perspective view of the coil holding sheet of another modified embodiment of the first embodiment, to which coils are held.

FIG. 29 is a front view depicting another modified embodiment of the coil holding sheet of the first embodiment. FIGS. 30 to 34 depict the coil holding sheet of another modified embodiment of the first embodiment. FIG. 30 is a front view of the coil holding sheet of another modified embodiment of the first embodiment, to which coils are held. FIG. 31 is a rear view of the coil holding sheet of another modified embodiment of the first embodiment, to which coils are held. FIG. 32 is a side view of the coil holding sheet of another modified embodiment of the first embodiment, to which coils are held. FIG. 33 is a plan view of the coil holding sheet of another modified embodiment of the first embodiment, to which coils are held. FIG. 34 is a perspective view of the coil holding sheet of another modified embodiment of the first embodiment, to which coils are held.

A coil holding sheet 100A4 of another modified embodiment of the first embodiment has the holders 101 configured to hold the coil 200. The coil holding sheet 100A4 is not provided with the escape holes 102 configured to escape circumferential portions of the coil 200 to the back surface of the coil holding sheet 100A (refer to FIG. 1 and the like). The coil holding sheet 100A4 has the holders 101 of which the number is equal to or larger than the number of turns of the coil 200, in conformity to the pitch P of the coil 200.

That is, the coil holding sheet 100A4 configures the coil holding row 103 for holding one coil 200 by the holders 101. In order to hold the plurality of coils 200 by one coil holding sheet 100A4, the coil holding sheet 100A3 is formed with the plurality of coil holding rows 103 with predetermined intervals in the direction perpendicular to the axial direction of the coil 200.

The holder 101 has the pair of push-up pieces 101*a* facing each other in the circumferential direction of the coil 200 and the slit 101*b* provided between the pair of push-up pieces 101*a*. The push-up piece 101*a* is formed by the cut 101*c* penetrating the front and back of the coil holding sheet 100A4 and having a shape of coupling a side, which is opposite to a side at which the slit 101*b* is provided, to the coil holding sheet 100A4. The push-up piece 101*a* is formed at a portion coupling to the coil holding sheet 100A4 with the bent portion 101*d*. The push-up piece 101*a* has a U-shape as shown in FIGS. 2 and 29, a C-shape or a rectangular or triangular shape of which one side couples to the coil holding sheet 100A4, which are not shown.

As shown in FIG. 2, the pair of push-up pieces 101*a* is configured so that the interval $L_1$ between the bent portion 101*d* of one push-up piece 101*a* and the bent portion 101*d* of the other push-up piece 101*a* is smaller than the outer diameter Ro of the coil 200. However, the interval $L_1$ between the pair of bent portions 101*d* may be equal to the outer diameter Ro of the coil 200 or larger than the outer diameter Ro of the coil 200.

The slit 101*b* is formed by linearly cutting the front and back of the coil holding sheet 100A3 between the cut 101*c* of one push-up piece 101*a* and the cut 101*c* of the other push-up piece 101*a*. The pair of cuts 101*c* is coupled by the slit 101*b*.

The coil holding sheet 100A4 has the holding pieces 101*f* provided at both sides of the slit 101*b* and protruding in the direction of the slit 101*b* along the axial direction of the coil 200. The holding pieces 101*f* are configured to openably and closably close a space, which may be configured by the cuts 101*c* and the slit 101*b*, and to detachably hold the coil 200.

The length $L_2$ of the slit 101*b* is smaller than the inner diameter Ri, which is the diameter of the inner periphery of the coil 200. When the coil 200 is attached to the coil holding sheet 100A4, a part of an area greater than a half of a circumference of the coil 200 protrudes to a front surface side, which is one side of the coil holding sheet 100A3, and a part of an area less than the half of the circumference of the coil 200 protrudes to a back surface side, which is the other side of the coil holding sheet 100A3, as shown in FIGS. 32 and 33 and the like, in this modified embodiment.

That is, the coil 200 is held to the coil holding sheet 100A4 with the radial center O of the coil 200 being offset to the front surface side, which is one side with respect to the coil holding sheet 100A4. For this reason, the slit 101*b* has a length tailored to the interval of the inner periphery-side of the coil 200 at a position at which the coil 200 is held by the coil holding sheet 100A4.

The coil holding sheet 100A4 has the holders 101 of which the number is equal to or larger than the number of turns of the coil 200 in each of the coil holding rows 103, in conformity to the pitch P of the coil 200. For this reason, each of the coil holding rows 103 becomes the holder forming place 103*a*, as a whole.

Examples of Operational Effect of Coil Holding Sheet of First Embodiment

The coil holding sheet 100A holds the coil 200 one by one in each of the coil holding rows 103. As shown in FIG. 8, at the holder forming place 103*a*, the circumferential portion of the coil 200 enters the back surface side of the coil holding sheet 100A beyond the slit 101*b* and the holding pieces 101*f* in a state where the push-up pieces 101*a* are deformed to the back surface side of the coil holding sheet 100A.

The coil holding sheet 100A1, 100A2, 100A3, 100A4 also holds the coil 200 one by one in each of the coil holding rows 103, like the coil holding sheet 100A. At the holder forming place 103*a*, the circumferential portion of the coil 200 enters the back surface side of the coil holding sheet 100A1, 100A2, 100A3, 100A4 beyond the slit 101*b* and the holding pieces 101*f* in a state where the push-up pieces 101*a* are deformed to the back surface side of the coil holding sheet 100A1, 100A2, 100A3, 100A4.

Thereby, the holding pieces 101*f* of the holder 101 enter the inner periphery side of the coil 200. The coil 200 of the portion having entered the back surface side of the coil holding sheet 100A, 100A1, 100A2, 100A3, 100A4 is pressed by the holding pieces 101*f* with being pushed up in the direction of the holding pieces 101*f* by the push-up pieces 101*a* to return to the original shape.

The slit 101*b* between the pair of holding pieces 101*f* does not form an interval through which the coil 200 can pass, unless an external force capable of separating the coil 200 from the coil holding sheet 100A, 100A1, 100A2, 100A3, 100A4 is applied. Therefore, it is possible to avoid the coil 200 from separating from the holder 101 by the holding pieces 101*f*, when an unintended external force is applied to the coil 200.

Also, the two or more sets of the holders 101 are provided at each holder forming place 103*a*, in conformity to the pitch P of the coil 200, so that even when the coil 200 separates from the holder 101 of one place, the coil 200 can be held at the other adjacent holder 101.

In the case of the coil holding sheet 100A, 100A1, 100A2 having the escape holes 102 formed therein, when the coil 200 is held in the coil holding row 103, the circumferential portion of the coil 200 enters the escape hole 102 at the portion at which the escape hole 102 is formed, as shown in FIG. 9. In the escape hole 102, the coil 200 cannot enter the escape hole 102 to the position at which the radial center O of the coil 200 becomes flush with the coil holding sheet 100A, 100A1, 100A2.

Therefore, the coil 200 is held to the coil holding sheet 100A, 100A1, 100A2 in the state where the coil is offset with respect to the coil holding sheet 100A, 100A1, 100A2 so that the protrusion height to the front surface side is greater than the protrusion height to the back surface side.

Also, in the case of the coil holding sheet 100A3 having no escape hole 102, the coil support part 103*c* configured to surface-support the outer periphery of the coil 200 is formed between the holder forming places 103*a*.

Thereby, the coil 200 held to the coil holding sheet 100A3 is offset with respect to the coil holding sheet 100A3 at the holder forming place 103*a* so that the protrusion height to the front surface side is greater than the protrusion height to the back surface side by a shape of the holder 101 such as a pushing-up force of the push-up pieces 101*a*, a length of the slit 101*b*, and the like. Also, the circumferentially entire coil 200 held to the coil holding sheet 100A3 protrudes to the front surface side of the coil holding sheet 100A3 at the formation place of the coil support part 103*c* and is thus offset to the front surface side of the coil holding sheet 100A3.

Also, in the case of the coil holding sheet 100A4 with no escape hole 102 and having the holders 101 formed therein in conformity to the number of turns of the coil 200, the coil 200 is held to the coil holding sheet 100A4 in the state where the coil is offset with respect to the coil holding sheet 100A4 so that the protrusion height to the front surface side is greater than the protrusion height to the back surface side by a shape of the holder 101 such as a pushing-up force of the push-up pieces 101*a*, a length of the slit 101*b*, and the like.

In the state where the coil 200 is held to the coil holding sheet 100A, 100A1, 100A2 having the escape holes 102 formed therein, even when the coil holding sheet 100A, 100A1, 100A2 is seen from the back surface side, it is possible to easily check that the coil 200 is held, because the portions of the coil 200 are exposed to the escape holes 102. In particular, as shown in FIGS. 4 and 13, the length $L_4$ of the escape hole 102 is configured as the length within which the coil 200 of multiple turns in the axial direction can enter therein, so that the visibility is improved.

In the meantime, when an opening area of each escape hole 102 is made small, like the coil holding sheet 100A1, 100A2, it is possible to increase the number of the coupling portions 103*b*, so that it is possible to improve the strength against the bending of the coil holding sheet 100A1, 100A2.

However, if the length $L_4$ of the escape hole 102 is set to a length within which the coil 200 of one turn is to enter the escape hole, the opening area of the escape hole 102 is decreased, so that the operability upon the manufacturing of the coil holding sheet 100A2 is lowered, as compared to a case where the opening area is large. For this reason, the length $L_4$ of the escape hole 102 is preferably configured as a length within which the coil 200 of multiple turns in the axial direction can enter the escape hole.

When detaching the coil 200 from the coil holding sheet 100A, a force of moving the coil 200 in a direction of separating from the coil holding sheet 100A is applied to the coil 200 from the front surface side of the coil holding sheet 100A, such as relative movement of the coil 200 and the coil holding sheet 100A in a direction along the coil holding sheet 100A.

When the force is applied in the direction of separating the coil 200 from the coil holding sheet 100A, the holding pieces 101*f* are pressed and deformed by the coil 200, and the width of the slit 101*b* is widened, so that the coil 200 is separated from the slit 101*b*. Thereby, the coil 200 is detached from the coil holding sheet 100A.

Also in a case of detaching the coil 200 from the coil holding sheet 100A1, 100A2, 100A3, 100A4, like the coil holding sheet 100A, a force of moving the coil 200 in a direction of separating from the coil holding sheet 100A1, 100A2, 100A3, 100A4 is applied to the coil 200 from the front surface side of the coil holding sheet 100A1, 100A2, 100A3, 100A4, such as relative movement of the coil 200 and the coil holding sheet 100A1, 100A2, 100A3, 100A4 in a direction along the coil holding sheet 100A1, 100A2, 100A3, 100A4.

When the force is applied in the direction of separating the coil 200 from the coil holding sheet 100A1, 100A2, 100A3, 100A4, the holding pieces 101*f* are pressed and deformed by the coil 200, and the width of the slit 101*b* is widened, so that the coil 200 is separated from the slit 101*b*. Thereby, the coil 200 is detached from the coil holding sheet 100A1, 100A2, 100A3, 100A4.

As described above, the coil 200 is held to the coil holding sheet 100A, 100A1, 100A2, 100A3, 100A4 in the state where the coil is offset with respect to the coil holding sheet 100A, 100A1, 100A2, 100A3, 100A4 so that the protrusion height to the front surface side is greater than the protrusion height to the back surface side. Thereby, it is possible to securely apply the force for detaching the coil 200 from the coil holding sheet 100A, 100A1, 100A2, 100A3, 100A4, from the front surface side of the coil holding sheet 100A.

Also, when attaching the coil 200 to the coil holding sheet 100A, 100A1, 100A2, 100A3, 100A4, the position of the coil 200 is aligned to the coil holding row 103 and the force is applied in a direction of pressing the coil 200 to the coil holding sheet 100A, 100A1, 100A2, 100A3, 100A4.

Thereby, the holding pieces 101*f* are pressed and deformed by the coil 200, and the width of the slit 101*b* is widened, so that the coil 200 passes through the slit 101*b*. Therefore, in a state where the push-up pieces 101*a* are deformed to the back surface side of the coil holding sheet 100A, the circumferential portion of the coil 200 enters the back surface side of the coil holding sheet 100A, 100A1, 100A2, 100A3, 100A4.

Therefore, in a state where the coil 200 of the portion having entered the back surface side of the coil holding sheet 100A, 100A1, 100A2, 100A3, 100A4 is pushed up in the direction of the holding pieces 101*f* by the push-up pieces 101*a*, the coil 200 is pressed with the holding pieces 101*f* and is attached to the coil holding sheet 100A, 100A1, 100A2, 100A3, 100A4.

Like this, during the operation of attaching the coil 200 to the coil holding sheet 100A, 100A1, 100A2, 100A3, 100A4, it is not necessary to perform an operation of deforming a predetermined part of the coil holding sheet 100A, 100A1, 100A2, 100A3, 100A4 in advance. Therefore, it is possible to easily attach and use the coil 200 of a single body to the coil holding sheet 100A, 100A1, 100A2, 100A3, 100A4.

In the case of the coil holding sheets 100A, 100A1, 100A2, 100A3, 100A4, since the holder 101 is configured by the slit 101*b* and the cuts 101*c*, the punch chad is not generated in the manufacturing process of the holder 101. Also, in the case of the coil holding sheets 100A, 100A1, since the escape hole 102 has the length corresponding to the multiple turns of the coil 200, the punch chad is large, so that it is possible to reduce the number of generation of the punch chad in the manufacturing process of the escape holes 102. Also, in the case of the coil holding sheet 100A, the coil holding sheet 100A1, the coil holding sheet 100A2 and the coil holding sheet 100A3, the combination is made by increasing and decreasing the number of the holders 101 and the escape holes 102, so that it is possible to easily adjust the holding force of the coil 200 in the coil holding sheet 100A, the coil holding sheet 100A1, the coil holding sheet 100A2 and the coil holding sheet 100A3.

Also, in the case of the coil holding sheets 100A3, 100A4, it is not necessary to form the escape holes in the manufacturing process of the coil holding sheets 100A3, 100A4, so that the operability is improved.

Configuration Example of Coil Holding Sheet of Second Embodiment

Figure 35:
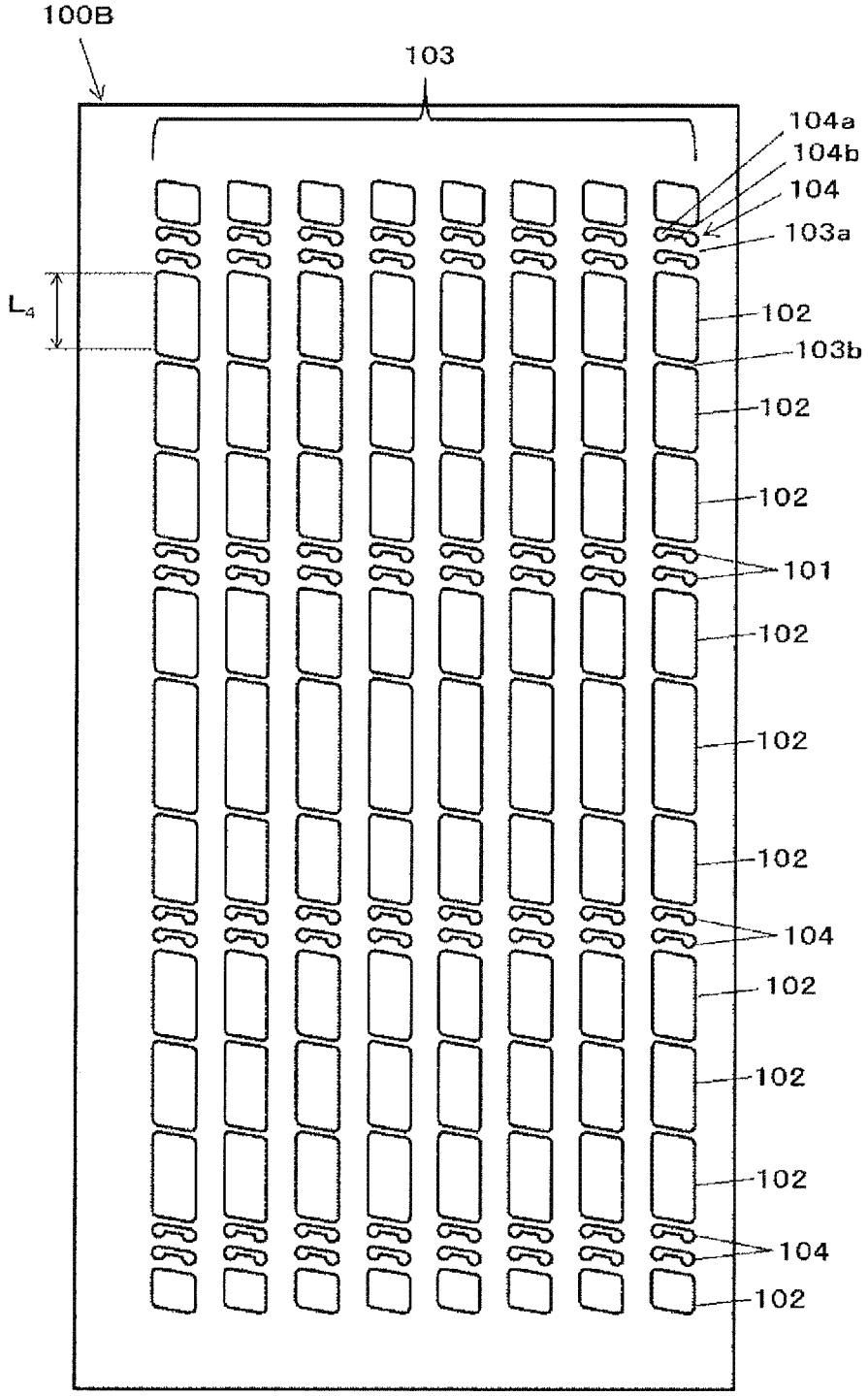
FIG. 35 is a front view depicting an example of the coil holding sheet of a second embodiment.
Figure 36:
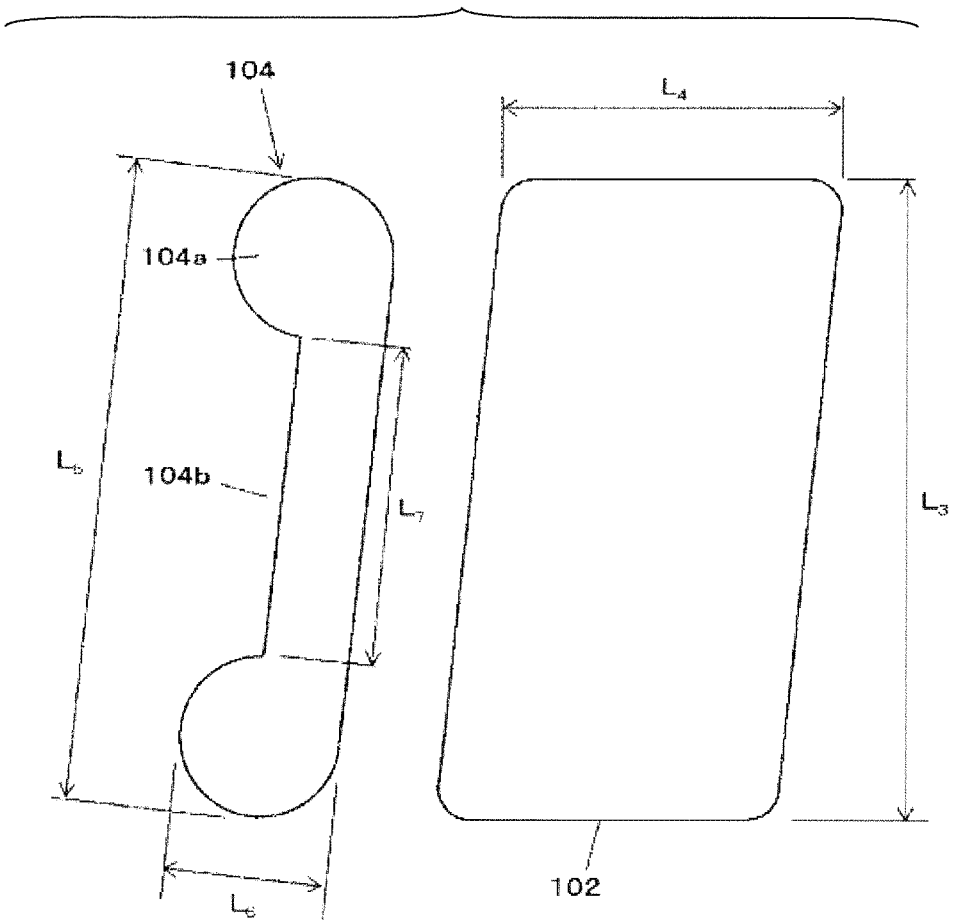
FIG. 36 is a front view depicting a configuration of main parts of the coil holding sheet of the second embodiment.
Figure 37:
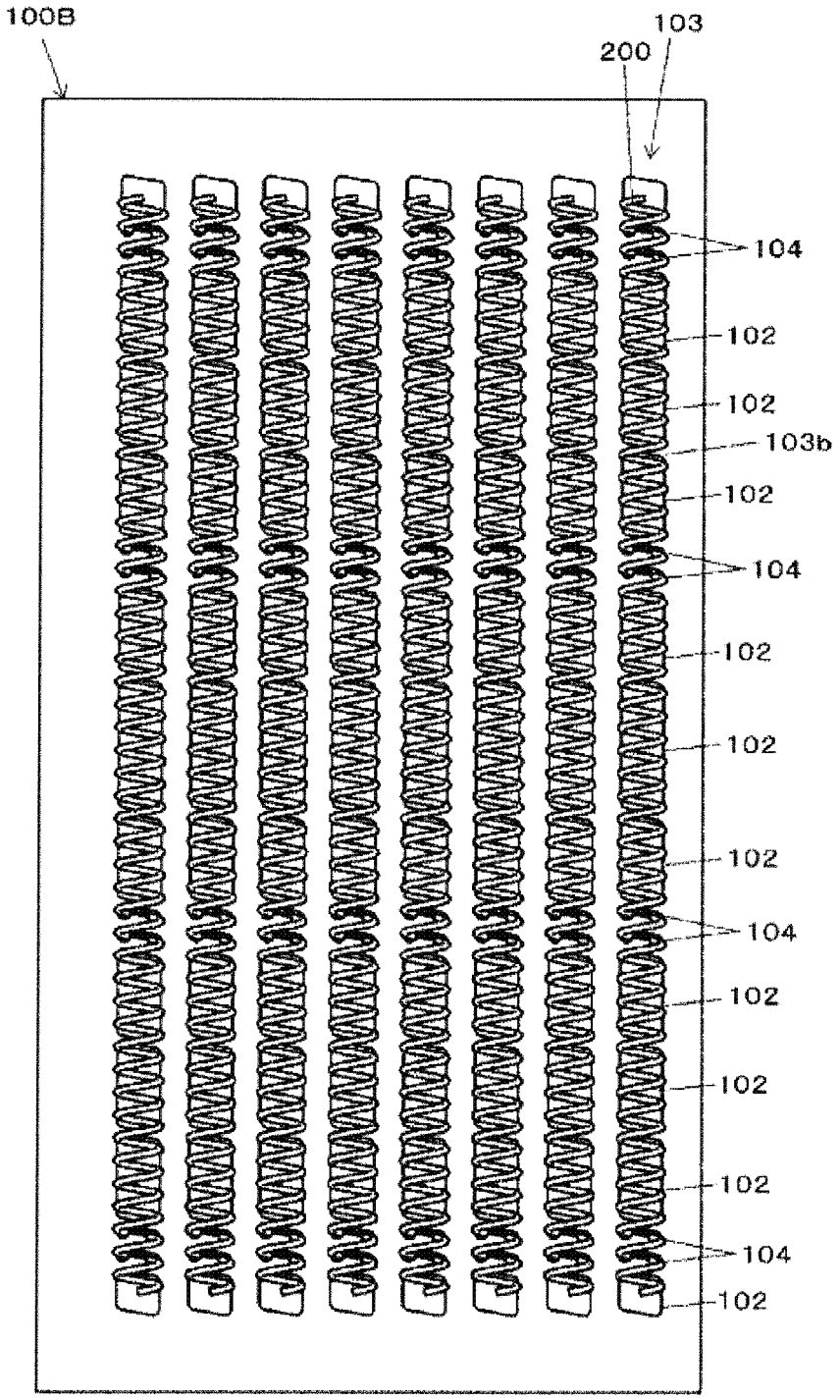
FIG. 37 is a front view of the coil holding sheet of the second embodiment, to which coils are held.
Figure 38:
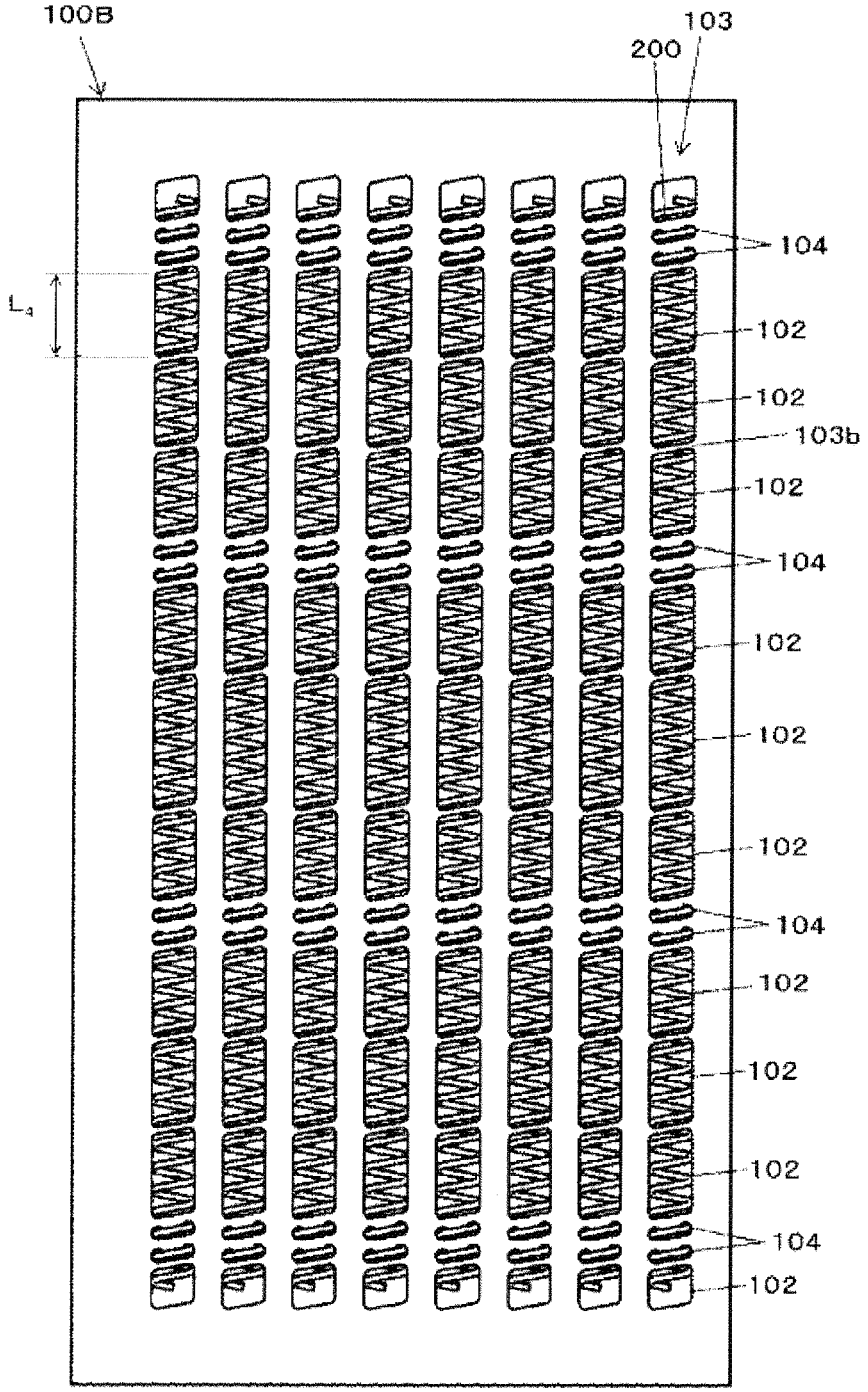
FIG. 38 is a rear view of the coil holding sheet of the second embodiment, to which coils are held.
Figure 39:
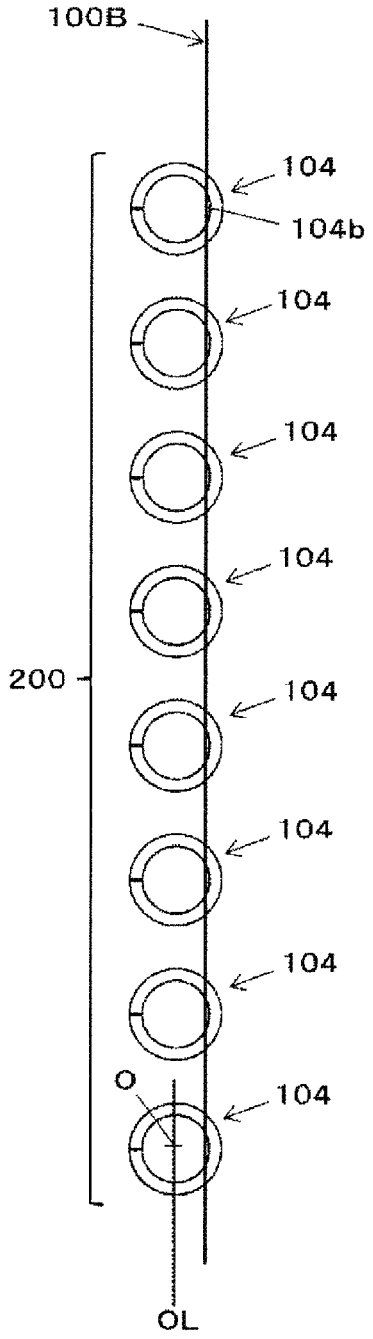
FIG. 39 is a side view of the coil holding sheet of the second embodiment, to which coils are held.
Figure 40:
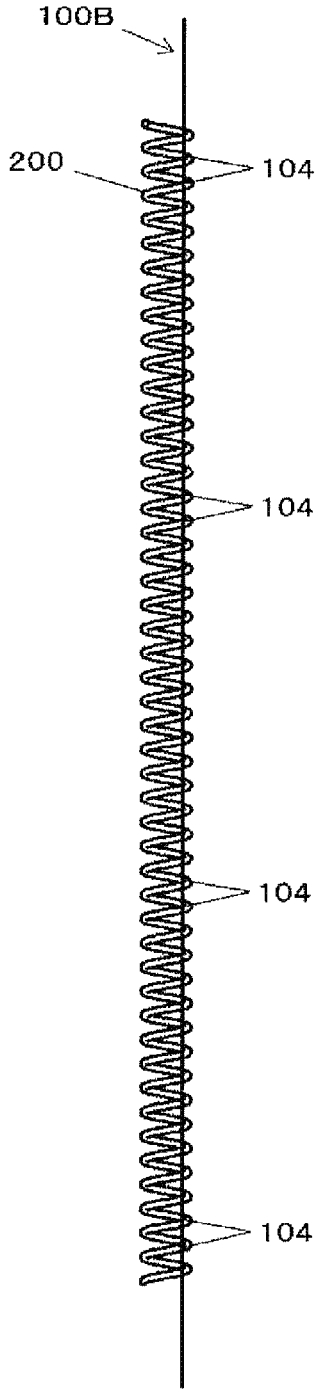
FIG. 40 is a plan view of the coil holding sheet of the second embodiment, to which coils are held.
Figure 41:
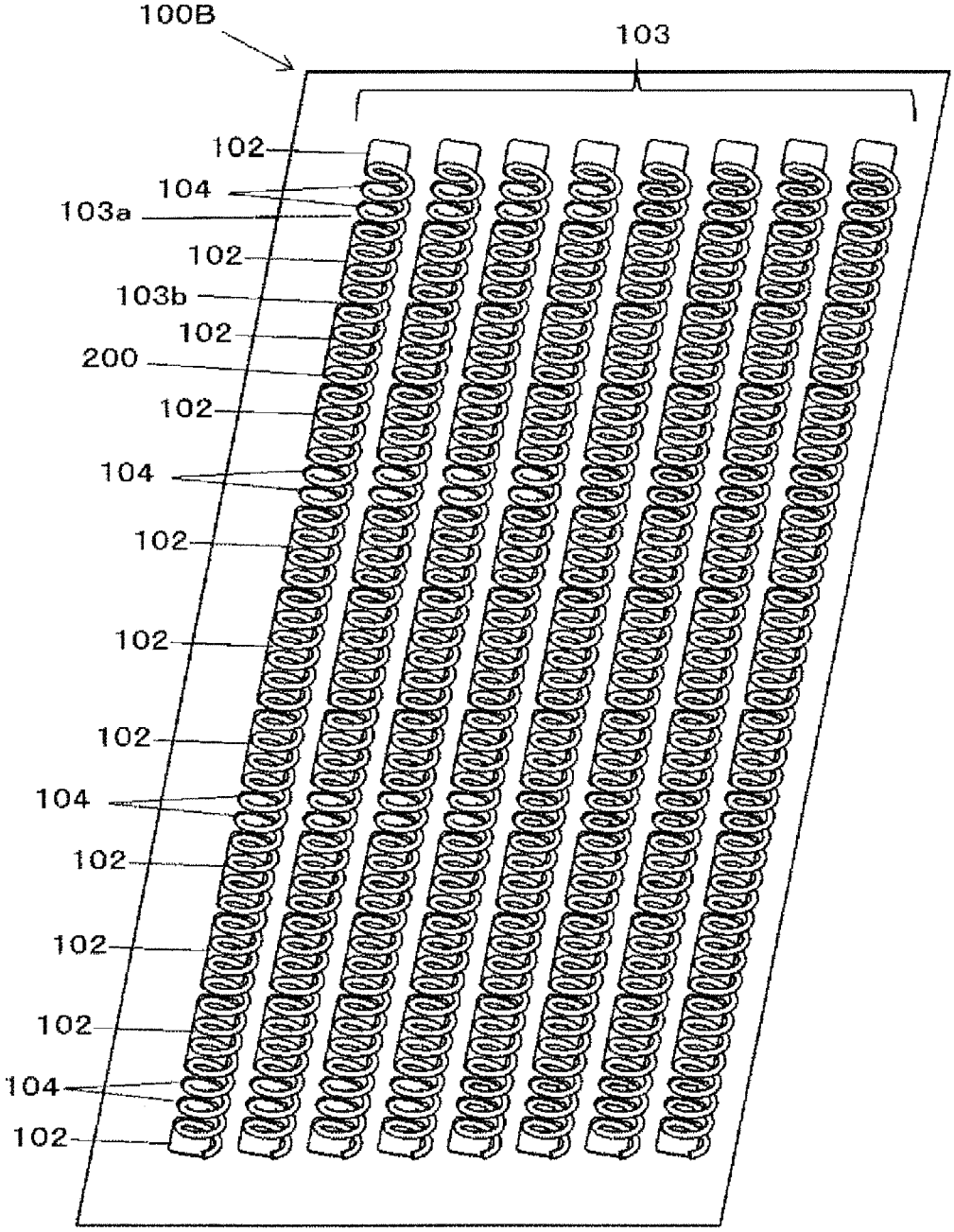
FIG. 41 is a perspective view of the coil holding sheet of the second embodiment, to which coils are held.

FIG. 35 is a front view depicting an example of the coil holding sheet of a second embodiment. FIG. 36 is a front view depicting a configuration of main parts of the coil holding sheet of the second embodiment. FIGS. 37 to 41 depict the coil holding sheet of the second embodiment, to which coils are held. FIG. 37 is a front view of the coil holding sheet of the second embodiment, to which coils are held. FIG. 38 is a rear view of the coil holding sheet of the second embodiment, to which coils are held. FIG. 39 is a side view of the coil holding sheet of the second embodiment, to which coils are held. FIG. 40 is a plan view of the coil holding sheet of the second embodiment, to which coils are held. FIG. 41 is a perspective view of the coil holding sheet of the second embodiment, to which coils are held.

A coil holding sheet 100B of the second embodiment has holders 104 configured to hold the coil 200, and the escape holes 102 configured to escape circumferential portions of the coil 200 from a front surface, which is one surface of the coil holding sheet 100B, to a back surface, which is the other surface. Here, the escape hole 102 has the same configuration as the coil holding sheet 100A of the first embodiment or the coil holding sheet 100A1 of the modified embodiment of the first embodiment.

The coil holding sheet 100B configures the coil holding row 103 for holding one coil 200 by a combination of the holders 104 and the escape holes 102. In order to hold a plurality of coils 200 by one coil holding sheet 100B, the coil holding sheet 100B is formed with a plurality of coil holding rows 103 with predetermined intervals in the direction perpendicular to the axial direction of the coil 200.

The holder 104 has a holding hole 104*a* in which the coil 200 of one turn is to enter, and a holding piece 104*b* configured to hold the coil 200 inserted in the holding hole 104*a*. The holding hole 104*a* is formed by an opening penetrating the front and back of the coil holding sheet 100B and having a shape by which a circumferential portion of the coil 200 can be inserted and pulled out.

The holding hole 104*a* is configured so that a length $L_5$ in the radial direction of the coil 200 is smaller than the outer diameter Ro of the coil 200. Thereby, the coil 200 cannot enter the holding hole 104*a* to a position at which the radial center O becomes flush with the coil holding sheet 100B. However, in a configuration where a radial position of the coil 200 is determined by the escape hole 102, the length $L_5$ of the holding hole 104*a* may be equal to the outer diameter Ro of the coil 200 or larger than the outer diameter Ro of the coil 200.

Also, the holding hole 104*a* is configured so that a length $L_6$ in the axial direction of the coil 200 is a length within which the coil 200 of one turn in the axial direction can enter the holding hole.

The holding piece 104*b* protrudes in the axial direction of the coil 200 from one side of the holding hole 104*a* in the axial direction of the coil 200. The holding piece 104*b* is configured to openably and closably close a part of a space, which is configured by the holding hole 104*a*, and to detachably hold the coil 200.

A length $L_7$ of the holding piece 104*b* in the radial direction of the coil 200 is configured to be smaller than the inner diameter Ri, which is the diameter of the inner periphery of the coil 200. When the coil 200 is attached to the coil holding sheet 100B, a part of an area greater than a half of a circumference of the coil 200 protrudes to a front surface side, which is one side of the coil holding sheet 100B, and a part of an area less than the half of the circumference of the coil 200 protrudes to a back surface side, which is the other side of the coil holding sheet 100B.

That is, the coil 200 is held to the coil holding sheet 100B with the radial center O of the coil 200 being offset to the front surface side, which is one side with respect to the coil holding sheet 100B. For this reason, the holding piece 104*b* has a length tailored to the interval of the inner periphery-side of the coil 200 at a position at which the coil 200 is held by the coil holding sheet 100B.

The coil holding sheet 100B has the holder forming places 103*a*, at which the holders 104 are formed, at a plurality of places of the coil holding row 103 along the axial direction of the coil 200. In the second embodiment, the holder forming places 103*a* are formed at four places spaced with predetermined intervals along the axial direction of the coil 200.

Also, the coil holding sheet 100B has at least one holder 104 provided at each of the holder forming places 103*a*. In the second embodiment, two sets of the holders 104 are provided at each of the holder forming places 103*a* in conformity to the pitch P of the coil 200.

The escape hole 102 is configured by an opening penetrating the front and back of the coil holding sheet 100B and having a shape by which a circumferential portion of the coil 200 can be inserted and pulled out. The escape holes 102 are provided in parallel with the holder forming places 103*a* along the axial direction of the coil 200 held to the coil holding sheet 100B by the holders 104.

The escape hole 102 is configured so that the length $L_3$ in the radial direction of the coil 200 is smaller than the outer diameter Ro of the coil 200. Thereby, the coil 200 cannot enter the escape hole 102 to a position at which the radial center O becomes flush with the coil holding sheet 100B.

Therefore, the coil 200 is held to the coil holding sheet 100B in a state where the coil is offset with respect to the coil holding sheet 100B so that a protrusion height to the front surface side is greater than a protrusion height to the back surface side. An offset amount is determined with the length $L_3$ of the escape hole 102 in the radial direction of the coil 200.

The escape hole 102 is configured so that the length $L_4$ in the axial direction of the coil 200 is a length within which the coil 200 of two or more turns in the axial direction is to enter the escape hole. In the second embodiment, the escape hole 102 having a length within which the coil 200 of two turns is to enter the escape hole, the escape hole 102 having a length within which the coil 200 of four turns is to enter the escape hole, and the escape hole 102 having a length within which the coil 200 of six turns is to enter the escape hole are provided in correspondence to the number of turns of the coil 200.

The coil holding row 103 is provided with the coupling portions 103*b* each of which is formed between the escape holes 102 arranged in parallel in the axial direction of the coil 200 and is provided to couple one side and the other side of the escape holes 102 in the radial direction of the coil 200 therebetween.

Modified Embodiments of Coil Holding Sheet of Second Embodiment

Figure 42:
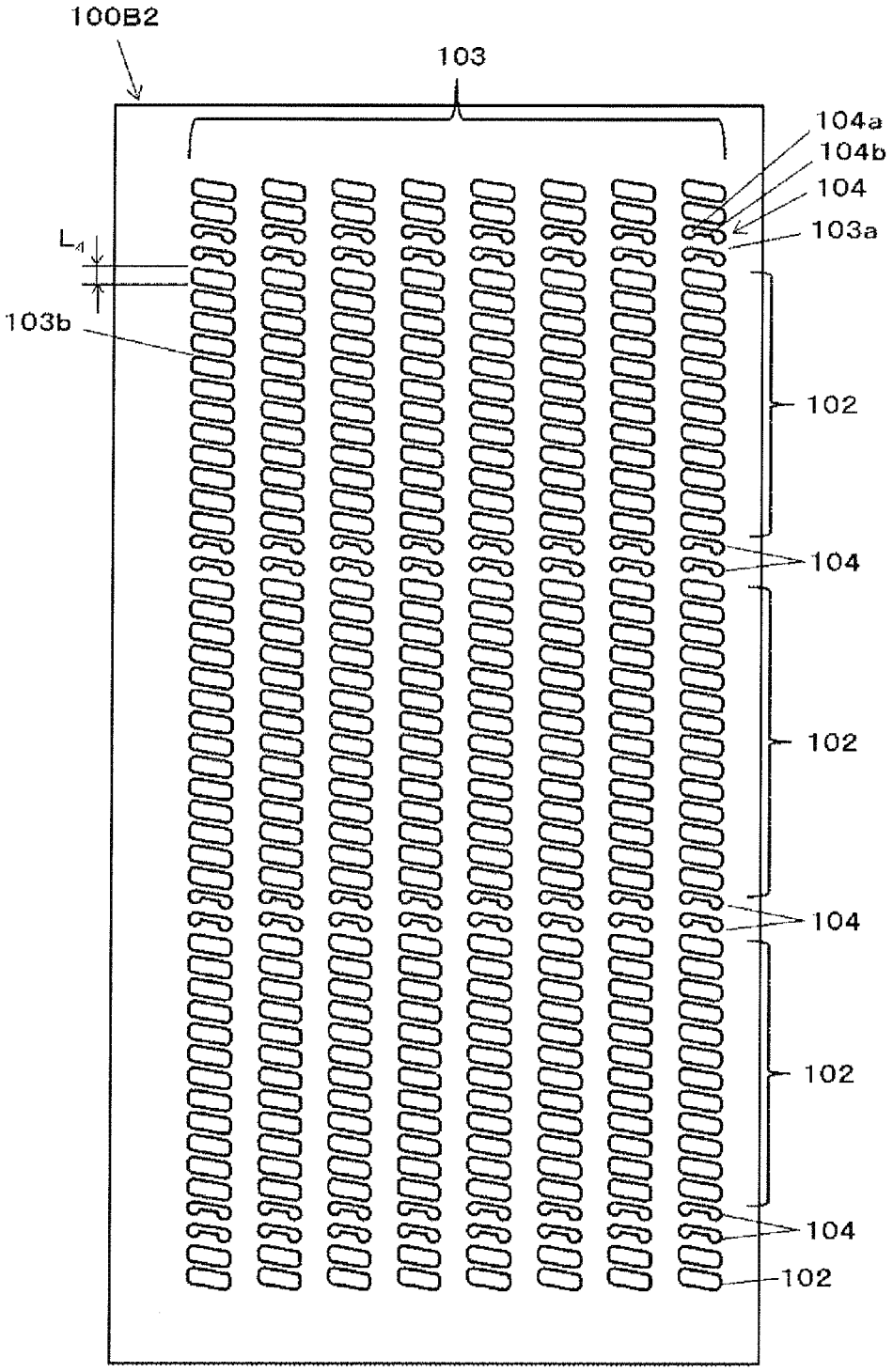
FIG. 42 is a front view depicting a modified embodiment of the coil holding sheet of the second embodiment.
Figure 43:
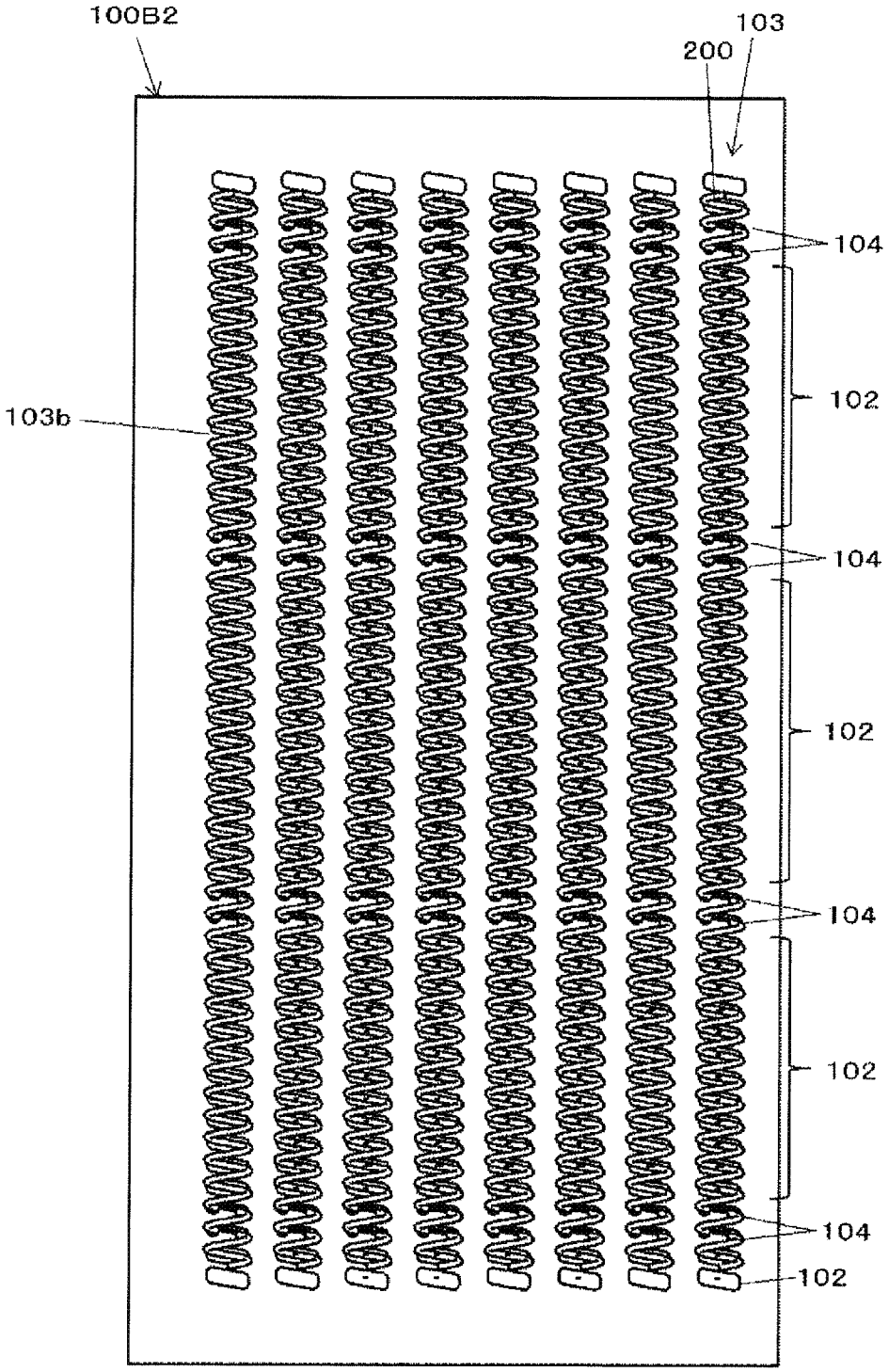
FIG. 43 is a front view of the coil holding sheet of the modified embodiment of the second embodiment, to which coils are held.
Figure 44:
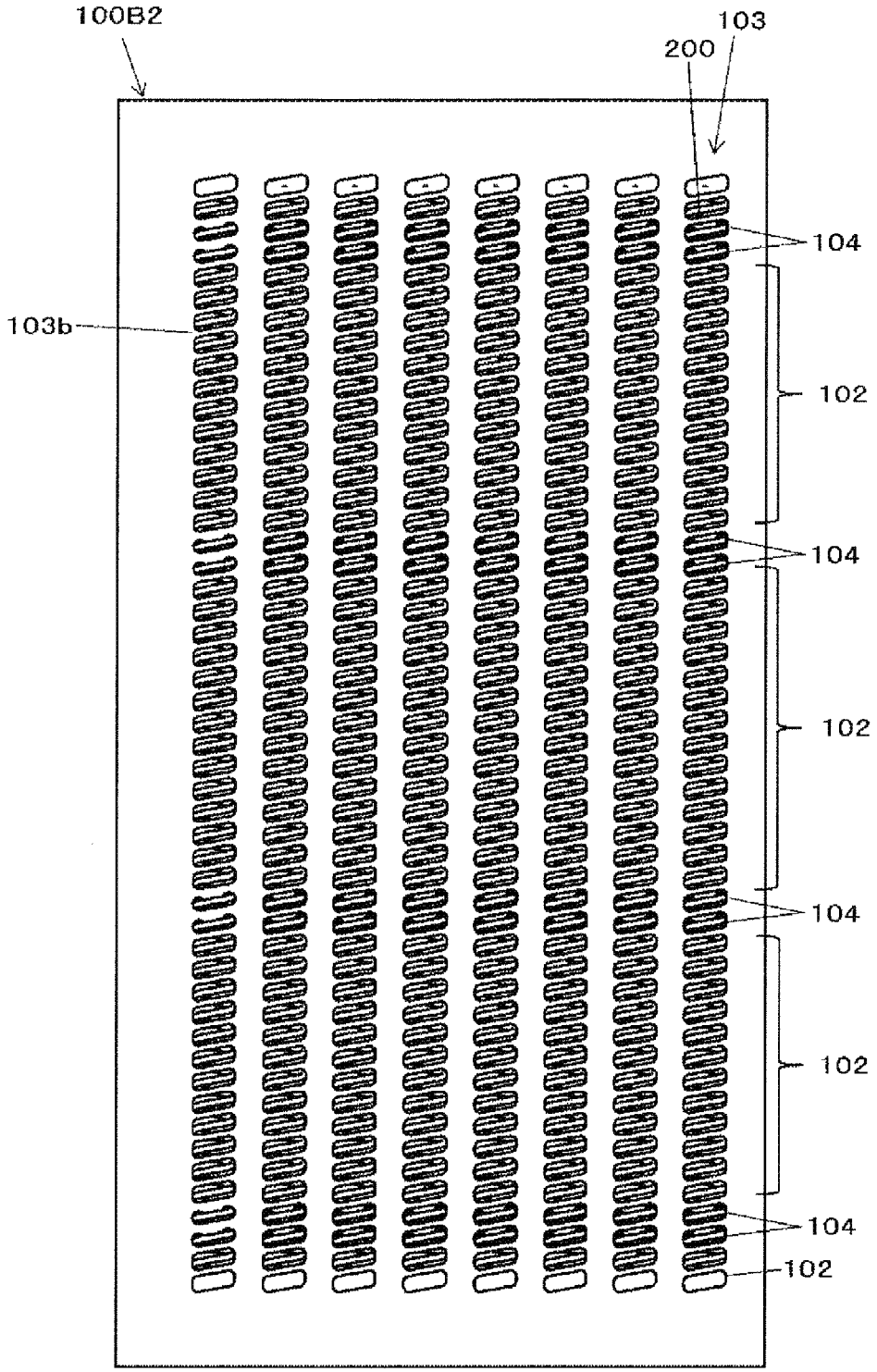
FIG. 44 is a rear view of the coil holding sheet of the modified embodiment of the second embodiment, to which coils are held.
Figure 45:
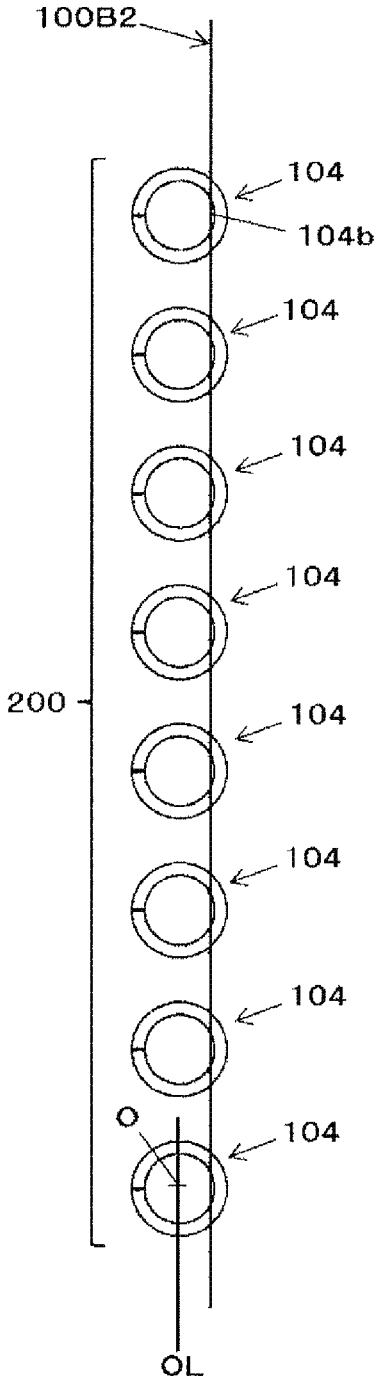
FIG. 45 is a side view of the coil holding sheet of the modified embodiment of the second embodiment, to which coils are held.
Figure 46:
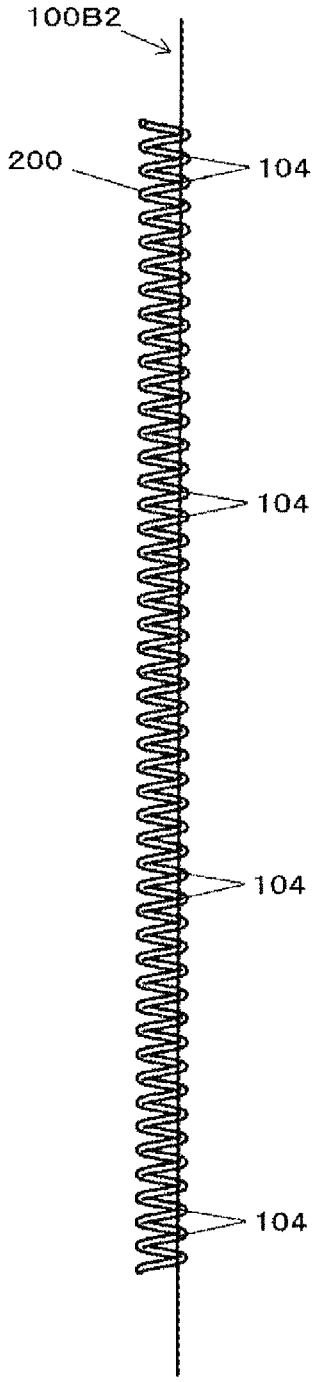
FIG. 46 is a plan view of the coil holding sheet of the modified embodiment of the second embodiment, to which coils are held.
Figure 47:
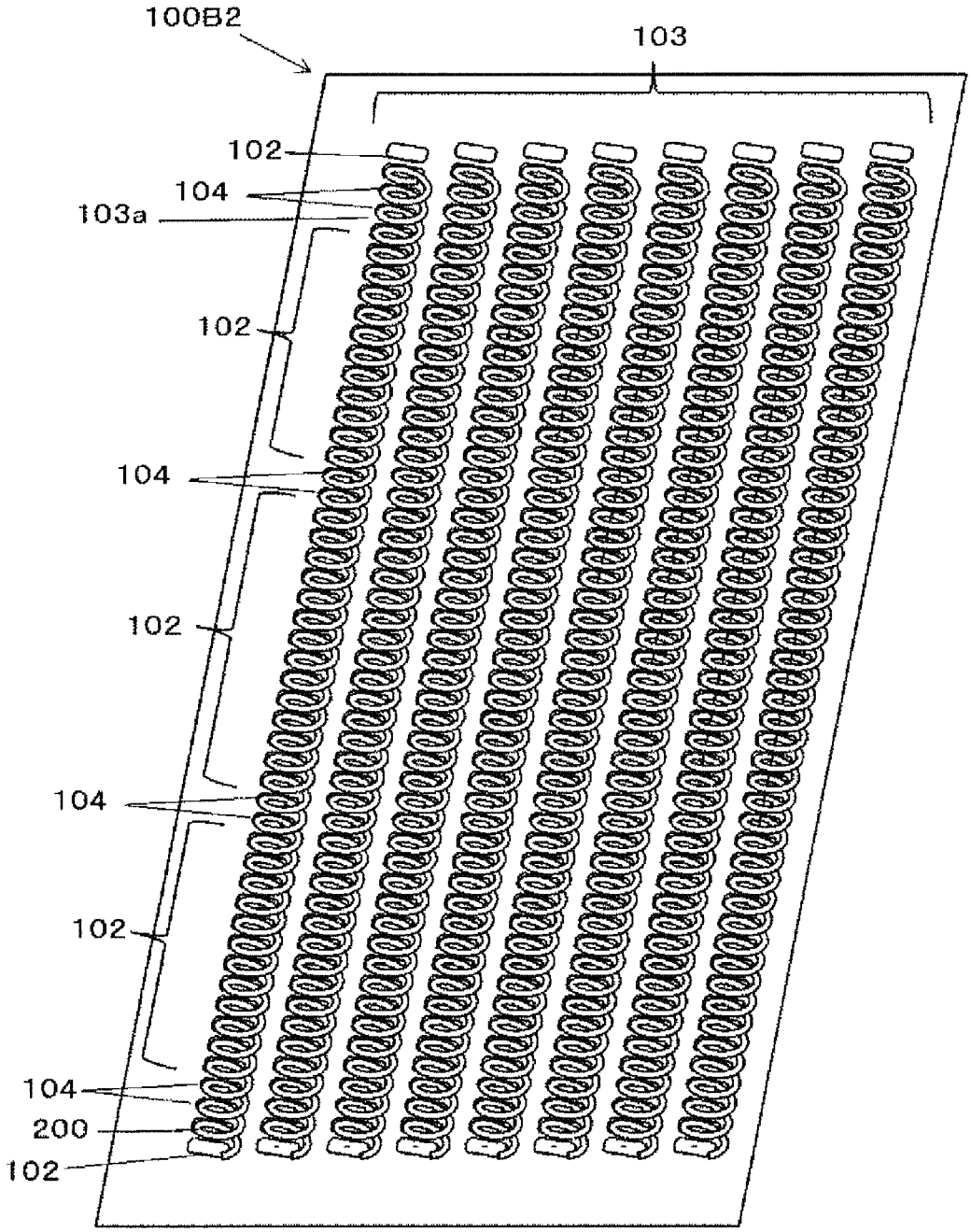
FIG. 47 is a perspective view of the coil holding sheet of the modified embodiment of the second embodiment, to which coils are held.

FIG. 42 is a front view depicting a modified embodiment of the coil holding sheet of the second embodiment. FIGS. 43 to 47 depict the coil holding sheet of the modified embodiment of the second embodiment, to which coils are held. FIG. 43 is a front view of the coil holding sheet of the modified embodiment of the second embodiment, to which coils are held. FIG. 44 is a rear view of the coil holding sheet of the modified embodiment of the second embodiment, to which coils are held. FIG. 45 is a side view of the coil holding sheet of the modified embodiment of the second embodiment, to which coils are held. FIG. 46 is a plan view of the coil holding sheet of the modified embodiment of the second embodiment, to which coils are held. FIG. 47 is a perspective view of the coil holding sheet of the modified embodiment of the second embodiment, to which coils are held.

A coil holding sheet 100B2 of the modified embodiment of the second embodiment has the holders 104 configured to hold the coil 200, and the escape holes 102 configured to escape circumferential portions of the coil 200 from a front surface, which is one surface of the coil holding sheet 100B2, to a back surface, which is the other surface. The coil holding sheet 100B2 is configured so that the length $L_4$ of each escape hole 102 in the axial direction of the coil 200 is a length within which the coil 200 of one turn is to enter the escape hole. The other configurations are the same as the coil holding sheet 100B of the second embodiment.

That is, the coil holding sheet 100B2 configures the coil holding row 103 for holding one coil 200 by a combination of the holders 104 and the escape holes 102. In order to hold the plurality of coils 200 by one coil holding sheet 100B2, the coil holding sheet 100B2 is formed with the plurality of coil holding rows 103 with predetermined intervals in the direction perpendicular to the axial direction of the coil 200.

The holder 104 has the holding hole 104*a* in which the coil 200 of one turn is to enter, and the holding piece 104*b* configured to hold the coil 200 inserted in the holding hole 104*a*. The holding hole 104*a* is formed by an opening penetrating the front and back of the coil holding sheet 100B2 and having a shape by which a circumferential portion of the coil 200 can be inserted and pulled out.

The holding hole 104*a* is configured so that the length $L_5$ in the radial direction of the coil 200 is smaller than the outer diameter Ro of the coil 200. Thereby, the coil 200 cannot enter the holding hole 104*a* to a position at which the radial center O becomes flush with the coil holding sheet 100B. However, in a configuration where a radial position of the coil 200 is determined by the escape hole 102, the length $L_5$ of the holding hole 104*a* may be equal to the outer diameter Ro of the coil 200 or larger than the outer diameter Ro of the coil 200.

Also, the holding hole 104*a* is configured so that the length $L_6$ in the axial direction of the coil 200 is a length within which the coil 200 of one turn in the axial direction can enter the holding hole.

The holding piece 104*b* protrudes in the axial direction of the coil 200 from one side of the holding hole 104*a* in the axial direction of the coil 200. The holding piece 104*b* is configured to openably and closably close a part of a space, which is configured by the holding hole 104*a*, and to detachably hold the coil 200.

The length $L_7$ of the holding piece 104*b* in the radial direction of the coil 200 is configured to be smaller than the inner diameter Ri, which is the diameter of the inner periphery of the coil 200. When the coil 200 is attached to the coil holding sheet 100B2, a part of an area greater than a half of a circumference of the coil 200 protrudes to a front surface side, which is one side of the coil holding sheet 100B2, and a part of an area less than the half of the circumference of the coil 200 protrudes to a back surface side, which is the other side of the coil holding sheet 100B2.

That is, the coil 200 is held to the coil holding sheet 100B2 with the radial center O of the coil 200 being offset to the front surface side, which is one side with respect to the coil holding sheet 100B2. For this reason, the holding piece 104*b* has a length tailored to the interval of the inner periphery-side of the coil 200 at a position at which the coil 200 is held by the coil holding sheet 100B2.

The coil holding sheet 100B2 has the holder forming places 103*a*, at which the holders 104 are formed, at a plurality of places of the coil holding row 103 along the axial direction of the coil 200. In this modified embodiment, the holder forming places 103*a* are formed at four places spaced with predetermined intervals along the axial direction of the coil 200.

Also, the coil holding sheet 100B2 has at least one holder 104 provided at each of the holder forming places 103*a*. In this modified embodiment, two sets of the holders 104 are provided at each of the holder forming places 103*a* in conformity to the pitch P of the coil 200.

The escape hole 102 is configured by an opening penetrating the front and back of the coil holding sheet 100B2 and having a shape by which a circumferential portion of the coil 200 can be inserted and pulled out. The escape holes 102 are provided in parallel with the holder forming places 103*a* along the axial direction of the coil 200 held to the coil holding sheet 100B2 by the holders 104.

The escape hole 102 is configured so that the length $L_3$ in the radial direction of the coil 200 is smaller than the outer diameter Ro of the coil 200. Thereby, the coil 200 cannot enter the escape hole 102 to a position at which the radial center O becomes flush with the coil holding sheet 100B2.

Therefore, the coil 200 is held to the coil holding sheet 100B2 in a state where the coil is offset with respect to the coil holding sheet 100B2 so that a protrusion height to the front surface side is greater than a protrusion height to the back surface side. An offset amount is determined with the length $L_3$ of the escape hole 102 in the radial direction of the coil 200.

The escape hole 102 is configured so that the length $L_4$ in the axial direction of the coil 200 is a length within which the coil 200 of one turn in the axial direction is to enter the escape hole.

The coil holding row 103 is provided with the coupling portions 103*b* each of which is formed between the escape holes 102 arranged in parallel in the axial direction of the coil 200 and is provided to couple one side and the other side of the escape holes 102 in the radial direction of the coil 200 therebetween.

Figure 48:
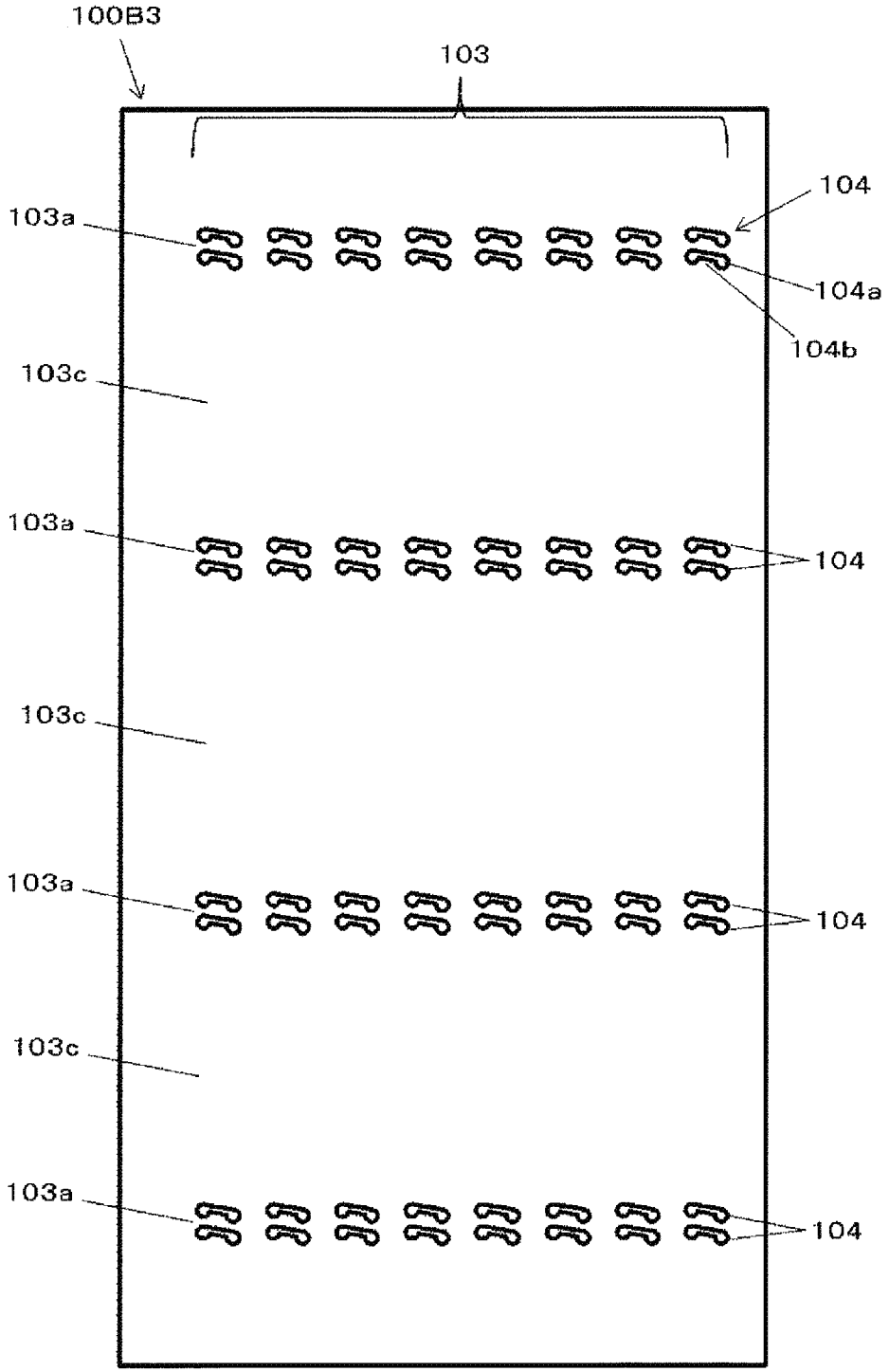
FIG. 48 is a front view depicting another modified embodiment of the coil holding sheet of the second embodiment.
Figure 49:
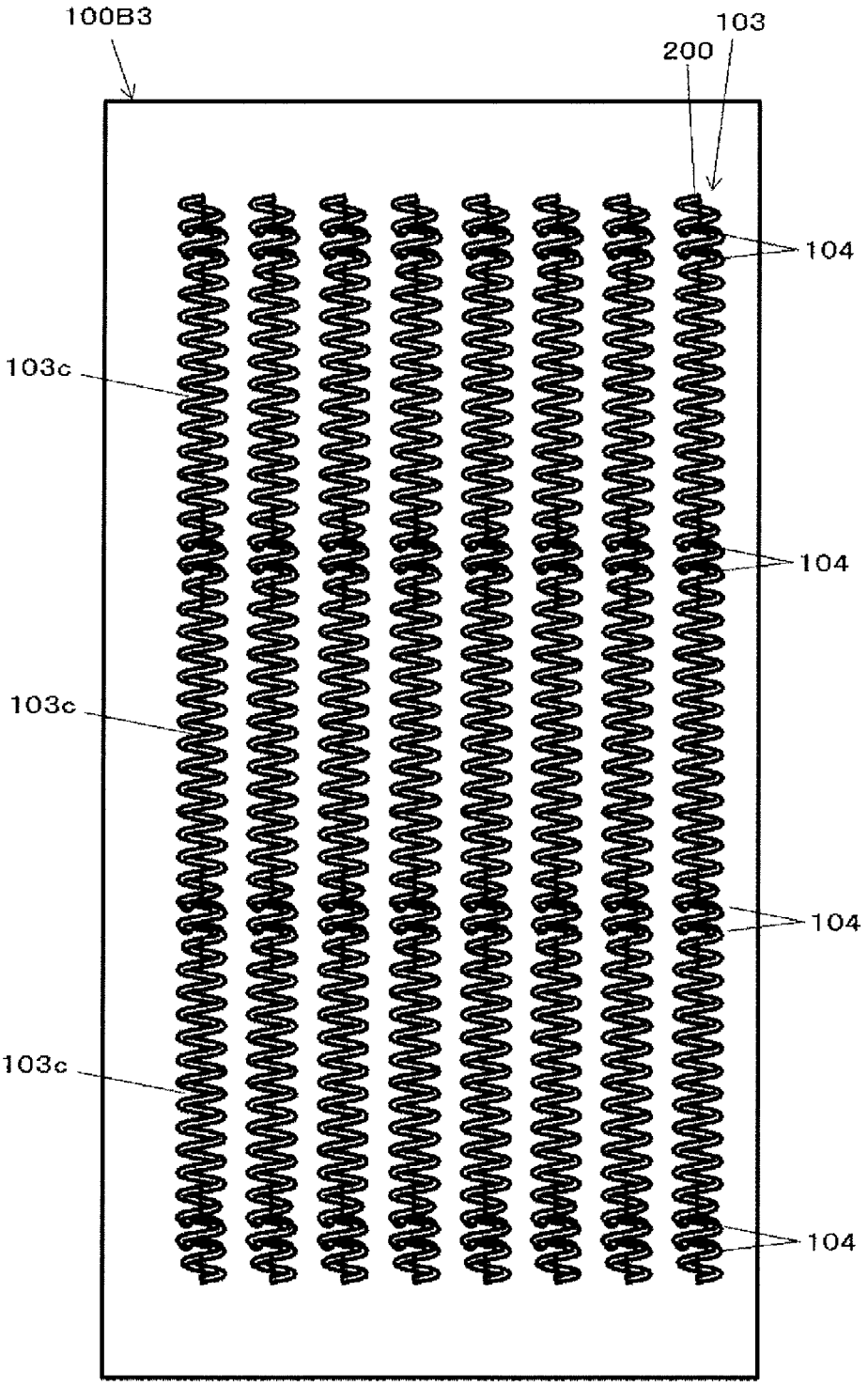
FIG. 49 is a front view depicting another modified embodiment of the coil holding sheet of the second embodiment, to which coils are held.
Figure 50:
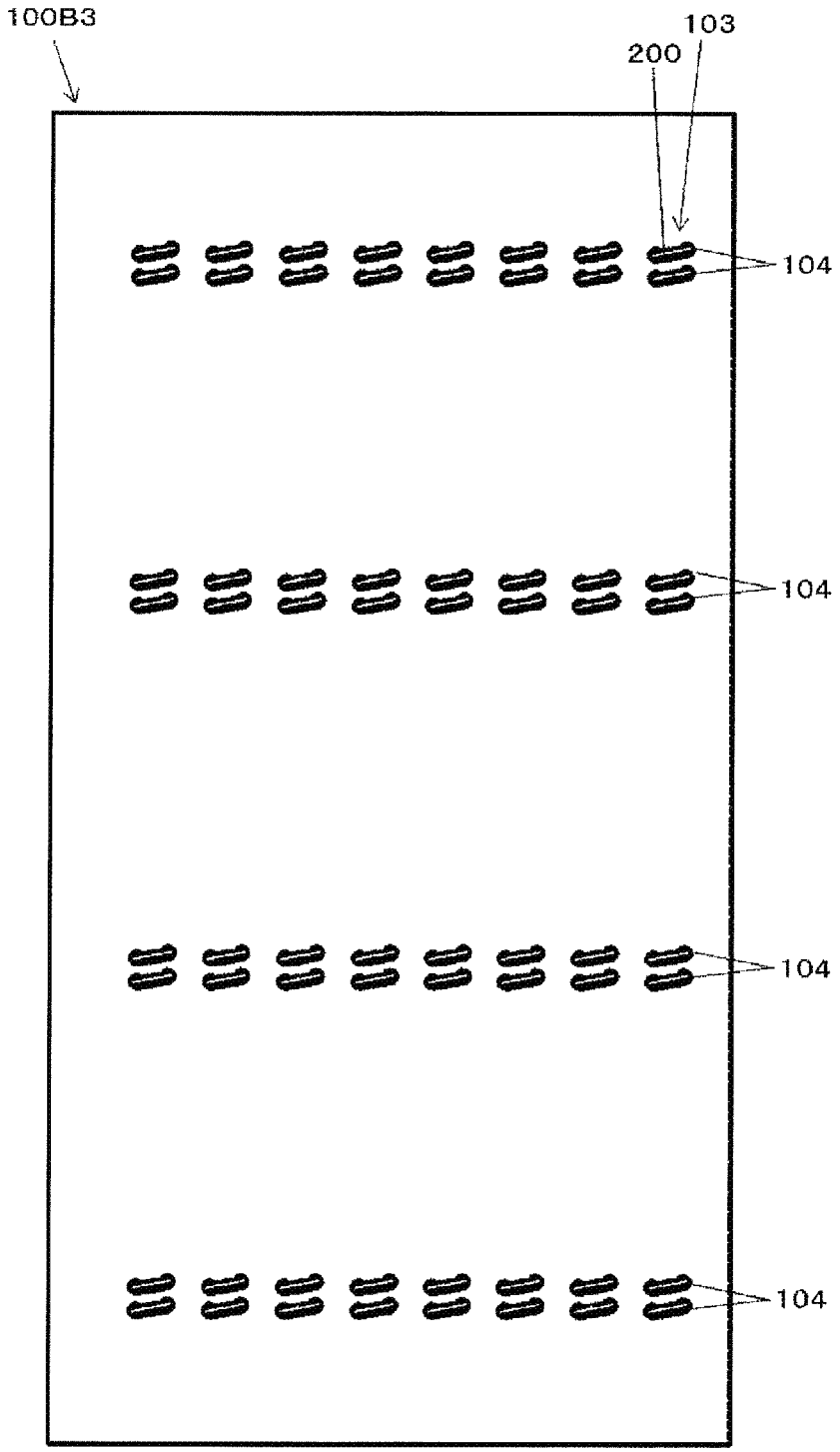
FIG. 50 is a rear view depicting another modified embodiment of the coil holding sheet of the second embodiment, to which coils are held.

FIG. 48 is a front view depicting another modified embodiment of the coil holding sheet of the second embodiment. FIGS. 49 to 53 depict the coil holding sheet of another modified embodiment of the second embodiment, to which coils are held. FIG. 49 is a front view depicting another modified embodiment of the coil holding sheet of the second embodiment, to which coils are held. FIG. 50 is a rear view depicting another modified embodiment of the coil holding sheet of the second embodiment, to which coils are held.

Figure 51:
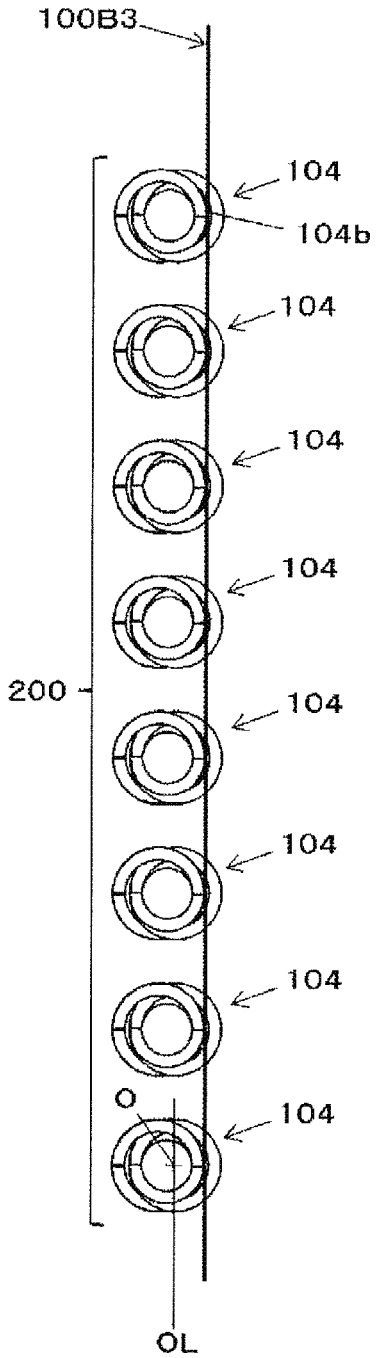
FIG. 51 is a side view depicting another modified embodiment of the coil holding sheet of the second embodiment, to which coils are held.
Figure 52:
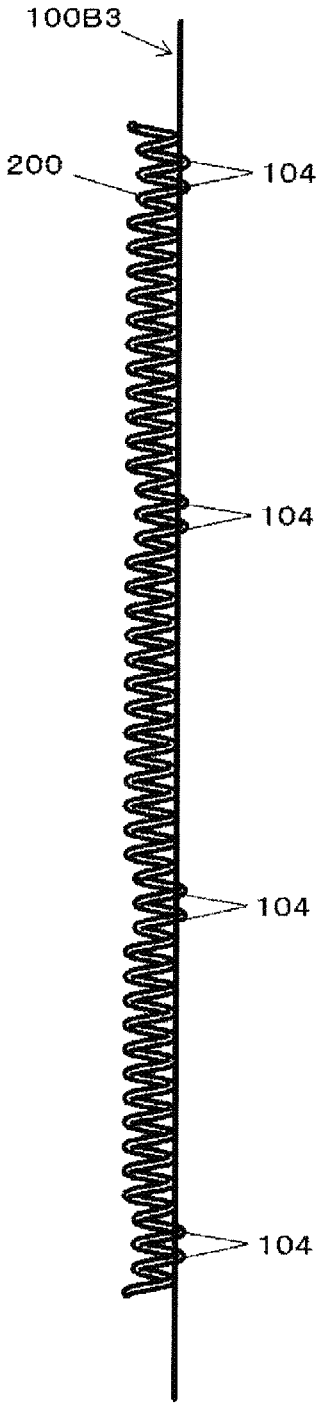
FIG. 52 is a plan view depicting another modified embodiment of the coil holding sheet of the second embodiment, to which coils are held.
Figure 53:
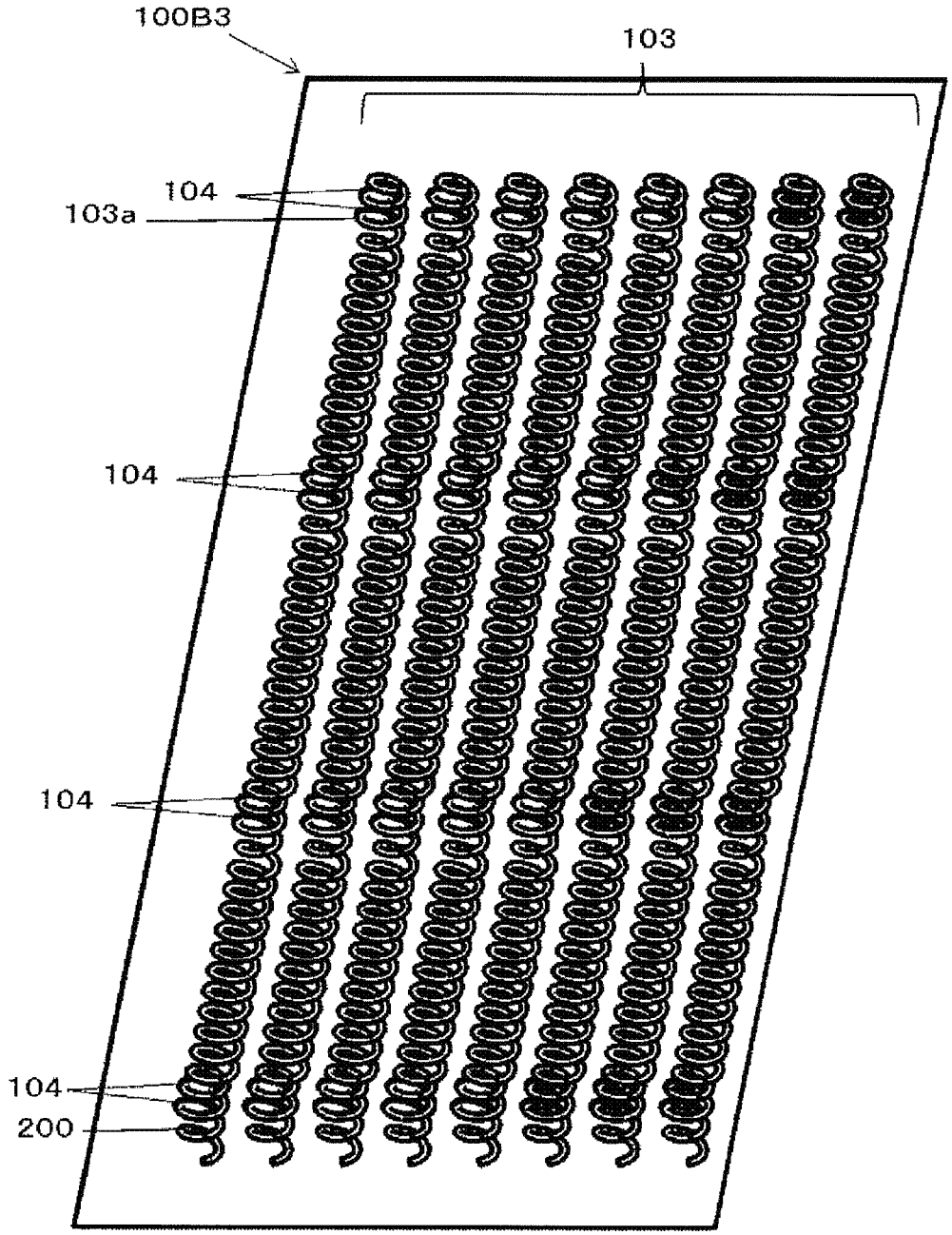
FIG. 53 is a perspective view depicting another modified embodiment of the coil holding sheet of the second embodiment, to which coils are held.

FIG. 51 is a side view depicting another modified embodiment of the coil holding sheet of the second embodiment, to which coils are held. FIG. 52 is a plan view depicting another modified embodiment of the coil holding sheet of the second embodiment, to which coils are held. FIG. 53 is a perspective view depicting another modified embodiment of the coil holding sheet of the second embodiment, to which coils are held.

A coil holding sheet 100B3 of the modified embodiment of the second embodiment has the holders 104 configured to hold the coil 200. The coil holding sheet 100B3 is not provided with the escape holes 102 configured to escape circumferential portions of the coil 200 to the back surface of the coil holding sheet 100A (refer to FIG. 35 and the like).

That is, the coil holding sheet 100B3 configures the coil holding row 103 for holding one coil 200 by the holders 104. In order to hold the plurality of coils 200 by one coil holding sheet 100B3, the coil holding sheet 100B3 is formed with the plurality of coil holding rows 103 with predetermined intervals in the direction perpendicular to the axial direction of the coil 200.

The holder 104 has the holding hole 104*a* in which the coil 200 of one turn is to enter, and the holding piece 104*b* configured to hold the coil 200 inserted in the holding hole 104*a*. The holding hole 104*a* is formed by an opening penetrating the front and back of the coil holding sheet 100B3 and having a shape by which a circumferential portion of the coil 200 can be inserted and pulled out.

The holding hole 104*a* is configured so that the length $L_5$ in the radial direction of the coil 200 is smaller than the outer diameter Ro of the coil 200. Thereby, the coil 200 cannot enter the holding hole 104*a* to a position at which the radial center O becomes flush with the coil holding sheet 100B3.

Also, the holding hole 104*a* is configured so that the length $L_6$ in the axial direction of the coil 200 is a length within which the coil 200 of one turn in the axial direction can enter the holding hole.

The holding piece 104*b* protrudes in the axial direction of the coil 200 from one side of the holding hole 104*a* in the axial direction of the coil 200. The holding piece 104*b* is configured to openably and closably close a part of a space, which is configured by the holding hole 104*a*, and to detachably hold the coil 200.

The length $L_7$ of the holding piece 104*b* in the radial direction of the coil 200 is configured to be smaller than the inner diameter Ri, which is the diameter of the inner periphery of the coil 200. When the coil 200 is attached to the coil holding sheet 100B3, at the holder forming places 103*a*, a part of an area greater than a half of a circumference of the coil 200 protrudes to a front surface side, which is one side of the coil holding sheet 100B3, and a part of an area less than the half of the circumference of the coil 200 protrudes to a back surface side, which is the other side of the coil holding sheet 100B3. At the places where the holders 104 are not provided, the circumferentially entire coil 200 protrudes to the front surface side of the coil holding sheet 100B3.

That is, the coil 200 is held to the coil holding sheet 100B3 with the radial center O of the coil 200 being offset to the front surface side, which is one side with respect to the coil holding sheet 100B3. For this reason, the holding piece 104*b* has a length tailored to the interval of the inner periphery-side of the coil 200 at a position at which the coil 200 is held by the coil holding sheet 100B3.

The coil holding sheet 100B3 has the holder forming places 103*a*, at which the holders 104 are formed, at a plurality of places of the coil holding row 103 along the axial direction of the coil 200. In this modified embodiment, the holder forming places 103*a* are formed at four places spaced with predetermined intervals along the axial direction of the coil 200.

Also, the coil holding sheet 100B3 has at least one holder 104 provided at each of the holder forming places 103*a*. In this modified embodiment, two sets of the holders 104 are provided at each of the holder forming places 103*a* in conformity to the pitch P of the coil 200.

The coil holding sheet 100B3 is not provided with an opening penetrating the front and back thereof between the holder forming places 103*a*, and is formed with the coil support parts 103*c* configured to surface-support the outer peripheries of the coils 200.

Figure 54:
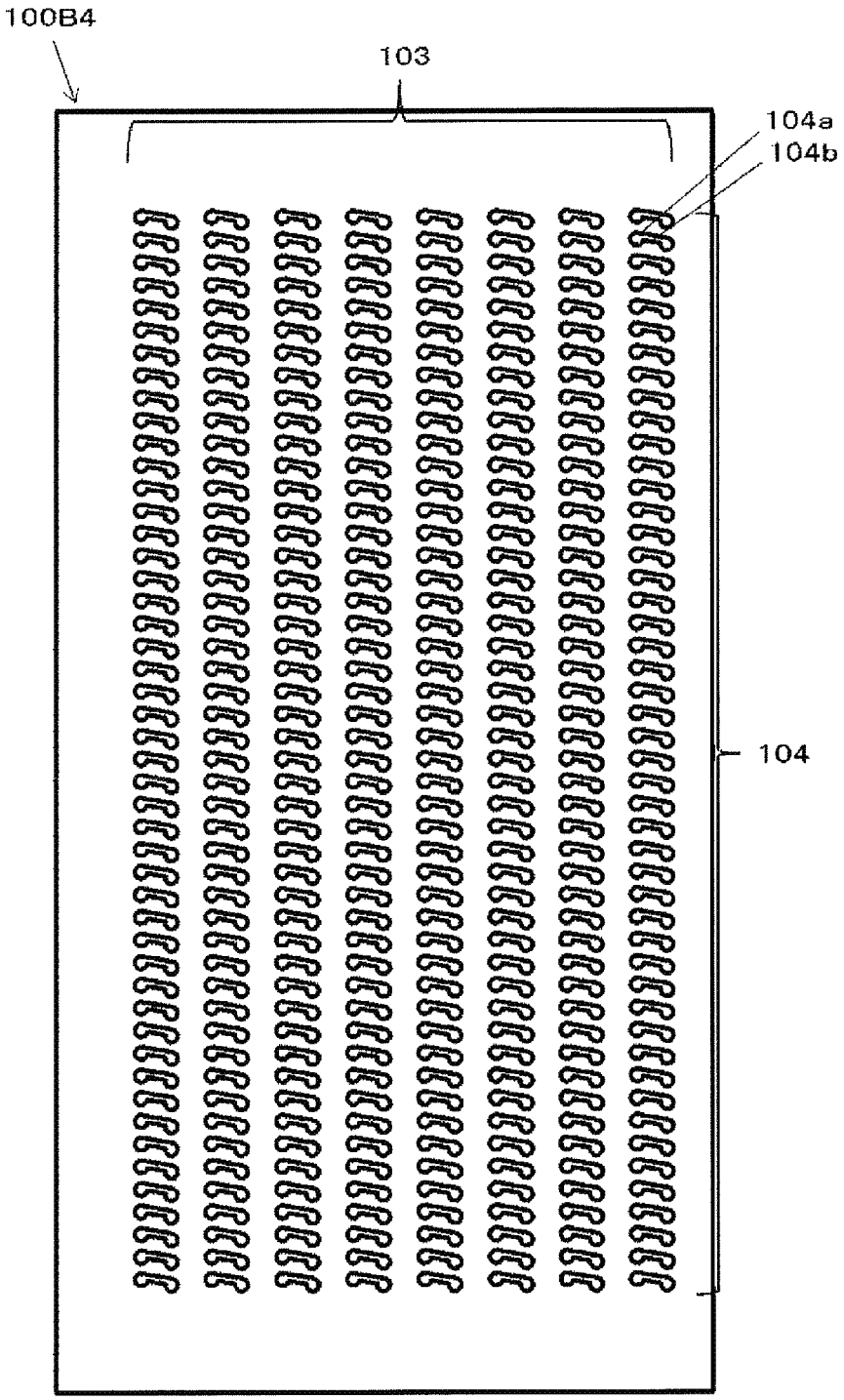
FIG. 54 is a front view depicting another modified embodiment of the coil holding sheet of the second embodiment.
Figure 55:
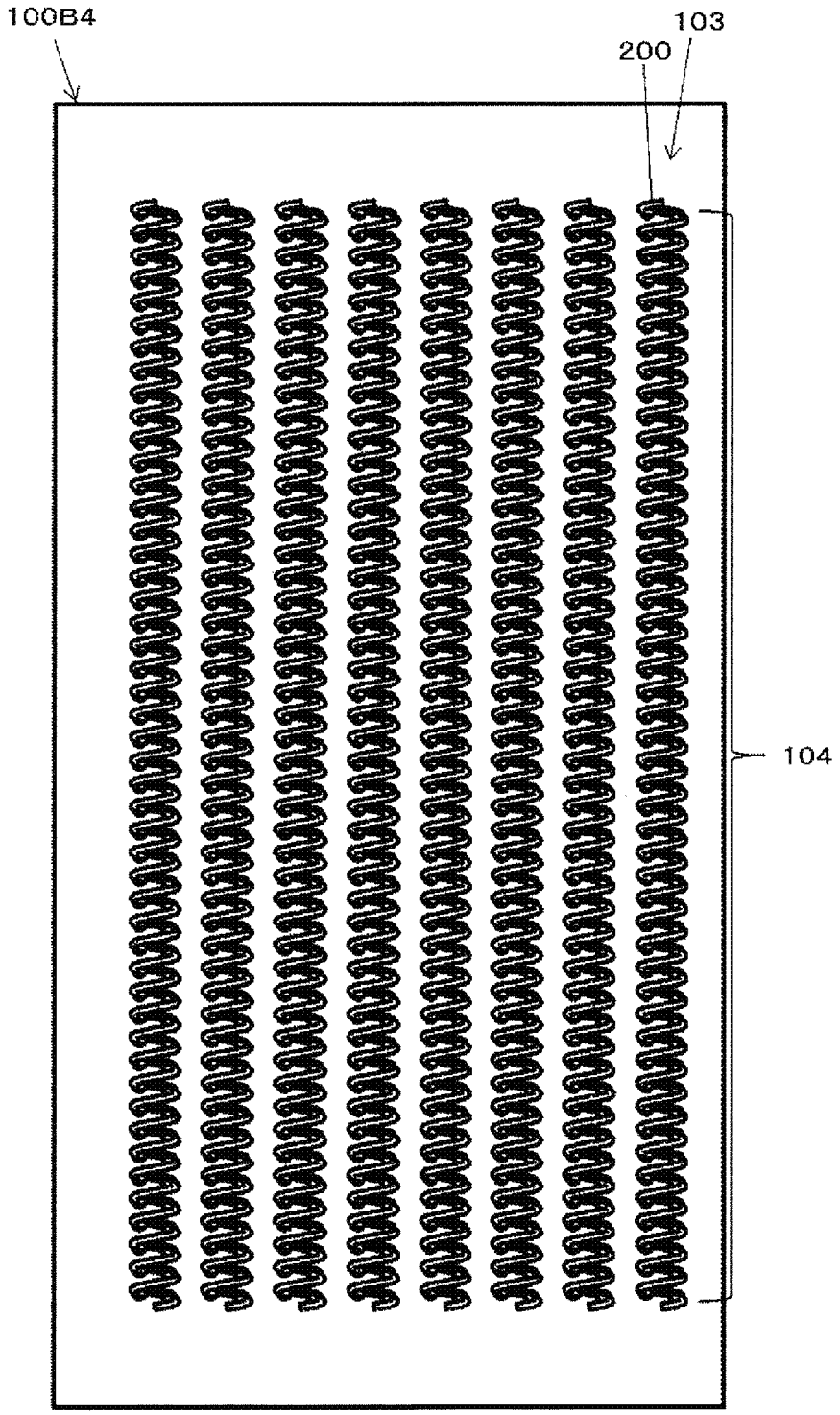
FIG. 55 is a front view of the coil holding sheet of another modified embodiment of the second embodiment, to which coils are held.
Figure 56:
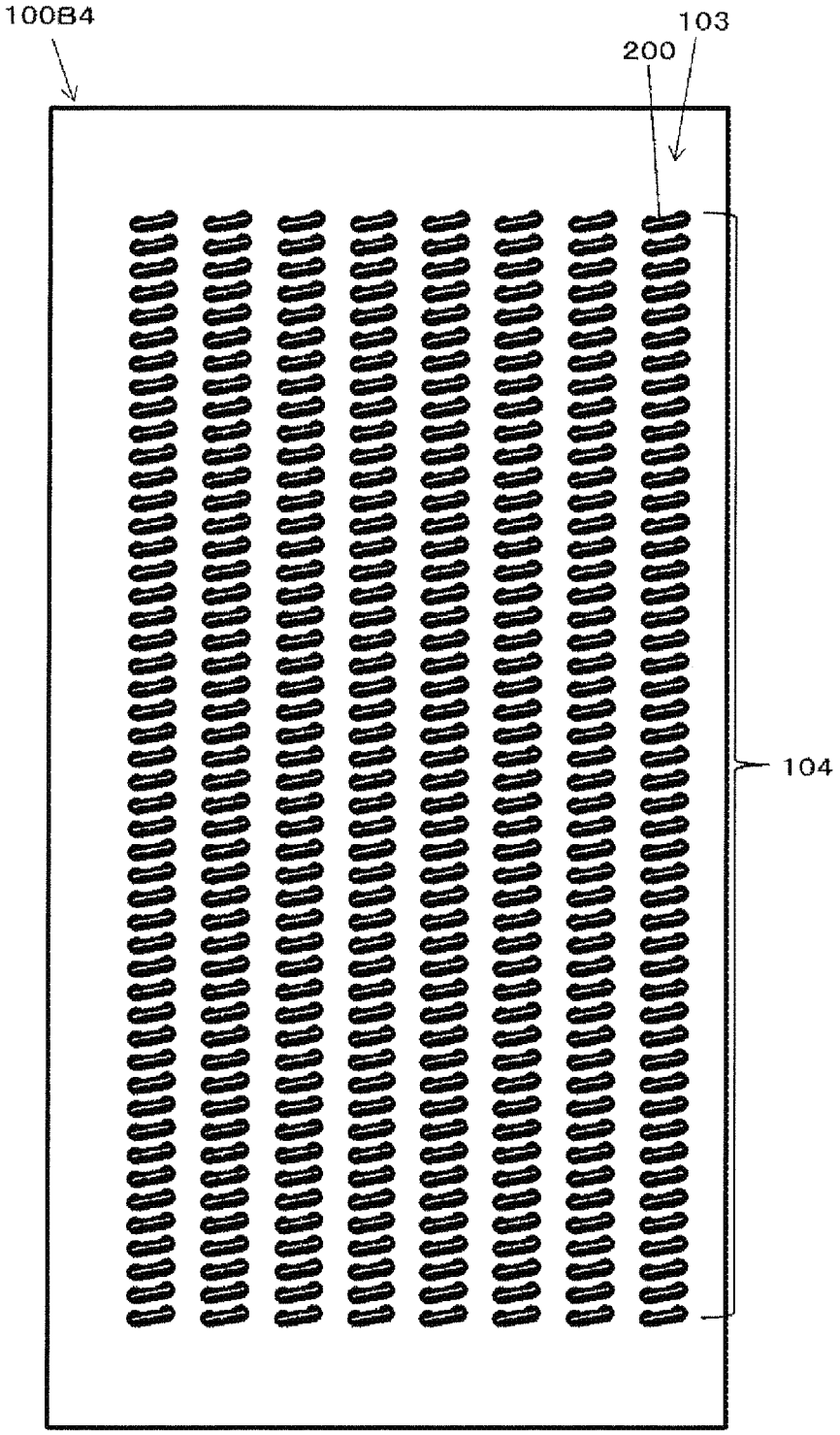
FIG. 56 is a rear view of the coil holding sheet of another modified embodiment of the second embodiment, to which coils are held.
Figure 57:
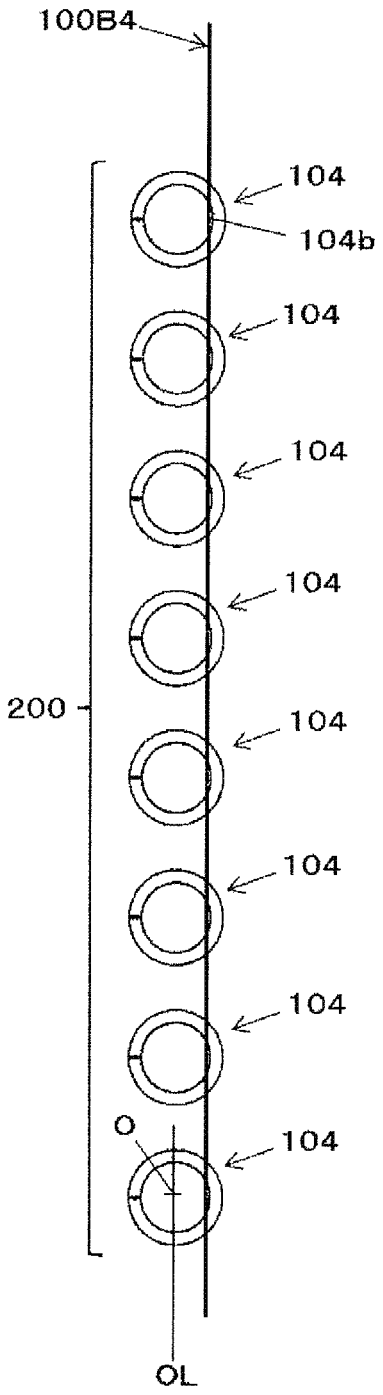
FIG. 57 is a side view of the coil holding sheet of another modified embodiment of the second embodiment, to which coils are held.
Figure 58:
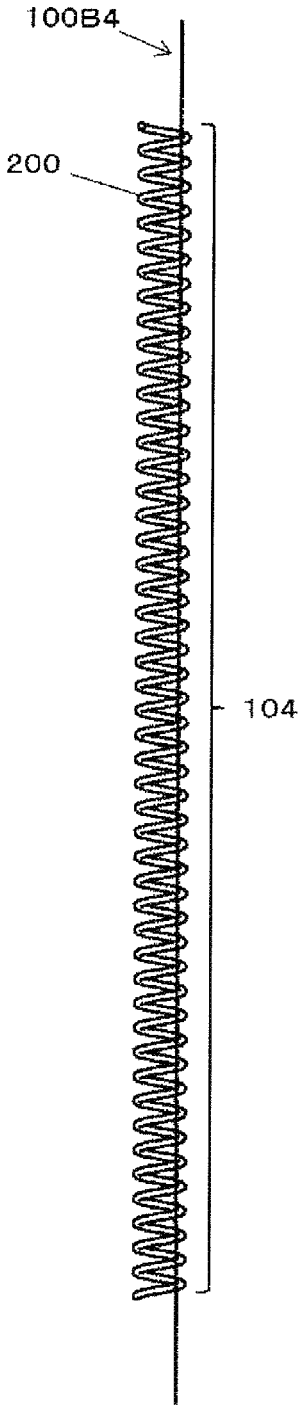
FIG. 58 is a plan view of the coil holding sheet of another modified embodiment of the second embodiment, to which coils are held.
Figure 59:
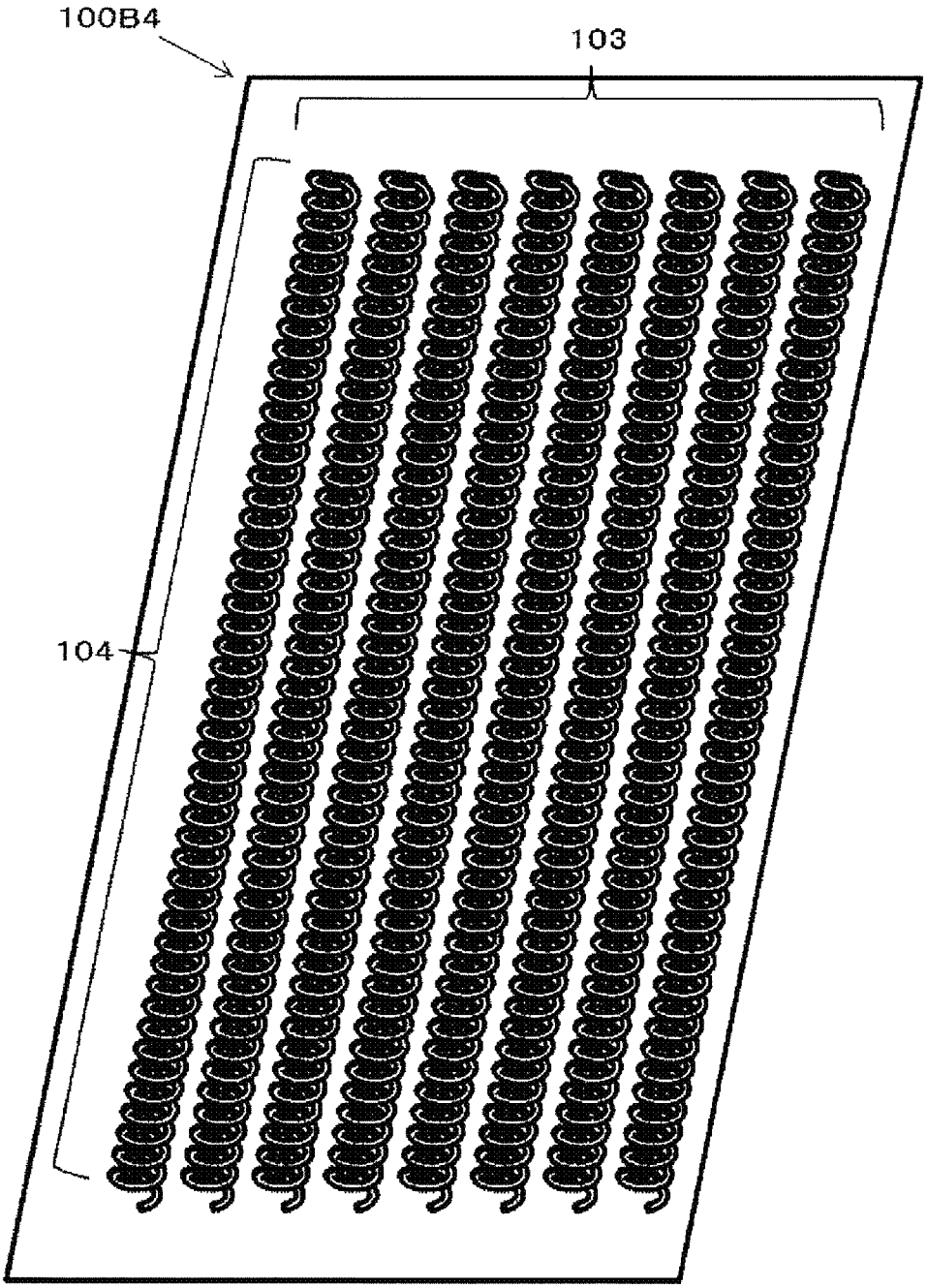
FIG. 59 is a perspective view of the coil holding sheet of another modified embodiment of the second embodiment, to which coils are held.

FIG. 54 is a front view depicting another modified embodiment of the coil holding sheet of the second embodiment. FIGS. 54 to 59 depict the coil holding sheet of another modified embodiment of the second embodiment, to which coils are held. FIG. 55 is a front view of the coil holding sheet of another modified embodiment of the second embodiment, to which coils are held. FIG. 56 is a rear view of the coil holding sheet of another modified embodiment of the second embodiment, to which coils are held. FIG. 57 is a side view of the coil holding sheet of another modified embodiment of the second embodiment, to which coils are held. FIG. 58 is a plan view of the coil holding sheet of another modified embodiment of the second embodiment, to which coils are held. FIG. 59 is a perspective view of the coil holding sheet of another modified embodiment of the second embodiment, to which coils are held.

A coil holding sheet 100B4 of the modified embodiment of the second embodiment has the holders 104 configured to hold the coil 200. The coil holding sheet 100B4 is not provided with the escape holes 102 configured to escape circumferential portions of the coil 200 to the back surface of the coil holding sheet 100A (refer to FIG. 35 and the like). The coil holding sheet 100B4 has the holders 104 of which the number is equal to or larger than the number of turns of the coil 200, in conformity to the pitch P of the coil 200.

That is, the coil holding sheet 100B4 configures the coil holding row 103 for holding one coil 200 by the holders 104. In order to hold the plurality of coils 200 by one coil holding sheet 100B4, the coil holding sheet 100B4 is formed with the plurality of coil holding rows 103 with predetermined intervals in the direction perpendicular to the axial direction of the coil 200.

The holder 104 has the holding hole 104*a* in which the coil 200 of one turn is to enter, and the holding piece 104*b* configured to hold the coil 200 inserted in the holding hole 104*a*. The holding hole 104*a* is formed by an opening penetrating the front and back of the coil holding sheet 100B4 and having a shape by which a circumferential portion of the coil 200 can be inserted and pulled out.

The holding hole 104*a* is configured so that the length $L_5$ in the radial direction of the coil 200 is smaller than the outer diameter Ro of the coil 200. Thereby, the coil 200 cannot enter the holding hole 104*a* to a position at which the radial center O becomes flush with the coil holding sheet 100B4.

Also, the holding hole 104*a* is configured so that the length $L_6$ in the axial direction of the coil 200 is a length within which the coil 200 of one turn in the axial direction can enter the holding hole.

The holding piece 104*b* protrudes in the axial direction of the coil 200 from one side of the holding hole 104*a* in the axial direction of the coil 200. The holding piece 104*b* is configured to openably and closably close a part of a space, which is configured by the holding hole 104*a*, and to detachably hold the coil 200.

The length $L_7$ of the holding piece 104*b* in the radial direction of the coil 200 is configured to be smaller than the inner diameter Ri, which is the diameter of the inner periphery of the coil 200. When the coil 200 is attached to the coil holding sheet 100B4, a part of an area greater than a half of a circumference of the coil 200 protrudes to a front surface side, which is one side of the coil holding sheet 100B4, and a part of an area less than the half of the circumference of the coil 200 protrudes to a back surface side, which is the other side of the coil holding sheet 100B4.

That is, the coil 200 is held to the coil holding sheet 100B4 with the radial center O of the coil 200 being offset to the front surface side, which is one side with respect to the coil holding sheet 100B4. For this reason, the holding piece 104*b* has a length tailored to the interval of the inner periphery-side of the coil 200 at a position at which the coil 200 is held by the coil holding sheet 100B4.

The coil holding sheet 100B4 has the holders 104 of which the number is equal to or larger than the number of turns of the coil 200 in each of the coil holding rows 103, in conformity to the pitch P of the coil 200. For this reason, each of the coil holding rows 103 becomes the holder forming place 103*a*, as a whole.

Examples of Operational Effect of Coil Holding Sheet of Second Embodiment

The coil holding sheet 100B holds the coil 200 one by one in each of the coil holding rows 103. At the holder forming place 103*a*, the circumferential portion of the coil 200 enters the back surface side of the coil holding sheet 100B beyond the holding piece 104*b*.

The coil holding sheet 100B2, 100B3, 100B4 also holds the coil 200 one by one in each of the coil holding rows 103. At the holder forming place 103*a*, the circumferential portion of the coil 200 enters the back surface side of the coil holding sheet 100B2, 100B3, 100B4 beyond holding piece 104*b*.

Thereby, the holding piece 104*b* of the holder 104 enters the inner periphery side of the coil 200. The holding piece 104*b* and the holding hole 104*a* do not form intervals through which the coil 200 can pass, unless an external force capable of separating the coil 200 from the coil holding sheet 100B, 100B2, 100B3, 100B4 is applied. Therefore, it is possible to avoid the coil 200 from separating from the holder 104 by the holding piece 104*b*, when an unintended external force is applied to the coil 200.

Also, the two or more sets of the holders 104 are provided at each holder forming place 103*a*, in conformity to the pitch P of the coil 200, so that even when the coil 200 separates from the holder 101 of one place, the coil 200 can be held at the other adjacent holder 104.

In the case of the coil holding sheet 100B, 100B2 having the escape holes 102 formed therein, when the coil 200 is held in the coil holding row 103, the circumferential portion of the coil 200 enters the escape hole 102 at the portion at which the escape hole 102 is formed. In the escape hole 102, the coil 200 cannot enter the escape hole 102 to the position at which the radial center O of the coil 200 becomes flush with the coil holding sheet 100B, 100B2.

Therefore, the coil 200 is held to the coil holding sheet 100B, 100B2 in the state where the coil is offset with respect to the coil holding 100B, 100B2 sheet so that the protrusion height to the front surface side is greater than the protrusion height to the back surface side.

Also, in the case of the coil holding sheet 100B3 having no escape hole 102, the coil support part 103*c* configured to surface-support the outer periphery of the coil 200 is formed between the holder forming places 103*a*.

Thereby, the coil 200 held to the coil holding sheet 100B3 is offset with respect to the coil holding sheet 100B3 at the holder forming place 103*a* so that the protrusion height to the front surface side is greater than the protrusion height to the back surface side by a shape of the holder 104 such as a length of the holding piece 104*b*, and the like. Also, the circumferentially entire coil 200 held to the coil holding sheet 100B3 protrudes to the front surface side of the coil holding sheet 100B3 at the formation place of the coil support part 103*c* and is thus offset to the front surface side of the coil holding sheet 100B3.

Also, in the case of the coil holding sheet 100B4 with no escape hole 102 and having the holders 101 formed therein in conformity to the number of turns of the coil 200, the coil 200 is held to the coil holding sheet 100B4 in the state where the coil is offset with respect to the coil holding sheet 100B4 so that the protrusion height to the front surface side is greater than the protrusion height to the back surface side by a shape of the holder 104 such as a length of the holding piece 104*b*, and the like.

In the state where the coil 200 is held to the coil holding sheet 100B, 100B2 having the escape holes 102 formed therein, even when the coil holding sheet 100B, 100B2 is seen from the back surface side, it is possible to easily check that the coil 200 is held, because the portions of the coil 200 are exposed to the escape holes 102. In particular, as shown in FIG. 38, the length $L_4$ of the escape hole 102 is configured as the length within which the coil 200 of multiple turns in the axial turns can enter therein, so that the visibility is improved.

In the meantime, when an opening area of each escape hole 102 is made small, like the coil holding sheet 100B2, it is possible to increase the number of the coupling portions 103*b*, so that it is possible to improve the strength against the bending of the coil holding sheet 100B2.

However, if the length $L_4$ of the escape hole 102 is set to a length within which the coil 200 of one turn is to enter the escape hole, the opening area of the escape hole 102 is decreased, so that the operability upon the manufacturing of the coil holding sheet 100B2 is lowered, as compared to a case where the opening area is large. For this reason, the length $L_4$ of the escape hole 102 is preferably configured as a length within which the coil 200 of multiple turns in the axial direction can enter the escape hole.

When detaching the coil 200 from the coil holding sheet 100B, a force of moving the coil 200 in a direction of separating from the coil holding sheet 100B is applied to the coil 200 from the front surface side of the coil holding sheet 100B, such as relative movement of the coil 200 and the coil holding sheet 100B in a direction along the coil holding sheet 100B.

When the force is applied in the direction of separating the coil 200 from the coil holding sheet 100B, the holding piece 104*b* is pressed and deformed by the coil 200, and the intervals of the holding piece 104*b* and the holding hole 104*a* are widened, so that the coil 200 is separated from the holding hole 104*a*. Thereby, the coil 200 is detached from the coil holding sheet 100B.

Also in a case of detaching the coil 200 from the coil holding sheet 100B2, 100B3, 100B4, like the coil holding sheet 100B, a force of moving the coil 200 in a direction of separating from the coil holding sheet 100B2, 100B3, 100B4 is applied to the coil 200 from the front surface side of the coil holding sheet 100B2, 100B3, 100B4, such as relative movement of the coil 200 and the coil holding sheet 100B2, 100B3, 100B4 in a direction along the coil holding sheet 100B2, 100B3, 100B4.

When the force is applied in the direction of separating the coil 200 from the coil holding sheet 100B2, 100B3, 100B4, the holding piece 104*b* is pressed and deformed by the coil 200, and the intervals of the holding piece 104*b* and the holding hole 104*a* are widened, so that the coil 200 is separated from the holding hole 104*a*. Thereby, the coil 200 is detached from the coil holding sheet 100B2, 100B3, 100B4.

As described above, the coil 200 is held to the coil holding sheet 100B, 100B2, 100B3, 100B4 in the state where the coil is offset with respect to the coil holding sheet 100B, 100B2, 100B3, 100B4 so that the protrusion height to the front surface side is greater than the protrusion height to the back surface side. Thereby, it is possible to securely apply the force for detaching the coil 200 from the coil holding sheet 100B, 100B2, 100B3, 100B4, from the front surface side of the coil holding sheet 100B, 100B2, 100B3, 100B4.

Also, when attaching the coil 200 to the coil holding sheet 100B, 100B2, 100B3, 100B4, the position of the coil 200 is aligned to the coil holding row 103 and the force is applied in a direction of pressing the coil 200 to the coil holding sheet 100B, 100B2, 100B3, 100B4.

Thereby, the holding piece 104*b* is pressed and deformed by the coil 200, and the intervals of the holding piece 104*b* and the holding hole 104*a* are widened, so that the coil 200 passes through the holding hole 104*a*. Therefore, the circumferential portion of the coil 200 enters the back surface side of the coil holding sheet 100B, 100B2, 100B3, 100B4.

Therefore, the coil 200 of the portion having entered the back surface side of the coil holding sheet 100B, 100B2, 100B3, 100B4 is pressed by the holding piece 104*b*, so that the coil 200 is attached to the coil holding sheet 100B, 100B2, 100B3, 100B4.

Like this, during the operation of attaching the coil 200 to the coil holding sheet 100B, 100B2, 100B3, 100B4, it is not necessary to perform an operation of deforming a predetermined part of the coil holding sheet 100B, 100B2, 100B3, 100B4 in advance. Therefore, it is possible to easily attach and use the coil 200 of a single body to the coil holding sheet 100B, 100B2, 100B3, 100B4.

In the case of the coil holding sheet 100B, since the escape hole 102 has the length corresponding to the multiple turns of the coil 200, the punch chad is large, so that it is possible to reduce the number of generation of the punch chad in the manufacturing process of the escape holes 102.

Also, in the case of the coil holding sheets 100B3, 100B4, it is not necessary to form the escape holes in the manufacturing process of the coil holding sheets 100B3, 100B4, so that the operability is improved. Also, in the case of the coil holding sheet 100B, and the coil holding sheet 100B2, the combination is made by increasing and decreasing the number of the holders 104 and the escape holes 102, so that it is possible to easily adjust the holding force of the coil 200 in the coil holding sheet 100B and the coil holding sheet 100B2. Also, in the case of the coil holding sheet 100B3, the combination is made by increasing and decreasing the number of the holders 104 and the areas of the coil support parts 103*c*, so that it is possible to easily adjust the holding force of the coil 200 in the coil holding sheet 100B3.

Configuration Example of Coil Holding Sheet of Third Embodiment

Figure 60:
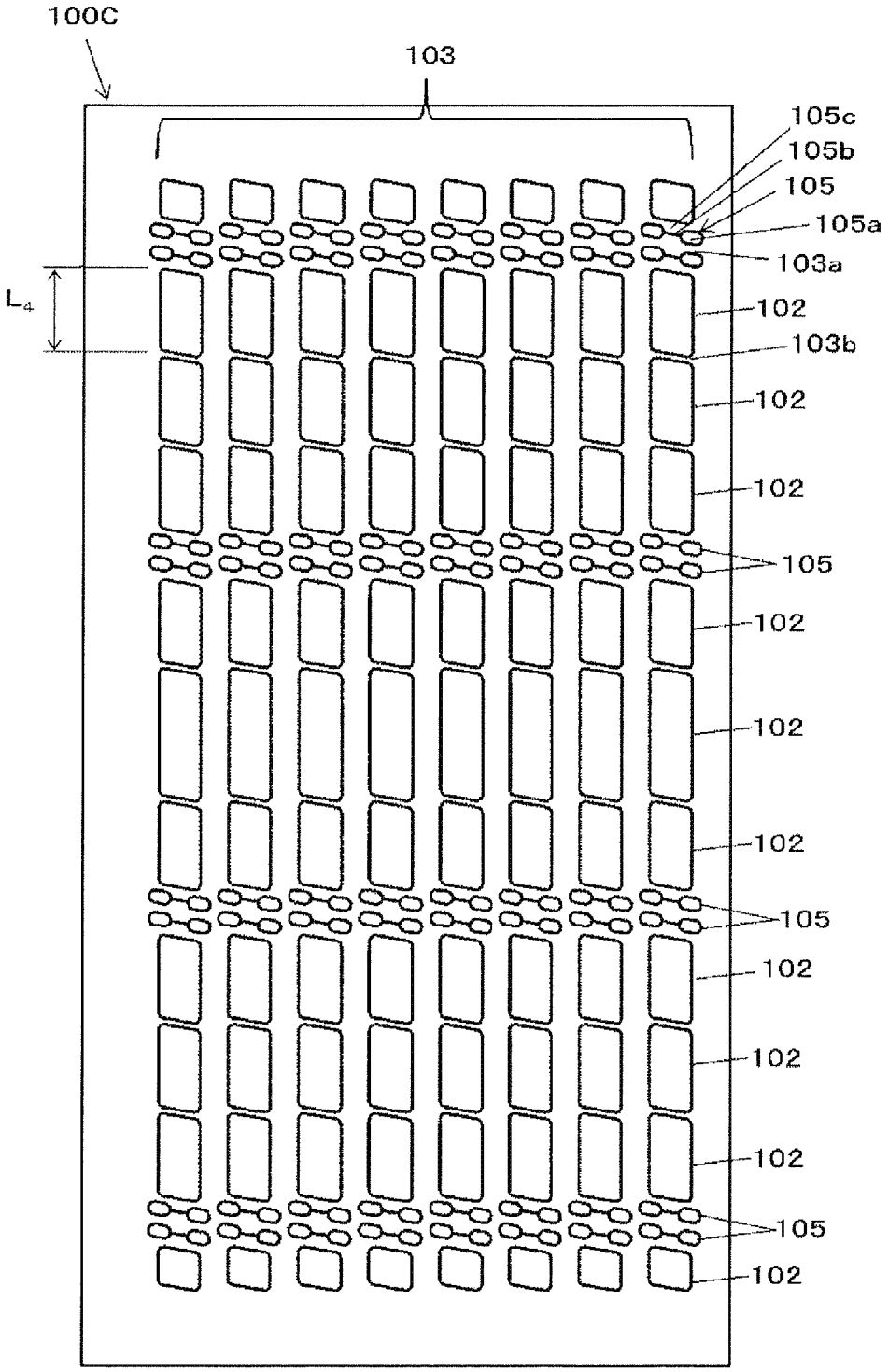
FIG. 60 is a front view depicting an example of the coil holding sheet of a third embodiment.
Figure 61:
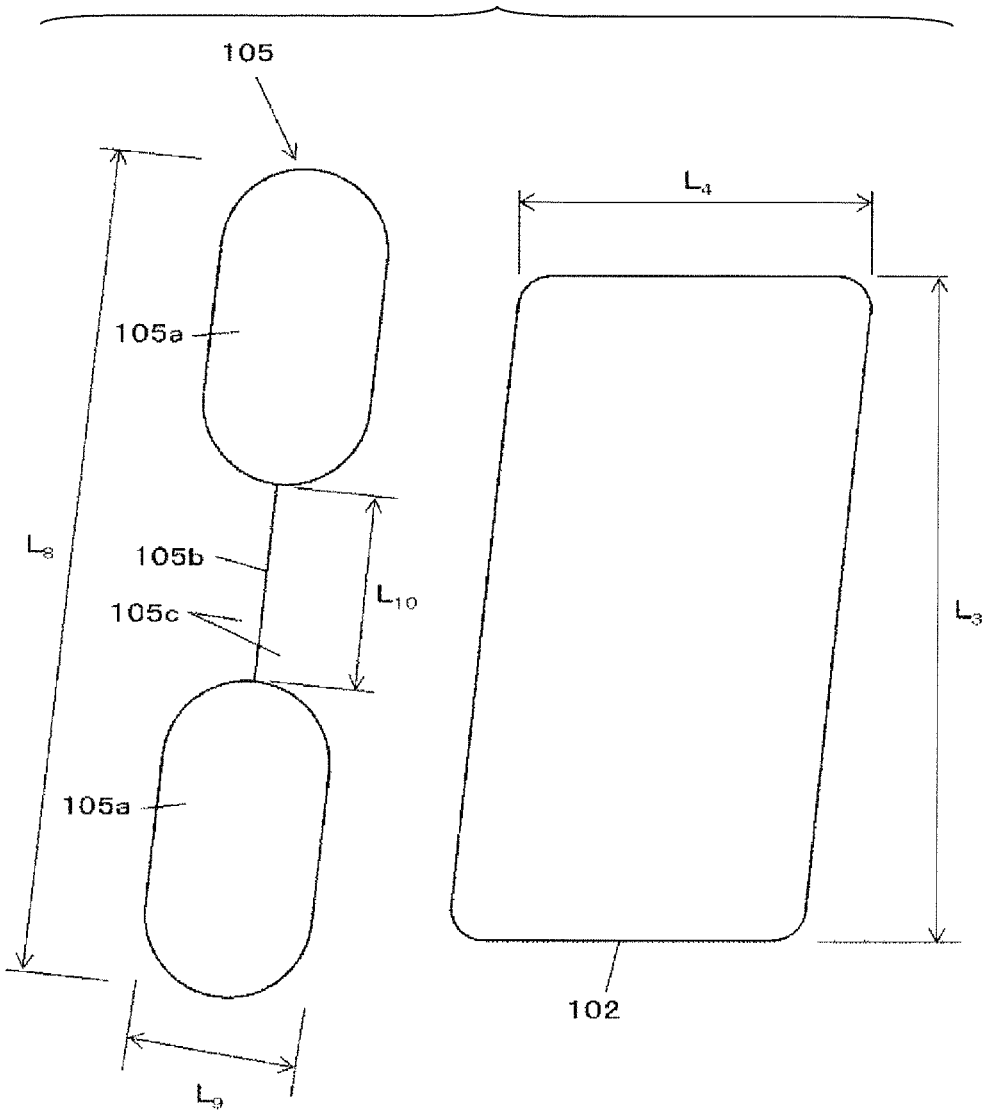
FIG. 61 is a front view depicting a configuration of main parts of the coil holding sheet of the third embodiment.
Figure 62:
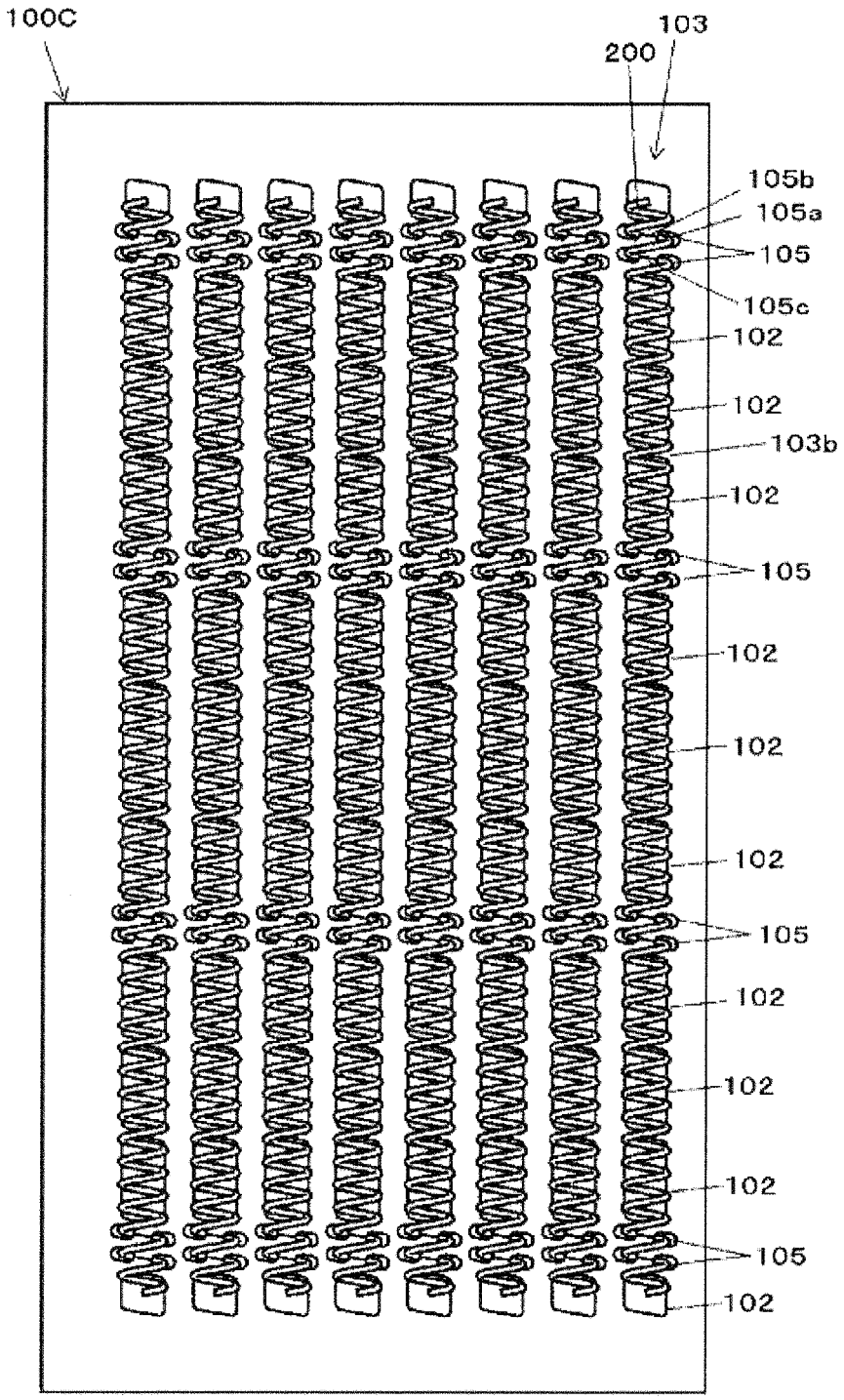
FIG. 62 is a front view of the coil holding sheet of the third embodiment, to which coils are held.
Figure 63:
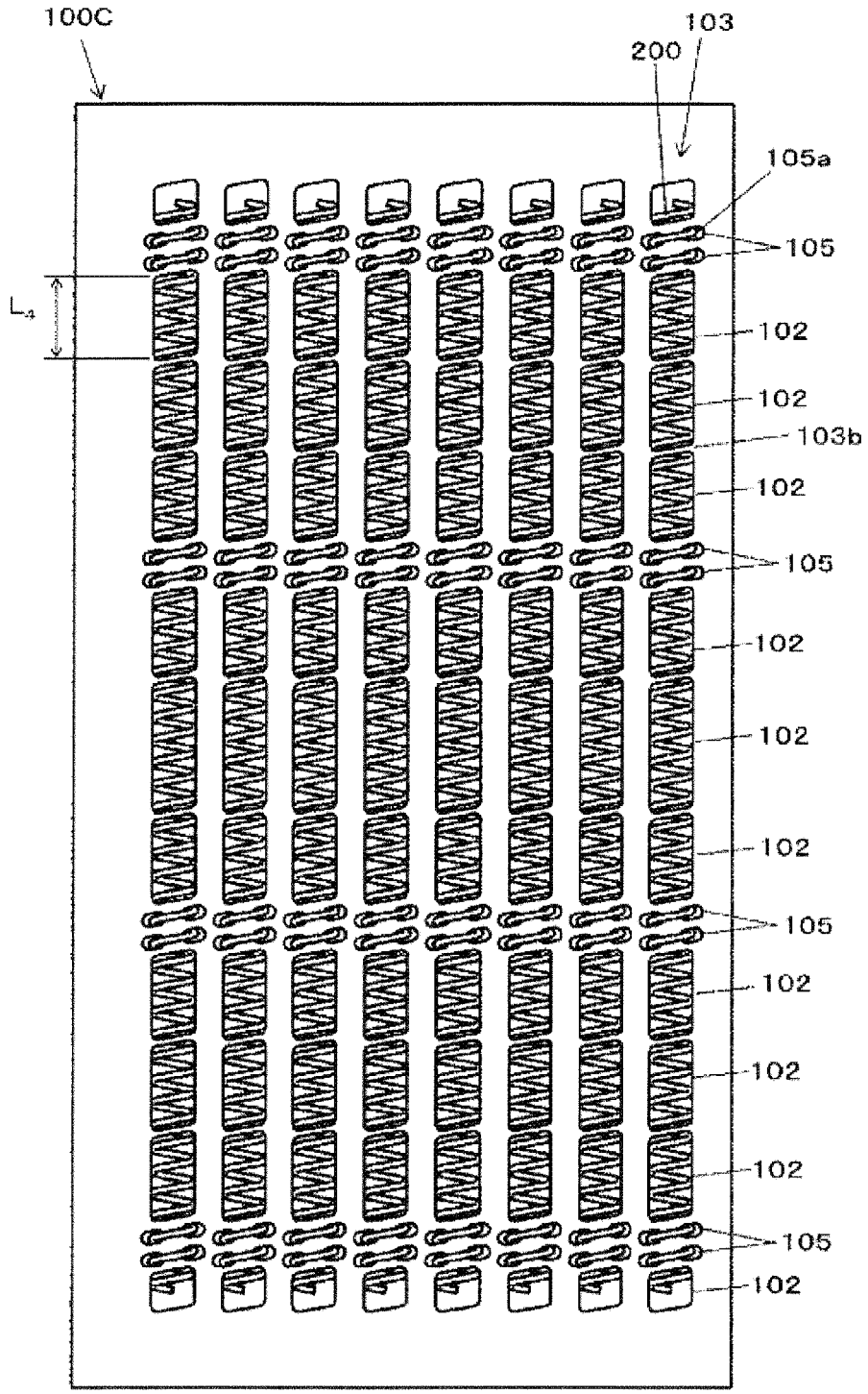
FIG. 63 is a rear view of the coil holding sheet of the third embodiment, to which coils are held.
Figure 64:
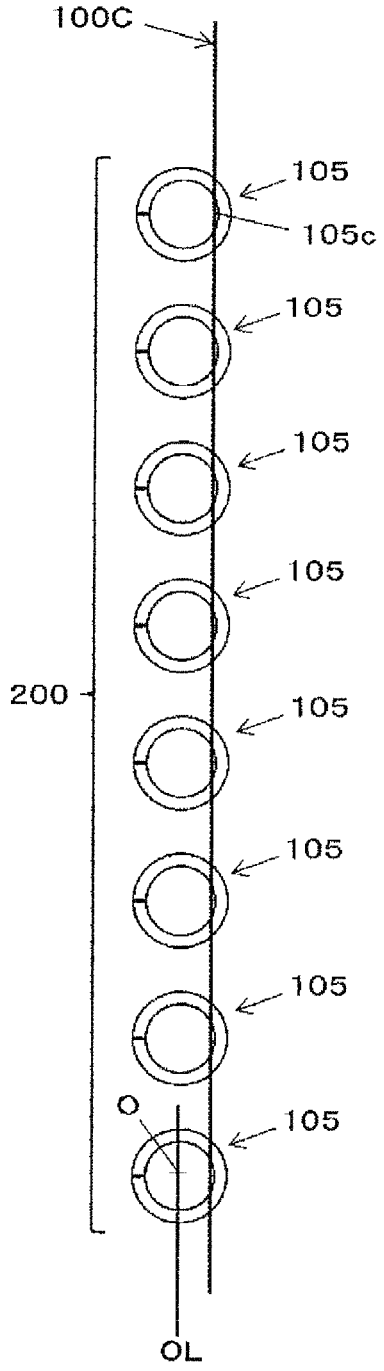
FIG. 64 is a side view of the coil holding sheet of the third embodiment, to which coils are held.
Figure 65:
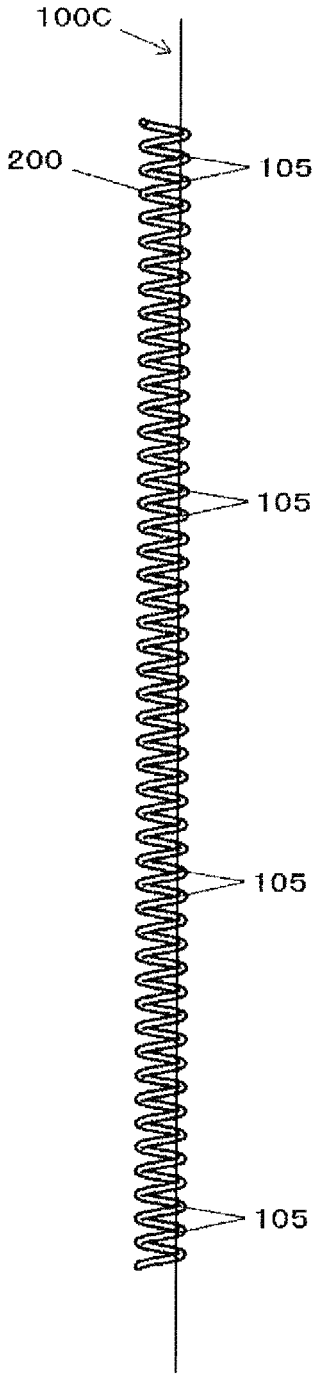
FIG. 65 is a plan view of the coil holding sheet of the third embodiment, to which coils are held.
Figure 66:
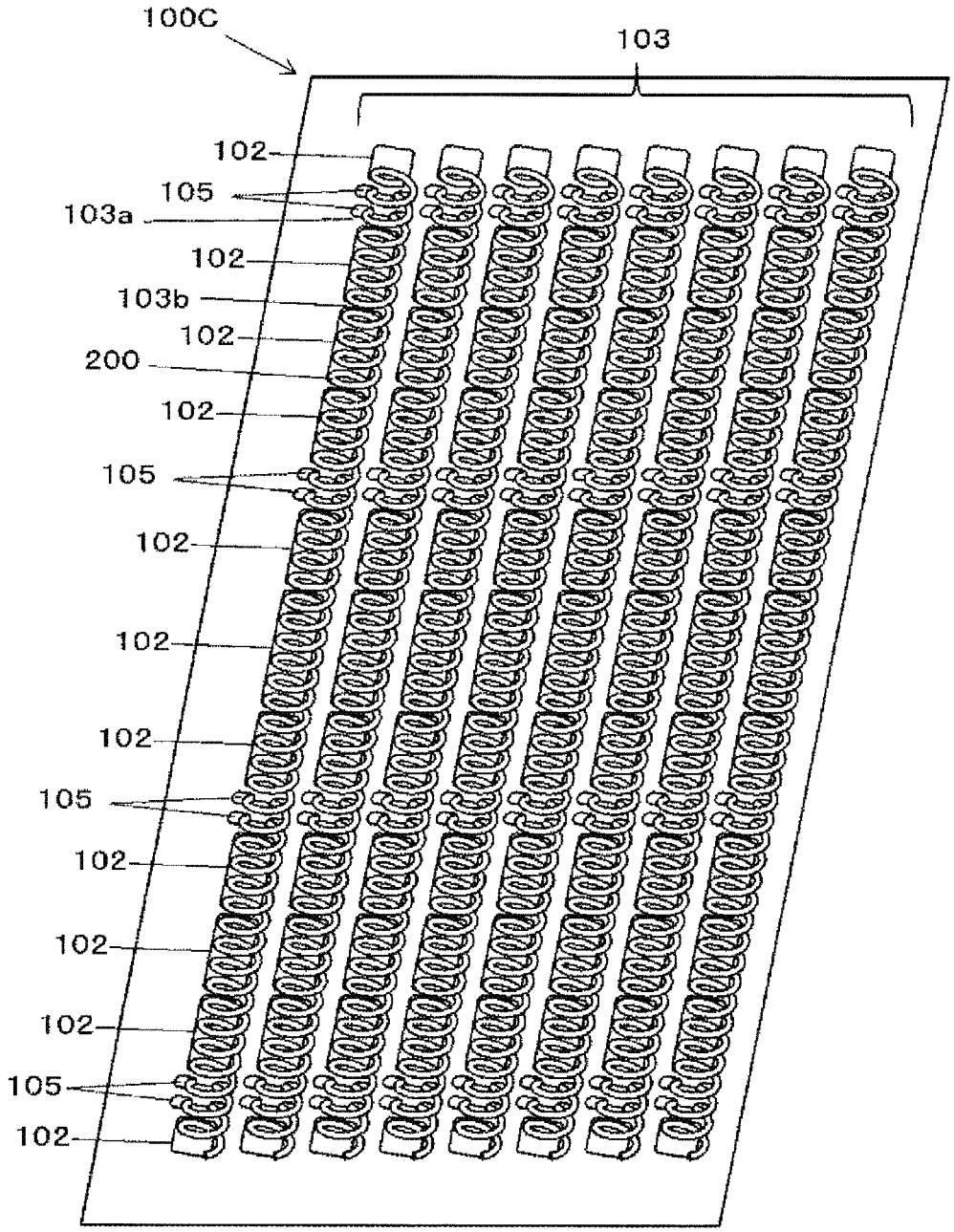
FIG. 66 is a perspective view of the coil holding sheet of the third embodiment, to which coils are held.

FIG. 60 is a front view depicting an example of the coil holding sheet of a third embodiment. FIG. 61 is a front view depicting a configuration of main parts of the coil holding sheet of the third embodiment. FIGS. 62 to 66 depict the coil holding sheet of the third embodiment, to which coils are held. FIG. 62 is a front view of the coil holding sheet of the third embodiment, to which coils are held. FIG. 63 is a rear view of the coil holding sheet of the third embodiment, to which coils are held. FIG. 64 is a side view of the coil holding sheet of the third embodiment, to which coils are held. FIG. 65 is a plan view of the coil holding sheet of the third embodiment, to which coils are held. FIG. 66 is a perspective view of the coil holding sheet of the third embodiment, to which coils are held.

A coil holding sheet 100C of the third embodiment has holders 105 configured to hold the coil 200, and the escape holes 102 configured to escape circumferential portions of the coil 200 from a front surface, which is one surface of the coil holding sheet 100C, to a back surface, which is the other surface. Here, the escape hole 102 has the same configuration as the coil holding sheet 100A of the first embodiment or the coil holding sheet 100A1 of the modified embodiment of the first embodiment.

The coil holding sheet 100C configures the coil holding row 103 for holding one coil 200 by a combination of the holders 105 and the escape holes 102. In order to hold a plurality of coils 200 by one coil holding sheet 100C, the coil holding sheet 100C is formed with a plurality of coil holding rows 103 with predetermined intervals in the direction perpendicular to the axial direction of the coil 200.

The holder 105 has a pair of holding holes 105*a* in which the coil 200 of one turn is to enter, and a slit 105*b* provided between the pair of holding holes 105*a*. The holding hole 105*a* is formed by an opening penetrating the front and back of the coil holding sheet 100C and having a shape by which a circumferential portion of the coil 200 can be inserted and pulled out.

An interval $L_8$ in the radial direction of the coil 200 between outer sides of the pair of holding holes 105*a* is configured to be smaller than the outer diameter Ro of the coil 200. Also, the holding hole 105*a* is configured so that a length $L_9$ in the axial direction of the coil 200 is a length within which the coil 200 of one turn in the axial direction is to enter the holding hole.

The slit 105*b* is formed by linearly cutting the front and back of the coil holding sheet 100C between an inner side of one holding hole 105*a* and an inner side of the other holding hole 105*a*. The pair of holding holes 105*a* is coupled by the slit 105*b*.

The coil holding sheet 100C has holding pieces 105*c* provided at both sides of the slit 105*b* and protruding in a direction of the slit 105*b* along the axial direction of the coil 200. The holding pieces 105*c* are configured to openably and closably close a space, which may be configured by the holding holes 105*a* and the slit 105*b*, and to detachably hold the coil 200.

A length $L_{10}$ of the slit 105*b* is smaller than the inner diameter Ri, which is the diameter of the inner periphery of the coil 200. When the coil 200 is attached to the coil holding sheet 100C, a part of an area greater than a half of a circumference of the coil 200 protrudes to a front surface side, which is one side of the coil holding sheet 100C, and a part of an area less than the half of the circumference of the coil 200 protrudes to a back surface side, which is the other side of the coil holding sheet 100C.

That is, the coil 200 is held to the coil holding sheet 100C with the radial center O of the coil 200 being offset to the front surface side, which is one side with respect to the coil holding sheet 100C. For this reason, the slit 105*b* has a length tailored to the interval of the inner periphery-side of the coil 200 at a position at which the coil 200 is held by the coil holding sheet 100C.

The coil holding sheet 100C has the holder forming places 103*a*, at which the holders 105 are formed, at a plurality of places of the coil holding row 103 along the axial direction of the coil 200. In the third embodiment, the holder forming places 103*a* are formed at four places spaced with predetermined intervals along the axial direction of the coil 200.

Also, the coil holding sheet 100*c* has at least one holder 105 provided at each of the holder forming places 103*a*. In the third embodiment, two sets of the holders 105 are provided at each of the holder forming places 103*a* in conformity to the pitch P of the coil 200.

The escape hole 102 is configured by an opening penetrating the front and back of the coil holding sheet 100C and having a shape by which a circumferential portion of the coil 200 can be inserted and pulled out. The escape holes 102 are provided in parallel with the holder forming places 103*a* along the axial direction of the coil 200 held to the coil holding sheet 100C by the holders 105.

The escape hole 102 is configured so that the length $L_3$ in the radial direction of the coil 200 is smaller than the outer diameter Ro of the coil 200. Thereby, the coil 200 cannot enter the escape hole 102 to a position at which the radial center O becomes flush with the coil holding sheet 100C.

Therefore, the coil 200 is held to the coil holding sheet 100C in a state where the coil is offset with respect to the coil holding sheet 100C so that a protrusion height to the front surface side is greater than a protrusion height to the back surface side. An offset amount is determined with the length $L_3$ of the escape hole 102 in the radial direction of the coil 200.

The escape hole 102 is configured so that the length $L_4$ in the axial direction of the coil 200 is a length within which the coil 200 of two or more turns in the axial direction is to enter the escape hole. In the third embodiment, the escape hole 102 having a length within which the coil 200 of two turns is to enter the escape hole, the escape hole 102 having a length within which the coil 200 of four turns is to enter the escape hole, and the escape hole 102 having a length within which the coil 200 of six turns is to enter the escape hole are provided in correspondence to the number of turns of the coil 200.

The coil holding row 103 is provided with the coupling portions 103*b* each of which is formed between the escape holes 102 arranged in parallel in the axial direction of the coil 200 and is provided to couple one side and the other side of the escape holes 102 in the radial direction of the coil 200 therebetween.

Modified Embodiments of Coil Holding Sheet of Third Embodiment

Figure 67:
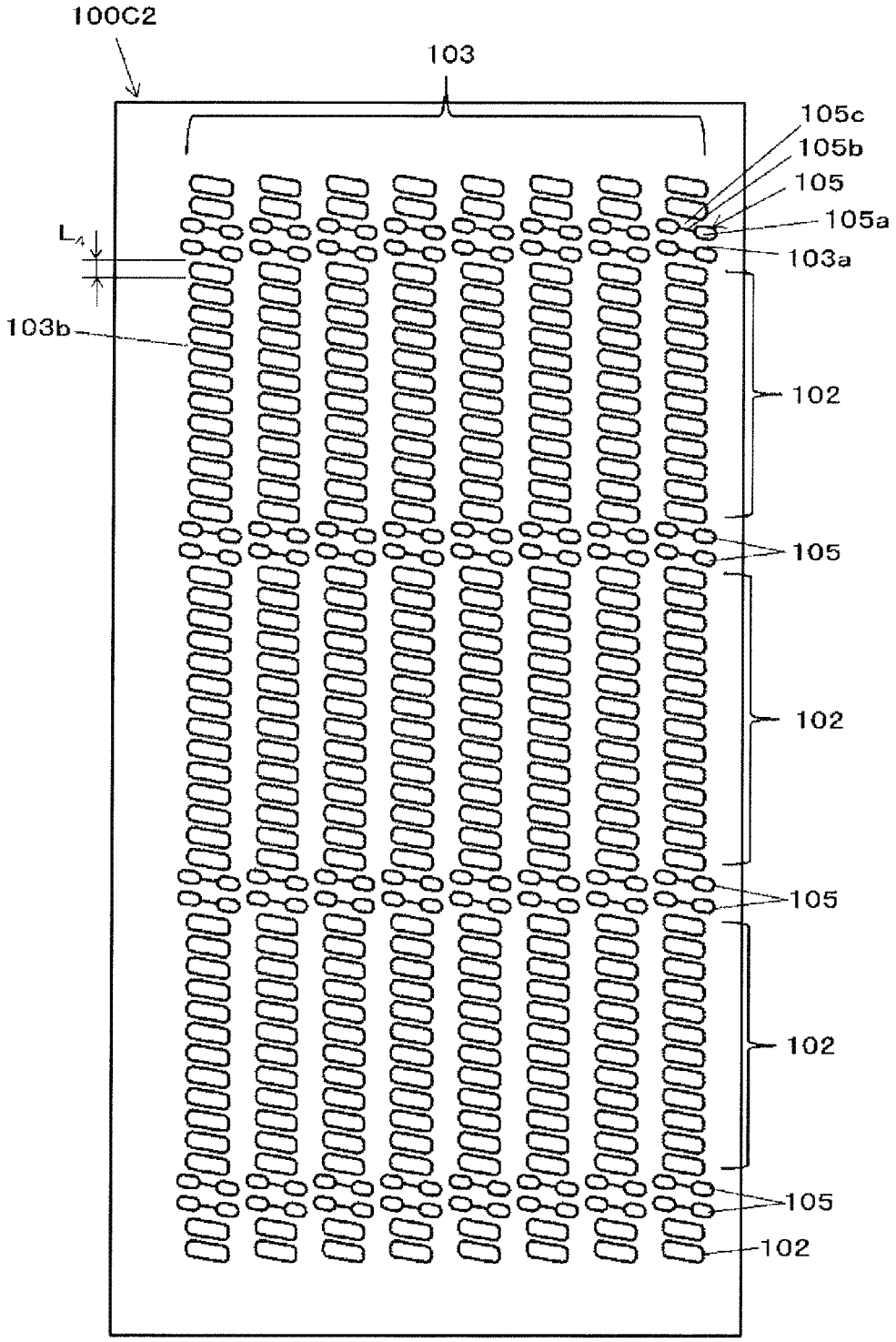
FIG. 67 is a front view depicting a modified embodiment of the coil holding sheet of the third embodiment.
Figure 68:
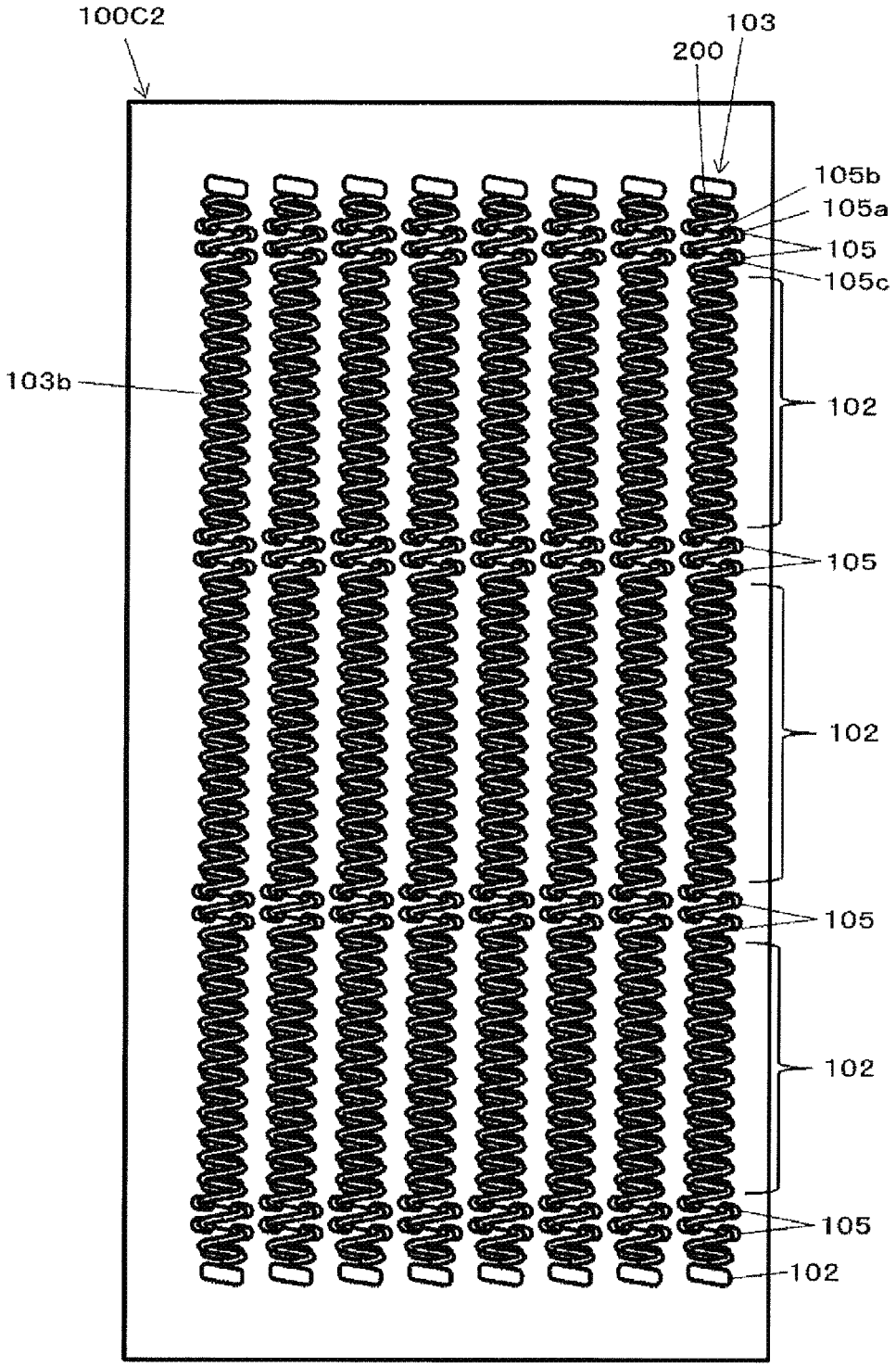
FIG. 68 is a front view of the coil holding sheet of the modified embodiment of the third embodiment, to which coils are held.
Figure 69:
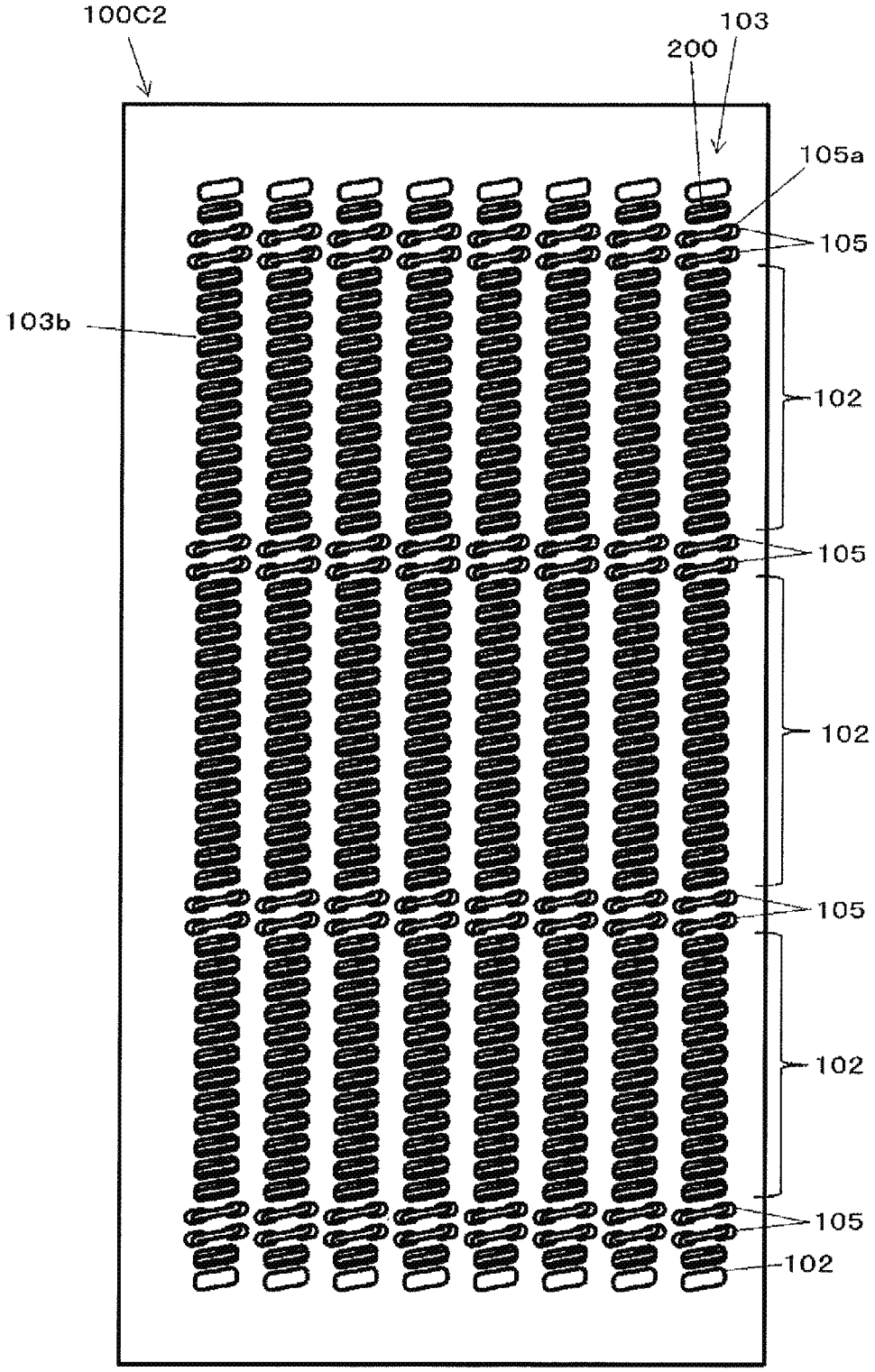
FIG. 69 is a rear view of the coil holding sheet of the modified embodiment of the third embodiment, to which coils are held.
Figure 70:
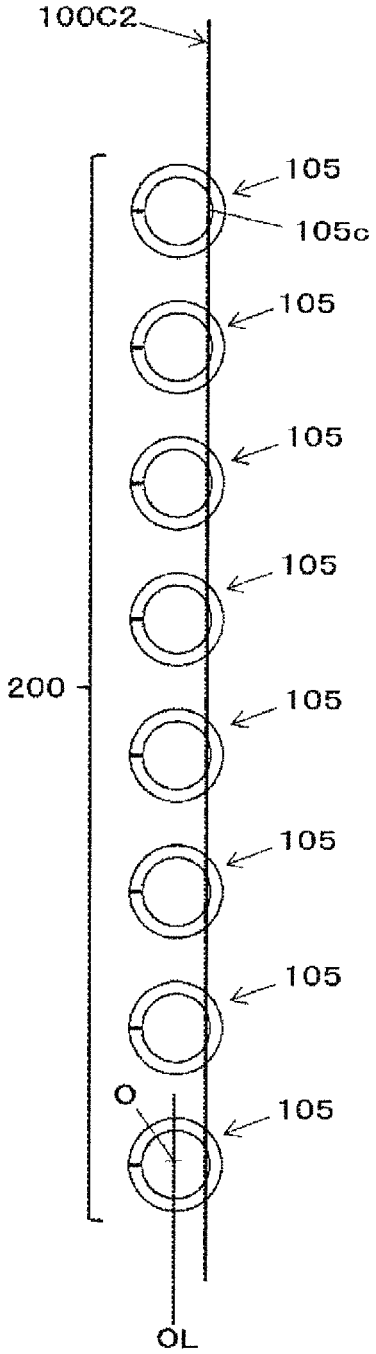
FIG. 70 is a side view of the coil holding sheet of the modified embodiment of the third embodiment, to which coils are held.
Figure 71:
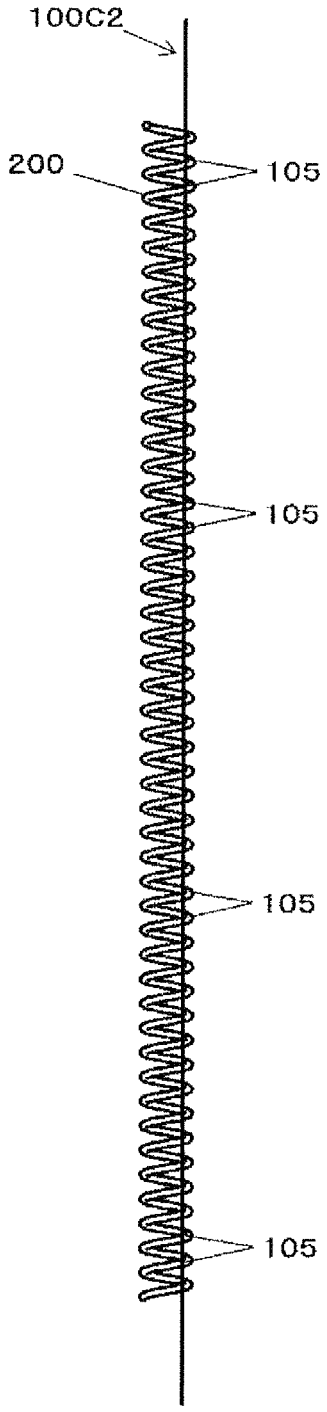
FIG. 71 is a plan view of the coil holding sheet of the modified embodiment of the third embodiment, to which coils are held.
Figure 72:
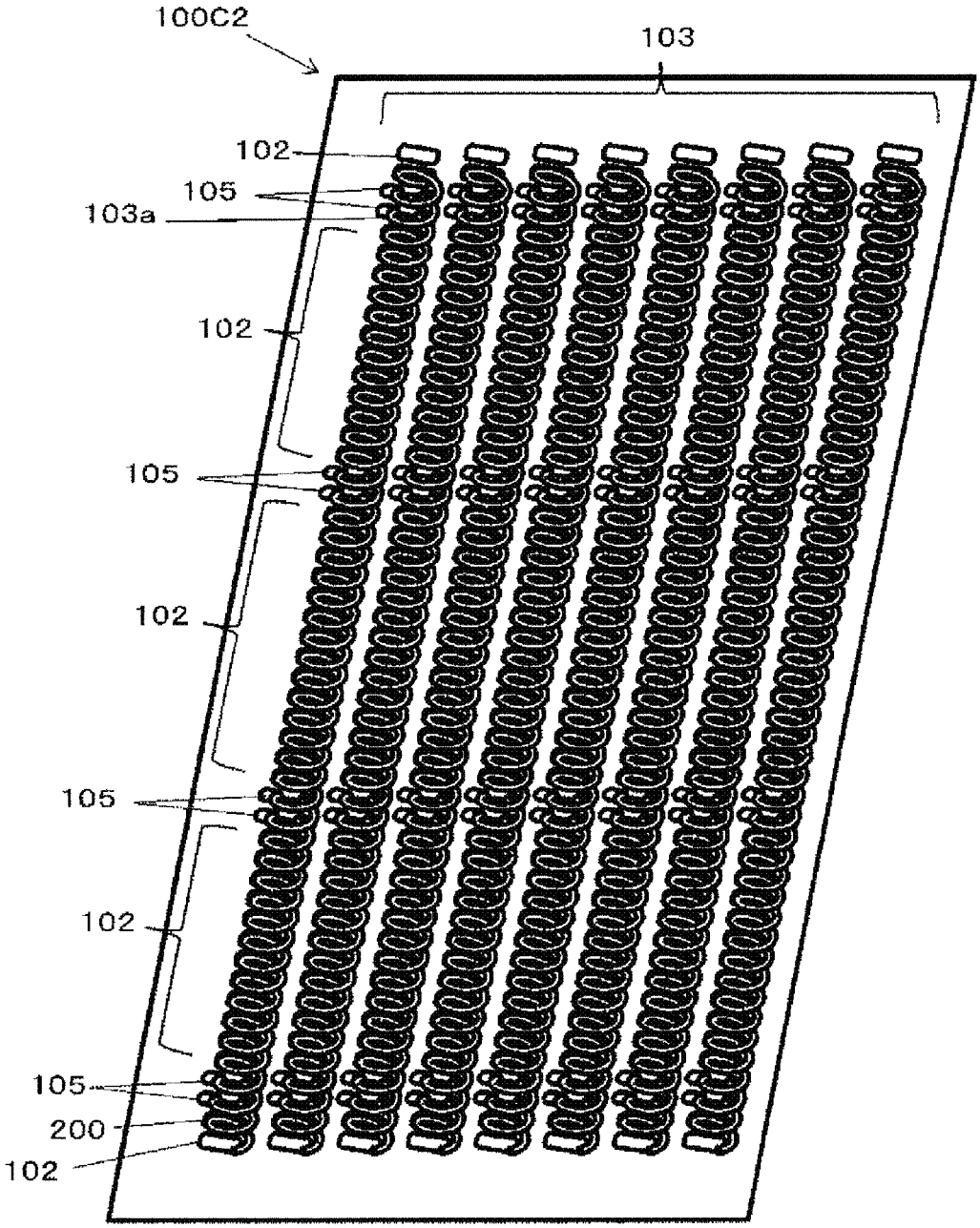
FIG. 72 is a perspective view of the coil holding sheet of the modified embodiment of the third embodiment, to which coils are held.

FIG. 67 is a front view depicting a modified embodiment of the coil holding sheet of the third embodiment. FIGS. 68 to 72 depict the coil holding sheet of the modified embodiment of the third embodiment, to which coils are held. FIG. 68 is a front view of the coil holding sheet of the modified embodiment of the third embodiment, to which coils are held. FIG. 69 is a rear view of the coil holding sheet of the modified embodiment of the third embodiment, to which coils are held. FIG. 70 is a side view of the coil holding sheet of the modified embodiment of the third embodiment, to which coils are held. FIG. 71 is a plan view of the coil holding sheet of the modified embodiment of the third embodiment, to which coils are held. FIG. 72 is a perspective view of the coil holding sheet of the modified embodiment of the third embodiment, to which coils are held.

A coil holding sheet 100C2 of the modified embodiment of the third embodiment has the holders 105 configured to hold the coil 200, and the escape holes 102 configured to escape circumferential portions of the coil 200 from a front surface, which is one surface of the coil holding sheet 100C2, to a back surface, which is the other surface. The coil holding sheet 100C2 is configured so that the length $L_4$ of each escape hole 102 in the axial direction of the coil 200 is a length within which the coil 200 of one turn is to enter the escape hole. The other configurations are the same as the coil holding sheet 100C of the third embodiment.

That is, the coil holding sheet 100C2 configures the coil holding row 103 for holding one coil 200 by a combination of the holders 105 and the escape holes 102. In order to hold the plurality of coils 200 by one coil holding sheet 100C2, the coil holding sheet 100C2 is formed with the plurality of coil holding rows 103 with predetermined intervals in the direction perpendicular to the axial direction of the coil 200.

The holder 105 has the pair of holding holes 105*a* in which the coil 200 of one turn is to enter, and the slit 105*b* provided between the pair of holding holes 105*a*. The holding hole 105*a* is formed by an opening penetrating the front and back of the coil holding sheet 100C2 and having a shape by which a circumferential portion of the coil 200 can be inserted and pulled out.

The interval $L_8$ in the radial direction of the coil 200 between the outer sides of the pair of holding holes 105*a* is configured to be greater than the outer diameter Ro of the coil 200. Also, the holding hole 105*a* is configured so that the length $L_9$ in the axial direction of the coil 200 is a length within which the coil 200 of one turn in the axial direction is to enter the holding hole.

The slit 105*b* is formed by linearly cutting the front and back of the coil holding sheet 100C2 between the inner side of one holding hole 105*a* and the inner side of the other holding hole 105*a*. The pair of holding holes 105*a* is coupled by the slit 105*b*.

The coil holding sheet 100C2 has the holding pieces 105*c* provided at both sides of the slit 105*b* and protruding in the direction of the slit 105*b* along the axial direction of the coil 200. The holding pieces 105*c* are configured to openably and closably close a space, which may be configured by the holding holes 105*a* and the slit 105*b*, and to detachably hold the coil 200.

The length $L_{10}$ of the slit 105*b* is configured to be smaller than the inner diameter Ri, which is the diameter of the inner periphery of the coil 200. When the coil 200 is attached to the coil holding sheet 100C2, a part of an area greater than a half of a circumference of the coil 200 protrudes to a front surface side, which is one side of the coil holding sheet 100C2, and a part of an area less than the half of the circumference of the coil 200 protrudes to a back surface side, which is the other side of the coil holding sheet 100C2.

That is, the coil 200 is held to the coil holding sheet 100C2 with the radial center O of the coil 200 being offset to the front surface side, which is one side with respect to the coil holding sheet 100C2. For this reason, the slit 105*b* has a length tailored to the interval of the inner periphery-side of the coil 200 at a position at which the coil 200 is held by the coil holding sheet 100C2.

The coil holding sheet 100C2 has the holder forming places 103*a*, at which the holders 105 are formed, at a plurality of places of the coil holding row 103 along the axial direction of the coil 200. In this modified embodiment, the holder forming places 103*a* are formed at four places spaced with predetermined intervals along the axial direction of the coil 200.

Also, the coil holding sheet 100C2 has at least one holder 105 provided at each of the holder forming places 103*a*. In this modified embodiment, two sets of the holders 105 are provided at each of the holder forming places 103*a* in conformity to the pitch P of the coil 200.

The escape hole 102 is configured by an opening penetrating the front and back of the coil holding sheet 100C2 and having a shape by which a circumferential portion of the coil 200 can be inserted and pulled out. The escape holes 102 are provided in parallel with the holder forming places 103*a* along the axial direction of the coil 200 held to the coil holding sheet 100C2 by the holders 105.

The escape hole 102 is configured so that the length $L_3$ in the radial direction of the coil 200 is smaller than the outer diameter Ro of the coil 200. Thereby, the coil 200 cannot enter the escape hole 102 to a position at which the radial center O becomes flush with the coil holding sheet 100C2.

Therefore, the coil 200 is held to the coil holding sheet 100C2 in a state where the coil is offset with respect to the coil holding sheet 100C2 so that a protrusion height to the front surface side is greater than a protrusion height to the back surface side. An offset amount is determined with the length $L_3$ of the escape hole 102 in the radial direction of the coil 200.

The escape hole 102 is configured so that the length $L_4$ in the axial direction of the coil 200 is a length within which the coil 200 of one turn in the axial direction is to enter the escape hole.

The coil holding row 103 is provided with the coupling portions 103*b* each of which is formed between the escape holes 102 arranged in parallel in the axial direction of the coil 200 and is provided to couple one side and the other side of the escape holes 102 in the radial direction of the coil 200 therebetween.

Figure 73:
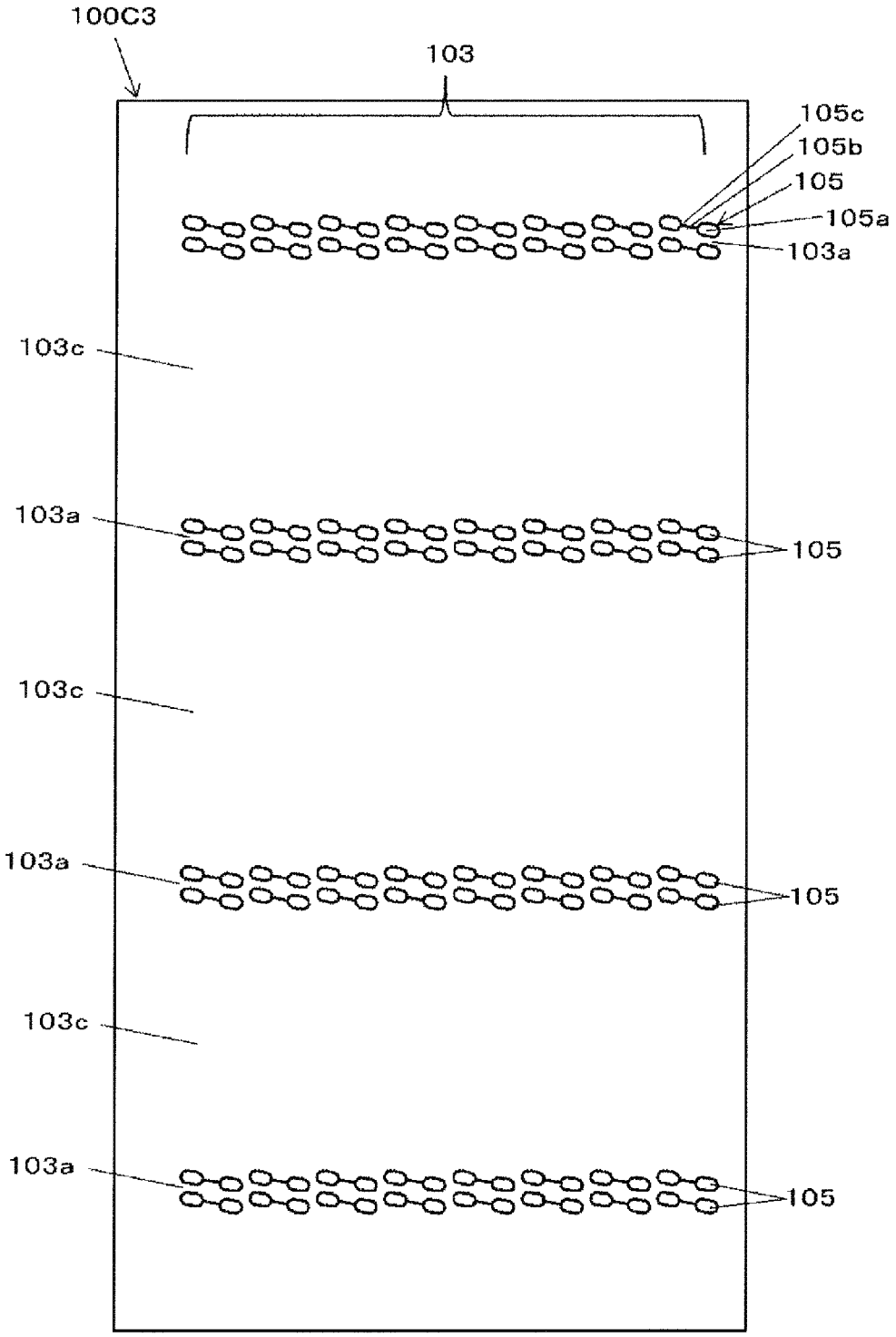
FIG. 73 is a front view depicting another modified embodiment of the coil holding sheet of the third embodiment.
Figure 74:
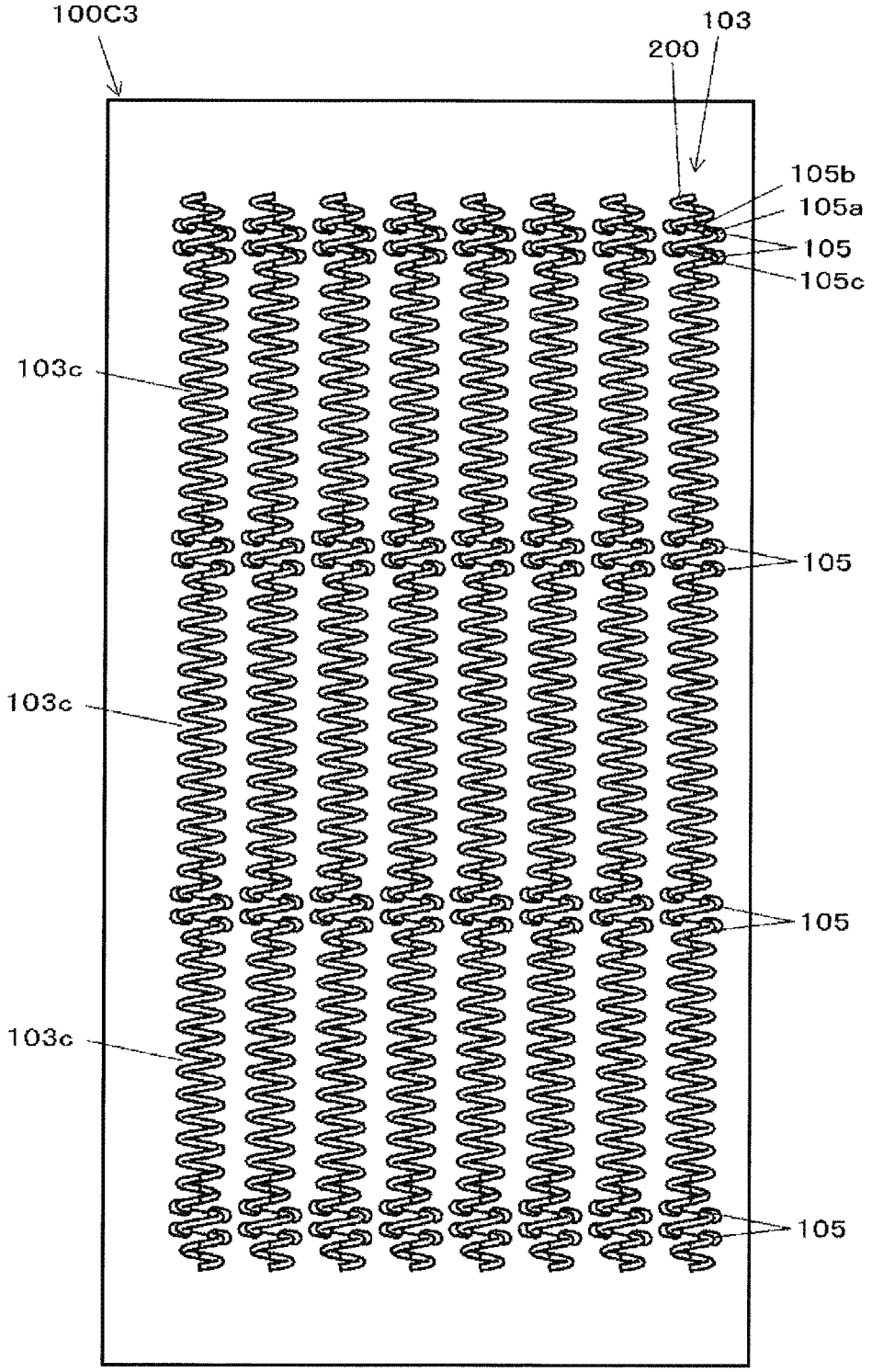
FIG. 74 is a front view of the coil holding sheet of another modified embodiment of the third embodiment, to which coils are held.
Figure 75:
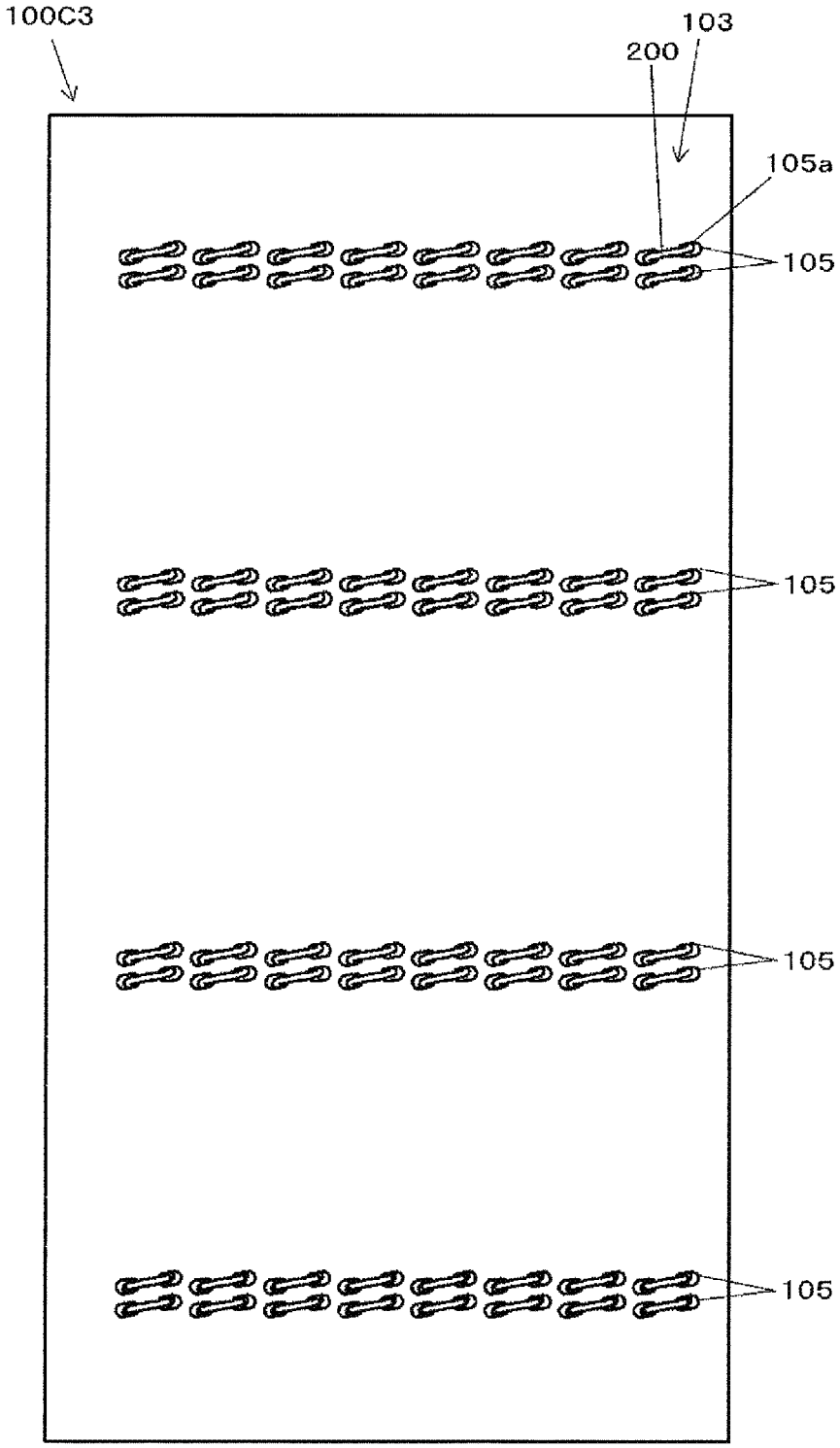
FIG. 75 is a rear view of the coil holding sheet of another modified embodiment of the third embodiment, to which coils are held.
Figure 76:
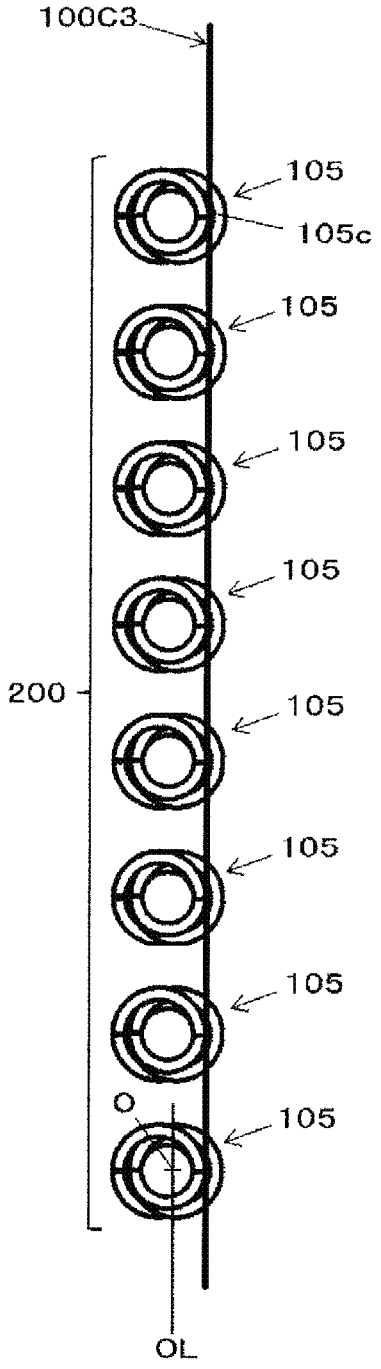
FIG. 76 is a side view of the coil holding sheet of another modified embodiment of the third embodiment, to which coils are held.
Figure 77:
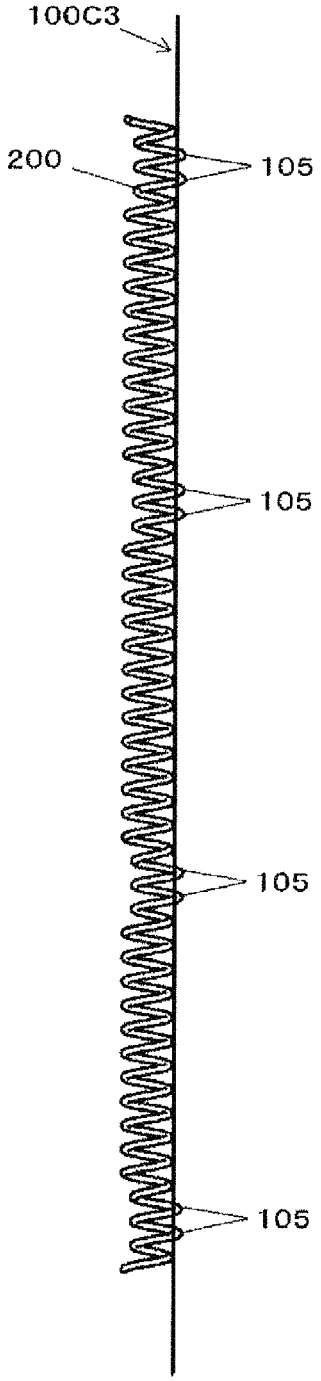
FIG. 77 is a plan view of the coil holding sheet of another modified embodiment of the third embodiment, to which coils are held.
Figure 78:
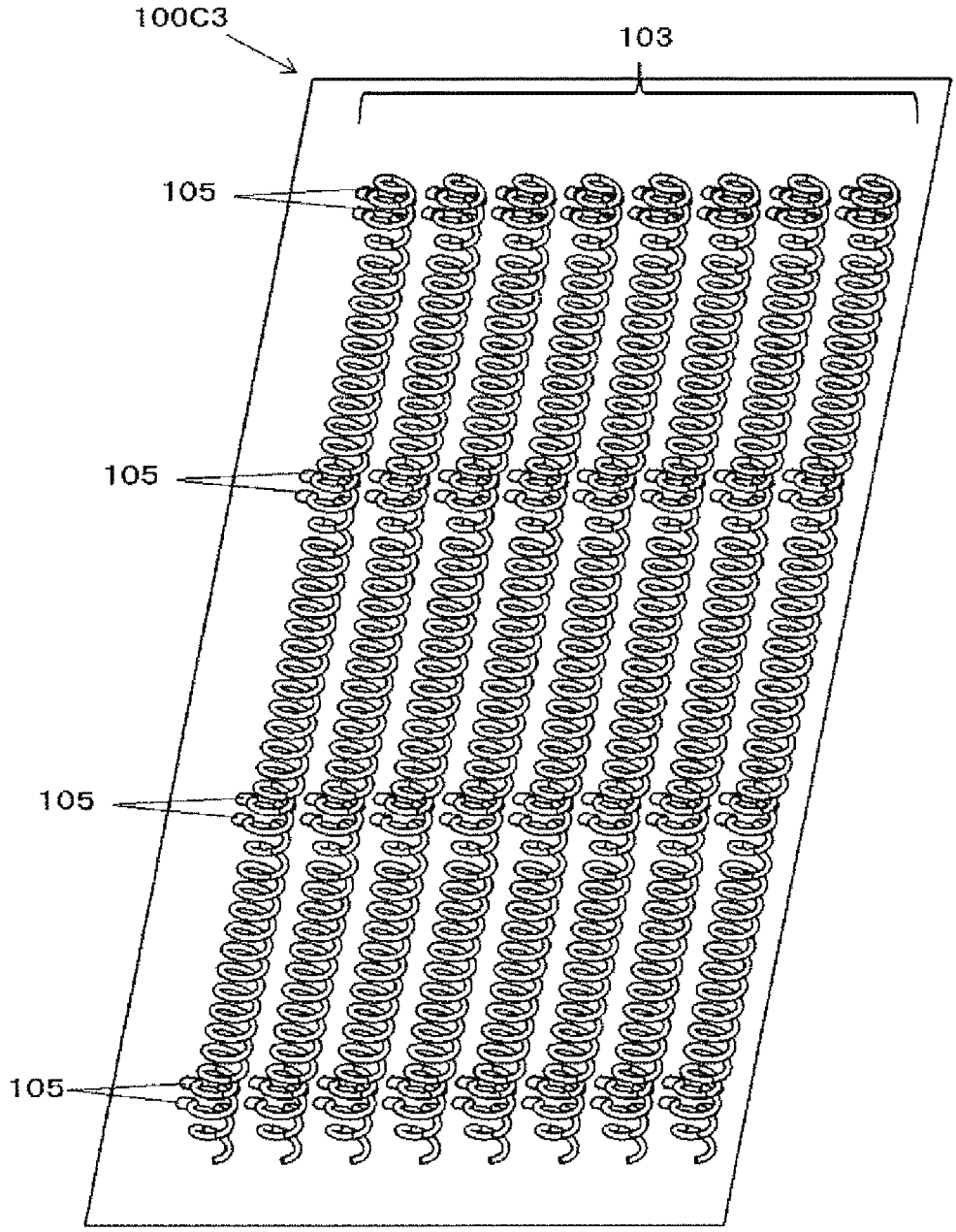
FIG. 78 is a perspective view of the coil holding sheet of another modified embodiment of the third embodiment, to which coils are held.

FIG. 73 is a front view depicting another modified embodiment of the coil holding sheet of the third embodiment. FIGS. 74 to 78 depict the coil holding sheet of another modified embodiment of the third embodiment, to which coils are held. FIG. 74 is a front view of the coil holding sheet of another modified embodiment of the third embodiment, to which coils are held. FIG. 75 is a rear view of the coil holding sheet of another modified embodiment of the third embodiment, to which coils are held. FIG. 76 is a side view of the coil holding sheet of another modified embodiment of the third embodiment, to which coils are held. FIG. 77 is a plan view of the coil holding sheet of another modified embodiment of the third embodiment, to which coils are held. FIG. 78 is a perspective view of the coil holding sheet of another modified embodiment of the third embodiment, to which coils are held.

A coil holding sheet 100C3 of the modified embodiment of the third embodiment has the holders 105 configured to hold the coil 200. The coil holding sheet 100C3 is not provided with the escape holes 102 configured to escape circumferential portions of the coil 200 to the back surface of the coil holding sheet 100C3 (refer to FIG. 60 and the like).

That is, the coil holding sheet 100C3 configures the coil holding row 103 for holding one coil 200 by the holders 105. In order to hold the plurality of coils 200 by one coil holding sheet 100C3, the coil holding sheet 100C3 is formed with the plurality of coil holding rows 103 with predetermined intervals in the direction perpendicular to the axial direction of the coil 200.

The holder 105 has the pair of holding holes 105*a* in which the coil 200 of one turn is to enter, and the slit 105*b* provided between the pair of holding holes 105*a*. The holding hole 105*a* is formed by an opening penetrating the front and back of the coil holding sheet 100C3 and having a shape by which a circumferential portion of the coil 200 can be inserted and pulled out.

The interval $L_8$ in the radial direction of the coil 200 between the outer sides of the pair of holding holes 105*a* is configured to be greater than the outer diameter Ro of the coil 200. Also, the holding hole 105*a* is configured so that the length $L_9$ in the axial direction of the coil 200 is a length within which the coil 200 of one turn in the axial direction is to enter the holding hole.

The slit 105*b* is formed by linearly cutting the front and back of the coil holding sheet 100C3 between the inner side of one holding hole 105*a* and the inner side of the other holding hole 105*a*. The pair of holding holes 105*a* is coupled by the slit 105*b*.

The coil holding sheet 100C3 has the holding pieces 105*c* provided at both sides of the slit 105*b* and protruding in the direction of the slit 105*b* along the axial direction of the coil 200. The holding pieces 105*c* are configured to openably and closably close a space, which may be configured by the holding holes 105*a* and the slit 105*b*, and to detachably hold the coil 200.

The length $L_{10}$ of the slit 105*b* is configured to be smaller than the inner diameter Ri, which is the diameter of the inner periphery of the coil 200. When the coil 200 is attached to the coil holding sheet 100C3, at the holder forming places 103*a*, a part of an area greater than a half of a circumference of the coil 200 protrudes to a front surface side, which is one side of the coil holding sheet 100C3, and a part of an area less than the half of the circumference of the coil 200 protrudes to a back surface side, which is the other side of the coil holding sheet 100C3. At the places where the holders 105 are not provided, the circumferentially entire coil 200 protrudes to the front surface side of the coil holding sheet 100C3.

That is, the coil 200 is held to the coil holding sheet 100C3 with the radial center O of the coil 200 being offset to the front surface side, which is one side with respect to the coil holding sheet 100C3. For this reason, the slit 105*b* has a length tailored to the interval of the inner periphery-side of the coil 200 at a position at which the coil 200 is held by the coil holding sheet 100C3.

The coil holding sheet 100C3 has the holder forming places 103*a*, at which the holders 105 are formed, at a plurality of places of the coil holding row 103 along the axial direction of the coil 200. In this modified embodiment, the holder forming places 103*a* are formed at four places spaced with predetermined intervals along the axial direction of the coil 200.

Also, the coil holding sheet 100C3 has at least one holder 105 provided at each of the holder forming places 103*a*. In this modified embodiment, two sets of the holders 105 are provided at each of the holder forming places 103*a* in conformity to the pitch P of the coil 200.

The coil holding sheet 100C3 is not provided with an opening penetrating the front and back thereof between the holder forming places 103*a*, and is formed with coil support parts 103*c* configured to surface-support the outer peripheries of the coils 200.

Figure 79:
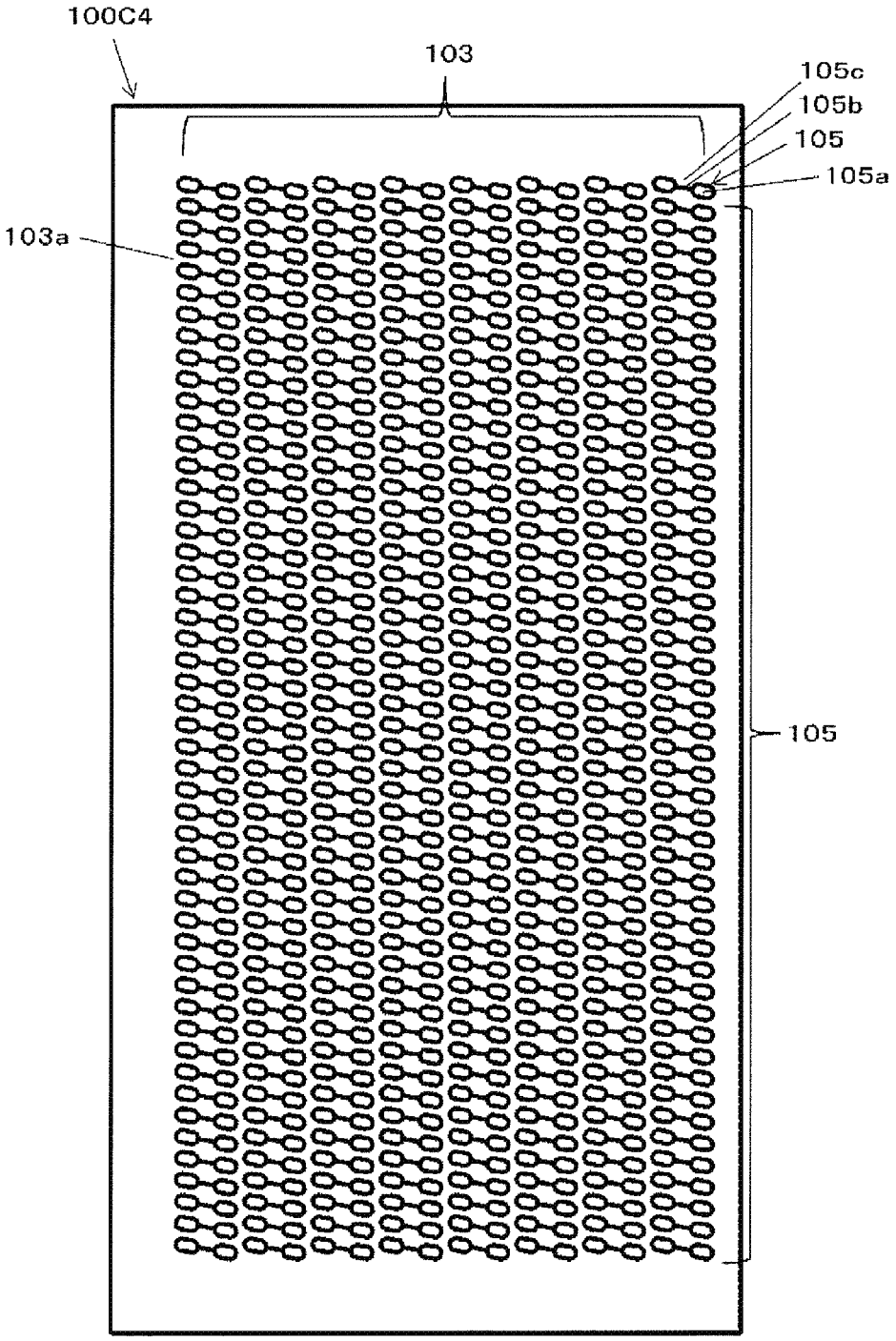
FIG. 79 is a front view of the coil holding sheet of another modified embodiment of the third embodiment, to which coils are held.
Figure 80:
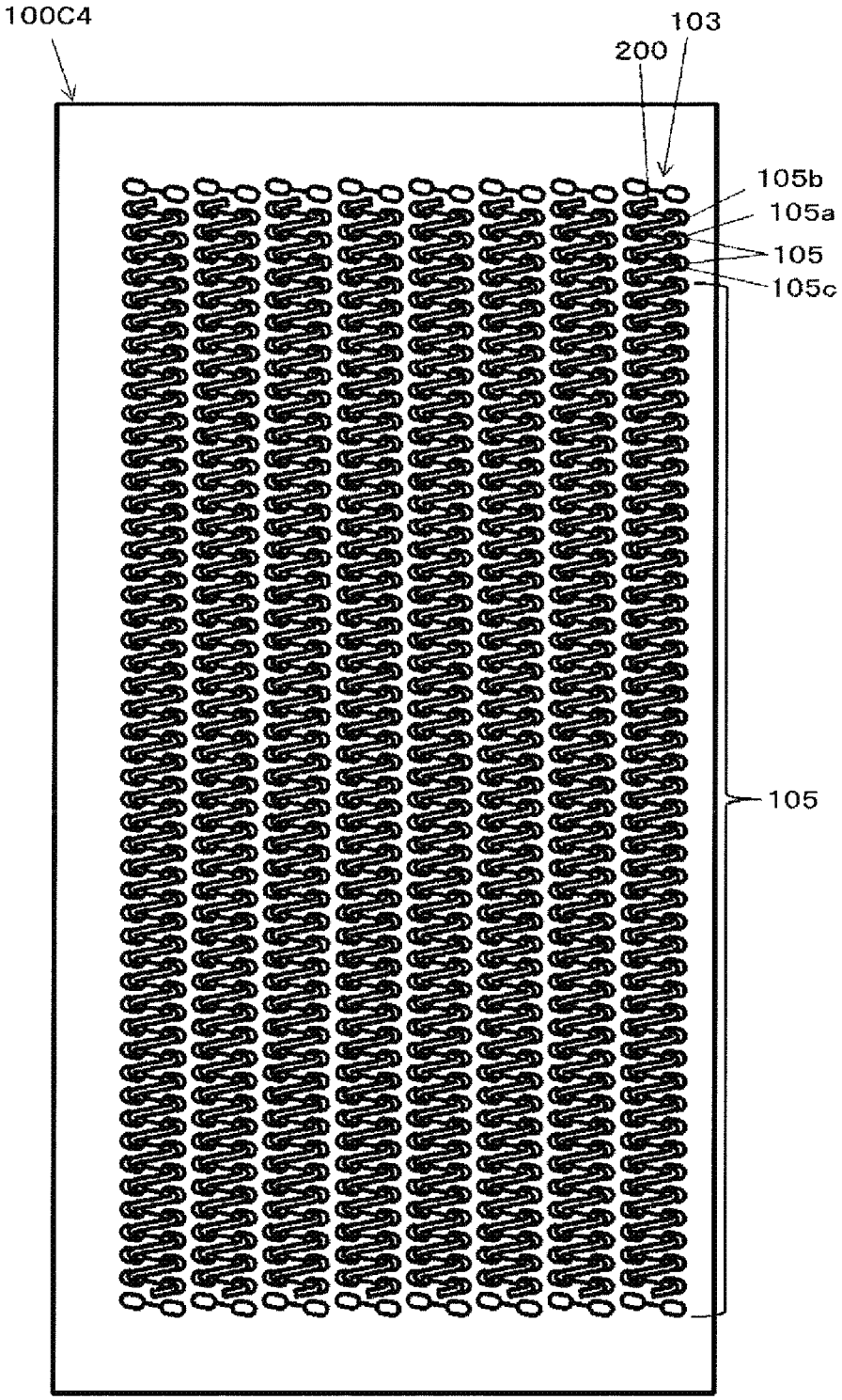
FIG. 80 is a front view of the coil holding sheet of another modified embodiment of the third embodiment, to which coils are held.
Figure 81:
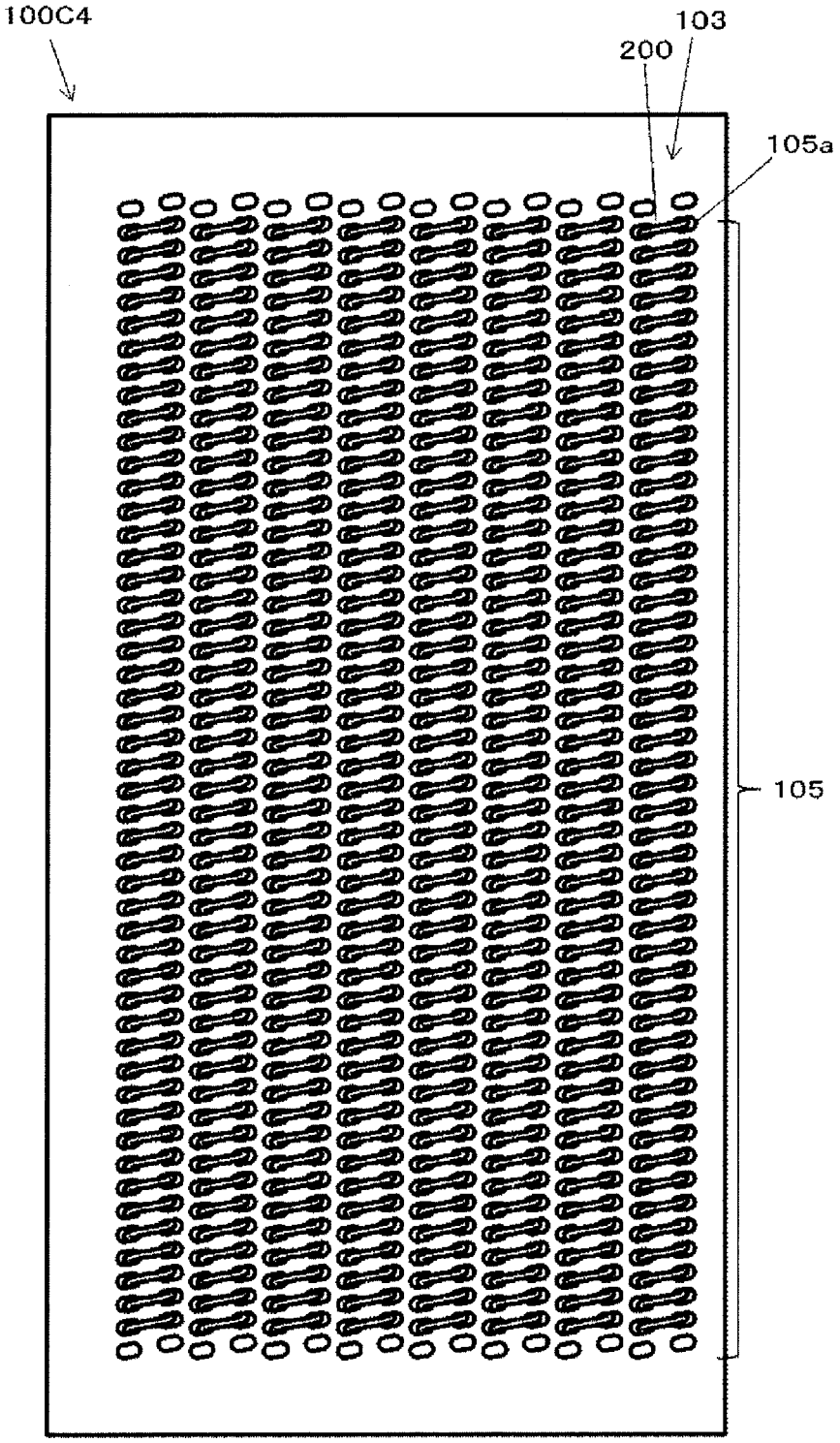
FIG. 81 is a rear view of the coil holding sheet of another modified embodiment of the third embodiment, to which coils are held.
Figure 82:
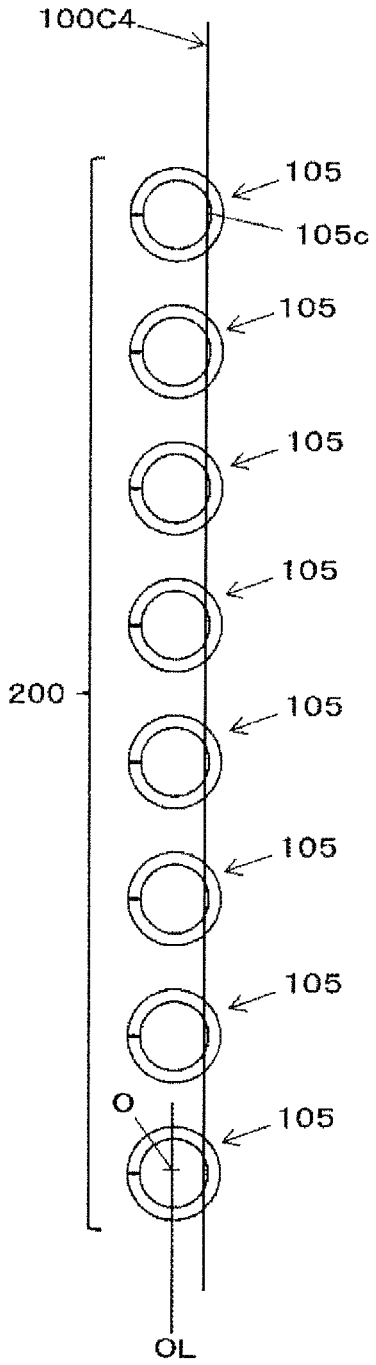
FIG. 82 is a side view of the coil holding sheet of another modified embodiment of the third embodiment, to which coils are held.
Figure 83:
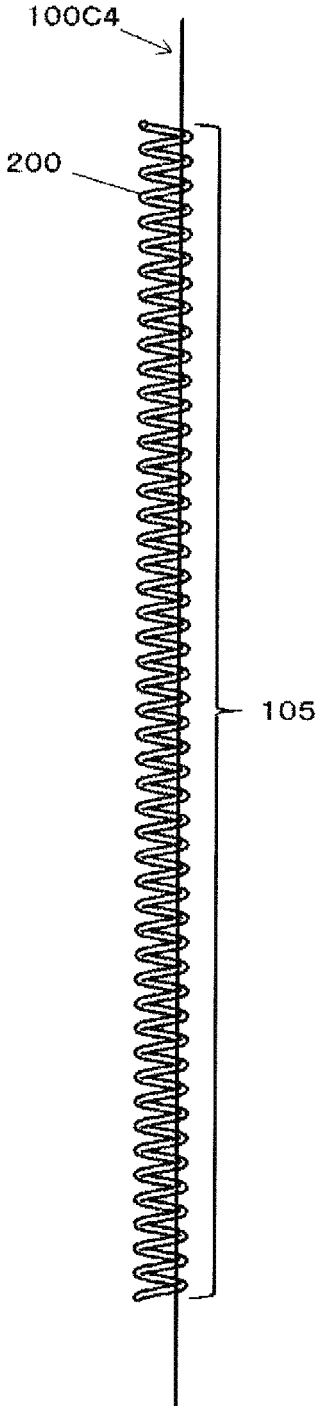
FIG. 83 is a plan view of the coil holding sheet of another modified embodiment of the third embodiment, to which coils are held.
Figure 84:
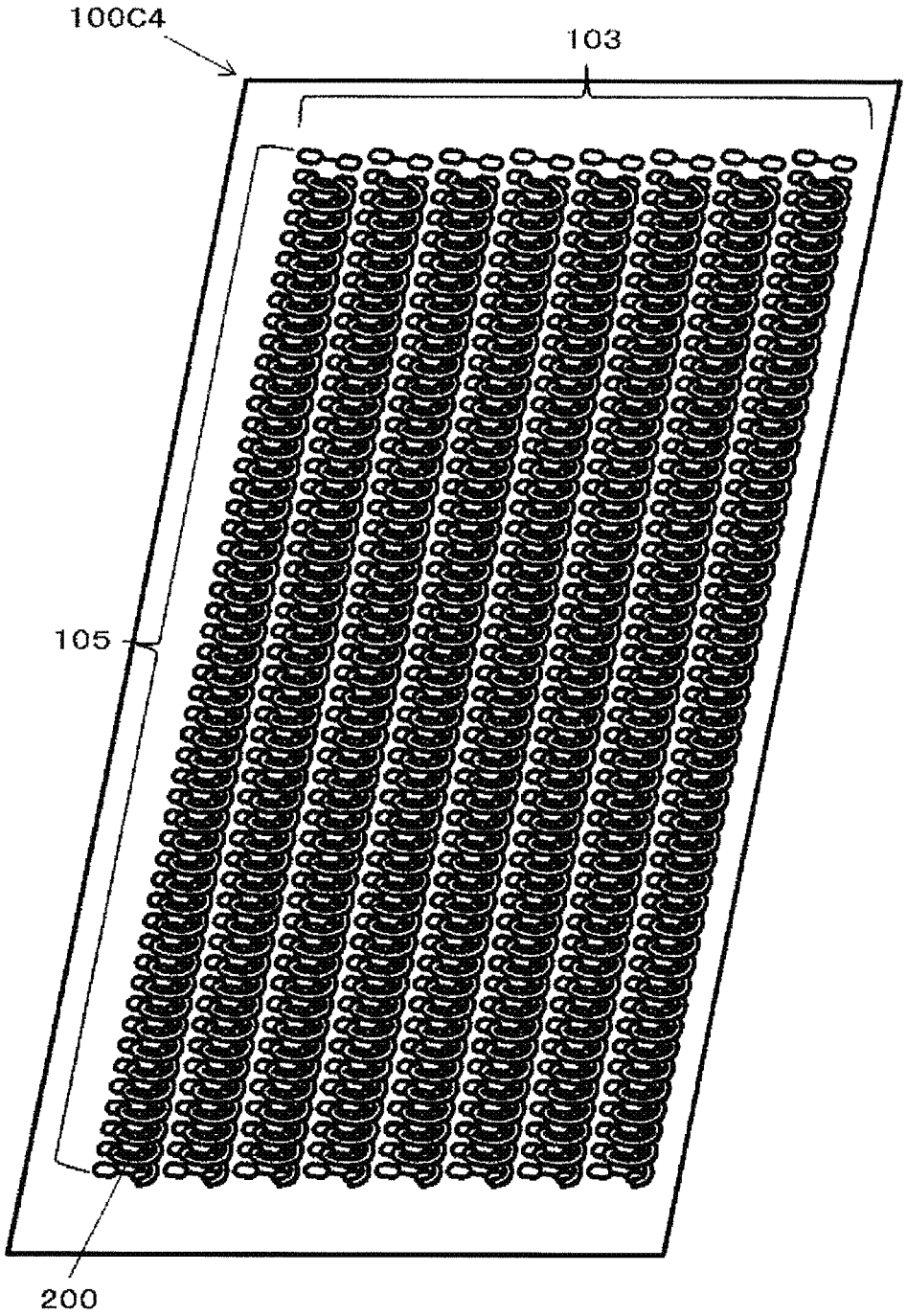
FIG. 84 is a perspective view of the coil holding sheet of another modified embodiment of the third embodiment, to which coils are held.

FIG. 79 is a front view of the coil holding sheet of another modified embodiment of the third embodiment, to which coils are held. FIGS. 80 to 84 depict the coil holding sheet of another modified embodiment of the third embodiment, to which coils are held. FIG. 80 is a front view of the coil holding sheet of another modified embodiment of the third embodiment, to which coils are held. FIG. 81 is a rear view of the coil holding sheet of another modified embodiment of the third embodiment, to which coils are held. FIG. 82 is a side view of the coil holding sheet of another modified embodiment of the third embodiment, to which coils are held. FIG. 83 is a plan view of the coil holding sheet of another modified embodiment of the third embodiment, to which coils are held. FIG. 84 is a perspective view of the coil holding sheet of another modified embodiment of the third embodiment, to which coils are held.

A coil holding sheet 100C4 of the modified embodiment of the third embodiment has the holders 105 configured to hold the coil 200. The coil holding sheet 100C4 is not provided with the escape holes 102 configured to escape circumferential portions of the coil 200 to the back surface of the coil holding sheet 100A (refer to FIG. 60 and the like). The coil holding sheet 100C4 has the holders 105 of which the number is equal to or larger than the number of turns of the coil 200, in conformity to the pitch P of the coil 200.

That is, the coil holding sheet 100C4 configures the coil holding row 103 for holding one coil 200 by the holders 105. In order to hold the plurality of coils 200 by one coil holding sheet 100C4, the coil holding sheet 100C4 is formed with the plurality of coil holding rows 103 with predetermined intervals in the direction perpendicular to the axial direction of the coil 200.

The holder 105 has the pair of holding holes 105*a* in which the coil 200 of one turn is to enter, and the slit 105*b* provided between the pair of holding holes 105*a*. The holding hole 105*a* is formed by an opening penetrating the front and back of the coil holding sheet 100C4 and having a shape by which a circumferential portion of the coil 200 can be inserted and pulled out.

The interval $L_8$ in the radial direction of the coil 200 between the outer sides of the pair of holding holes 105*a* is configured to be greater than the outer diameter Ro of the coil 200. Also, the holding hole 105*a* is configured so that the length $L_9$ in the axial direction of the coil 200 is a length within which the coil 200 of one turn in the axial direction is to enter the holding hole.

The slit 105*b* is formed by linearly cutting the front and back of the coil holding sheet 100C4 between the inner side of one holding hole 105*a* and the inner side of the other holding hole 105*a*. The pair of holding holes 105*a* is coupled by the slit 105*b*.

The coil holding sheet 100C4 has the holding pieces 105*c* provided at both sides of the slit 105*b* and protruding in the direction of the slit 105*b* along the axial direction of the coil 200. The holding pieces 105*c* are configured to openably and closably close a space, which may be configured by the holding holes 105*a* and the slit 105*b*, and to detachably hold the coil 200.

The length $L_{10}$ of the slit 105*b* is configured to be smaller than the inner diameter Ri, which is the diameter of the inner periphery of the coil 200. When the coil 200 is attached to the coil holding sheet 100C4, a part of an area greater than a half of a circumference of the coil 200 protrudes to a front surface side, which is one side of the coil holding sheet 100C4, and a part of an area less than the half of the circumference of the coil 200 protrudes to a back surface side, which is the other side of the coil holding sheet 100C4.

That is, the coil 200 is held to the coil holding sheet 100C4 with the radial center O of the coil 200 being offset to the front surface side, which is one side with respect to the coil holding sheet 100C4. For this reason, the slit 105*b* has a length tailored to the interval of the inner periphery-side of the coil 200 at a position at which the coil 200 is held by the coil holding sheet 100C4.

The coil holding sheet 100C4 has the holders 104 of which the number is equal to or larger than the number of turns of the coil 200 in each of the coil holding rows 103, in conformity to the pitch P of the coil 200. For this reason, each of the coil holding rows 103 becomes the holder forming place 103*a*, as a whole.

Examples of Operational Effect of Coil Holding Sheet of Third Embodiment

The coil holding sheet 100C holds the coil 200 one by one in each of the coil holding rows 103. At the holder forming place 103*a*, the circumferential portion of the coil 200 enters the back surface side of the coil holding sheet 100C beyond the slit 105*b* and the holding pieces 105*c*.

The coil holding sheet 100C2, 100C3, 100C4 also holds the coil 200 one by one in each of the coil holding rows 103, like the coil holding sheet 100C. At the holder forming place 103*a*, the circumferential portion of the coil 200 enters the back surface side of the coil holding sheet 100C2, 100C3, 100C4 beyond the slit 105*b* and the holding pieces 105*c*.

Thereby, the holding pieces 105*c* of the holder 105 enter the inner periphery side of the coil 200. The slit 105*b* does not form an interval through which the coil 200 can pass, unless an external force capable of separating the coil 200 from the coil holding sheet 100C, 100C2, 100C3, 100C4 is applied. Therefore, it is possible to avoid the coil 200 from separating from the holder 105 by the holding pieces 105*c*, when an unintended external force is applied to the coil 200.

Also, the two or more sets of the holders 105 are provided at each holder forming place 103*a*, in conformity to the pitch P of the coil 200, so that even when the coil 200 separates from the holder 105 of one place, the coil 200 can be held at the other adjacent holder 105.

In the case of the coil holding sheet 100C, 100C2 having the escape holes 102 formed therein, when the coil 200 is held in the coil holding row 103, the circumferential portion of the coil 200 enters the escape hole 102 at the portion at which the escape hole 102 is formed. In the escape hole 102, the coil 200 cannot enter the escape hole 102 to the position at which the radial center O of the coil 200 becomes flush with the coil holding sheet 100C, 100C2.

Therefore, the coil 200 is held to the coil holding sheet 100C, 100C2 in the state where the coil is offset with respect to the coil holding 100C, 100C2 sheet so that the protrusion height to the front surface side is greater than the protrusion height to the back surface side.

Also, in the case of the coil holding sheet 100C3 having no escape hole 102, the coil support part 103*c* configured to surface-support the outer periphery of the coil 200 is formed between the holder forming places 103*a*.

Thereby, the coil 200 held to the coil holding sheet 100C3 is offset with respect to the coil holding sheet 100C3 at the holder forming place 103*a* so that the protrusion height to the front surface side is greater than the protrusion height to the back surface side by a shape of the holder 105 such as lengths of the slit 105*b* and the holding piece 105*c*, and the like. Also, the circumferentially entire coil 200 held to the coil holding sheet 100C3 protrudes to the front surface side of the coil holding sheet 100B3 at the formation place of the coil support part 103*c* and is offset to the front surface side of the coil holding sheet 100C3.

Also, in the case of the coil holding sheet 100C4 with no escape hole 102 and having the holders 105 formed therein in conformity to the number of turns of the coil 200, the coil 200 is held to the coil holding sheet 100C4 in the state where the coil is offset with respect to the coil holding sheet 100C4 so that the protrusion height to the front surface side is greater than the protrusion height to the back surface side by a shape of the holder 105 such as lengths of the slit 105*b* and the holding piece 105*c*, and the like.

In the state where the coil 200 is held to the coil holding sheet 100C, 100B2 having the escape holes 102 formed therein, even when the coil holding sheet 100C, 100C2 is seen from the back surface side, it is possible to easily check that the coil 200 is held, because the portions of the coil 200 are exposed to the escape holes 102. In particular, as shown in FIG. 63, the length $L_4$ of the escape hole 102 is configured as the length within which the coil 200 of multiple turns in the axial turns can enter therein, so that the visibility is improved.

In the meantime, when an opening area of each escape hole 102 is made small, like the coil holding sheet 100C2, it is possible to increase the number of the coupling portions 103*b*, so that it is possible to improve the strength against the bending of the coil holding sheet 100C2.

However, if the length $L_4$ of the escape hole 102 is set to a length within which the coil 200 of one turn is to enter the escape hole, the opening area of the escape hole 102 is decreased, so that the operability upon the manufacturing of the coil holding sheet 100C2 is lowered, as compared to a case where the opening area is large. For this reason, the length $L_4$ of the escape hole 102 is preferably configured as a length within which the coil 200 of multiple turns in the axial direction can enter the escape hole.

When detaching the coil 200 from the coil holding sheet 100C, a force of moving the coil 200 in a direction of separating from the coil holding sheet 100C is applied to the coil 200 from the front surface side of the coil holding sheet 100C, such as relative movement of the coil 200 and the coil holding sheet 100C in a direction along the coil holding sheet 100C.

When the force is applied in the direction of separating the coil 200 from the coil holding sheet 100C, the holding pieces 105*c* are pressed and deformed by the coil 200, and the width of the slit 105*b* is widened, so that the coil 200 is separated from the slit 105*b*. Thereby, the coil 200 is detached from the coil holding sheet 100C.

Also in a case of detaching the coil 200 from the coil holding sheet 100C2, 100C3, 100C4, like the coil holding sheet 100C, a force of moving the coil 200 in a direction of separating from the coil holding sheet 100C2, 100C3, 100C4 is applied to the coil 200 from the front surface side of the coil holding sheet 100C2, 100C3, 100C4, such as relative movement of the coil 200 and the coil holding sheet 100C2, 100C3, 100C4 in a direction along the coil holding sheet 100C2, 100C3, 100C4.

When the force is applied in the direction of separating the coil 200 from the coil holding sheet 100C2, 100C3, 100C4, the holding pieces 105*c* are pressed and deformed by the coil 200, and the width of the slit 105*b* is widened, so that the coil 200 is separated from the slit 105*b*. Thereby, the coil 200 is detached from the coil holding sheet 100C2, 100C3, 100C4.

As described above, the coil 200 is held to the coil holding sheet 100C, 100C2, 100C3, 100C4 in the state where the coil is offset with respect to the coil holding sheet 100C, 100C2, 100C3, 100C4 so that the protrusion height to the front surface side is greater than the protrusion height to the back surface side. Thereby, it is possible to securely apply the force for detaching the coil 200 from the coil holding sheet 100C, 100C2, 100C3, 100C4, from the front surface side of the coil holding sheet 100C, 100C2, 100C3, 100C4.

Also, when attaching the coil 200 to the coil holding sheet 100C, 100C2, 100C3, 100C4, the position of the coil 200 is aligned to the coil holding row 103 and the force is applied in a direction of pressing the coil 200 to the coil holding sheet 100C, 100C2, 100C3, 100C4.

Thereby, the holding pieces 105*c* are pressed and deformed by the coil 200, and the width of the slit 105*b* is widened, so that the coil 200 passes through the slit 105*b*. Therefore, the circumferential portion of the coil 200 enters the back surface side of the coil holding sheet 100C, 100C2, 100C3, 100C4.

Therefore, the coil 200 of the portion having entered the back surface side of the coil holding sheet 100C, 100C2, 100C3, 100C4 is pressed by the holding pieces 105*c*, so that the coil 200 is attached to the coil holding sheet 100C, 100C2, 100C3, 100C4.

Like this, during the operation of attaching the coil 200 to the coil holding sheet 100C, 100C2, 100C3, 100C4, it is not necessary to perform an operation of deforming a predetermined part of the coil holding sheet 100C, 100C2, 100C3, 100C4 in advance. Therefore, it is possible to easily attach and use the coil 200 of a single body to the coil holding sheet 100C, 100C2, 100C3, 100C4.

In the case of the coil holding sheet 100C, since the escape hole 102 has the length corresponding to the multiple turns of the coil 200, the punch chad is large, so that it is possible to reduce the number of generation of the punch chad in the manufacturing process of the escape holes 102.

Also, in the case of the coil holding sheets 100C3, 100C4, it is not necessary to form the escape holes in the manufacturing process of the coil holding sheets 100C3, 100C4, so that the operability is improved. Also, in the case of the coil holding sheet 100C and the coil holding sheet 100C2, the combination is made by increasing and decreasing the number of the holders 105 and the escape holes 102, so that it is possible to easily adjust the holding force of the coil 200 in the coil holding sheet 100C and the coil holding sheet 100C2. Also, in the case of the coil holding sheet 100C3, the combination is made by increasing and decreasing the number of the holders 105 and the areas of the coil support parts 103*c*, so that it is possible to easily adjust the holding force of the coil 200 in the coil holding sheet 100C3.

Configuration Example of Coil Holding Sheet of Fourth Embodiment

Figure 85:
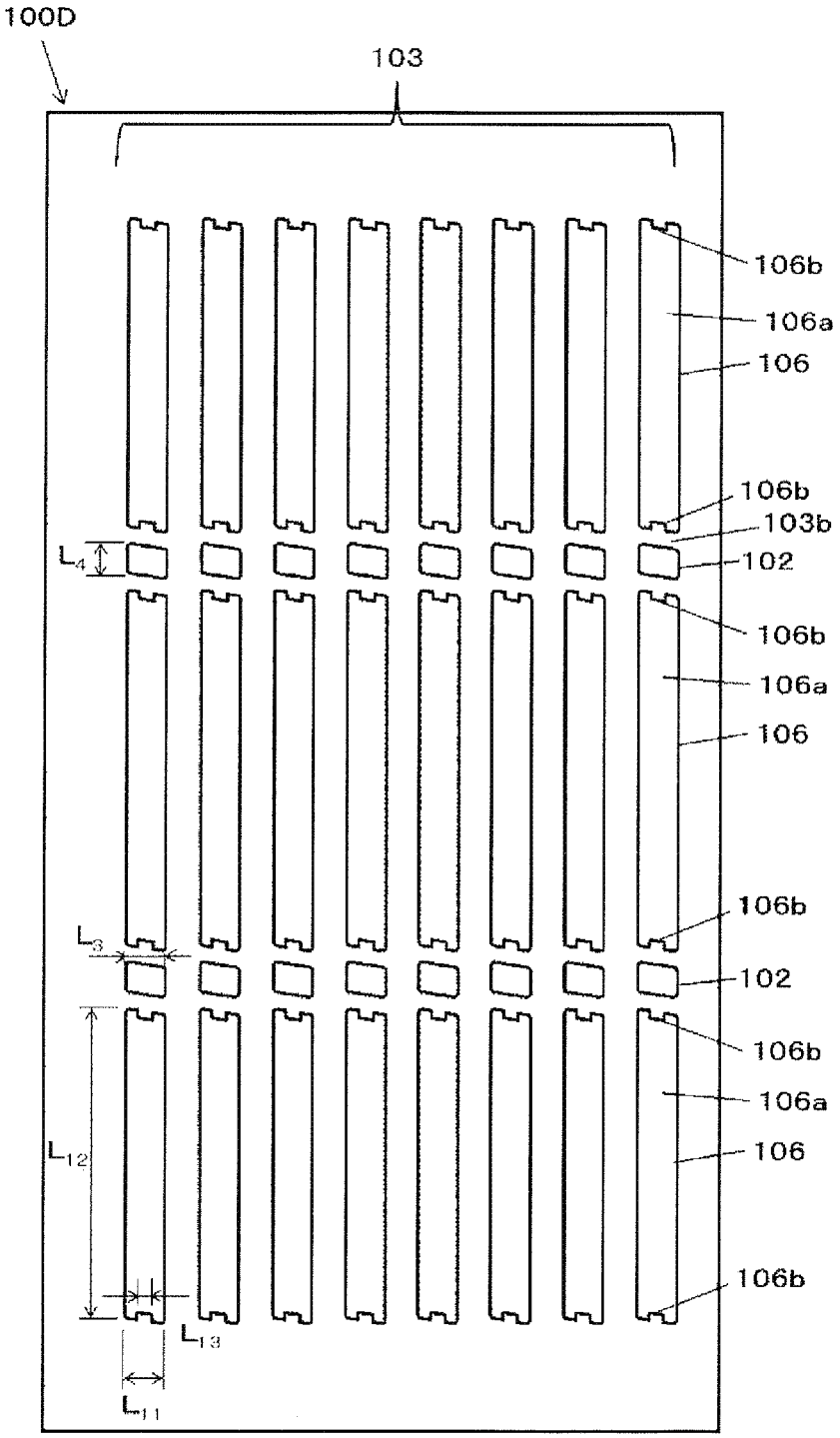
FIG. 85 is a front view depicting an example of the coil holding sheet of a fourth embodiment.
Figure 86:
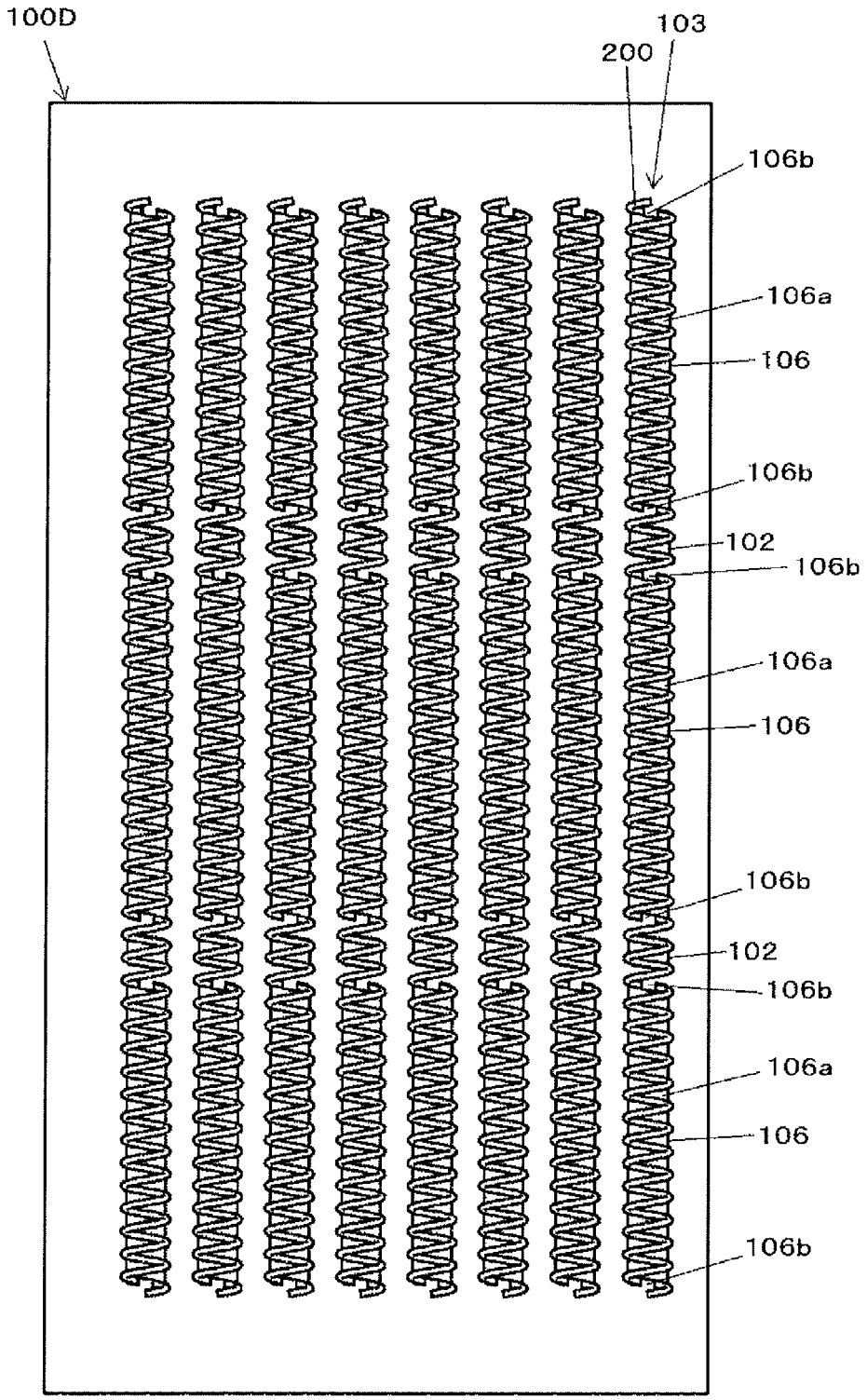
FIG. 86 is a front view of the coil holding sheet of the fourth embodiment, to which coils are held.
Figure 87:
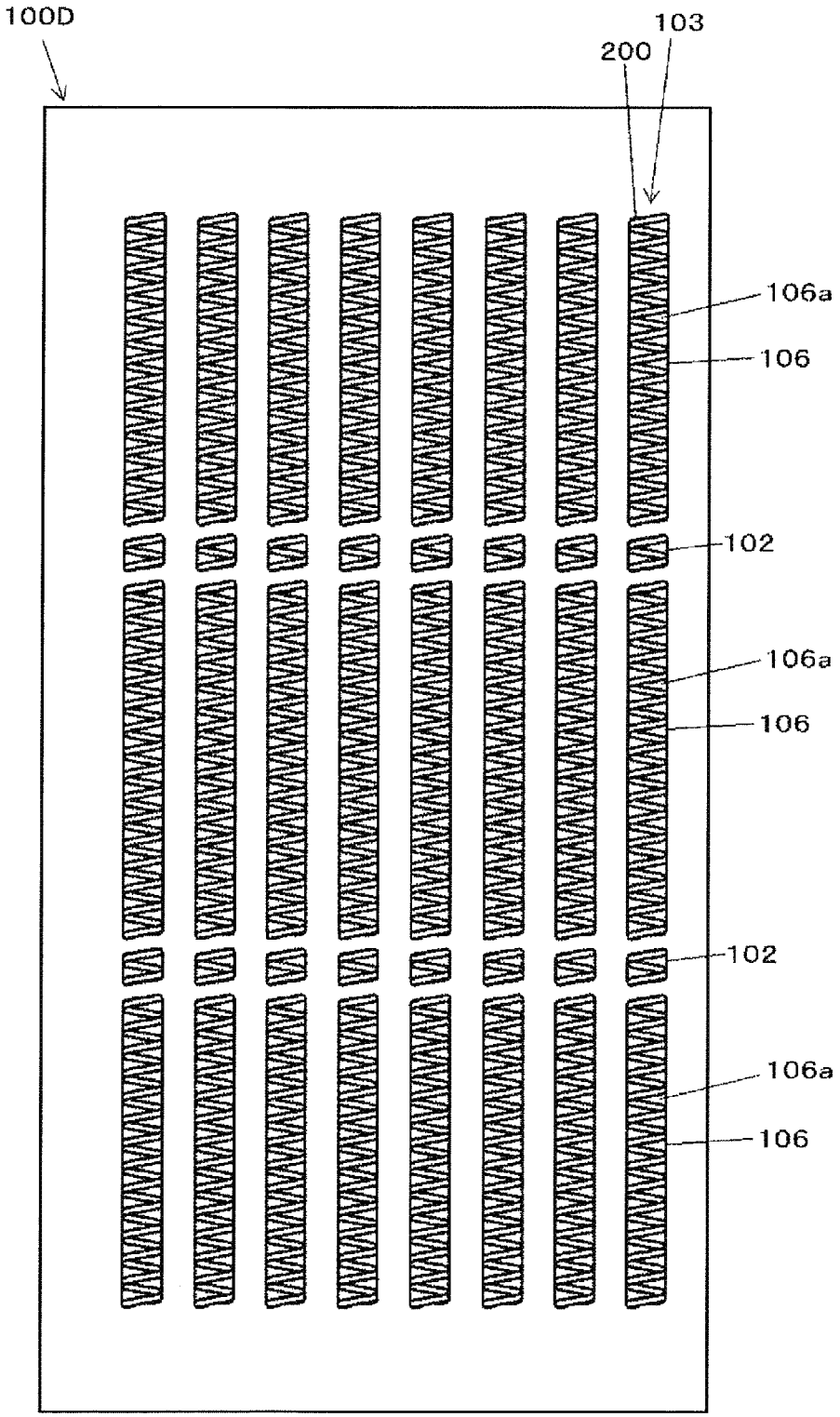
FIG. 87 is a rear view of the coil holding sheet of the fourth embodiment, to which coils are held.
Figure 88:
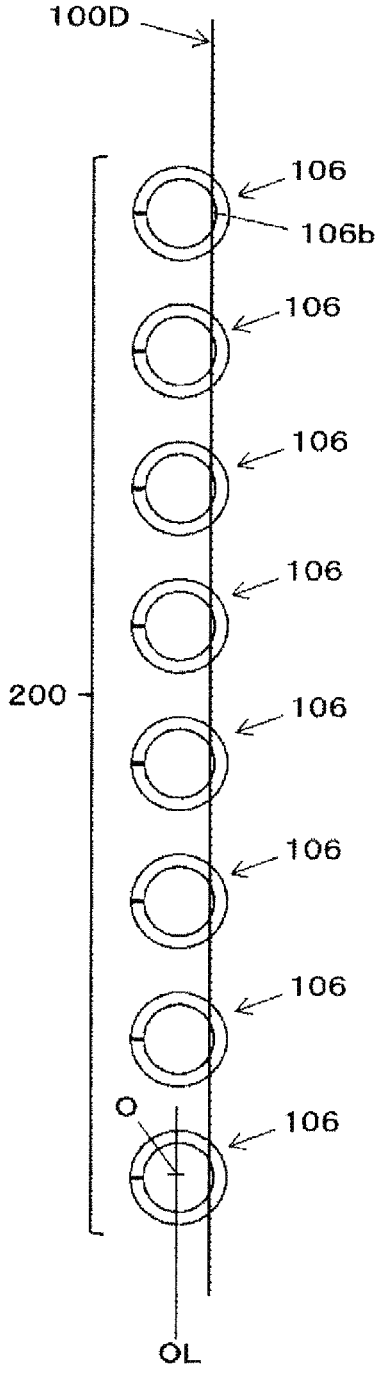
FIG. 88 is a side view of the coil holding sheet of the fourth embodiment, to which coils are held.
Figure 89:
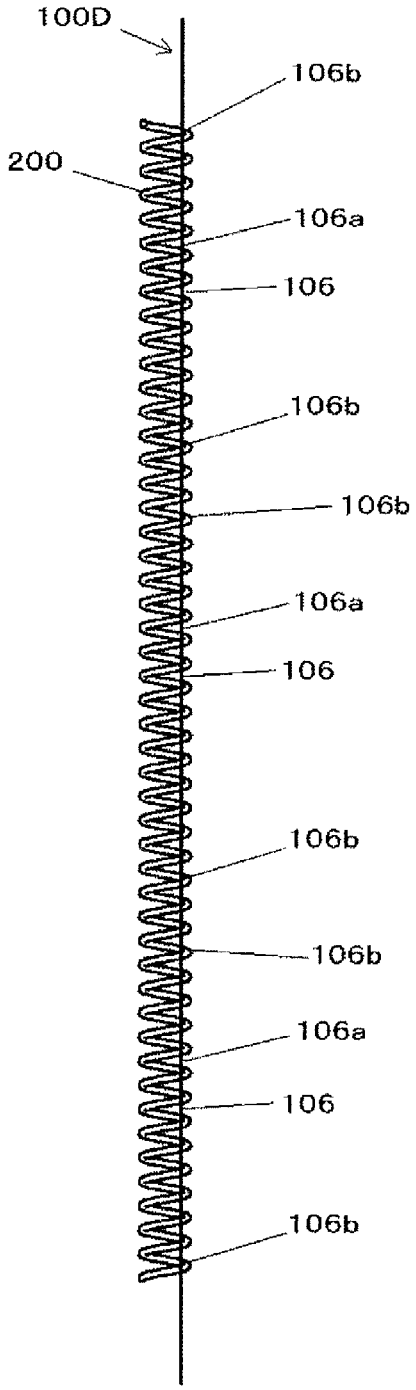
FIG. 89 is a plan view of the coil holding sheet of the fourth embodiment, to which coils are held.
Figure 90:
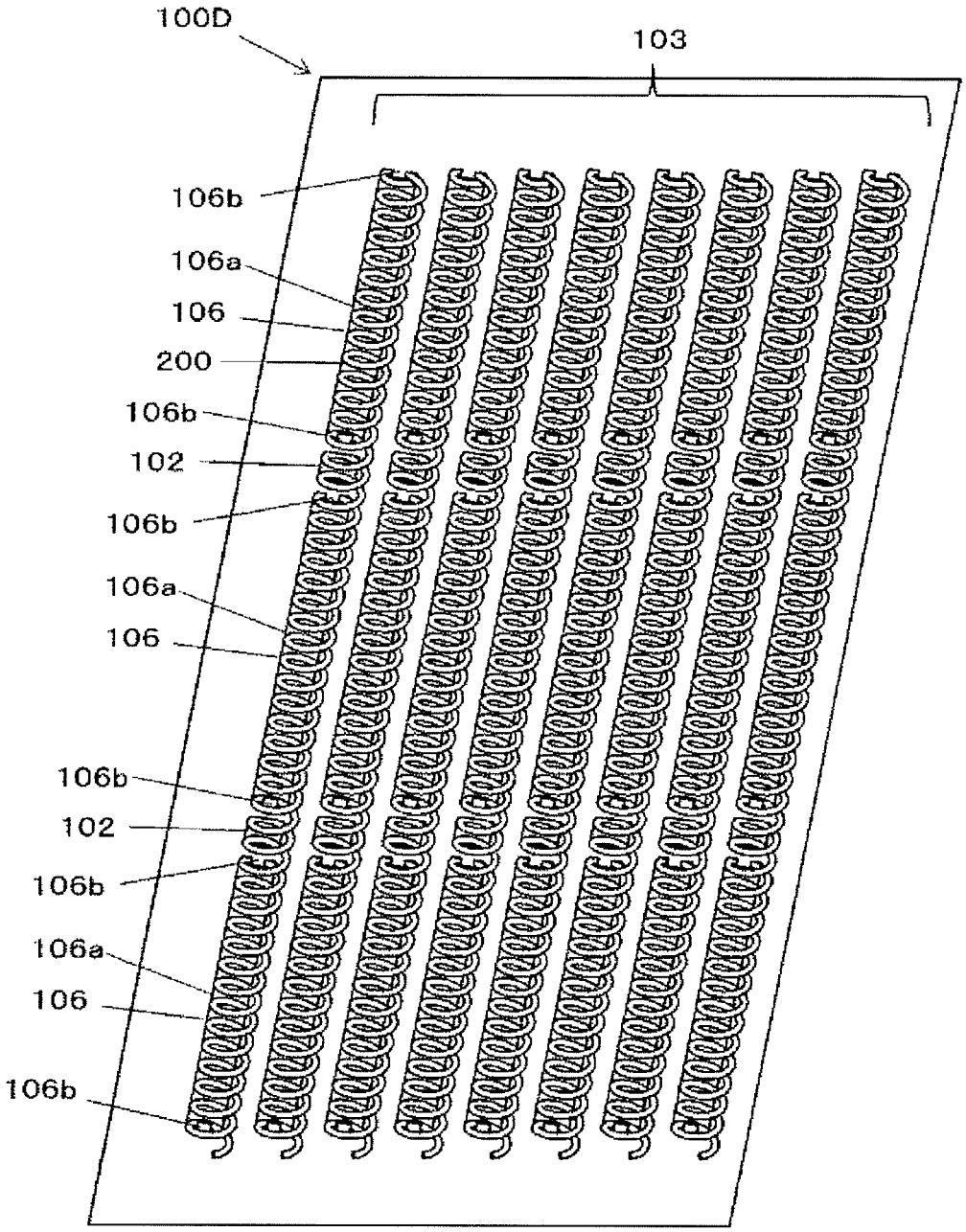
FIG. 90 is a perspective view of the coil holding sheet of the fourth embodiment, to which coils are held.

FIG. 85 is a front view depicting an example of the coil holding sheet of a fourth embodiment. FIGS. 86 to 90 depict the coil holding sheet of the fourth embodiment, to which coils are held. FIG. 86 is a front view of the coil holding sheet of the fourth embodiment, to which coils are held. FIG. 87 is a rear view of the coil holding sheet of the fourth embodiment, to which coils are held. FIG. 88 is a side view of the coil holding sheet of the fourth embodiment, to which coils are held. FIG. 89 is a plan view of the coil holding sheet of the fourth embodiment, to which coils are held. FIG. 90 is a perspective view of the coil holding sheet of the fourth embodiment, to which coils are held.

A coil holding sheet 100D of the fourth embodiment has holders 106 configured to hold the coil 200, and the escape holes 102 configured to escape circumferential portions of the coil 200 from a front surface, which is one surface of the coil holding sheet 100D, to a back surface, which is the other surface. Here, the escape hole 102 has the same configuration as the coil holding sheet 100A of the first embodiment or the coil holding sheet 100A1 of the modified embodiment of the first embodiment.

The coil holding sheet 100D configures the coil holding row 103 for holding one coil 200 by a combination of the holders 106 and the escape holes 102. In order to hold a plurality of coils 200 by one coil holding sheet 100D, the coil holding sheet 100D is formed with a plurality of coil holding rows 103 with predetermined intervals in the direction perpendicular to the axial direction of the coil 200.

The holder 106 has a holding hole 106*a* in which the coil 200 of multiple turns is to enter, and holding pieces 106*b* configured to hold the coil 200 inserted in the holding hole 106*a*. The holding hole 104*a* is formed by an opening penetrating the front and back of the coil holding sheet 100D and having a shape by which a circumferential portion of the coil 200 can be inserted and pulled out.

The holding hole 106*a* is configured so that a length $L_{11}$ in the radial direction of the coil 200 is smaller than the outer diameter Ro of the coil 200. Thereby, the coil 200 cannot enter the holding hole 106*a* to a position at which the radial center O becomes flush with the coil holding sheet 100D. Also, the holding hole 106*a* is configured so that a length $L_{12}$ in the axial direction of the coil 200 is a length within which the coil 200 of multiple turns in the axial direction can enter the holding hole.

The holding pieces 106*b* protrude in the axial direction of the coil 200 from one side and other side of the holding hole 106*a* in the axial direction of the coil 200. The holding pieces 106*b* are configured to openably and closably close a part of a space, which is configured by the holding hole 106*a*, and to detachably hold the coil 200.

A length $L_{13}$ of the holding piece 106*b* in the radial direction of the coil 200 is configured to be smaller than the inner diameter Ri, which is the diameter of the inner periphery of the coil 200. When the coil 200 is attached to the coil holding sheet 100D, a part of an area greater than a half of a circumference of the coil 200 protrudes to a front surface side, which is one side of the coil holding sheet 100D, and a part of an area less than the half of the circumference of the coil 200 protrudes to a back surface side, which is the other side of the coil holding sheet 100D.

That is, the coil 200 is held to the coil holding sheet 100D with the radial center O of the coil 200 being offset to the front surface side, which is one side with respect to the coil holding sheet 100D. For this reason, the holding piece 106*b* has a length tailored to the interval of the inner periphery-side of the coil 200 at a position at which the coil 200 is held by the coil holding sheet 100D.

The escape hole 102 is configured by an opening penetrating the front and back of the coil holding sheet 100D and having a shape by which a circumferential portion of the coil 200 can be inserted and pulled out. The escape holes 102 are provided in parallel with the holding holes 106*a* along the axial direction of the coil 200 held to the coil holding sheet 100D by the holding holes 106*a*.

The escape hole 102 is configured so that the length $L_3$ in the radial direction of the coil 200 is smaller than the outer diameter Ro of the coil 200. Thereby, the coil 200 cannot enter the escape hole 102 to a position at which the radial center O becomes flush with the coil holding sheet 100D.

Therefore, the coil 200 is held to the coil holding sheet 100D in a state where the coil is offset with respect to the coil holding sheet 100D so that a protrusion height to the front surface side is greater than a protrusion height to the back surface side. An offset amount is determined with the length $L_{11}$ of the holding hole 106*a* in the radial direction of the coil 200 and the length $L_3$ of the escape hole 102 in the radial direction of the coil 200.

The escape hole 102 is configured so that the length $L_4$ in the axial direction of the coil 200 is a length within which the coil 200 of two or more turns in the axial direction is to enter the escape hole. In the fourth embodiment, the escape hole is configured to have a length within which the coil 200 of two turns is to enter the escape hole.

The coil holding row 103 is provided with the coupling portions 103*b* each of which is formed between the escape hole 102 and the holding hole 106*a* arranged in parallel in the axial direction of the coil 200.

Examples of Operational Effect of Coil Holding Sheet of Fourth Embodiment

The coil holding sheet 100D holds the coil 200 one by one in each of the coil holding rows 103. In the holder 106, the circumferential portion of the coil 200 enters the back surface side of the coil holding sheet 100D beyond the holding pieces 106*b*.

Thereby, the holding pieces 106*b* of the holder 106 enter the inner periphery side of the coil 200. Therefore, it is possible to avoid the coil 200 from separating from the holder 106 by the holding pieces 106*b*, when an unintended external force is applied to the coil 200.

Also, when the coil 200 is held in the coil holding row 103, the coil 200 cannot enter the holding hole 106*a* and the escape hole 102 to the position at which the radial center O of the coil 200 becomes flush with the coil holding sheet 100D.

Therefore, the coil 200 is held to the coil holding sheet 100D in the state where the coil is offset with respect to the coil holding 100D sheet so that the protrusion height to the front surface side is greater than the protrusion height to the back surface side.

Also, in the state where the coil 200 is held to the coil holding sheet 100D, even when the coil holding sheet 100D is seen from the back surface side, it is possible to easily check that the coil 200 is held, because the portions of the coil 200 are exposed to the escape holes 102. The length $L_4$ of the escape hole 102 is configured as the length within which the coil 200 of multiple turns in the axial turns can enter therein, so that the visibility is improved.

Also, the holding hole 106*a* of the holder 106 is configured to function as an escape hole, so that it is possible to escape a circumferential portion of the coil 200 to the back surface side of the coil holding sheet 100D and to check that the coil 200 is held, from the back surface side of the coil holding sheet 100D.

When detaching the coil 200 from the coil holding sheet 100D, a force of moving the coil 200 in a direction of separating from the coil holding sheet 100D is applied to the coil 200 from the front surface side of the coil holding sheet 100D, such as relative movement of the coil 200 and the coil holding sheet 100D in a direction along the coil holding sheet 100D.

When the force is applied in the direction of separating the coil 200 from the coil holding sheet 100D, the holding pieces 106*b* are pressed and deformed by the coil 200, so that the coil 200 is separated from the holding hole 106*a*. Thereby, the coil 200 is detached from the coil holding sheet 100D. In the meantime, since the holding hole 106*a* is configured so that the coil 200 of multiple turns is to enter therein, the coil 200 can be separated from the holding hole 106*a* beyond the holding pieces 106*b* by elastic deformation of the coil 200, too.

As described above, the coil 200 is held to the coil holding sheet 100D in the state where the coil is offset with respect to the coil holding sheet 100D so that the protrusion height to the front surface side is greater than the protrusion height to the back surface side. Thereby, it is possible to securely apply the force for detaching the coil 200 from the coil holding sheet 100D, from the front surface side of the coil holding sheet 100D.

Also, when attaching the coil 200 to the coil holding sheet 100D, the position of the coil 200 is aligned to the coil holding row 103 and the force is applied in a direction of pressing the coil 200 to the coil holding sheet 100D.

Thereby, the holding pieces 106*b* are pressed and deformed by the coil 200, so that the coil 200 passes through the holding hole 106*a* beyond the holding pieces 106*b*. Therefore, the circumferential portion of the coil 200 enters the back surface side of the coil holding sheet 100D.

Therefore, the coil 200 of the portion having entered the back surface side of the coil holding sheet 100D is pressed by the holding pieces 106*b*, so that the coil 200 and is attached to the coil holding sheet 100D.

Like this, during the operation of attaching the coil 200 to the coil holding sheet 100D, it is not necessary to perform an operation of deforming a predetermined part of the coil holding sheet 100D in advance. Therefore, it is possible to easily attach and use the coil 200 of a single body to the coil holding sheet 100D. Also, in the case of the coil holding sheet 100D, the combination is made by increasing and decreasing the number of the holders 106 and the escape holes 102, so that it is possible to easily adjust the holding force of the coil 200 in the coil holding sheet 100D. Also, it is possible to easily adjust the holding force of the coil 200 in the coil holding sheet 100D by increasing and decreasing the length $L_{12}$ of the holding hole 106*a* of the holder 106 in the axial direction of the coil 200 and increasing and decreasing the number of the holders 106.

Configuration Example of Coil Holding Sheet of Fifth Embodiment

Figure 91:
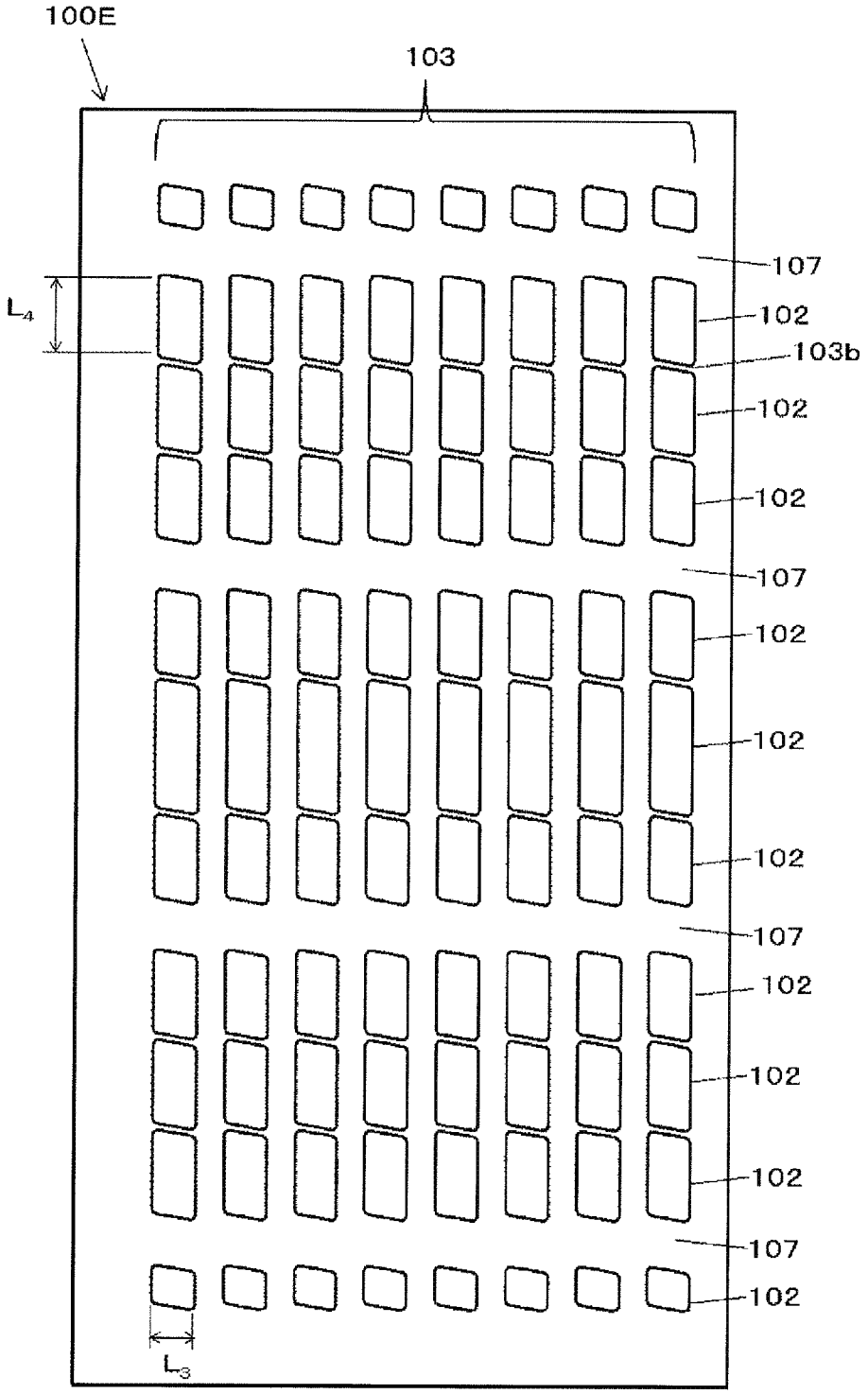
FIG. 91 is a front view depicting an example of the coil holding sheet of a fifth embodiment.
Figure 92:
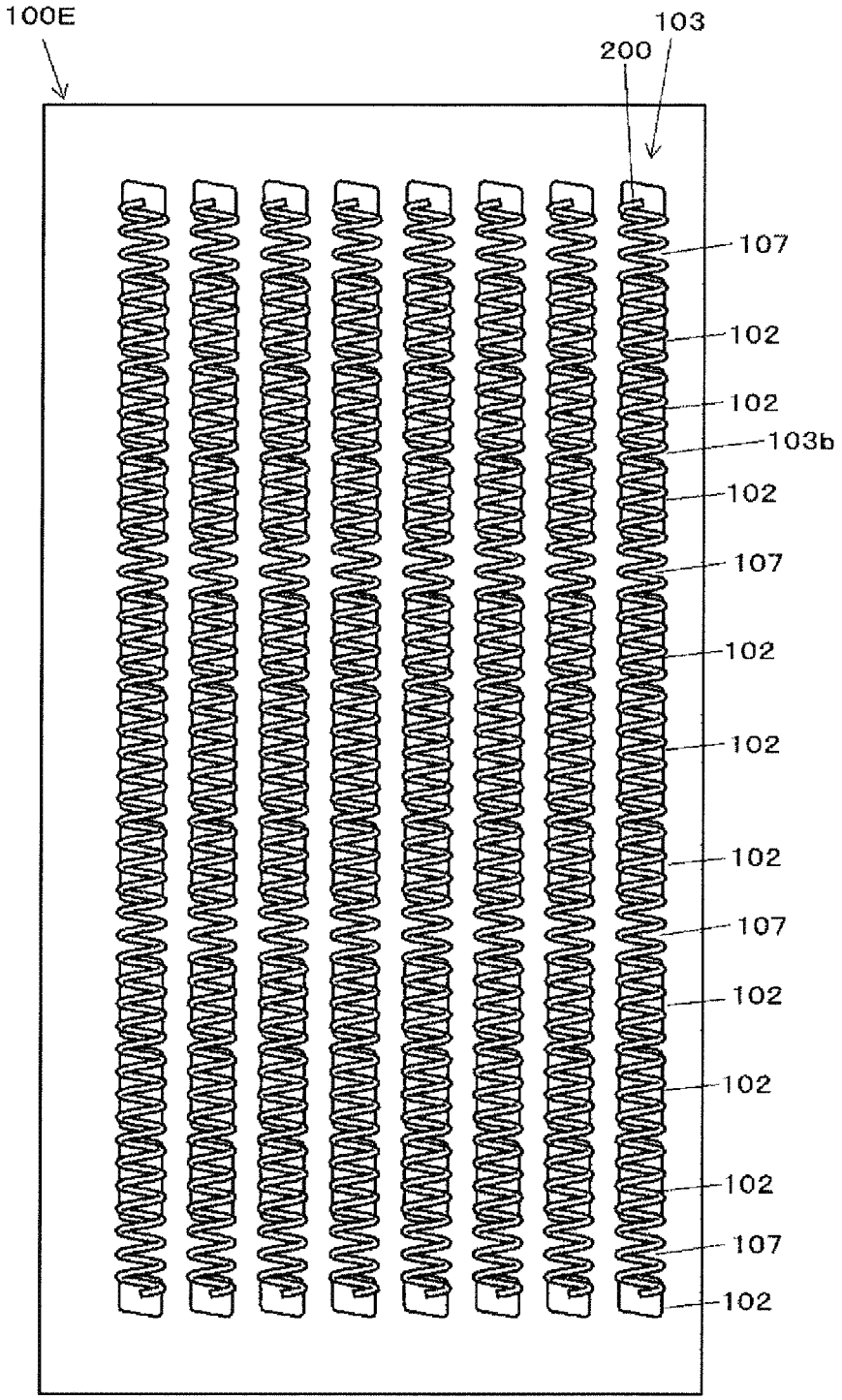
FIG. 92 is a front view of the coil holding sheet of the fifth embodiment, to which coils are held.
Figure 93:
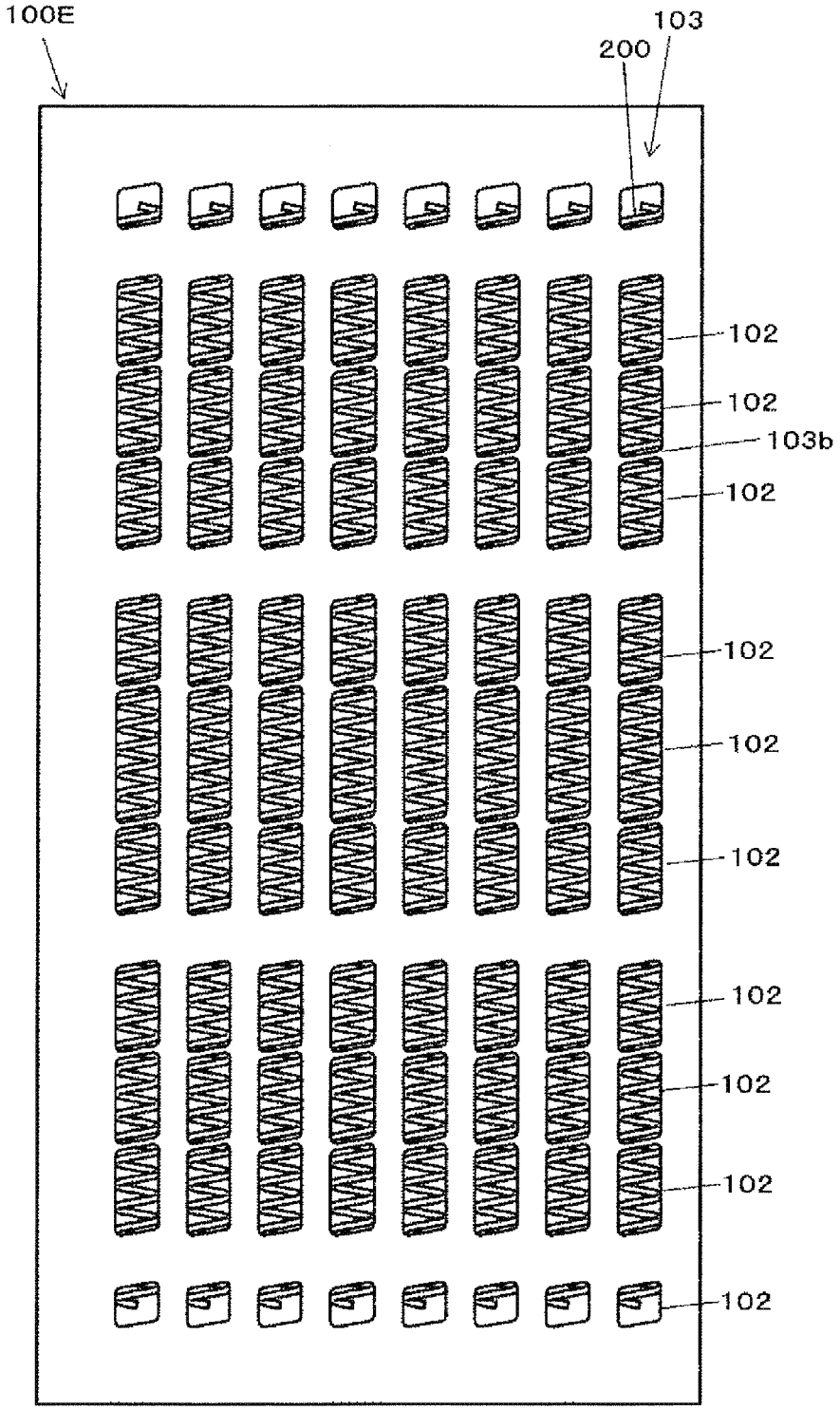
FIG. 93 is a rear view of the coil holding sheet of the fifth embodiment, to which coils are held.
Figure 94:
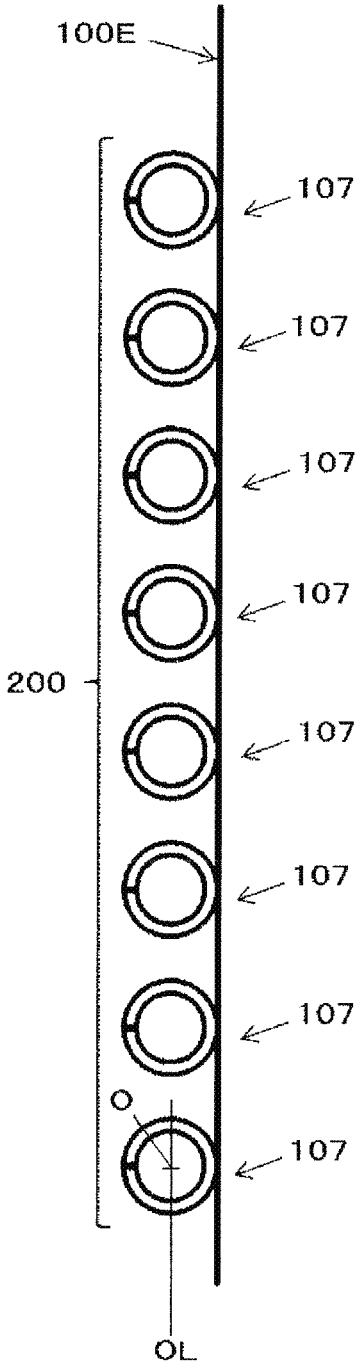
FIG. 94 is a side view of the coil holding sheet of the fifth embodiment, to which coils are held.
Figure 95:
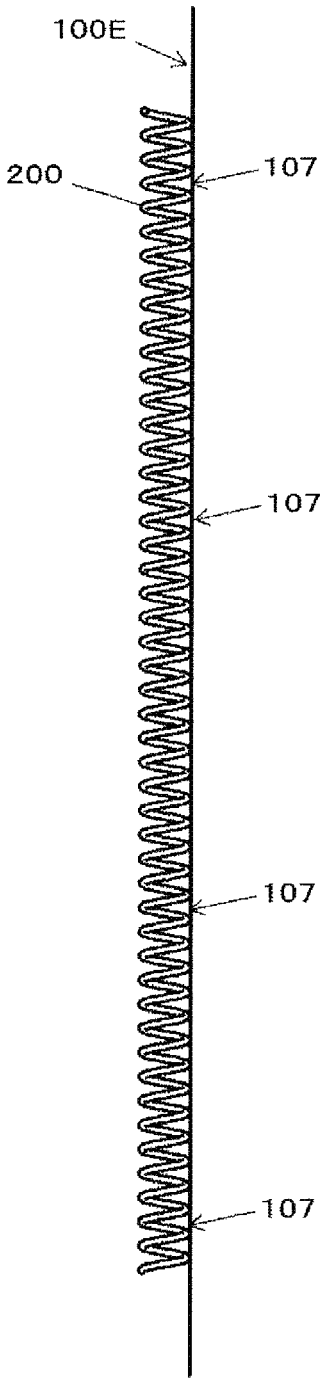
FIG. 95 is a plan view of the coil holding sheet of the fifth embodiment, to which coils are held.
Figure 96:
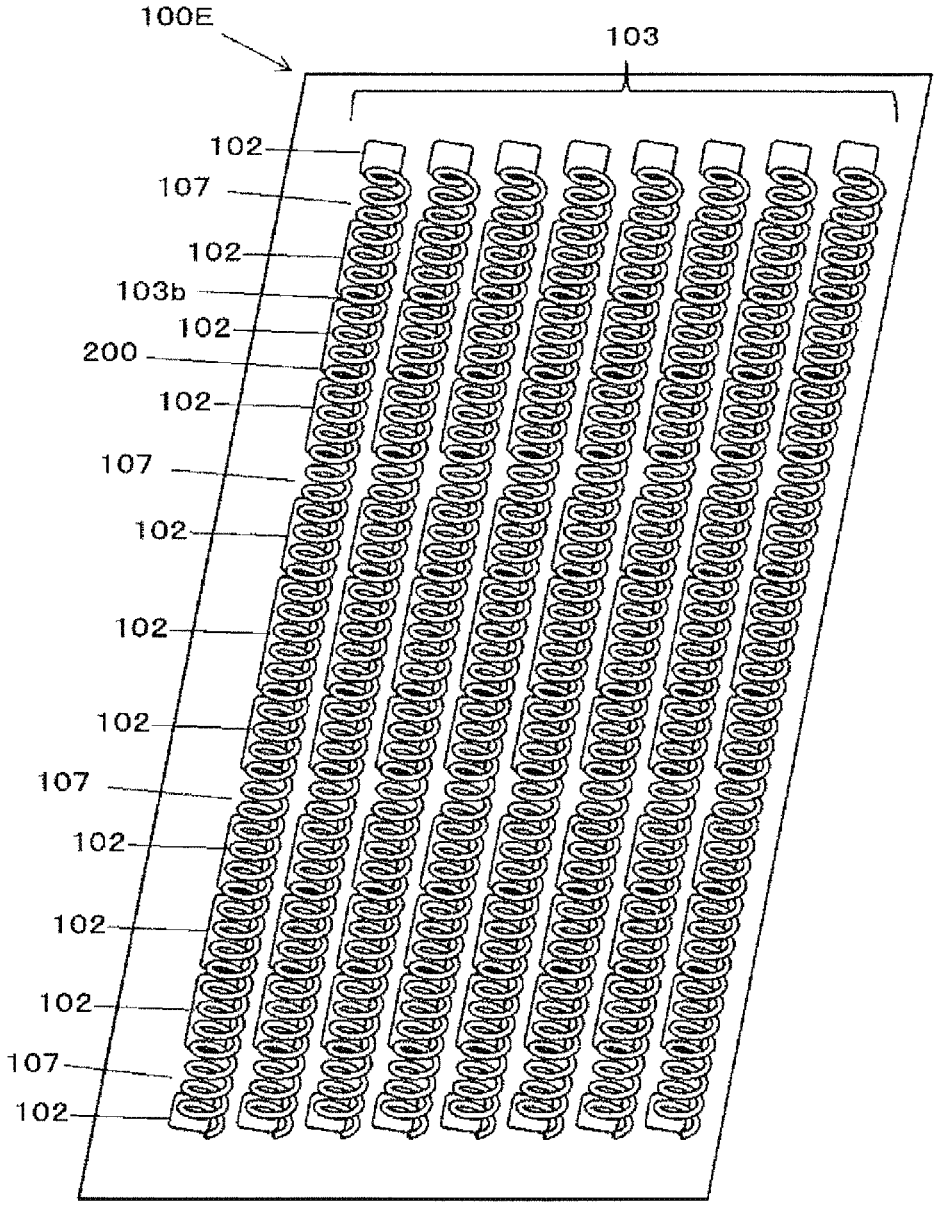
FIG. 96 is a perspective view of the coil holding sheet of the fifth embodiment, to which coils are held.

FIG. 91 is a front view depicting an example of the coil holding sheet of a fifth embodiment. FIGS. 92 to 96 depict the coil holding sheet of the fifth embodiment, to which coils are held. FIG. 92 is a front view of the coil holding sheet of the fifth embodiment, to which coils are held. FIG. 93 is a rear view of the coil holding sheet of the fifth embodiment, to which coils are held. FIG. 94 is a side view of the coil holding sheet of the fifth embodiment, to which coils are held. FIG. 95 is a plan view of the coil holding sheet of the fifth embodiment, to which coils are held. FIG. 96 is a perspective view of the coil holding sheet of the fifth embodiment, to which coils are held.

A coil holding sheet 100E of the fifth embodiment has holders 107 configured to hold the coil 200, and the escape holes 102 configured to escape circumferential portions of the coil 200 from a front surface, which is one surface of the coil holding sheet 100E, to a back surface, which is the other surface.

The coil holding sheet 100E configures the coil holding row 103 for holding one coil 200 by a combination of the holders 107 and the escape holes 102. In order to hold a plurality of coils 200 by one coil holding sheet 100E, the coil holding sheet 100E is formed with a plurality of coil holding rows 103 with predetermined intervals in the direction perpendicular to the axial direction of the coil 200.

The holder 107 is configured as a planar surface to which an outer peripheral surface of the coil 200 is to be bonded by an adhesive, a both-sided adhesive tape or the like. The coil holding sheet 100E is formed with the holders 107 at a plurality of places of the coil holding row 103 along the axial direction of the coil 200. In the fifth embodiment, the holders 107 are formed at four places spaced with predetermined intervals along the axial direction of the coil 200.

The escape hole 102 is configured by an opening penetrating the front and back of the coil holding sheet 100E. The escape holes 102 are provided in parallel with the holders 107 along the axial direction of the coil 200 held to the coil holding sheet 100E by the holders 107.

The escape hole 102 is configured so that the length $L_3$ in the radial direction of the coil 200 is smaller than the outer diameter Ro of the coil 200. Alternatively, the length $L_3$ of the escape hole 102 may be equal to or greater than the outer diameter Ro of the coil 200.

The escape hole 102 is configured so that the length $L_4$ in the axial direction of the coil 200 is a length within which the coil 200 of two or more turns in the axial direction is to enter the escape hole. In the fifth embodiment, the escape hole 102 having a length within which the coil 200 of two turns is to enter the escape hole, the escape hole 102 having a length within which the coil 200 of four turns is to enter the escape hole, and the escape hole 102 having a length within which the coil 200 of six turns is to enter the escape hole are provided in correspondence to the number of turns of the coil 200.

The coil holding row 103 is provided with the coupling portions 103*b* each of which is formed between the escape holes 102 arranged in parallel in the axial direction of the coil 200 and is configured to couple one side and other side of the escape holes 102 in the radial direction therebetween.

Examples of Operational Effect of Coil Holding Sheet of Fifth Embodiment

The coil holding sheet 100E holds the coil 200 one by one in each of the coil holding rows 103. The outer peripheral surface of the coil 200 is bonded to the holder 107 by an adhesive, a both-sided adhesive tape or the like.

Therefore, the coil 200 is held to the coil holding sheet 100E in the state where the circumferentially entire coil protrudes to the front surface side of the coil holding sheet 100E and is offset to the front surface side of the coil holding sheet 100E.

In the state where the coil 200 is held to the coil holding sheet 100E, even when the coil holding sheet 100E is seen from the back surface side, it is possible to easily check that the coil 200 is held, because the portions of the coil 200 are exposed to the escape holes 102. Particularly, the length $L_4$ of the escape hole 102 is configured as the length within which the coil 200 of multiple turns in the axial turns can enter therein, so that the visibility is improved.

When detaching the coil 200 from the coil holding sheet 100E, a force of moving the coil 200 in a direction of separating from the coil holding sheet 100E is applied to the coil 200 from the front surface side of the coil holding sheet 100E, such as relative movement of the coil 200 and the coil holding sheet 100E in a direction along the coil holding sheet 100E.

When the force is applied in the direction of separating the coil 200 from the coil holding sheet 100E, the portions of the coil 200 bonded to the coil holding sheet 100E are peeled off from the holders 107, so that the coil 200 is detached from the coil holding sheet 100E.

As described above, the coil 200 is held to the coil holding sheet 100E in the state where the circumferentially entire coil protrudes to the front surface side of the coil holding sheet 100E and is offset to the front surface side of the coil holding sheet 100E. Thereby, it is possible to securely apply the force for detaching the coil 200 from the coil holding sheet 100E, from the front surface side of the coil holding sheet 100E.

In the case of the coil holding sheet 100E, it is not necessary to form the holes in the holders during the process of manufacturing the coil holding sheet 100E, so that the operability is improved. Also, in the case of the coil holding sheet 100E, it is possible to easily adjust the holding force of the coil 200 in the coil holding sheet 100E by increasing and decreasing the areas and number of the holders 107 and increasing and decreasing the number of the escape holes 102 and the length $L_4$ of the escape hole 102 in the axial direction of the coil 200.

Configuration Example of Coil Holding Sheet of Sixth Embodiment

Figure 97:
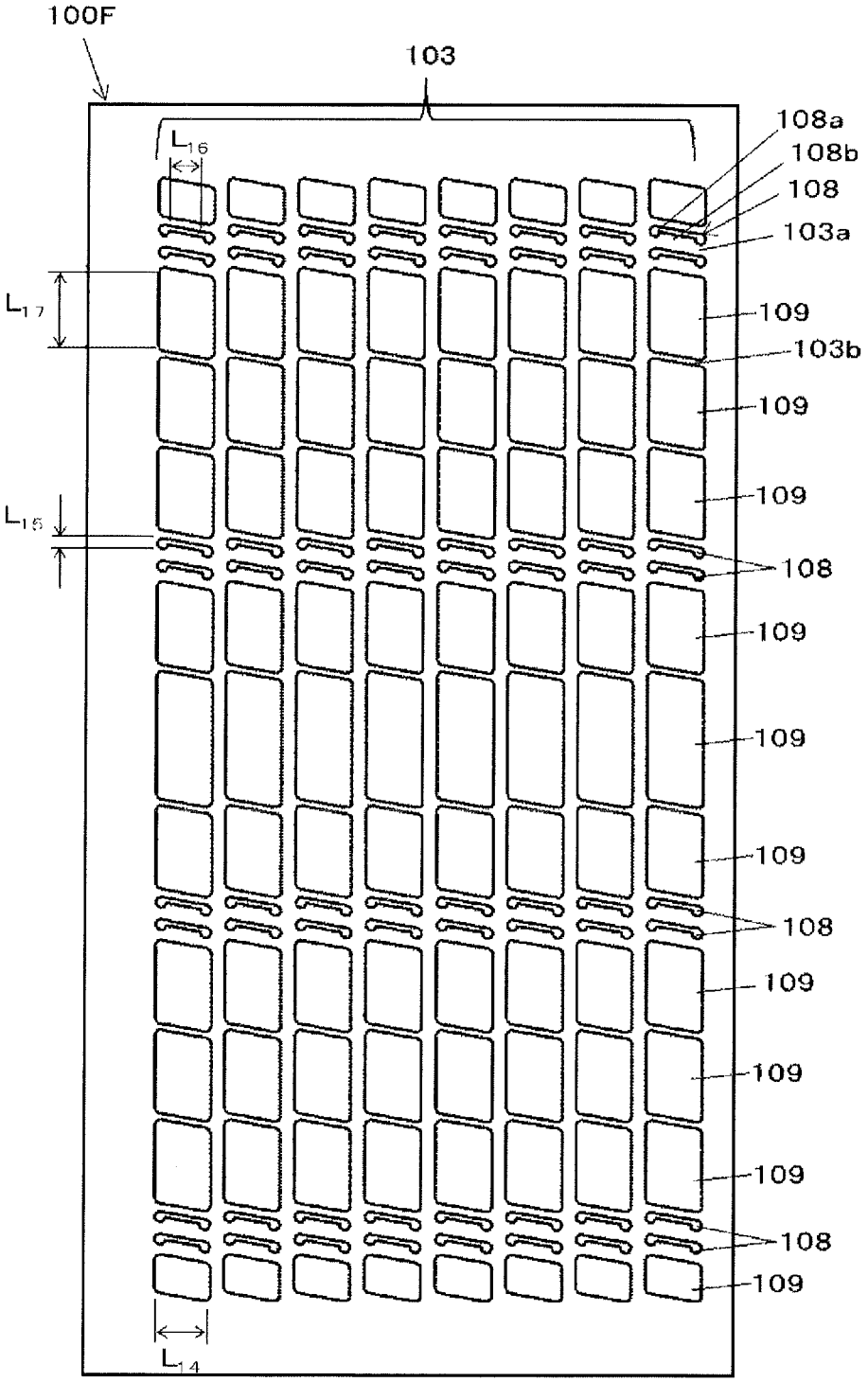
FIG. 97 is a front view depicting an example of the coil holding sheet of a sixth embodiment.
Figure 98:
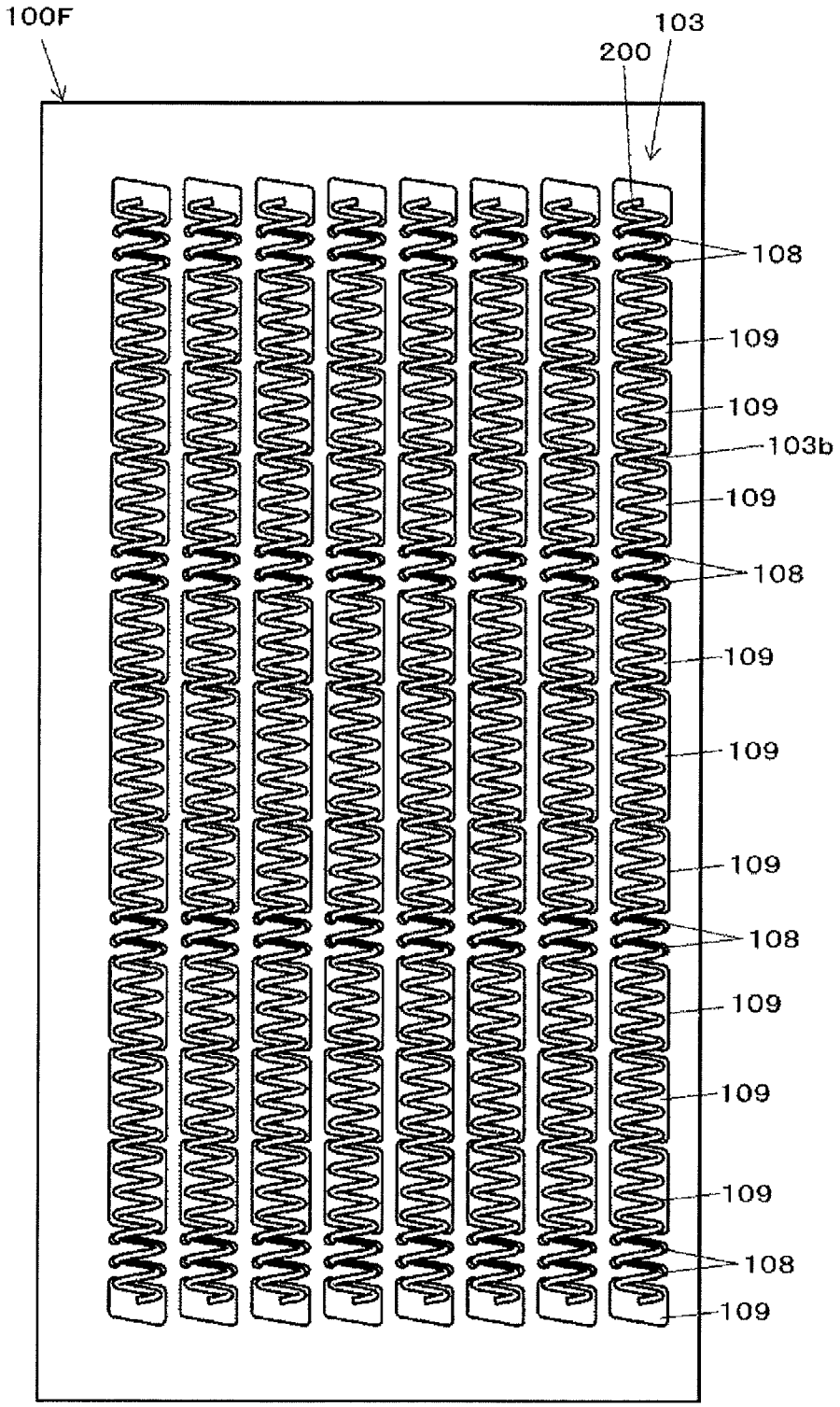
FIG. 98 is a front view of the coil holding sheet of the sixth embodiment, to which coils are held.
Figure 99:
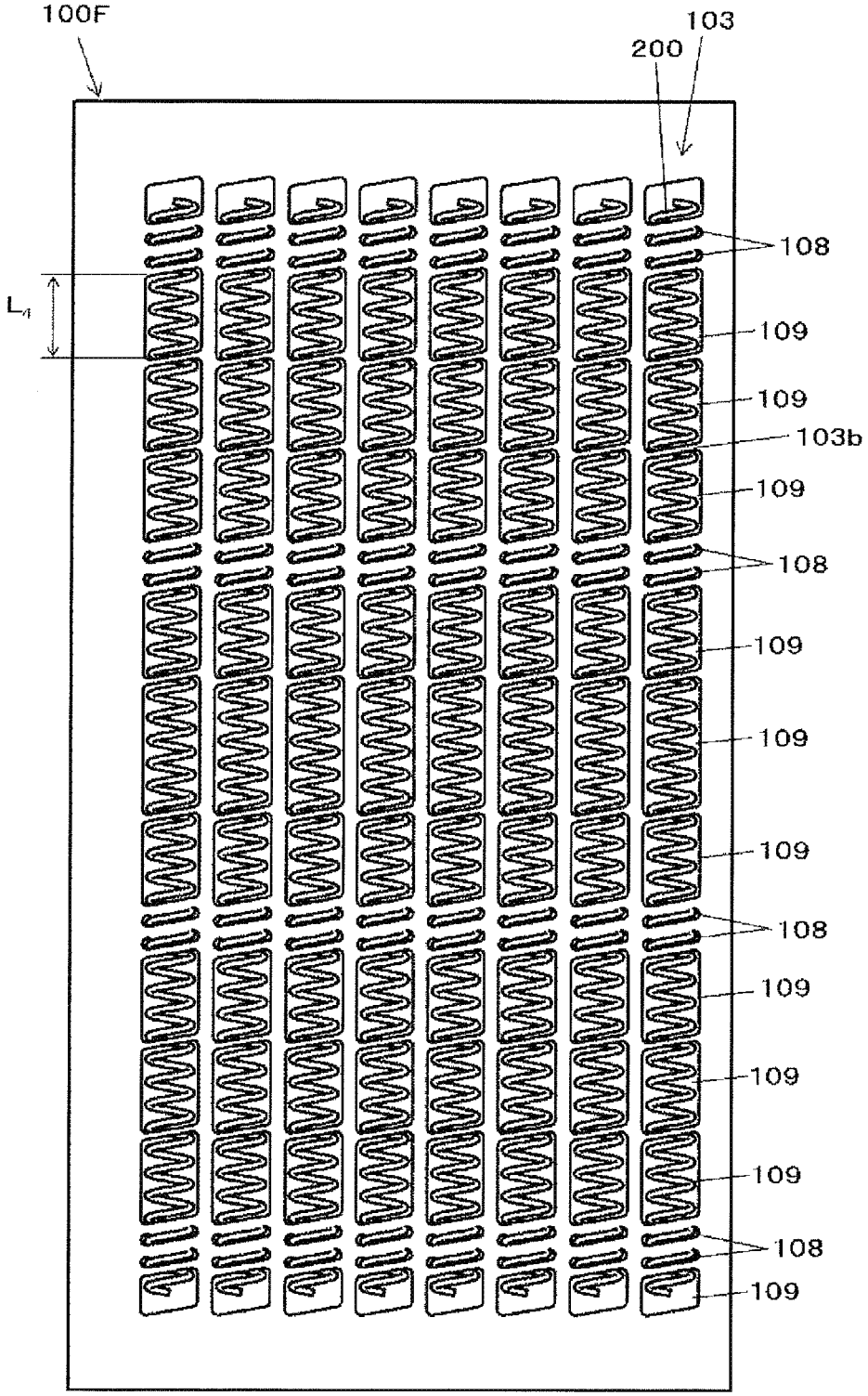
FIG. 99 is a rear view of the coil holding sheet of the sixth embodiment, to which coils are held.
Figure 100:
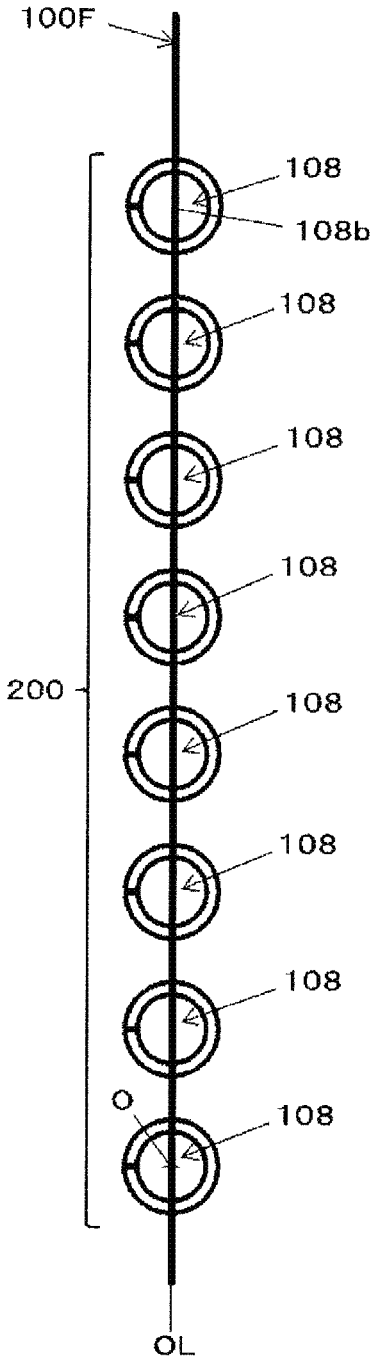
FIG. 100 is a side view of the coil holding sheet of the sixth embodiment, to which coils are held.
Figure 101:
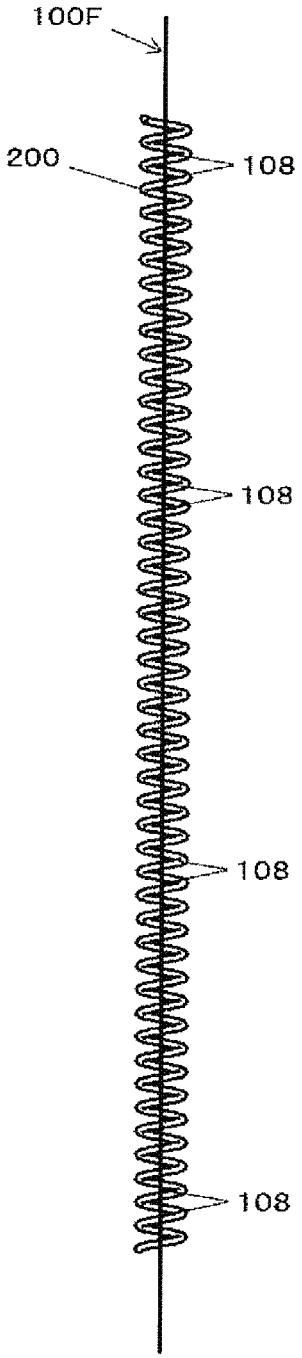
FIG. 101 is a plan view of the coil holding sheet of the sixth embodiment, to which coils are held.
Figure 102:
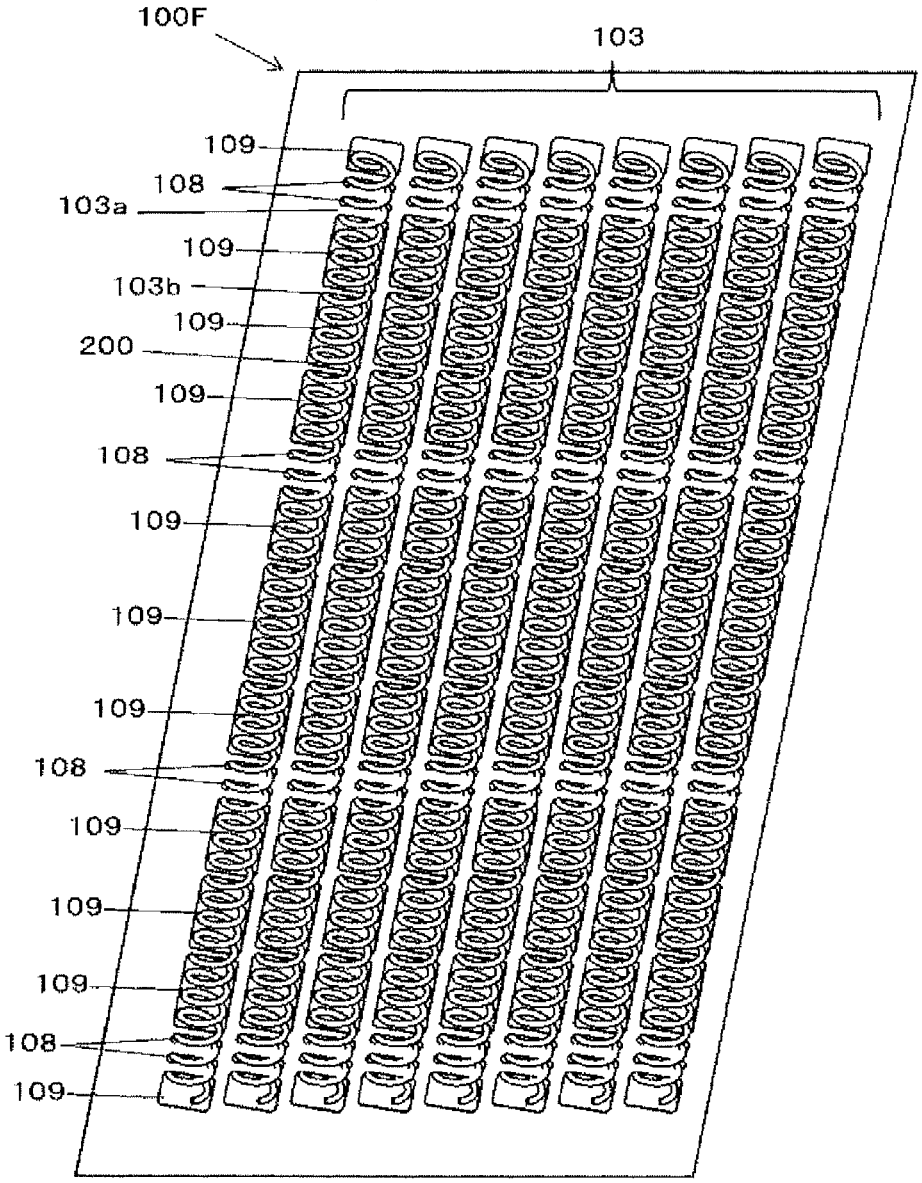
FIG. 102 is a perspective view of the coil holding sheet of the sixth embodiment, to which coils are held.

FIG. 97 is a front view depicting an example of the coil holding sheet of a sixth embodiment. FIGS. 98 to 102 depict the coil holding sheet of the sixth embodiment, to which coils are held. FIG. 98 is a front view of the coil holding sheet of the sixth embodiment, to which coils are held. FIG. 99 is a rear view of the coil holding sheet of the sixth embodiment, to which coils are held. FIG. 100 is a side view of the coil holding sheet of the sixth embodiment, to which coils are held. FIG. 101 is a plan view of the coil holding sheet of the sixth embodiment, to which coils are held. FIG. 102 is a perspective view of the coil holding sheet of the sixth embodiment, to which coils are held.

A coil holding sheet 100F of the sixth embodiment has holders 108 configured to hold the coil 200, and escape holes 109 configured to escape circumferential portions of the coil 200 from a front surface, which is one surface of the coil holding sheet 100F, to a back surface, which is the other surface.

The coil holding sheet 100F configures a coil holding row 103 for holding one coil 200 by a combination of the holders 108 and the escape holes 109. In order to hold a plurality of coils 200 by one coil holding sheet 100F, the coil holding sheet 100F is formed with a plurality of coil holding rows 103 with predetermined intervals in the direction perpendicular to the axial direction of the coil 200.

The holder 108 has a holding hole 108*a* in which the coil 200 of one turn is to enter, and a holding piece 108*b* configured to hold the coil 200 inserted in the holding hole 108*a*. The holding hole 108*a* is formed by an opening penetrating the front and back of the coil holding sheet 100F and having a shape by which a circumferential portion of the coil 200 can be inserted and pulled out.

The holding hole 108*a* is configured so that a length $L_{14}$ in the radial direction of the coil 200 is equal to the outer diameter Ro of the coil 200. Thereby, the coil 200 can enter the holding hole 108*a* to a position at which the radial center O becomes flush with the coil holding sheet 100F.

Also, the holding hole 108*a* is configured so that a length $L_{15}$ in the axial direction of the coil 200 is a length within which the coil 200 of one turn in the axial direction can enter the holding hole.

The holding piece 108*b* protrudes in the axial direction of the coil 200 from one side of the holding hole 108*a* in the axial direction of the coil 200. The holding piece 108*b* is configured to openably and closably close a part of a space, which is configured by the holding hole 108*a*, and to detachably hold the coil 200.

A length $L_{16}$ of the holding piece 108*b* in the radial direction of the coil 200 is configured to be equal to the inner diameter Ri, which is the diameter of the inner periphery of the coil 200.

The coil holding sheet 100F has the holder forming places 103*a*, at which the holders 108 are formed, at a plurality of places of the coil holding row 103 along the axial direction of the coil 200. In the sixth embodiment, the holder forming places 103*a* are formed at four places spaced with predetermined intervals along the axial direction of the coil 200.

Also, the coil holding sheet 100F has at least one holder 108 provided at each of the holder forming places 103*a*. In the sixth embodiment, two sets of the holders 108 are provided at each of the holder forming places 103*a* in conformity to the pitch P of the coil 200.

The escape hole 109 is configured by an opening penetrating the front and back of the coil holding sheet 100F and having a shape by which a circumferential portion of the coil 200 can be inserted and pulled out. The escape holes 109 are provided in parallel with the holder forming places 103*a* along the axial direction of the coil 200 held to the coil holding sheet 100F by the holder 108.

The escape hole 109 is configured so that a length $L_{14}$ in the radial direction of the coil 200 is equal to the outer diameter Ro of the coil 200. Thereby, the coil 200 can enter the escape hole 109 to a position at which the radial center O becomes flush with the coil holding sheet 100F.

The escape hole 109 is configured so that the length $L_{17}$ in the axial direction of the coil 200 is a length within which the coil 200 of two or more turns in the axial direction is to enter the escape hole. In the sixth embodiment, the escape hole 109 having a length within which the coil 200 of two turns is to enter the escape hole, the escape hole 109 having a length within which the coil 200 of four turns is to enter the escape hole, and the escape hole 109 having a length within which the coil 200 of six turns is to enter the escape hole are provided in correspondence to the number of turns of the coil 200.

The coil holding row 103 is provided with the coupling portions 103*b* each of which is formed between the escape holes 109 arranged in parallel in the axial direction of the coil 200 and is provided to couple one side and the other side of the escape holes 109 in the radial direction of the coil 200 therebetween.

Examples of Operational Effect of Coil Holding Sheet of Sixth Embodiment

The coil holding sheet 100F holds the coil 200 one by one in each of the coil holding rows 103. In the holder 108, the circumferential portion of the coil 200 enters the back surface side of the coil holding sheet 100F beyond the holding piece 108*b*.

Thereby, the holding piece 108*b* of the holder 108 enters the inner periphery side of the coil 200. The holding piece 108*b* and the holding hole 108*a* do not form intervals through which the coil 200 can pass, unless an external force capable of separating the coil 200 from the coil holding sheet 100F is applied. Therefore, it is possible to avoid the coil 200 from separating from the holder 108 by the holding piece 108*b*, when an unintended external force is applied to the coil 200.

Also, the two or more sets of the holders 108 are provided at each holder forming place 103*a*, in conformity to the pitch P of the coil 200, so that even when the coil 200 separates from the holder 108 of one place, the coil 200 can be held at the other adjacent holder 108.

When the coil 200 is held in the coil holding row 103, the circumferential portion of the coil 200 enters the escape hole 109 at the portion at which the escape hole 109 is formed. In the escape hole 109, the coil 200 enters the escape hole 102 to the position at which the radial center O of the coil 200 becomes flush with the coil holding sheet 100F.

In the state where the coil 200 is held to the coil holding sheet 100F, even when the coil holding sheet 100F is seen from the back surface side, it is possible to easily check that the coil 200 is held, because the portions of the coil 200 are exposed to the escape holes 109. In particular, the length $L_{17}$ of the escape hole 102 is configured as the length within which the coil 200 of multiple turns in the axial turns can enter therein, so that the visibility is improved.

When detaching the coil 200 from the coil holding sheet 100F, a force of moving the coil 200 in a direction of separating from the coil holding sheet 100F is applied to the coil 200 from the front surface side of the coil holding sheet 100F, such as relative movement of the coil 200 and the coil holding sheet 100F in a direction along the coil holding sheet 100F.

When the force is applied in the direction of separating the coil 200 from the coil holding sheet 100F, the holding piece 108*b* is pressed and deformed by the coil 200, and the intervals of the holding piece 108*b* and the holding hole 108*a* are widened, so that the coil 200 is separated from the holding hole 108*a*. Thereby, the coil 200 is detached from the coil holding sheet 100F.

Also, when attaching the coil 200 to the coil holding sheet 100F, the position of the coil 200 is aligned to the coil holding row 103 and the force is applied in a direction of pressing the coil 200 to the coil holding sheet 100F.

Thereby, the holding piece 108*b* is pressed and deformed by the coil 200, and the intervals of the holding piece 108*b* and the holding hole 108*a* are widened, so that the coil 200 passes through the holding hole 108*a*. Therefore, the circumferential portion of the coil 200 enters the back surface side of the coil holding sheet 100F.

Therefore, the coil 200 of the portion having entered the back surface side of the coil holding sheet 100F is pressed by the holding piece 108*b*, so that the coil 200 is attached to the coil holding sheet 100F.

Like this, during the operation of attaching the coil 200 to the coil holding sheet 100F, it is not necessary to perform an operation of deforming a predetermined part of the coil holding sheet 100F in advance. Therefore, it is possible to easily attach and use the coil 200 of a single body to the coil holding sheet 100F.

In the case of the coil holding sheet 100F, since the escape hole 109 has the length corresponding to the multiple turns of the coil 200, the punch chad is large, so that it is possible to reduce the number of generation of the punch chad in the manufacturing process of the escape holes 109. Also, in the case of the coil holding sheet 100F, the combination is made by increasing and decreasing the number of the holders 108 and the number of the escape holes 109, so that it is possible to easily adjust the holding force of the coil 200 in the coil holding sheet 100F.

Modified Embodiments of Coil Holding Sheet of Each Embodiment

As described above with reference to FIG. 10, the coils 200 having a plurality of different sizes of the outer diameters Ro are prepared in correspondence to a thickness of a sheet bundle, which changes depending on the number of sheets to be bound, a sheet thickness, and the like.

Therefore, a plurality of types of the coil holding sheets 100A is prepared in which the interval $L_1$ between the bent portion 101*d* of one push-up piece 101*a* of the holder 101 and the bent portion 101*d* of the other push-up piece 101*a* and the length $L_3$ of the escape hole 102 in the radial direction of the coil 200 are respectively configured to be different in conformity to the outer diameter Ro of the coil 200.

Figure 103:
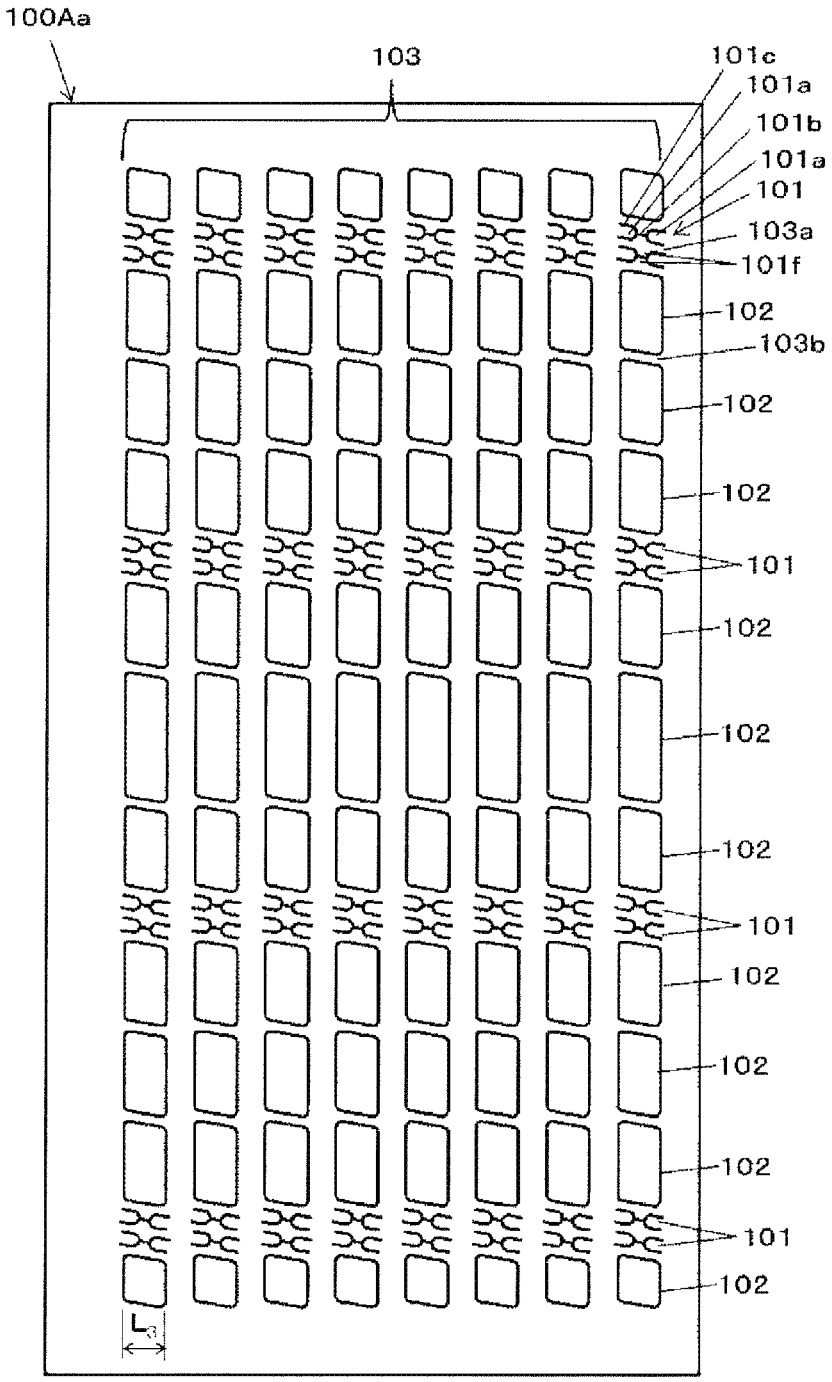
FIG. 103 is a plan view depicting an example of the coil holding sheet corresponding to a difference in coil diameter.
Figure 104:
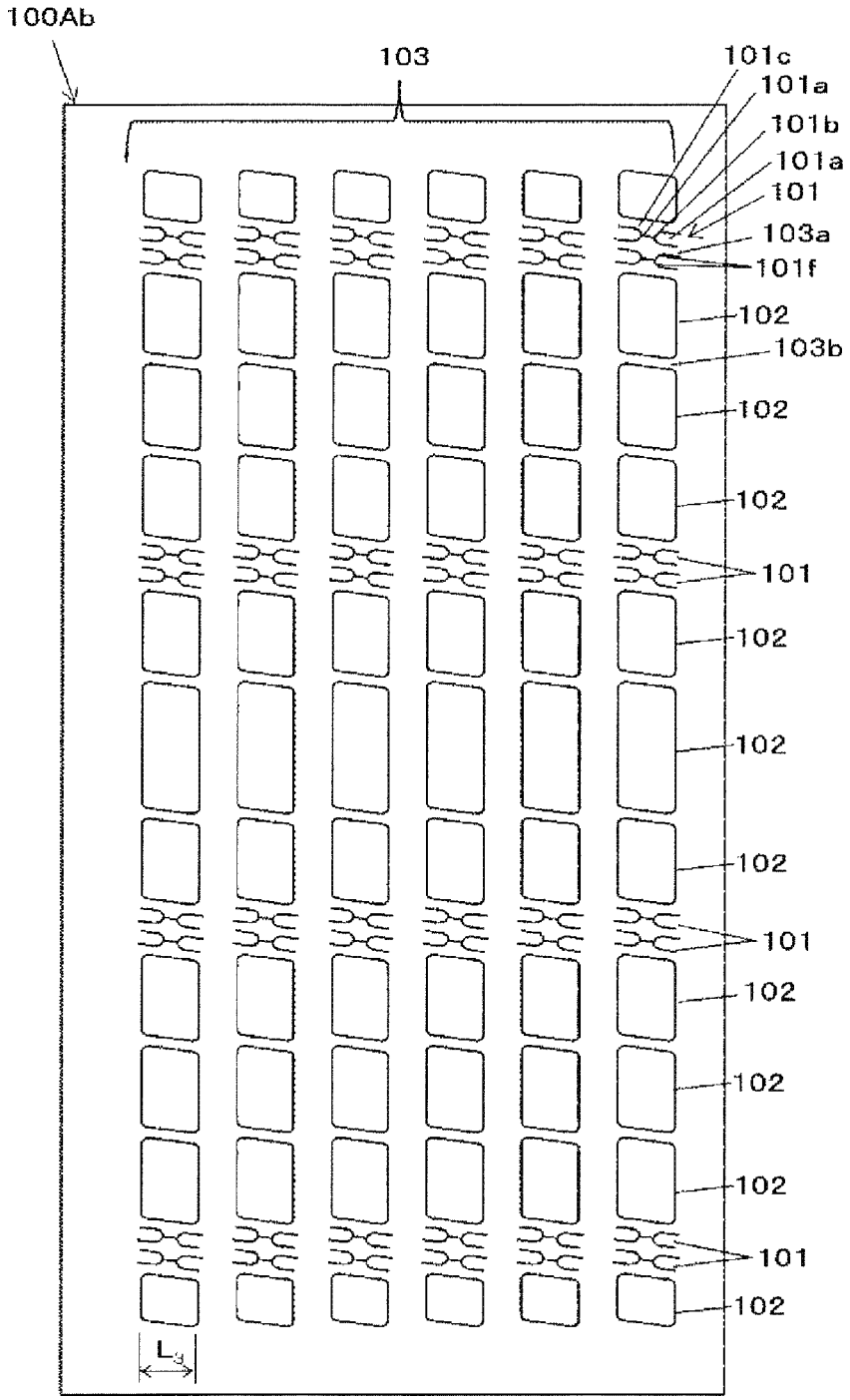
FIG. 104 is a plan view depicting an example of the coil holding sheet corresponding to a difference in coil diameter.
Figure 105:
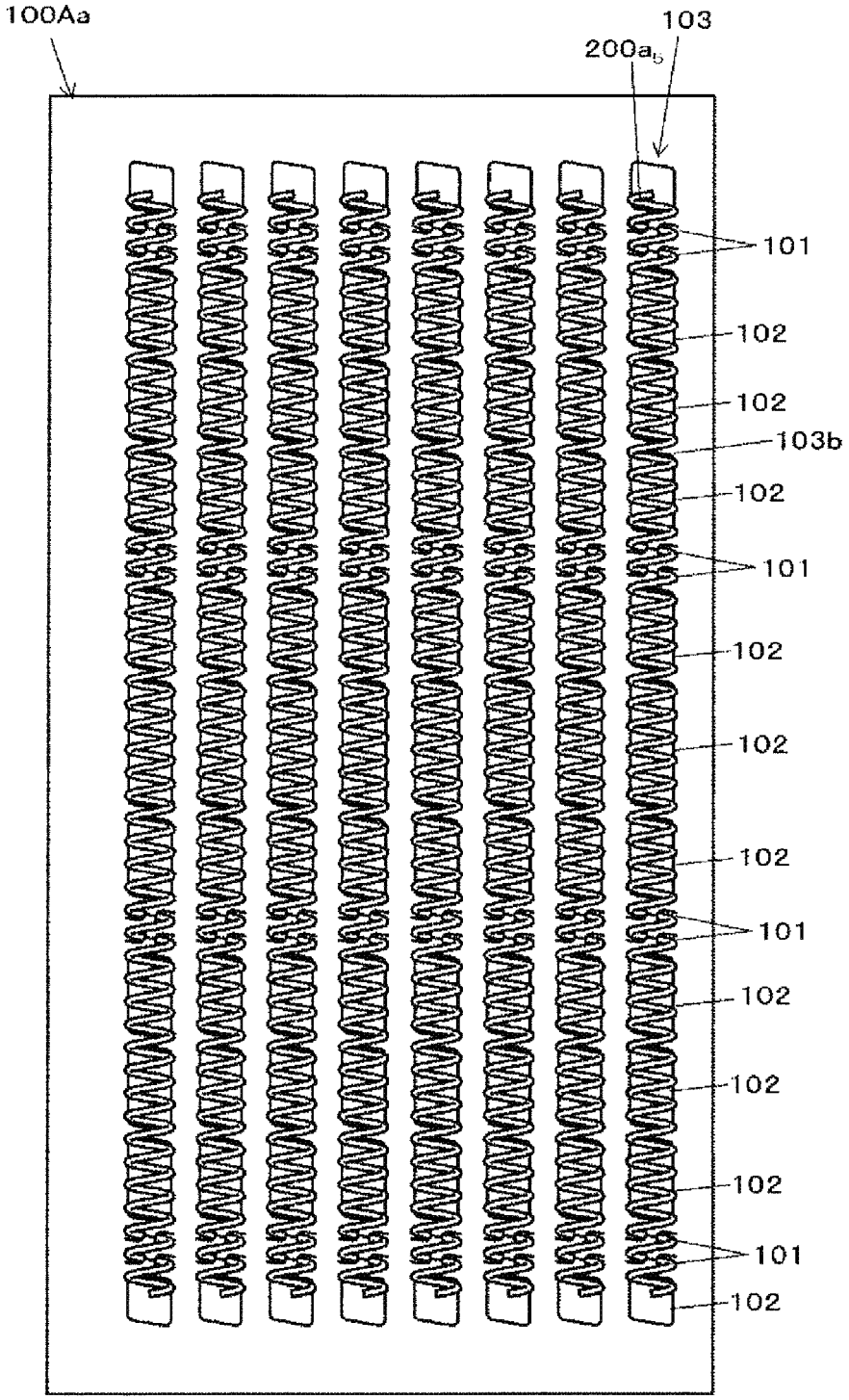
FIG. 105 is a front view depicting an example where coils are held to the coil holding sheet corresponding to a difference in coil diameter.
Figure 106:
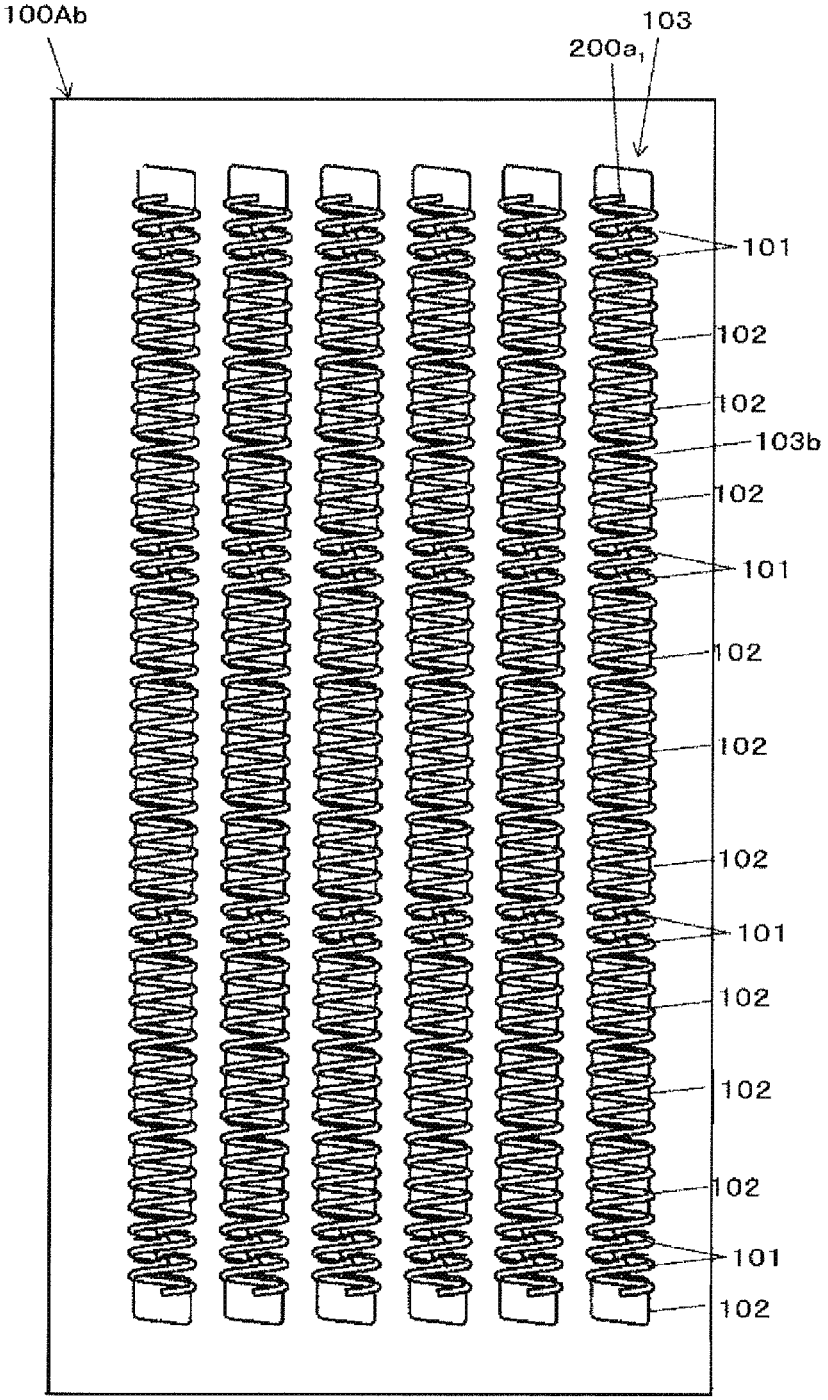
FIG. 106 is a front view depicting an example where coils are held to the coil holding sheet corresponding to a difference in coil diameter.

FIGS. 103 and 104 are plan views depicting examples of the coil holding sheet corresponding to a difference in coil diameter. FIGS. 105 and 106 are front views depicting examples where coils are held to the coil holding sheets corresponding to a difference in coil diameter.

Referring to the coil holding sheet 100A, FIGS. 103 and 105 depict a coil holding sheet 100Aa configured to hold coils 200$a_5$ having a small outer diameter Ro, and FIGS. 104 and 106 depict a coil holding sheet 100Ab configured to hold coils 200$a_1$ having an outer diameter Ro larger than the coils 200$a_5$.

The coil holding sheet 100Aa and the coil holding sheet 100Ab have the same outer shape size. Therefore, the coil holding sheet 100Aa and the coil holding sheet 100Ab are made to have the different numbers of the coil holding rows 103, so that the numbers of the coils 200 to be held are made to be different.

In the above example, the coil holding sheet 100A has been exemplified. However, the coil holding sheet of each of the above embodiments can also be made to correspond to a difference in outer diameter of the coil 200.

Configuration Example of Bookbinding Apparatus of First Embodiment

Figure 107:
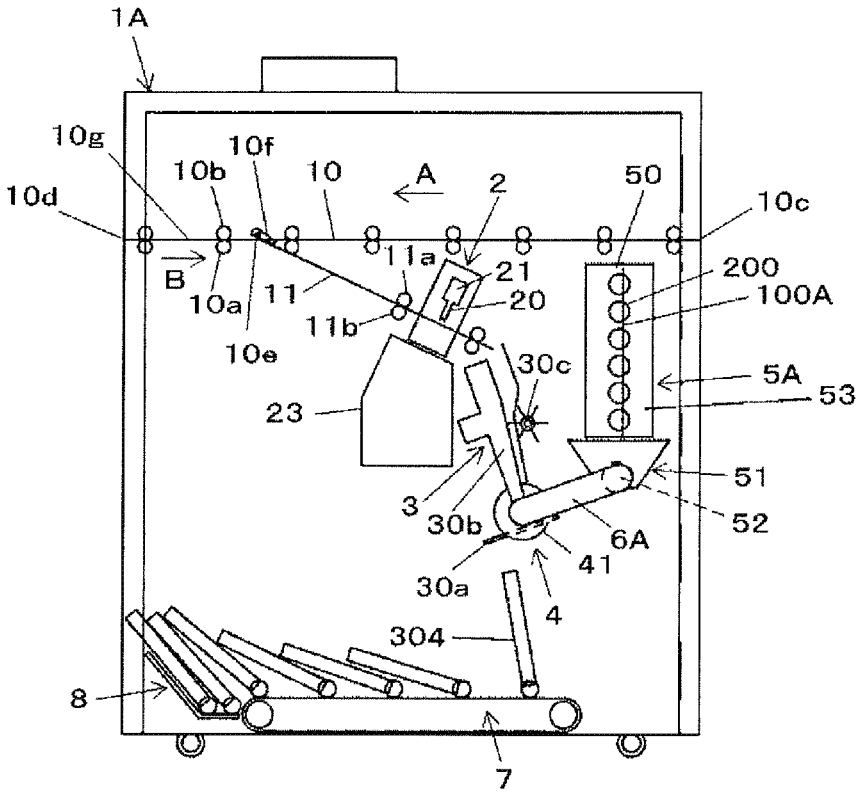
FIG. 107 is a configuration view depicting an example of a bookbinding apparatus of a first embodiment.
Figure 108:
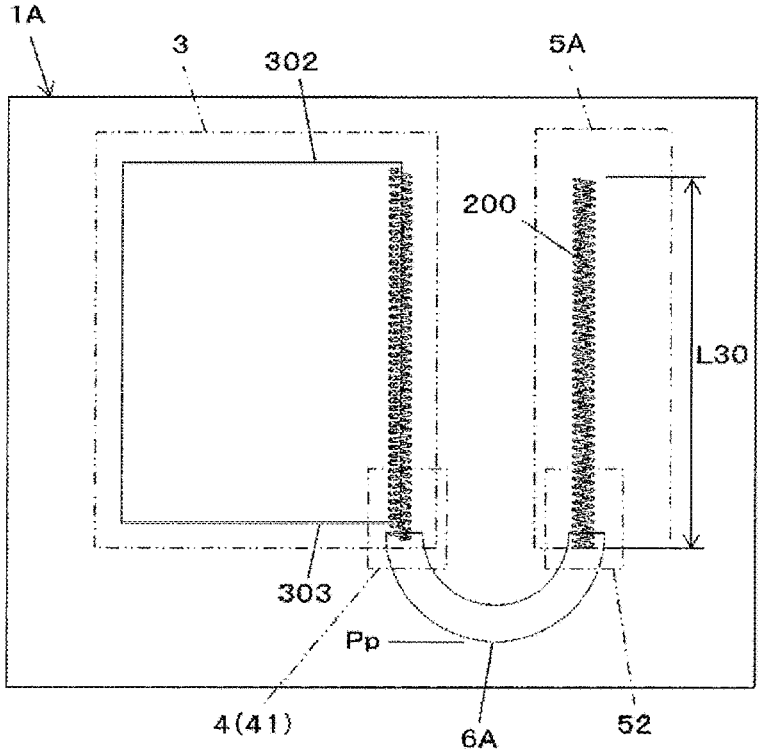
FIG. 108 is a configuration view depicting an example of the bookbinding apparatus of the first embodiment.
Figure 109:
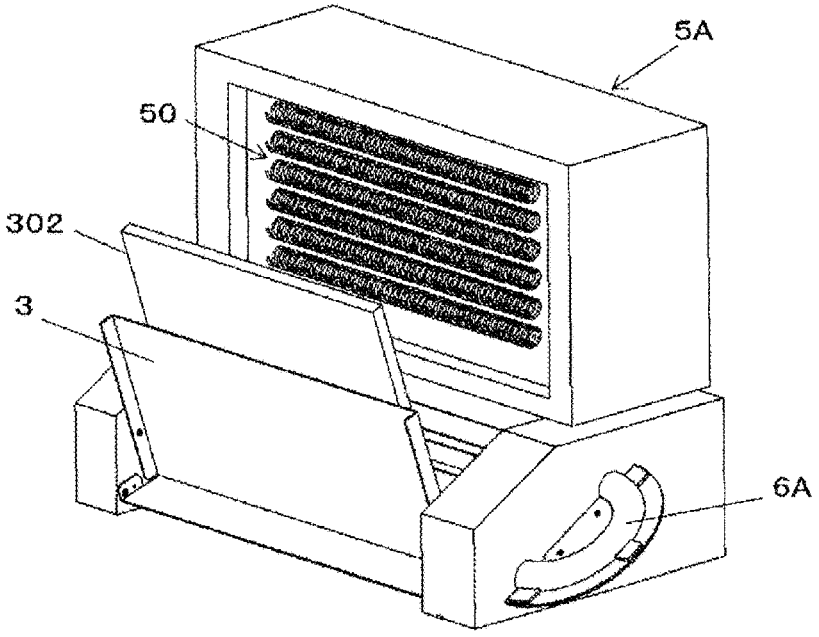
FIG. 109 is a configuration view depicting an example of the bookbinding apparatus of the first embodiment.

FIGS. 107 to 109 are configuration views depicting an example of a bookbinding apparatus of a first embodiment. FIG. 107 is a front view depicting an outline of an internal configuration of the bookbinding apparatus of the first embodiment. FIG. 108 is a plan view of main parts depicting the outline of the internal configuration of the bookbinding apparatus of the first embodiment. FIG. 109 is a perspective view of main parts depicting the outline of the internal configuration of the bookbinding apparatus of the first embodiment.

Figure 110:
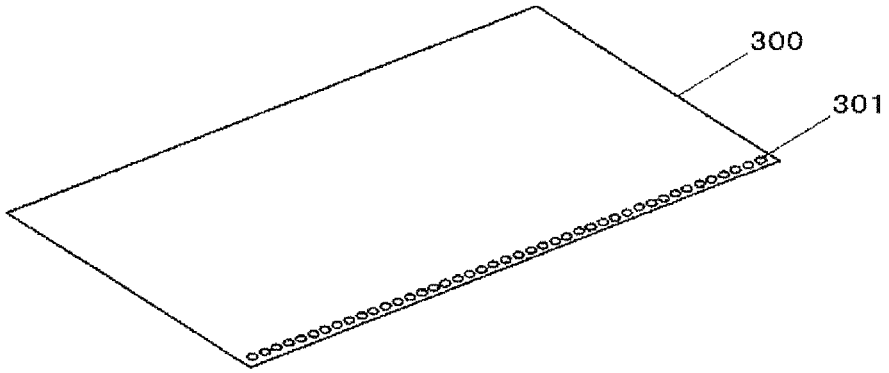
FIG. 110 illustrates an outline of a bookbinding process to be performed by the bookbinding apparatus of each embodiment.
Figure 111:
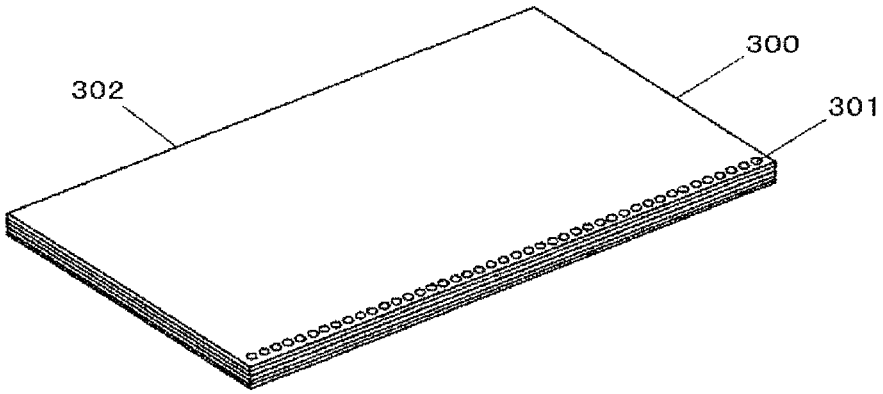
FIG. 111 illustrates the outline of the bookbinding process to be performed by the bookbinding apparatus of each embodiment.
Figure 112:
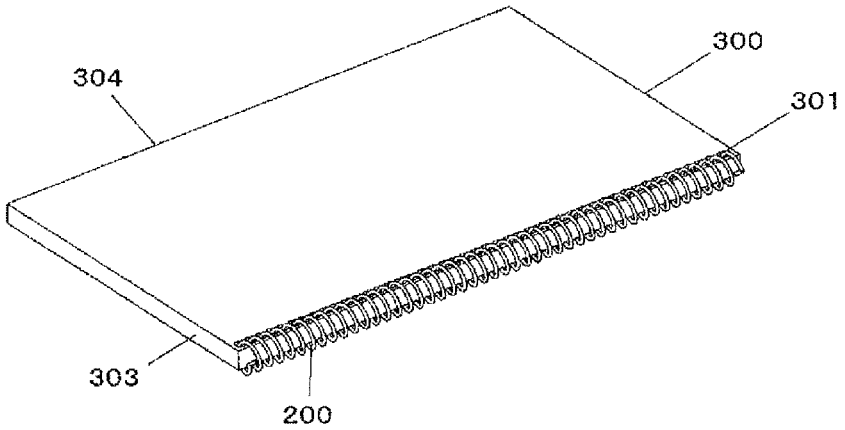
FIG. 112 illustrates the outline of the bookbinding process to be performed by the bookbinding apparatus of each embodiment.

Also, FIGS. 110 to 112 illustrate an outline of a bookbinding process that is to be performed by the bookbinding apparatus of each embodiment. First, an outline of a bookbinding process is described with reference to FIGS. 110 to 112. As shown in FIG. 110, a predetermined number of multiple holes 301 are formed in one sheet 300. Then, as shown in FIG. 111, the sheets 300 in which the holes 301 are formed are stacked and aligned, so that a sheet bundle 302 is configured. Then, as shown in FIG. 112, the coil 200 is inserted into the holes 301 from one side end portion 303 of the sheets 300 with respect to a direction in which the holes 301 are arranged in parallel, so that a booklet 304 is made.

Subsequently, a bookbinding apparatus 1A of the first embodiment for implementing the above bookbinding process is described. The bookbinding apparatus 1A of the first embodiment has a first conveyance path 10 and a second conveyance path 11 branched from the first conveyance path 10, as an example of the sheet conveyance path configured to convey the sheet 300. The first conveyance path 10 and the second conveyance path 11 configure a switchback-type conveyance route configured to reverse a conveying direction of the sheet 300 on the way.

Also, the bookbinding apparatus 1A includes a punching unit 2, which is an example of the hole forming unit configured to form the holes 301 in a predetermined arrangement in the sheet 300, and a sheet aligning unit 3 configured to accumulate the sheets 300 having the holes 301 formed in the punching unit 2, to align the plurality of accumulated sheets 300, and to make the sheet bundle 302. In addition, the bookbinding apparatus 1A includes a binding unit 4 configured to bind the sheet bundle 302 aligned in the sheet aligning unit 3 with the coil 200 and to make the booklet 304, a coil supply unit 5A configured to supply the coil 200, and a coil conveyance path 6A configured to convey the coil 200 supplied from the coil supply unit 5A to the binding unit 4. Also, the bookbinding apparatus 1A includes a discharging unit 7 configured to discharge the booklet 304 bound in the binding unit 4.

The first conveyance path 10 and the second conveyance path 11 are configured by a plurality of pairs of rollers provided along the conveyance route of the sheet 300, pairs of belts extending along the conveyance route of the sheet 300, a guide member configured to guide conveyance of the sheet 300, and the like.

In the first embodiment, the first conveyance path 10 includes a plurality of feed rollers 10*a* configured to rotatively drive, and a plurality of guide rollers 10*b* configured to face the feed rollers 10*a*. The second conveyance path 11 includes a plurality of feed rollers 11*a* configured to rotatively drive, and a plurality of guide rollers 11*b* configured to face the feed rollers 11*a*.

The first conveyance path 10 is arranged at an upper side in the bookbinding apparatus 1A, and configures a linear conveyance route for conveying the sheet 300 between a feeder port 10*c* and a discharge port 10*d*. The conveyance route is substantially horizontal.

The first conveyance path 10 includes a switching blade 10*f* configured to switch the conveying direction at a branch portion 10*e* of the first conveyance path 10 and the second conveyance path 11. Also, the first conveyance path 10 includes a reversal holding unit 10*g* between the branch portion 10*e* and the discharge port 10*d*.

The second conveyance path 11 is branched downstream from the first conveyance path 10 at the branch portion 10*e*, and is configured to communicate with the reversal holding unit 10*g* by an operation of the switching blade 10*f*.

The switching blade 10*f* is rotatively driven to move between a position at which it is retracted from the first conveyance path 10 and a position at which it protrudes into the first conveyance path 10. When the switching blade 10*f* is moved to the position at which it is retracted from the first conveyance path 10, the sheet 300, which is conveyed on the first conveyance path 10 in a conveying direction A from the feeder port 10*c*, is moved through the switching blade 10*f* and is conveyed to the reversal holding unit 10*g*.

On the contrary, when the switching blade 10*f* is moved to the position at which it protrudes into the first conveyance path 10, the sheet 300, which is conveyed on the first conveyance path 10 in a conveying direction B from the reversal holding unit 10*g* while reversing the conveying direction, is sent to the second conveyance path 11 from the first conveyance path 10 by the guide of the switching blade 10*f*.

Thereby, the second conveyance path 11 configures a conveyance route where the conveying direction of the sheet 300, which is conveyed on the first conveyance path 10 in the conveying direction A from the feeder port 10*c* side to the discharge port 10*d* side, is reversed to the conveying direction B at the reversal holding unit 10*g* and the sheet 300 is switched back downward from the first conveyance path 10.

The punching unit 2 is an example of the hole forming unit, and is provided to the second conveyance path 11. The punching unit 2 includes punch blades 20 configured to form the holes 301 in the sheet 300, and a hole-forming drive mechanism 21 configured to drive the punch blades 20.

In the punching unit 2, a predetermined number of punch blades 20 are arranged in one row. The hole-forming drive mechanism 21 is configured to reciprocally move the punch blades 20 in a direction perpendicular to a surface of the sheet 300. The punching unit 2 is configured to form the holes 301 in one row with predetermined intervals in the sheet 300 by positionally adjusting the sheet 300 in the conveying direction and positionally adjusting the sheet 300 in a width direction perpendicular to the conveying direction with a hole-forming position adjustment mechanism (not shown) and reciprocally moving the punch blades 20.

In the meantime, in order to collect punch chad generated when forming the holes 301 in the sheet 300 by the punch blades 20, a punch chad stacker 23 is provided below the punching unit 2.

The sheet aligning unit 3 is arranged downstream of the punching unit 2 with respect to the conveying direction of the sheet 300. The sheet aligning unit 3 includes a contact shutter 30*a* configured to positionally adjust a leading end of the sheet 300 in the conveying direction, a width aligning mechanism 30*b* configured to positionally adjust the sheet 300 in the right and left direction, and a paddle mechanism 30*c* configured to cause the sheet 300 to contact against the contact shutter 30*a*.

The contact shutter 30*a* is configured to open and close the sheet aligning unit 3 by moving between a position at which the contact shutter protrudes into the sheet aligning unit 3 and the sheet 300 sent to the sheet aligning unit 3 is thus contacted against the contact shutter and a position at which the contact shutter is retracted from the sheet aligning unit 3 and the booklet 304 can pass therethrough.

The width aligning mechanism 30*b* includes a width aligning guide at one side of the right and the left with respect to the conveying direction of the sheet 300 and a reference guide at the other side. The width aligning mechanism 30*b* is configured to move in a direction in which the width aligning guide is to approach and separate with respect to the reference guide, thereby causing the sheet 300 sent to the sheet aligning unit 3 to be contacted against the reference guide.

The paddle mechanism 30*c* includes a paddle roller having a plurality of tongue pieces arranged in a circumferential direction and configured to rotatively drive. The paddle mechanism 30*c* is configured to cause the sheet 300 sent to the sheet aligning unit 3 to be contacted against the contact shutter 30*a* protruding into the sheet aligning unit 3. In the meantime, a rotary shaft of the paddle roller is inclined in a guide direction of a fixed side (not shown) of the width aligning mechanism 30*b*. The paddle roller is also configured to apply a force, which causes the sheet 300 sent to the sheet aligning unit 3 to be contacted in the guide direction of the fixed side of the width aligning mechanism 30*b*, to the sheet 300.

The binding unit 4 is an example of the binding mechanism, and includes a coil rotation/insertion unit 41 configured to bind the sheet bundle 302 aligned in the sheet aligning unit 3 with the coil 200. The coil rotation/insertion unit 41 is an example of the binding mechanism, and is configured to insert the coil 200 into the holes 301 of the sheet bundle 302, which is aligned and positionally adjusted in the sheet aligning unit 3, from one side end portion 303 of the sheet 300 while rotating the coil 200 around an axis and conveying the same in the axial direction.

The coil supply unit 5A of the first embodiment includes a coil storing unit 50 in which any one of the coil holding sheets 100A, 100A1, 100A2, 100A3, 100A4 of the first embodiment, any one of the coil holding sheets 100B, 100B2, 100B3, 100B4 of the second embodiment, any one of the coil holding sheets 100C, 100C2, 100C3, 100C4 of the third embodiment, the coil holding sheet 100D of the fourth embodiment, the coil holding sheet 100E of the fifth embodiment or the coil holding sheet 100F of the sixth embodiment, to which the coils 200 are held, is stored. In the below, the coil holding sheet 100A is exemplified.

Also, the coil supply unit 5A includes a coil separating unit 51 configured to separate the coils 200 from the coil holding sheet 100A. In addition, the coil supply unit 5A includes a coil feed unit 52 configured to feed the coils 200 separated from the coil separating unit 51, and a sheet collection unit 53 configured to collect the coil holding sheet 100A from which the coils 200 have been separated.

In the bookbinding apparatus 1A, a mounting position of the coil supply unit 5A is provided below the first conveyance path 10 and at a side the sheet aligning unit 3. The coil supply unit 5A is mounted to the bookbinding apparatus 1A so that the axial direction of the coils 200 held to the coil holding sheet 100A faces toward a direction along a surface of the sheet bundle 302 aligned in the sheet aligning unit 3.

The coil supply unit 5A is provided to be inserted and removed with respect to the bookbinding apparatus 1A. In the first embodiment, the coil supply unit 5A can be inserted and removed forward from a front face side of the bookbinding apparatus 1A. Here, the front face side of the bookbinding apparatus 1A indicates one side of the first conveyance path 10 perpendicular to the conveying direction of the sheet 300. In order to insert and remove the coil supply unit 5A from the front face side of the bookbinding apparatus 1A, a space through which the coil supply unit 5A can pass is formed between the coil supply unit 5A and the front face of the bookbinding apparatus 1A.

When the coil supply unit 5A is drawn out from the bookbinding apparatus 1A, the coil holding sheet 100A having the coils 200 held thereto can be loaded into the coil storing unit 50, the coil holding sheet 100A loaded in the coil storing unit 50 can be replaced, and the coil holding sheet 100A from which the coils 200 have been separated can be taken out from the sheet collection unit 53.

The coil storing unit 50 is an example of the binding component storing unit, and one coil holding sheet 100A capable of supporting the plurality of coils 200 is stored therein with an arranging direction of the coils 200 facing toward a vertical direction.

The coil separating unit 51 is an example of the binding component separating unit, and is configured to separate the coils 200 one by one from the coil holding sheet 100A by conveying the coil holding sheet 100A having the coils 200 held thereto.

The coil feed unit 52 is provided at a position at which the coil 200 separated from the coil holding sheet 100A and rolled radially is to enter, and is configured to axially convey one coil 200 separated from the coil separating unit 51. The sheet collection unit 53 is provided in parallel with a back surface of the coil storing unit 50.

The coil conveyance path 6A of the first embodiment is an example of the binding component conveyance path. The coil conveyance path 6A forms a curved conveyance path for conveying the coil 200 with being curved with respect to the axial direction to one side end portion 303, which is an end portion of a side, at which the coil rotation/insertion unit 41 starts insertion of the coil 200, of the sheet bundle 302 aligned in the sheet aligning unit 3, at a position Pp that is distant from the side end portion 303 by a distance smaller than a length $L_{30}$ of one coil 200.

In the first embodiment, a feed direction of the coil 200 fed from the coil feed unit 52 and an introduction direction of the coil 200 into the coil rotation/insertion unit 41 are opposite to each other. Therefore, the coil conveyance path 6A forms a conveyance route bent into a U-shape.

The discharging unit 7 is an example of the booklet discharging unit. The discharging unit 7 is configured by at least a pair of rollers, an endless belt put on the rollers, and the like. The discharging unit 7 is arranged below the sheet aligning unit 3. The discharging unit 7 forms a linear conveyance route for receiving the booklet 304 bound with the coil 200 and conveying the same to the sheet discharge stacker 8. The linear conveyance route is substantially horizontal. The discharging unit 7 is configured to convey the booklet 304 received from the sheet aligning unit 3 with being overturned.

The sheet discharge stacker 8 is arranged downstream of the discharging unit 7, and the booklet 304 conveyed from the discharging unit 7 is stacked thereon. The sheet discharge stacker 8 has a stacking surface having predetermined inclination. The sheet discharge stacker 8 is configured to erect and stack thereon the booklet 304 conveyed with being overturned from the discharging unit 5, in conformity to the inclination of the stacking surface.

Example of Using Aspect of Bookbinding Apparatus of an Embodiment

Figure 113:
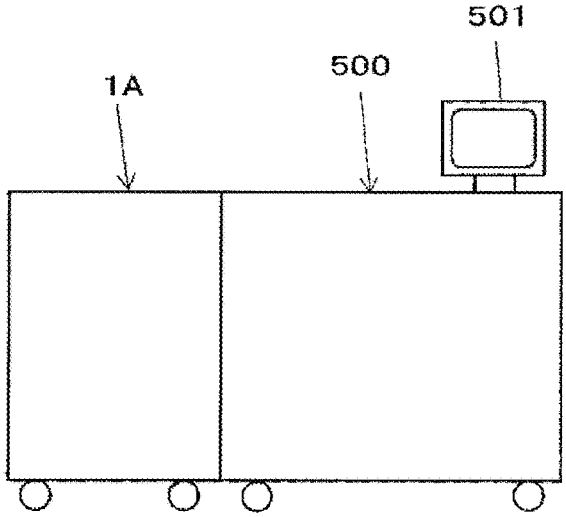
FIG. 113 is a configuration view depicting an example of a using aspect of the bookbinding apparatus of each embodiment.

FIG. 113 is a configuration view depicting an example of a using aspect of the bookbinding apparatus of an embodiment. The bookbinding apparatus 1A is used with being connected to an image forming apparatus 500. The image forming apparatus 500 is an electrophotographic image forming apparatus such as a copier, for example.

The electrophotographic image forming apparatus 500 is configured to form an electrostatic latent image on a photosensitive member in conformity to an image, and to attach toner to the electrostatic latent image on the photosensitive member, to develop the electrostatic latent image and to form a toner image in a process referred to as 'developing'.

The toner image formed on the photosensitive member is primarily transferred to an intermediate transfer medium and is then secondarily transferred to a sheet from the intermediate transfer medium. The sheet having the toner image transferred thereto is conveyed to a fixing device, in which the toner image is fixed on the sheet by heating and pressurization. The sheet having an image formed thereon by the series of processing is discharged. As an image forming apparatus configured to form a color image, a so-called tandem image forming apparatus has been known which is configured to form a full-color image by arranging vertically a plurality of photosensitive members with facing one intermediate transfer belt.

The bookbinding apparatus 1A is configured to perform bookbinding processing of using the coils 200, in conjunction with the image forming processing to be performed in the image forming apparatus 500, based on settings and operations on an operation unit 501 of the image forming apparatus 500.

Operation Example of Bookbinding Apparatus of First Embodiment

Subsequently, an operation example of the bookbinding processing of binding the sheets with the bookbinding apparatus 1A is described with reference to each drawing.

The bookbinding apparatus 1A is connected to the image forming apparatus 500, and the sheets 300 on which predetermined processing such as printing has been performed are fed one by one from the feeder port 10*c*. During an operation of binding the sheets 300 with the coil 200, conveying processing of conveying the sheet 300 to the punching unit 2 is performed, hole forming processing is performed in the punching unit 2, and then aligning processing is performed in the sheet aligning unit 3.

In the conveying processing of conveying the sheet 300 to the punching unit 2, the feed rollers 10*a* of the first conveyance path 10 are rotatively driven, so that the sheet 300 fed to the first conveyance path 10 is sandwiched between the feed rollers 10*a* and the guide rollers 10*b*, and is conveyed on the first conveyance path 10 in the conveying direction A from the feeder port 10*c* toward the discharge port 10*d*.

When it is determined that the sheet 300 being conveyed in the conveying direction A on the first conveyance path 10 has passed through the switching blade 10*f* and has been conveyed to the reversal holding unit 10*g*, the conveying of the sheet 300 is stopped. After stopping the conveying of the sheet 300, the switching blade 10*f* is driven to switch the conveyance route of the sheet 300 from the reversal holding unit 10*g* to the second conveyance path 11.

When the conveyance route is switched to the second conveyance path 11 by the switching blade 10*f*, the feed rollers 10*a* are rotated in a reverse direction in which the sheet 300 is to be conveyed in the conveying direction B. Also, the feed rollers 11*a* are rotated in a direction in which the sheet 300 on the second conveyance path 11 is to be conveyed to the punching unit 2.

Thereby, the conveying direction of the sheet 300 temporarily held with the reversal holding unit 10*g* is reversed, so that the sheet 300 is conveyed in the conveying direction B, and is sent from the first conveyance path 10 to the second conveyance path 11 with being guided by the switching blade 10*f*. The sheet 300 sent to the second conveyance path 11 is sandwiched between the feed rollers 11*a* and the guide rollers 11*b*, and is conveyed on the second conveyance path 11 toward the punching unit 2.

The sheet 300 conveyed to the punching unit 2 is positionally adjusted in the conveying direction of the sheet 300 and in the width direction perpendicular to the conveying direction of the sheet 300 by the hole-forming position adjustment mechanism (not shown).

When the sheet 300 is positionally adjusted, the punch blades 20 are reciprocally moved by the hole-forming drive mechanism 21, so that the sheet 300 is formed with the holes 301 with predetermined intervals.

The sheet 300 formed with the holes by the punching unit 2 is conveyed to the sheet aligning unit 3.

The leading end of the sheet 300 in the conveying direction is contacted against the contact shutter 30*a* protruding into the sheet aligning unit 3 by the paddle mechanism 30*c*, and side ends of the sheet 300 are contacted against the reference guide (not shown) of the width aligning mechanism 30*b*. Thereby, the sheet 300 being conveyed to the sheet aligning unit 3 is positionally adjusted.

The conveying processing, the hole forming processing and the aligning processing are repetitively performed until a predetermined number of the sheets 300 are aligned and accumulated in the sheet aligning unit 3. When the predetermined number of the sheets 300 are aligned, the series of the conveying processing, the hole forming processing and the aligning processing are stopped.

When the predetermined number of the sheets 300 are aligned in the sheet aligning unit 3, the contact shutter 30*a* is opened, and one coil 200 is separated from the coil holding sheet 100A stored in the coil storing unit 50 of the coil supply unit 5A.

The coil 200 separated from the coil holding sheet 100A is conveyed in the axial direction of the coil 200 and is sent to the coil conveyance path 6A by the coil feed unit 52. As shown in FIG. 108, the conveying direction of the coil 200 in the coil supply unit 5A and the conveying direction of the coil 200 in the binding unit 4 are different by 180°. In the coil conveyance path 6A, the conveyance route of the coil 200 is bent by 180°.

Thereby, the coil 200 being conveyed at the coil feed unit 52 from the coil supply unit 5A is sent to the binding unit 4. The coil 200 sent to the binding unit 4 is axially conveyed with being rotated in the circumferential direction by the coil rotation/insertion unit 41, so that the coil is inserted into the holes 301 of the sheet bundle 302 aligned and positionally adjusted in the sheet aligning unit 3 from one side end portion 303 of the sheets 300.

The booklet 304 bound with the coil 200 is dropped to the discharging unit 7. The discharging unit 7 overturns and conveys the booklet 304 received from the sheet aligning unit 3 to the sheet discharge stacker 8. The sheet discharge stacker 8 erects and stacks thereon the booklet 304 being conveyed with being overturned from the discharging unit 7.

Examples of Effect of Bookbinding Apparatus of First Embodiment

In the bookbinding apparatus 1A, the conveying processing of the sheet 300, the hole forming processing of the sheet 300, the aligning processing of the sheet 300, the binding processing of the sheet bundle 302 by the coil 200 and the discharge processing of the booklet 304 bound with the coil 200 are automatically performed. Therefore, it is not necessary for a person to align the sheet 300, to place the sheet bundle 302, to place the coils 200 one by one, and to take out the booklet 304 with a hand. Thereby, it is possible to collectively perform the printing processing and the bookbinding processing by connecting the bookbinding apparatus 1A to the image forming apparatus 500 and the like.

In the bookbinding processing of using the coil 200, the coil 200 is axially conveyed with being rotated in the circumferential direction, and is inserted into the holes 301 from one side end portion 303 of the sheets 300. For this reason, it is necessary to secure a space for conveying the coil 200 at a side of the sheets 300.

In the meantime, in the case of the configuration where the plurality of coils 200 is stored, if a storing unit where the coils 200 are stored with an axial direction of the coils 200 facing toward an aligning direction of the holes 301 of the sheets 300 is provided at one side of the sheets 300 to be aligned in the sheet aligning unit 3, i.e., in front of the bookbinding apparatus 1A, the apparatus becomes large. Therefore, the coil supply unit 5A and the binding unit 4 are connected at the coil conveyance path 6A configured to bend the conveyance route of the coil 200 with respect to the axial direction of the coil 200, which is an example of the binding component, so that it is possible to improve a degree of freedom of arrangement of the coil supply unit 5A.

Also, the coil conveyance path 6A forms the curved conveyance path for conveying the coil 200 with being curved with respect to the axial direction of the coil 200 to one side end portion 303 of the sheets 300 aligned in the sheet aligning unit 3, at the position Pp that is distant from the side end portion 303 by a distance smaller than the length $L_{30}$ of one coil 200.

Thereby, it is not necessary to secure a space corresponding to an entire length of one coil 200 in the axial direction at one side of the sheets 300 to be aligned in the sheet aligning unit 3, i.e., in front of the bookbinding apparatus 1A, so that it is possible to avoid the apparatus from being enlarged.

Configuration Example of Bookbinding Apparatus of Second Embodiment

Figure 114:
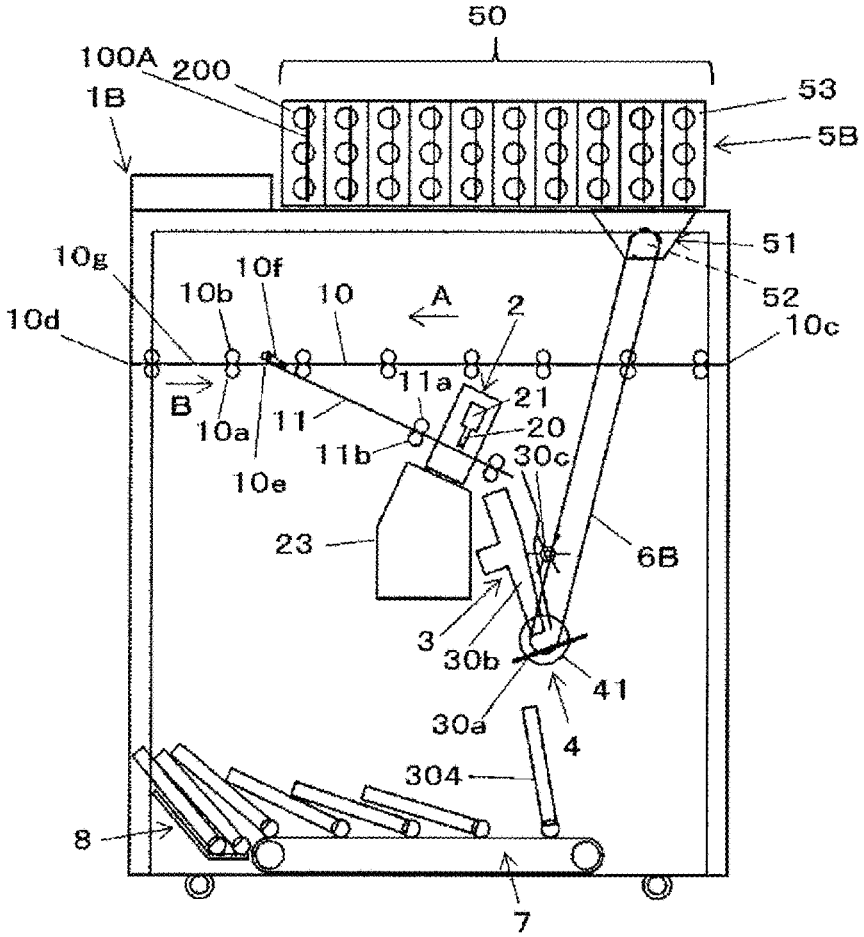
FIG. 114 is a front view depicting an outline of an internal configuration of the bookbinding apparatus of a second embodiment.
Figure 115:
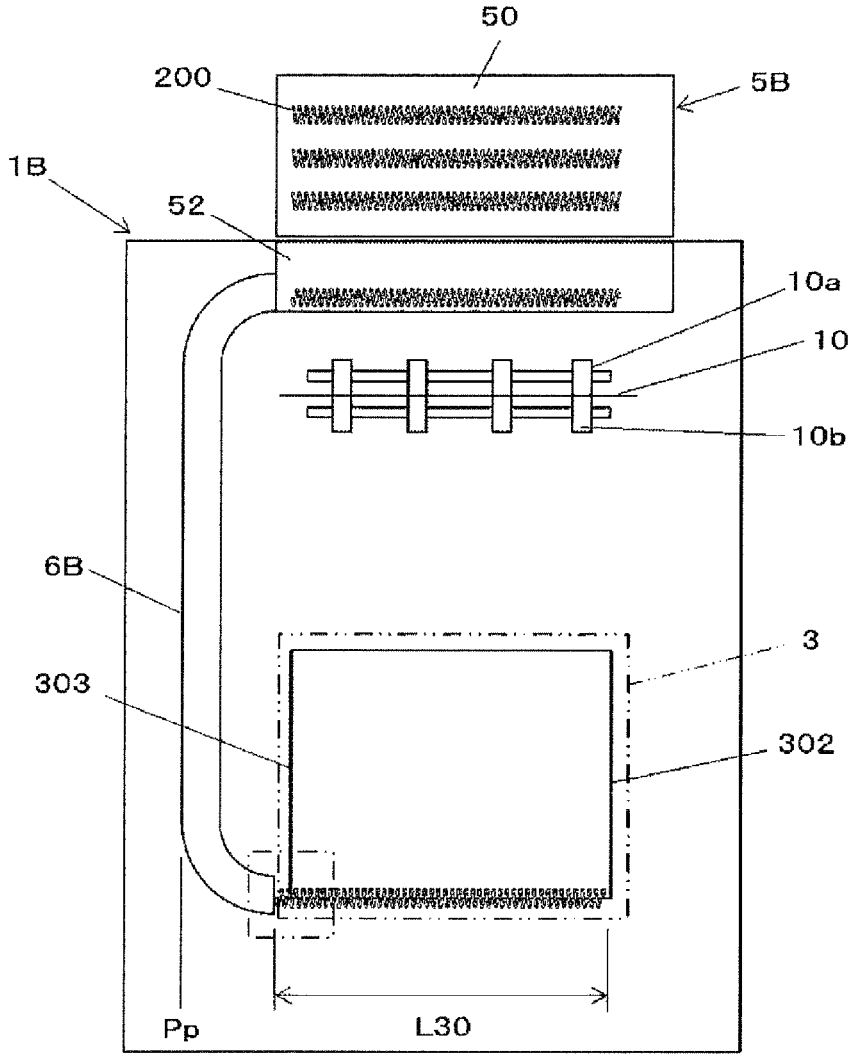
FIG. 115 is a side view of main parts depicting an outline of the internal configuration of the second embodiment.

FIGS. 114 and 115 depict an example of the bookbinding apparatus of a second embodiment. FIG. 114 is a front view depicting an outline of an internal configuration of the bookbinding apparatus of the second embodiment. FIG. 115 is a side view of main parts depicting an outline of the internal configuration of the second embodiment.

A bookbinding apparatus 1B of the second embodiment has the first conveyance path 10 configured to convey the sheet 300 and the second conveyance path 11 branched from the first conveyance path 10. The first conveyance path 10 and the second conveyance path 11 configure a switchback-type conveyance route configured to reverse a conveying direction of the sheet 300 on the way.

Also, the bookbinding apparatus 1B includes the punching unit 2 configured to form the holes 301 in a predetermined arrangement in the sheet 300, and the sheet aligning unit 3 configured to accumulate the sheets 300 having the holes 301 formed in the punching unit 2, to align the plurality of accumulated sheets 300, and to make the sheet bundle 302. In addition, the bookbinding apparatus 1B includes the binding unit 4 configured to bind the sheet bundle 302 aligned in the sheet aligning unit 3 with the coil 200 and to make the booklet 304, a coil supply unit 5B configured to supply the coil 200, and a coil conveyance path 6B configured to convey the coil 200 supplied from the coil supply unit 5B to the binding unit 4. Also, the bookbinding apparatus LB includes the discharging unit 7 configured to discharge the booklet 304 bound in the binding unit 4.

The first conveyance path 10 and the second conveyance path 11 are configured by a plurality of pairs of rollers provided along the conveyance route of the sheet 300, pairs of belts extending along the conveyance route of the sheet 300, a guide member configured to guide conveyance of the sheet 300, and the like.

In the second embodiment, the first conveyance path 10 includes the plurality of feed rollers 10*a* configured to rotatively drive, and the plurality of guide rollers 10*b* configured to face the feed rollers 10*a*. The second conveyance path 11 includes the plurality of feed rollers 11*a* configured to rotatively drive, and the plurality of guide rollers 11*b* configured to face the feed rollers 11*a*.

The first conveyance path 10 is arranged at an upper side in the bookbinding apparatus 1B, and configures a linear conveyance route for conveying the sheet 300 between the feeder port 10*c* and the discharge port 10*d*. The conveyance route is substantially horizontal.

The first conveyance path 10 includes the switching blade 10*f* configured to switch the conveying direction at the branch portion 10*e* of the first conveyance path 10 and the second conveyance path 11. Also, the first conveyance path 10 includes the reversal holding unit 10*g* between the branch portion 10*e* and the discharge port 10*d*.

The second conveyance path 11 is branched downstream from the first conveyance path 10 at the branch portion 10*e*, and is configured to communicate with the reversal holding unit 10*g* by an operation of the switching blade 10*f*.

The switching blade 10*f* is rotatively driven to move between the position at which it is retracted from the first conveyance path 10 and the position at which it protrudes into the first conveyance path 10. When the switching blade 10*f* is moved to the position at which it is retracted from the first conveyance path 10, the sheet 300, which is conveyed on the first conveyance path 10 in the conveying direction A from the feeder port 10*c*, is moved through the switching blade 10*f* and is conveyed to the reversal holding unit 10*g*.

On the contrary, when the switching blade 10*f* is moved to the position at which it protrudes into the first conveyance path 10, the sheet 300, which is conveyed on the first conveyance path 10 in the conveying direction B from the reversal holding unit 10*g* while reversing the conveying direction, is sent to the second conveyance path 11 from the first conveyance path 10 by the guide of the switching blade 10*f*.

Thereby, the second conveyance path 11 configures a conveyance route where the conveying direction of the sheet 300, which is conveyed on the first conveyance path 10 in the conveying direction A from the feeder port 10*c* side to the discharge port 10*d* side, is reversed to the conveying direction B at the reversal holding unit 10*g* and the sheet 300 is switched back downward from the first conveyance path 10.

The punching unit 2 is provided to the second conveyance path 11. The punching unit 2 includes the punch blades 20 configured to form the holes 301 in the sheet 300, and the hole-forming drive mechanism 21 configured to drive the punch blades 20.

In the punching unit 2, a predetermined number of punch blades 20 are arranged in one row. The hole-forming drive mechanism 21 is configured to reciprocally move the punch blades 20 in the direction perpendicular to a surface of the sheet 300. The punching unit 2 is configured to form the holes 301 in one row with predetermined intervals in the sheet 300 by positionally adjusting the sheet 300 in the conveying direction and positionally adjusting the sheet 300 in the width direction perpendicular to the conveying direction with the hole-forming position adjustment mechanism (not shown) and reciprocally moving the punch blades 20.

In the meantime, in order to collect punch chad generated when forming the holes 301 in the sheet 300 by the punch blades 20, the punch chad stacker 23 is provided below the punching unit 2.

The sheet aligning unit 3 is arranged downstream of the punching unit 2 with respect to the conveying direction of the sheet 300. The sheet aligning unit 3 includes the contact shutter 30*a* configured to positionally adjust a leading end of the sheet 300 in the conveying direction, the width aligning mechanism 30*b* configured to positionally adjust the sheet 300 in the right and left direction, and the paddle mechanism 30*c* configured to cause the sheet 300 to contact against the contact shutter 30*a*.

The contact shutter 30*a* is configured to open and close the sheet aligning unit 3 by moving between the position at which the contact shutter protrudes into the sheet aligning unit 3 and the sheet 300 sent to the sheet aligning unit 3 is thus contacted against the contact shutter and the position at which the contact shutter is retracted from the sheet aligning unit 3 and the booklet 304 can pass therethrough.

The width aligning mechanism 30*b* includes the width aligning guide at one side of the right and the left with respect to the conveying direction of the sheet 300 and the reference guide at the other side. The width aligning mechanism 30*b* is configured to move in a direction in which the width aligning guide is to approach and separate with respect to the reference guide, thereby causing the sheet 300 sent to the sheet aligning unit 3 to be contacted against the reference guide.

The paddle mechanism 30*c* includes the paddle roller having a plurality of tongue pieces arranged in a circumferential direction and configured to rotatively drive. The paddle mechanism 30*c* is configured to cause the sheet 300 sent to the sheet aligning unit 3 to be contacted against the contact shutter 30*a* protruding into the sheet aligning unit 3. In the meantime, the rotary shaft of the paddle roller is inclined in the guide direction of the fixed side (not shown) of the width aligning mechanism 30*b*. The paddle roller is also configured to apply a force, which causes the sheet 300 sent to the sheet aligning unit 3 to be contacted in the guide direction of the fixed side of the width aligning mechanism 30*b*, to the sheet 300.

The binding unit 4 includes the coil rotation/insertion unit 41 configured to bind the sheet bundle 302 aligned in the sheet aligning unit 3 by the coil 200. The coil rotation/insertion unit 41 is an example of the binding mechanism, and is configured to insert the coil 200 into the holes 301 of the sheet bundle 302, which is aligned and positionally adjusted in the sheet aligning unit 3, from one side end portion 303 of the sheet 300 while rotating the coil 200 around an axis and conveying the same in the axial direction.

The coil supply unit 5B of the second embodiment includes the coil storing unit 50 in which any one of the coil holding sheets 100A, 100A1, 100A2, 100A3, 100A4 of the first embodiment, any one of the coil holding sheets 100B, 100B2, 100B3, 100B4 of the second embodiment, any one of the coil holding sheets 100C, 100C2, 100C3, 100C4 of the third embodiment, the coil holding sheet 100D of the fourth embodiment, the coil holding sheet 100E of the fifth embodiment or the coil holding sheet 100F of the sixth embodiment, to which the coils 200 are held, is stored. In the below, the coil holding sheet 100A is exemplified.

Also, the coil supply unit 5B includes the coil separating unit 51 configured to separate the coils 200 from the coil holding sheet 100A. In addition, the coil supply unit 5B includes the coil feed unit 52 configured to feed the coils 200 separated from the coil separating unit 51, and the sheet collection unit 53 configured to collect the coil holding sheet 100A from which the coils 200 have been separated.

In the bookbinding apparatus 1B, a mounting position of the coil supply unit 5B is provided at an upper part of the apparatus main body. The coil supply unit 5B is mounted to the bookbinding apparatus 1B so that the axial direction of the coils 200 held to the coil holding sheet 100A faces toward a direction along a surface of the sheet bundle 302 aligned in the sheet aligning unit 3.

The coil supply unit 5B is provided to be inserted and removed with respect to the bookbinding apparatus 1B. In the second embodiment, the coil supply unit 5B can be inserted and removed forward from a front face side of the bookbinding apparatus 1B. Here, the front face side of the bookbinding apparatus 1B indicates one side of the first conveyance path 10 perpendicular to the conveying direction of the sheet 300.

When the coil supply unit 5B is drawn out from the bookbinding apparatus 1B, the coil holding sheet 100A having the coils 200 held thereto can be loaded into the coil storing unit 50, the coil holding sheet 100A loaded in the coil storing unit 50 can be replaced, and the coil holding sheet 100A from which the coils 200 have been separated can be taken out from the sheet collection unit 53.

In the coil storing unit 50, one coil holding sheet 100A capable of supporting the plurality of coils 200 is stored with the arranging direction of the coils 200 facing toward the vertical direction. In the coil supply unit 5B, a plurality of coil storing units 50 is provided in parallel, so that a plurality of coil holding sheets 100A can be stored therein.

The coil separating unit 51 is configured to separate the coils 200 one by one from the coil holding sheet 100A by conveying the coil holding sheet 100A having the coils 200 held thereto in each coil storing unit 50.

The coil feed unit 52 is provided at a position at which the coil 200 separated from the coil holding sheet 100A and rolled radially is to enter, and is configured to axially convey one coil 200 separated from the coil separating unit 51. The sheet collection unit 53 is provided in parallel with a back surface of each coil storing unit 50.

The coil conveyance path 6B of the second embodiment forms a curved conveyance path for conveying the coil 200 with being curved with respect to the axial direction of the coil 200 to the side end portion 303 of one side, which is a side at which the coil rotation/insertion unit 41 starts insertion of the coil 200, of the sheet bundle 302 aligned in the sheet aligning unit 3, at a position Pp that is distant from the side end portion 303 by a distance smaller than the length $L_{30}$ of one coil 200.

In the second embodiment, a feed direction of the coil 200 fed from the coil feed unit 52 and an introduction direction of the coil 200 into the coil rotation/insertion unit 41 are opposite to each other. Therefore, the coil conveyance path 6B forms a conveyance route bent into a U-shape.

The discharging unit 7 is configured by at least a pair of rollers, an endless belt put on the rollers, and the like, and is arranged below the sheet aligning unit 3. The discharging unit 7 forms a linear conveyance route for receiving the booklet 304 bound with the coil 200 and conveying the same to the sheet discharge stacker 8. The linear conveyance route is substantially horizontal. The discharging unit 7 is configured to convey the booklet 304 received from the sheet aligning unit 3 with being overturned.

The sheet discharge stacker 8 is arranged downstream of the discharging unit 7, and the booklet 304 conveyed from the discharging unit 7 is stacked thereon. The sheet discharge stacker 8 has a stacking surface having predetermined inclination. The sheet discharge stacker 8 is configured to erect and stack thereon the booklet 304 conveyed with being overturned from the discharging unit 5, in conformity to the inclination of the stacking surface.

Operation Example of Bookbinding Apparatus of Second Embodiment

Subsequently, an operation example of the bookbinding processing of binding the sheets with the bookbinding apparatus 1B is described with reference to each drawing.

The bookbinding apparatus 1B is connected to the image forming apparatus 500, and the sheets 300 on which predetermined processing such as printing has been performed are fed one by one from the feeder port 10*c*. During an operation of binding the sheets 300 with the coil 200, the conveying processing of conveying the sheet 300 to the punching unit 2 is performed, the hole forming processing is performed in the punching unit 2, and then the aligning processing is performed in the sheet aligning unit 3.

In the conveying processing of conveying the sheet 300 to the punching unit 2, the feed rollers 10*a* of the first conveyance path 10 are rotatively driven, so that the sheet 300 fed to the first conveyance path 10 is sandwiched between the feed rollers 10*a* and the guide rollers 10*b*, and is conveyed on the first conveyance path 10 in the conveying direction A from the feeder port 10*c* toward the discharge port 10*d*.

When it is determined that the sheet 300 being conveyed in the conveying direction A on the first conveyance path 10 has passed through the switching blade 10*f* and has been conveyed to the reversal holding unit 10*g*, the conveying of the sheet 300 is stopped. After stopping the conveying of the sheet 300, the switching blade 10*f* is driven to switch the conveyance route of the sheet 300 from the reversal holding unit 10*g* to the second conveyance path 11.

When the conveyance route is switched to the second conveyance path 11 by the switching blade 10*f*, the feed rollers 10*a* are rotated in a reverse direction in which the sheet 300 is to be conveyed in the conveying direction B. Also, the feed rollers 11*a* are rotated in a direction in which the sheet 300 on the second conveyance path 11 is to be conveyed to the punching unit 2.

Thereby, the conveying direction of the sheet 300 temporarily held with the reversal holding unit 10*g* is reversed, so that the sheet 300 is conveyed in the conveying direction B, and is sent from the first conveyance path 10 to the second conveyance path 11 with being guided by the switching blade 10*f*. The sheet 300 sent to the second conveyance path 11 is sandwiched between the feed rollers 11*a* and the guide rollers 11*b*, and is conveyed on the second conveyance path 11 toward the punching unit 2.

The sheet 300 conveyed to the punching unit 2 is positionally adjusted in the conveying direction of the sheet 300 and in the width direction perpendicular to the conveying direction of the sheet 300 by the hole-forming position adjustment mechanism (not shown).

When the sheet 300 is positionally adjusted, the punch blades 20 are reciprocally moved by the hole-forming drive mechanism 21, so that the sheet 300 is formed with the holes 301 with predetermined intervals.

The sheet 300 formed with the holes by the punching unit 2 is conveyed to the sheet aligning unit 3.

The leading end of the sheet 300 in the conveying direction is contacted against the contact shutter 30*a* protruding into the sheet aligning unit 3 by the paddle mechanism 30*c*, and side ends of the sheet 300 are contacted against the reference guide (not shown) of the width aligning mechanism 30*b*. Thereby, the sheet 300 being conveyed to the sheet aligning unit 3 is positionally adjusted.

The conveying processing, the hole forming processing and the aligning processing are repetitively performed until a predetermined number of the sheets 300 are aligned and accumulated in the sheet aligning unit 3. When the predetermined number of the sheets 300 are aligned, the series of the conveying processing, the hole forming processing and the aligning processing are stopped.

When the predetermined number of the sheets 300 are aligned in the sheet aligning unit 3, the contact shutter 30*a* is opened, and one coil 200 is separated from the coil holding sheet 100A stored in a predetermined coil storing unit 50 selected from the plurality of coil storing units 50 of the coil supply unit 5B.

The coil 200 separated from the coil holding sheet 100A is conveyed in the axial direction and is sent to the coil conveyance path 6B by the coil feed unit 52. As shown in FIG. 115, the conveying direction of the coil 200 in the coil supply unit 5B and the conveying direction of the coil 200 in the binding unit 4 are different by 180°. In the coil conveyance path 6B, the conveyance route of the coil 200 is bent by 180°.

Thereby, the coil 200 being conveyed at the coil feed unit 52 from the coil supply unit 5B is sent to the binding unit 4. The coil 200 sent to the binding unit 4 is axially conveyed with being rotated in the circumferential direction by the coil rotation/insertion unit 41, so that the coil is inserted into the holes 301 of the sheet bundle 302 aligned and positionally adjusted in the sheet aligning unit 3 from one side end portion 303 of the sheets 300.

The booklet 304 bound with the coil 200 is dropped to the discharging unit 7. The discharging unit 7 overturns and conveys the booklet 304 received from the sheet aligning unit 3 to the sheet discharge stacker 8. The sheet discharge stacker 8 erects and stacks thereon the booklet 304 being conveyed with being overturned from the discharging unit 7.

Examples of Effect of Bookbinding Apparatus of Second Embodiment

In the bookbinding apparatus 1B, the conveying processing of the sheet 300, the hole forming processing of the sheet 300, the aligning processing of the sheet 300, the binding processing of the sheet bundle 302 by the coil 200 and the discharge processing of the booklet 304 bound with the coil 200 are automatically performed. Therefore, it is not necessary for a person to align the sheet 300, to place the sheet bundle 302, to place the coils 200 one by one, and to take out the booklet 304 with a hand. Thereby, it is possible to collectively perform the printing processing and the bookbinding processing by connecting the bookbinding apparatus 1B to the image forming apparatus 500 and the like.

In the bookbinding processing of using the coil 200, the coil 200 is axially conveyed with being rotated in the circumferential direction, and is inserted into the holes 301 from one side end portion 303 of the sheets 300. For this reason, it is necessary to secure a space for conveying the coil 200 at a side of the sheets 300.

In the meantime, in the case of the configuration where the plurality of coils 200 is stored, if a storing unit where the coils 200 are stored with an axial direction of the coils 200 facing toward an aligning direction of the holes 301 of the sheets 300 is provided at one side of the sheets 300 to be aligned in the sheet aligning unit 3, i.e., in front of the bookbinding apparatus 1B, the apparatus becomes large. Therefore, the coil supply unit 5B and the binding unit 4 are connected at the coil conveyance path 6B configured to bend the conveyance route of the coil 200 with respect to the axial direction of the coil 200, so that it is possible to improve a degree of freedom of arrangement of the coil supply unit 5B.

In the second embodiment, the coil supply unit 5B is provided at the upper part of the bookbinding apparatus 1B, so that it is possible to arrange in parallel the plurality of coil storing units 50 and to increase the number of the coils 200 to be stored.

Also, the coil conveyance path 6B forms the curved conveyance path for conveying the coil 200 with being curved with respect to the axial direction of the coil 200 to one side end portion 303 of the sheets 300 aligned in the sheet aligning unit 3, at the position Pp that is distant from the side end portion 303 by a distance smaller than the length $L_{30}$ of one coil 200.

Thereby, it is not necessary to secure a space corresponding to an entire length of one coil 200 in the axial direction at one side of the sheets 300 to be aligned in the sheet aligning unit 3, i.e., in front of the bookbinding apparatus 1B, so that it is possible to avoid the apparatus from being enlarged.

Configuration Example of Bookbinding Apparatus of Third Embodiment

Figure 116:
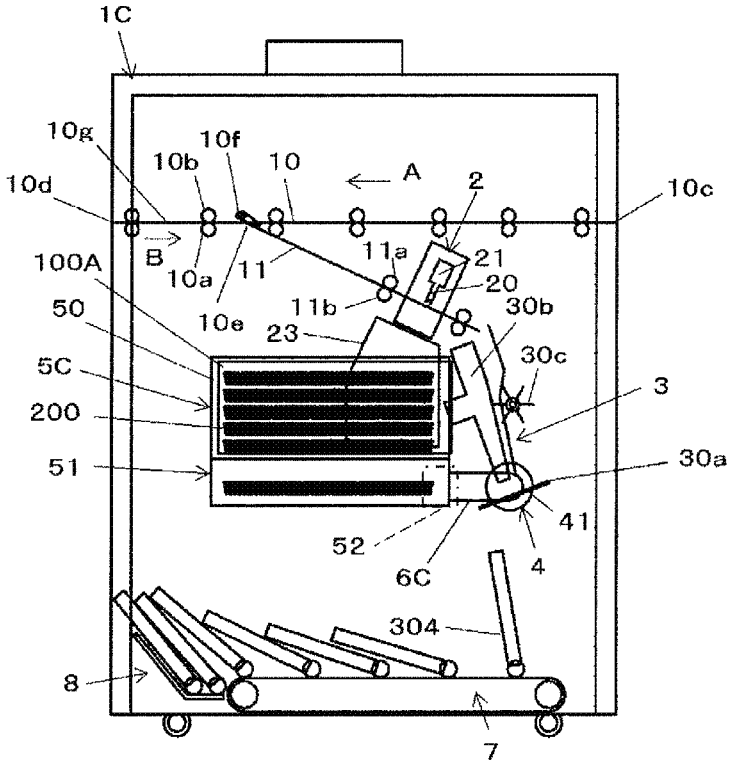
FIG. 116 is a front view depicting an outline of the internal configuration of the bookbinding apparatus of a third embodiment.
Figure 117:
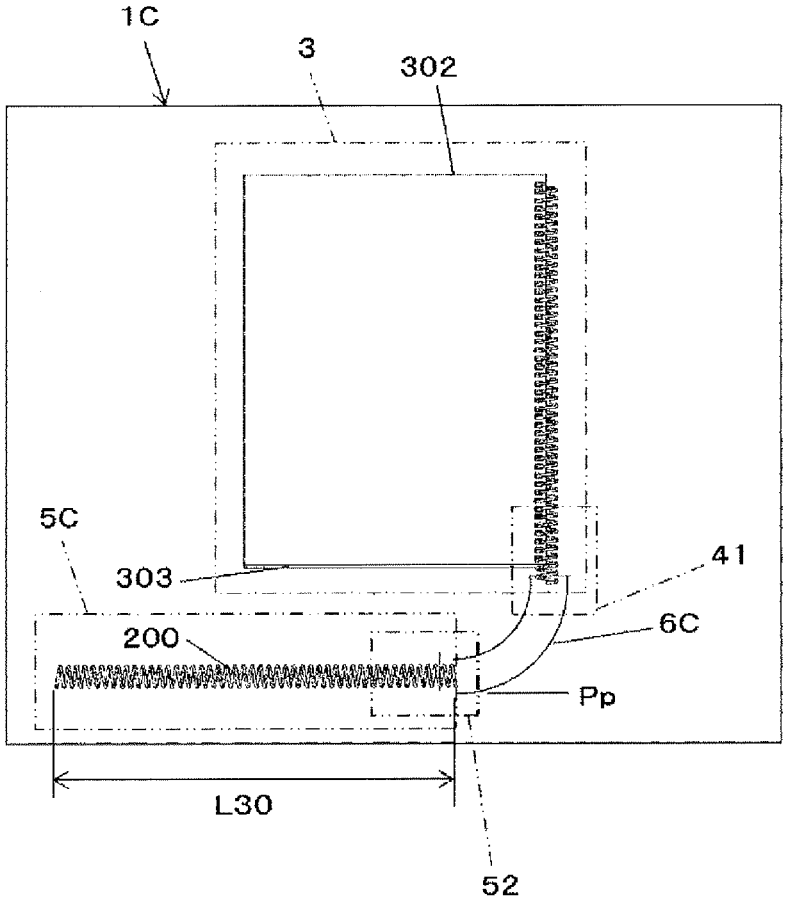
FIG. 117 is a plan view of main parts depicting an outline of the internal configuration of the bookbinding apparatus of the third embodiment.

FIGS. 116 and 117 depict an example of the bookbinding apparatus of a third embodiment. FIG. 116 is a front view depicting an outline of an internal configuration of the bookbinding apparatus of the third embodiment. FIG. 117 is a plan view of main parts depicting an outline of the internal configuration of the third embodiment.

A bookbinding apparatus 1C of the second embodiment has the first conveyance path 10 configured to convey the sheet 300 and the second conveyance path 11 branched from the first conveyance path 10. The first conveyance path 10 and the second conveyance path 11 configure a switchback-type conveyance route configured to reverse a conveying direction of the sheet 300 on the way.

Also, the bookbinding apparatus 1C includes the punching unit 2 configured to form the holes 301 in a predetermined arrangement in the sheet 300, and the sheet aligning unit 3 configured to accumulate the sheets 300 having the holes 301 formed in the punching unit 2, to align the plurality of accumulated sheets 300, and to make the sheet bundle 302. In addition, the bookbinding apparatus 1C includes the binding unit 4 configured to bind the sheet bundle 302 aligned in the sheet aligning unit 3 with the coil 200 and to make the booklet 304, a coil supply unit 5C configured to supply the coil 200, and a coil conveyance path 6C configured to convey the coil 200 supplied from the coil supply unit 5B to the binding unit 4. Also, the bookbinding apparatus 1C includes the discharging unit 7 configured to discharge the booklet 304 bound in the binding unit 4.

The first conveyance path 10 and the second conveyance path 11 are configured by a plurality of pairs of rollers provided along the conveyance route of the sheet 300, pairs of belts extending along the conveyance route of the sheet 300, a guide member configured to guide conveyance of the sheet 300, and the like.

In the third embodiment, the first conveyance path 10 includes the plurality of feed rollers 10*a* configured to rotatively drive, and the plurality of guide rollers 10*b* configured to face the feed rollers 10*a*. The second conveyance path 11 includes the plurality of feed rollers 11*a* configured to rotatively drive, and the plurality of guide rollers 11*b* configured to face the feed rollers 11*a*.

The first conveyance path 10 is arranged at an upper side in the bookbinding apparatus 1C, and configures a linear conveyance route for conveying the sheet 300 between the feeder port 10*c* and the discharge port 10*d*. The conveyance route is substantially horizontal.

The first conveyance path 10 includes the switching blade 10*f* configured to switch the conveying direction at the branch portion 10*e* of the first conveyance path 10 and the second conveyance path 11. Also, the first conveyance path 10 includes the reversal holding unit 10*g* between the branch portion 10*e* and the discharge port 10*d*.

The second conveyance path 11 is branched downstream from the first conveyance path 10 at the branch portion 10*e*, and is configured to communicate with the reversal holding unit 10*g* by an operation of the switching blade 10*f*.

The switching blade 10*f* is rotatively driven to move between the position at which it is retracted from the first conveyance path 10 and the position at which it protrudes into the first conveyance path 10. When the switching blade 10*f* is moved to the position at which it is retracted from the first conveyance path 10, the sheet 300, which is conveyed on the first conveyance path 10 in the conveying direction A from the feeder port 10*c*, is moved through the switching blade 10*f* and is conveyed to the reversal holding unit 100*g*.

On the contrary, when the switching blade 10*f* is moved to the position at which it protrudes into the first conveyance path 10, the sheet 300, which is conveyed on the first conveyance path 10 in the conveying direction B from the reversal holding unit 10*g* while reversing the conveying direction, is sent to the second conveyance path 11 from the first conveyance path 10 by the guide of the switching blade 10*f*.

Thereby, the second conveyance path 11 configures a conveyance route where the conveying direction of the sheet 300, which is conveyed on the first conveyance path 10 in the conveying direction A from the feeder port 10*c* side to the discharge port 10*d* side, is reversed to the conveying direction B at the reversal holding unit 10*g* and the sheet 300 is switched back downward from the first conveyance path 10.

The punching unit 2 is provided to the second conveyance path 11. The punching unit 2 includes the punch blades 20 configured to form the holes 301 in the sheet 300, and the hole-forming drive mechanism 21 configured to drive the punch blades 20.

In the punching unit 2, a predetermined number of punch blades 20 are arranged in one row. The hole-forming drive mechanism 21 is configured to reciprocally move the punch blades 20 in the direction perpendicular to a surface of the sheet 300. The punching unit 2 is configured to form the holes 301 in one row with predetermined intervals in the sheet 300 by positionally adjusting the sheet 300 in the conveying direction and positionally adjusting the sheet 300 in the width direction perpendicular to the conveying direction with the hole-forming position adjustment mechanism (not shown) and reciprocally moving the punch blades 20.

In the meantime, in order to collect punch chad generated when forming the holes 301 in the sheet 300 by the punch blades 20, the punch chad stacker 23 is provided below the punching unit 2.

The sheet aligning unit 3 is arranged downstream of the punching unit 2 with respect to the conveying direction of the sheet 300. The sheet aligning unit 3 includes the contact shutter 30*a* configured to positionally adjust a leading end of the sheet 300 in the conveying direction, the width aligning mechanism 30*b* configured to positionally adjust the sheet 300 in the right and left direction, and the paddle mechanism 30*c* configured to cause the sheet 300 to contact against the contact shutter 30*a*.

The contact shutter 30*a* is configured to open and close the sheet aligning unit 3 by moving between the position at which the contact shutter protrudes into the sheet aligning unit 3 and the sheet 300 sent to the sheet aligning unit 3 is thus contacted against the contact shutter and the position at which the contact shutter is retracted from the sheet aligning unit 3 and the booklet 304 can pass therethrough.

The width aligning mechanism 30*b* includes the width aligning guide at one side of the right and the left with respect to the conveying direction of the sheet 300 and the reference guide at the other side. The width aligning mechanism 30*b* is configured to move in a direction in which the width aligning guide is to approach and separate with respect to the reference guide, thereby causing the sheet 300 sent to the sheet aligning unit 3 to be contacted against the reference guide.

The paddle mechanism 30*c* includes the paddle roller having a plurality of tongue pieces arranged in a circumferential direction and configured to rotatively drive. The paddle mechanism 30*c* is configured to cause the sheet 300 sent to the sheet aligning unit 3 to be contacted against the contact shutter 30*a* protruding into the sheet aligning unit 3. In the meantime, the rotary shaft of the paddle roller is inclined in the guide direction of the fixed side (not shown) of the width aligning mechanism 30*b*. The paddle roller is also configured to apply a force, which causes the sheet 300 sent to the sheet aligning unit 3 to be contacted in the guide direction of the fixed side of the width aligning mechanism 30*b*, to the sheet 300.

The binding unit 4 includes the coil rotation/insertion unit 41 configured to bind the sheet bundle 302 aligned in the sheet aligning unit 3 by the coil 200. The coil rotation/insertion unit 41 is an example of the binding mechanism, and is configured to insert the coil 200 into the holes 301 of the sheet bundle 302, which is aligned and positionally adjusted in the sheet aligning unit 3, from one side end portion 303 of the sheet 300 while rotating the coil 200 around an axis and conveying the same in the axial direction.

The coil supply unit 5C of the third embodiment includes the coil storing unit 50 in which any one of the coil holding sheets 100A, 100A1, 100A2, 100A3, 100A4 of the first embodiment, any one of the coil holding sheets 100B, 100B2, 100B3, 100B4 of the second embodiment, any one of the coil holding sheets 100C, 100C2, 100C3, 100C4 of the third embodiment, the coil holding sheet 100D of the fourth embodiment, the coil holding sheet 100E of the fifth embodiment or the coil holding sheet 100F of the sixth embodiment, to which the coils 200 are held, is stored. In the below, the coil holding sheet 100A is exemplified.

Also, the coil supply unit 5C includes the coil separating unit 51 configured to separate the coils 200 from the coil holding sheet 100A. In addition, the coil supply unit 5B includes the coil feed unit 52 configured to feed the coils 200 separated from the coil separating unit 51, and a sheet collection unit (not shown) configured to collect the coil holding sheet 100A from which the coils 200 have been separated.

In the bookbinding apparatus 1C, a mounting position of the coil supply unit 5C is provided below the first conveyance path 10 and in front of the sheet aligning unit 3. The coil supply unit 5C is mounted to the bookbinding apparatus 1C so that the axial direction of the coils 200 held to the coil holding sheet 100A faces toward a direction along a side end portion 303 of the sheet bundle 302 aligned in the sheet aligning unit 3.

The coil supply unit 5C is provided to be inserted and removed with respect to the bookbinding apparatus 1C. In the third embodiment, the coil supply unit 5C can be inserted and removed forward from a front face side of the bookbinding apparatus 1C. Here, the front face side of the bookbinding apparatus 1C indicates one side of the first conveyance path 10 perpendicular to the conveying direction of the sheet 300. In order to insert and remove the coil supply unit 5C from the front face side of the bookbinding apparatus 1C, a space through which the coil supply unit 5C can pass is formed between the coil supply unit 5C and the front face of the bookbinding apparatus 1C.

When the coil supply unit 5C is drawn out from the bookbinding apparatus 1C, the coil holding sheet 100A having the coils 200 held thereto can be loaded into the coil storing unit 50, the coil holding sheet 100A loaded in the coil storing unit 50 can be replaced, and the coil holding sheet 100A from which the coils 200 have been separated can be taken out from the sheet collection unit 53.

In the coil storing unit 50, one coil holding sheet 100A capable of supporting the plurality of coils 200 is stored with an arranging direction of the coils 200 facing toward the vertical direction.

The coil separating unit 51 is configured to separate the coils 200 one by one from the coil holding sheet 100A by conveying the coil holding sheet 100A having the coils 200 held thereto.

The coil feed unit 52 is provided at a position at which the coil 200 separated from the coil holding sheet 100A and rolled radially is to enter, and is configured to axially convey one coil 200 separated from the coil separating unit 51.

The coil conveyance path 6C of the third embodiment forms a curved conveyance path for conveying the coil 200 with being curved with respect to the axial direction of the coil 200 to the side end portion 303 of one side, which is a side at which the coil rotation/insertion unit 41 starts insertion of the coil 200, of the sheet bundle 302 aligned in the sheet aligning unit 3, at a position Pp that is distant from the side end portion 303 by a distance smaller than the length $L_{30}$ of one coil 200.

In the third embodiment, a feed direction of the coil 200 fed from the coil feed unit 52 and an introduction direction of the coil 200 into the coil rotation/insertion unit 41 are opposite to each other. Therefore, the coil conveyance path 6C forms a conveyance route bent into an L-shape.

The discharging unit 7 is configured by at least a pair of rollers, an endless belt put on the rollers, and the like, and is arranged below the sheet aligning unit 3. The discharging unit 7 forms a linear conveyance route for receiving the booklet 304 bound with the coil 200 and conveying the same to the sheet discharge stacker 8. The linear conveyance route is substantially horizontal. The discharging unit 7 is configured to convey the booklet 304 received from the sheet aligning unit 3 with being overturned.

The sheet discharge stacker 8 is arranged downstream of the discharging unit 7, and the booklet 304 conveyed from the discharging unit 7 is stacked thereon. The sheet discharge stacker 8 has a stacking surface having predetermined inclination. The sheet discharge stacker 8 is configured to erect and stack thereon the booklet 304 conveyed with being overturned from the discharging unit 5, in conformity to the inclination of the stacking surface.

Operation Example of Bookbinding Apparatus of Third Embodiment

Subsequently, an operation example of the bookbinding processing of binding the sheets with the bookbinding apparatus 1C is described with reference to each drawing.

The bookbinding apparatus 1C is connected to the image forming apparatus 500, and the sheets 300 on which predetermined processing such as printing has been performed are fed one by one from the feeder port 10*c*. During an operation of binding the sheets 300 with the coil 200, the conveying processing of conveying the sheet 300 to the punching unit 2 is performed, the hole forming processing is performed in the punching unit 2, and then the aligning processing is performed in the sheet aligning unit 3.

In the conveying processing of conveying the sheet 300 to the punching unit 2, the feed rollers 10*a* of the first conveyance path 10 are rotatively driven, so that the sheet 300 fed to the first conveyance path 10 is sandwiched between the feed rollers 10*a* and the guide rollers 10*b*, and is conveyed on the first conveyance path 10 in the conveying direction A from the feeder port 10*c* toward the discharge port 10*d*.

When it is determined that the sheet 300 being conveyed in the conveying direction A on the first conveyance path 10 has passed through the switching blade 10*f* and has been conveyed to the reversal holding unit 10*g*, the conveying of the sheet 300 is stopped. After stopping the conveying of the sheet 300, the switching blade 10*f* is driven to switch the conveyance route of the sheet 300 from the reversal holding unit 10*g* to the second conveyance path 11.

When the conveyance route is switched to the second conveyance path 11 by the switching blade 10*f*, the feed rollers 10*a* are rotated in a reverse direction in which the sheet 300 is to be conveyed in the conveying direction B. Also, the feed rollers 11*a* are rotated in a direction in which the sheet 300 on the second conveyance path 11 is to be conveyed to the punching unit 2.

Thereby, the conveying direction of the sheet 300 temporarily held with the reversal holding unit 10*g* is reversed, so that the sheet 300 is conveyed in the conveying direction B, and is sent from the first conveyance path 10 to the second conveyance path 11 with being guided by the switching blade 10*f*. The sheet 300 sent to the second conveyance path 11 is sandwiched between the feed rollers 11*a* and the guide rollers 11*b*, and is conveyed on the second conveyance path 11 toward the punching unit 2.

The sheet 300 conveyed to the punching unit 2 is positionally adjusted in the conveying direction of the sheet 300 and in the width direction perpendicular to the conveying direction of the sheet 300 by the hole-forming position adjustment mechanism (not shown).

When the sheet 300 is positionally adjusted, the punch blades 20 are reciprocally moved by the hole-forming drive mechanism 21, so that the sheet 300 is formed with the holes 301 with predetermined intervals.

The sheet 300 formed with the holes by the punching unit 2 is conveyed to the sheet aligning unit 3.

The leading end of the sheet 300 in the conveying direction is contacted against the contact shutter 30*a* protruding into the sheet aligning unit 3 by the paddle mechanism 30*c*, and side ends of the sheet 300 are contacted against the reference guide (not shown) of the width aligning mechanism 30*b*. Thereby, the sheet 300 being conveyed to the sheet aligning unit 3 is positionally adjusted.

The conveying processing, the hole forming processing and the aligning processing are repetitively performed until a predetermined number of the sheets 300 are aligned and accumulated in the sheet aligning unit 3. When the predetermined number of the sheets 300 are aligned, the series of the conveying processing, the hole forming processing and the aligning processing are stopped.

When the predetermined number of the sheets 300 are aligned in the sheet aligning unit 3, one coil 200 is separated from the coil holding sheet 100A stored in the coil storing unit 50 of the coil supply unit 5C.

The coil 200 separated from the coil holding sheet 100A is conveyed in the axial direction of the coil 200 and is sent to the coil conveyance path 6C by the coil feed unit 52. As shown in FIG. 117, the conveying direction of the coil 200 in the coil supply unit 5C and the conveying direction of the coil 200 in the binding unit 4 are different by 90°. In the coil conveyance path 6C, the conveyance route of the coil 200 is bent by 90°.

Thereby, the coil 200 being conveyed at the coil feed unit 52 from the coil supply unit 5C is sent to the binding unit 4. The coil 200 sent to the binding unit 4 is axially conveyed with being rotated in the circumferential direction by the coil rotation/insertion unit 41, so that the coil is inserted into the holes 301 of the sheet bundle 302 aligned and positionally adjusted in the sheet aligning unit 3 from one side end portion 303 of the sheets 300.

The booklet 304 bound with the coil 200 is dropped to the discharging unit 7 by opening the contact shutter 30*a*. The discharging unit 7 overturns and conveys the booklet 304 received from the sheet aligning unit 3 to the sheet discharge stacker 8. The sheet discharge stacker 8 erects and stacks thereon the booklet 304 being conveyed with being overturned from the discharging unit 7.

Examples of Effect of Bookbinding Apparatus of Third Embodiment

In the bookbinding apparatus 1C, the conveying processing of the sheet 300, the hole forming processing of the sheet 300, the aligning processing of the sheet 300, the binding processing of the sheet bundle 302 by the coil 200 and the discharge processing of the booklet 304 bound with the coil 200 are automatically performed. Therefore, it is not necessary for a person to align the sheet 300, to place the sheet bundle 302, to place the coils 200 one by one, and to take out the booklet 304 with a hand. Thereby, it is possible to collectively perform the printing processing and the bookbinding processing by connecting the bookbinding apparatus 1C to the image forming apparatus 500 and the like.

In the bookbinding processing of using the coil 200, the coil 200 is axially conveyed with being rotated in the circumferential direction, and is inserted into the holes 301 from one side end portion 303 of the sheets 300. For this reason, it is necessary to secure a space for conveying the coil 200 at a side of the sheets 300.

In the meantime, in the case of the configuration where the plurality of coils 200 is stored, if a storing unit where the coils 200 are stored with an axial direction of the coils 200 facing toward an aligning direction of the holes 301 of the sheets 300 is provided at one side of the sheets 300 to be aligned in the sheet aligning unit 3, i.e., in front of the bookbinding apparatus 1C, the apparatus becomes large. Therefore, the coil supply unit 5C and the binding unit 4 are connected at the coil conveyance path 6C configured to bend the conveyance route of the coil 200 with respect to the axial direction of the coil 200, so that it is possible to improve a degree of freedom of arrangement of the coil supply unit 5C.

Also, the coil conveyance path 6C forms the curved conveyance path for conveying the coil 200 with being curved with respect to the axial direction of the coil 200 to one side end portion 303 of the sheets 300 aligned in the sheet aligning unit 3, at the position Pp that is distant from the side end portion 303 by a distance smaller than the length $L_{30}$ of one coil 200.

Thereby, even with the configuration where the coil supply unit 5C is provided at one side of the sheets 300 to be aligned in the sheet aligning unit 3, i.e., in front of the sheet aligning unit 3, it is not necessary to secure a space corresponding to an entire length of one coil 200 in the axial direction in front of the bookbinding apparatus 1C, so that it is possible to avoid the apparatus from being enlarged.

Configuration Example of Bookbinding Apparatus of Fourth Embodiment

Figure 118:
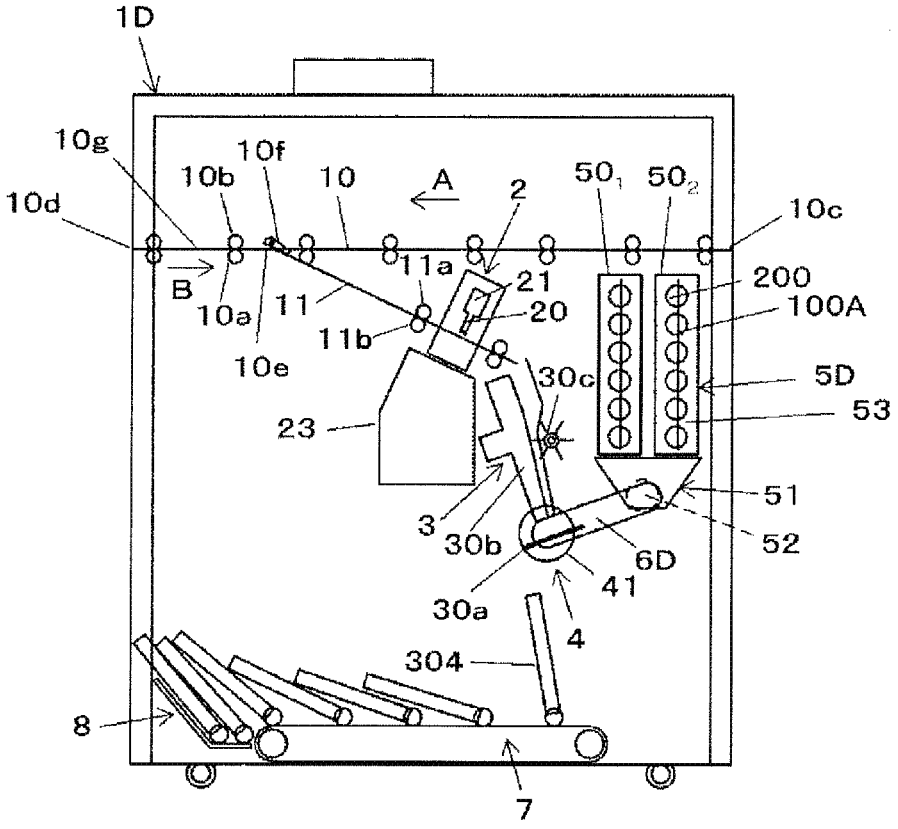
FIG. 118 is a front view depicting an outline of the internal configuration of the bookbinding apparatus of a fourth embodiment.
Figure 119:
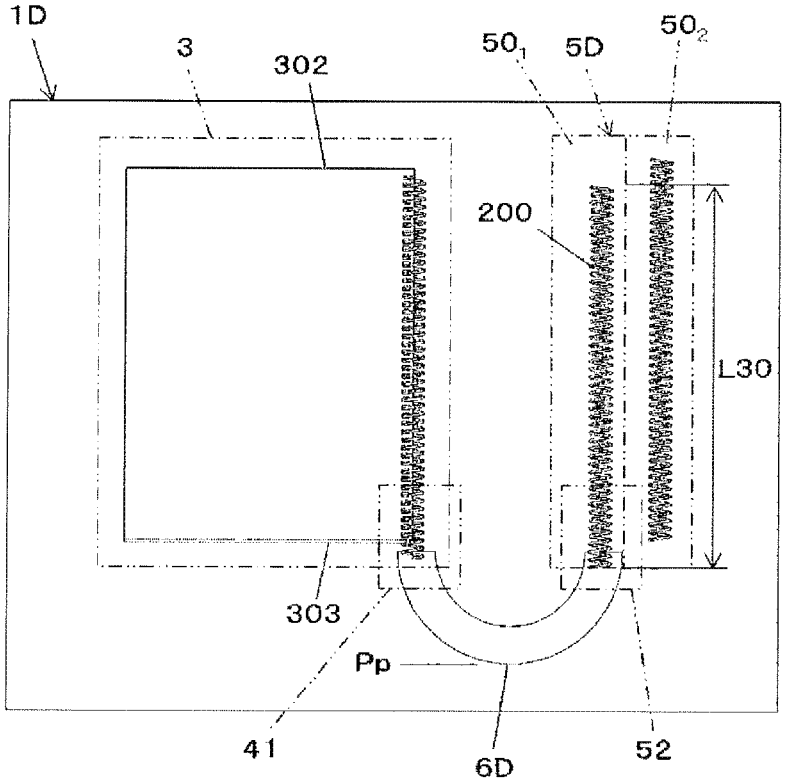
FIG. 119 is a plan view of main parts depicting an outline of the internal configuration of the bookbinding apparatus of the fourth embodiment.

FIGS. 118 and 119 depict an example of a bookbinding apparatus of a fourth embodiment. FIG. 118 is a front view depicting an outline of an internal configuration of the bookbinding apparatus of the fourth embodiment. FIG. 119 is a plan view of main parts depicting an outline of the internal configuration of the fourth embodiment.

A bookbinding apparatus 1D of the fourth embodiment has the first conveyance path 10 configured to convey the sheet 300 and the second conveyance path 11 branched from the first conveyance path 10. The first conveyance path 10 and the second conveyance path 11 configure a switchback-type conveyance route configured to reverse a conveying direction of the sheet 300 on the way.

Also, the bookbinding apparatus 1D includes the punching unit 2 configured to form the holes 301 in a predetermined arrangement in the sheet 300, and the sheet aligning unit 3 configured to accumulate the sheets 300 having the holes 301 formed in the punching unit 2, to align the plurality of accumulated sheets 300, and to make the sheet bundle 302. In addition, the bookbinding apparatus 1D includes the binding unit 4 configured to bind the sheet bundle 302 aligned in the sheet aligning unit 3 with the coil 200 and to make the booklet 304, a coil supply unit 5D configured to supply the coil 200, and a coil conveyance path 6D configured to convey the coil 200 supplied from the coil supply unit 5B to the binding unit 4. Also, the bookbinding apparatus 1D includes the discharging unit 7 configured to discharge the booklet 304 bound in the binding unit 4.

The first conveyance path 10 and the second conveyance path 11 are configured by a plurality of pairs of rollers provided along the conveyance route of the sheet 300, pairs of belts extending along the conveyance route of the sheet 300, a guide member configured to guide conveyance of the sheet 300, and the like.

In the fourth embodiment, the first conveyance path 10 includes the plurality of feed rollers 10*a* configured to rotatively drive, and the plurality of guide rollers 10*b* configured to face the feed rollers 10*a*. The second conveyance path 11 includes the plurality of feed rollers 11*a* configured to rotatively drive, and the plurality of guide rollers 11*b* configured to face the feed rollers 11*a*.

The first conveyance path 10 is arranged at an upper side in the bookbinding apparatus 1D, and configures a linear conveyance route for conveying the sheet 300 between the feeder port 10*c* and the discharge port 10*d*. The conveyance route is substantially horizontal.

The first conveyance path 10 includes the switching blade 10*f* configured to switch the conveying direction at the branch portion 10*e* of the first conveyance path 10 and the second conveyance path 11. Also, the first conveyance path 10 includes the reversal holding unit 10*g* between the branch portion 10*e* and the discharge port 10*d*.

The second conveyance path 11 is branched downstream from the first conveyance path 10 at the branch portion 10*e*, and is configured to communicate with the reversal holding unit 10*g* by an operation of the switching blade 10*f*.

The switching blade 10*f* is rotatively driven to move between the position at which it is retracted from the first conveyance path 10 and the position at which it protrudes into the first conveyance path 10. When the switching blade 10*f* is moved to the position at which it is retracted from the first conveyance path 10, the sheet 300, which is conveyed on the first conveyance path 10 in the conveying direction A from the feeder port 10*c*, is moved through the switching blade 10*f* and is conveyed to the reversal holding unit 10*g*.

On the contrary, when the switching blade 10*f* is moved to the position at which it protrudes into the first conveyance path 10, the sheet 300, which is conveyed on the first conveyance path 10 in the conveying direction B from the reversal holding unit 10*g* while reversing the conveying direction, is sent to the second conveyance path 11 from the first conveyance path 10 by the guide of the switching blade 10*f*.

Thereby, the second conveyance path 11 configures a conveyance route where the conveying direction of the sheet 300, which is conveyed on the first conveyance path 10 in the conveying direction A from the feeder port 10*c* side to the discharge port 10*d* side, is reversed to the conveying direction B at the reversal holding unit 10*g* and the sheet 300 is switched back downward from the first conveyance path 10.

The punching unit 2 is provided to the second conveyance path 11. The punching unit 2 includes the punch blades 20 configured to form the holes 301 in the sheet 300, and the hole-forming drive mechanism 21 configured to drive the punch blades 20.

In the punching unit 2, a predetermined number of punch blades 20 are arranged in one row. The hole-forming drive mechanism 21 is configured to reciprocally move the punch blades 20 in the direction perpendicular to a surface of the sheet 300. The punching unit 2 is configured to form the holes 301 in one row with predetermined intervals in the sheet 300 by positionally adjusting the sheet 300 in the conveying direction and positionally adjusting the sheet 300 in the width direction perpendicular to the conveying direction with the hole-forming position adjustment mechanism (not shown) and reciprocally moving the punch blades 20.

In the meantime, in order to collect punch chad generated when forming the holes 301 in the sheet 300 by the punch blades 20, the punch chad stacker 23 is provided below the punching unit 2.

The sheet aligning unit 3 is arranged downstream of the punching unit 2 with respect to the conveying direction of the sheet 300. The sheet aligning unit 3 includes the contact shutter 30*a* configured to positionally adjust a leading end of the sheet 300 in the conveying direction, the width aligning mechanism 30*b* configured to positionally adjust the sheet 300 in the right and left direction, and the paddle mechanism 30*c* configured to cause the sheet 300 to contact against the contact shutter 30*a*.

The contact shutter 30*a* is configured to open and close the sheet aligning unit 3 by moving between the position at which the contact shutter protrudes into the sheet aligning unit 3 and the sheet 300 sent to the sheet aligning unit 3 is thus contacted against the contact shutter and the position at which the contact shutter is retracted from the sheet aligning unit 3 and the booklet 304 can pass therethrough.

The width aligning mechanism 30*b* includes the width aligning guide at one side of the right and the left with respect to the conveying direction of the sheet 300 and the reference guide at the other side. The width aligning mechanism 30*b* is configured to move in a direction in which the width aligning guide is to approach and separate with respect to the reference guide, thereby causing the sheet 300 sent to the sheet aligning unit 3 to be contacted against the reference guide.

The paddle mechanism 30*c* includes the paddle roller having a plurality of tongue pieces arranged in a circumferential direction and configured to rotatively drive. The paddle mechanism 30*c* is configured to cause the sheet 300 sent to the sheet aligning unit 3 to be contacted against the contact shutter 30*a* protruding into the sheet aligning unit 3. In the meantime, the rotary shaft of the paddle roller is inclined in the guide direction of the fixed side (not shown) of the width aligning mechanism 30*b*. The paddle roller is also configured to apply a force, which causes the sheet 300 sent to the sheet aligning unit 3 to be contacted in the guide direction of the fixed side of the width aligning mechanism 30*b*, to the sheet 300.

The binding unit 4 includes the coil rotation/insertion unit 41 configured to bind the sheet bundle 302 aligned in the sheet aligning unit 3 by the coil 200. The coil rotation/insertion unit 41 is an example of the binding mechanism, and is configured to insert the coil 200 into the holes 301 of the sheet bundle 302, which is aligned and positionally adjusted in the sheet aligning unit 3, from one side end portion 303 of the sheet 300 while rotating the coil 200 around an axis and conveying the same in the axial direction.

The coil supply unit 5D of the fourth embodiment includes the coil storing unit 50 in which any one of the coil holding sheets 100A, 100A1, 100A2, 100A3, 100A4 of the first embodiment, any one of the coil holding sheets 100B, 100B2, 100B3, 100B4 of the second embodiment, any one of the coil holding sheets 100C, 100C2, 100C3, 100C4 of the third embodiment, the coil holding sheet 100D of the fourth embodiment, the coil holding sheet 100E of the fifth embodiment or the coil holding sheet 100F of the sixth embodiment, to which the coils 200 are held, is stored. In the below, the coil holding sheet 100A is exemplified.

Also, the coil supply unit 5D includes the coil separating unit 51 configured to separate the coils 200 from the coil holding sheet 100A. In addition, the coil supply unit 5D includes the coil feed unit 52 configured to feed the coils 200 separated from the coil separating unit 51, and the sheet collection unit 53 configured to collect the coil holding sheet 100A from which the coils 200 have been separated.

In the bookbinding apparatus 1D, a mounting position of the coil supply unit 5D is provided below the first conveyance path 10 and at a side of the sheet aligning unit 3. The coil supply unit 5D is mounted to the bookbinding apparatus 1D so that the axial direction of the coils 200 held to the coil holding sheet 100A faces toward a direction along a surface of the sheet bundle 302 aligned in the sheet aligning unit 3.

The coil supply unit 5D is provided with a plurality of coil storing units 50. In the fourth embodiment, the coil supply unit 5D is provided with a first coil storing unit $\mathbf{50}_1$ and a second coil storing unit $\mathbf{50}_2$ in parallel, so that two coil holding sheets 100A can be stored therein.

The coil supply unit 5D is provided so that the first coil storing unit $\mathbf{50}_1$ and the second coil storing unit $\mathbf{50}_2$ can be inserted and removed with respect to the bookbinding apparatus 1D. In the fourth embodiment, the first coil storing unit $50_1$ and the second coil storing unit $50_2$ can be inserted and removed forward from a front face side of the bookbinding apparatus 1D. Here, the front face side of the bookbinding apparatus 1D indicates one side of the first conveyance path 10 perpendicular to the conveying direction of the sheet 300. In order to insert and remove the first coil storing unit $50_1$ and the second coil storing unit $50_2$ forward from the front face side of the bookbinding apparatus 1D, a space through which the first coil storing unit $50_1$ and the second coil storing unit $50_2$ can pass is provided between the coil supply unit 5D and the bookbinding apparatus 1D.

When the first coil storing unit 50 and the second coil storing unit $50_2$ of the coil supply unit 5D are drawn out from the bookbinding apparatus 1D, the coil holding sheet 100A having the coils 200 held thereto can be loaded into the first coil storing unit $50_1$ or the second coil storing unit $50_2$, the coil holding sheet 100A loaded in the first coil storing unit $50_1$ or the second coil storing unit $50_2$ can be replaced, and the coil holding sheet 100A from which the coils 200 have been separated can be taken out from the sheet collection unit 53.

The coil supply unit 5D is configured so that the first coil storing unit $50_1$ and the second coil storing unit $50_2$ can be independently inserted and removed with respect to the bookbinding apparatus 1D. Thereby, for example, while supplying the coil 200 from the first coil storing unit $50_1$, it is possible to draw out the second coil storing unit $50_2$ and to replace the coil holding sheet 100A. Also, while supplying the coil 200 from the second coil storing unit $50_2$, it is possible to draw out the first coil storing unit 501 and to replace the coil holding sheet 100A.

In each of the first coil storing unit 50, and the second coil storing unit $50_2$, one coil holding sheet 100A capable of supporting the plurality of coils 200 is stored with an arranging direction of the coils 200 facing toward the vertical direction.

The coil separating unit 51 is configured to separate the coils 200 one by one from the coil holding sheet 100A by conveying the coil holding sheet 100A having the coils 200 held thereto.

The coil feed unit 52 is provided at a position at which the coil 200 separated from the coil holding sheet 100A and rolled radially is to enter, and is configured to axially convey one coil 200 separated from the coil separating unit 51. The sheet collection unit 53 is provided in parallel with back surfaces of the first coil storing unit 501 and the second coil storing unit $50_2$.

The coil conveyance path 6D of the fourth embodiment forms a curved conveyance path for conveying the coil 200 with being curved with respect to the axial direction of the coil 200 to the side end portion 303 of one side, which is a side at which the coil rotation/insertion unit 41 starts insertion of the coil 200, of the sheet bundle 302 aligned in the sheet aligning unit 3, at a position Pp that is distant from the side end portion 303 by a distance smaller than the length $L_{30}$ of one coil 200.

In the fourth embodiment, a feed direction of the coil 200 fed from the coil feed unit 52 and an introduction direction of the coil 200 into the coil rotation/insertion unit 41 are opposite to each other. Therefore, the coil conveyance path 6D forms a conveyance route bent into a U-shape.

The discharging unit 7 is configured by at least a pair of rollers, an endless belt put on the rollers, and the like, and is arranged below the sheet aligning unit 3. The discharging unit 7 forms a linear conveyance route for receiving the booklet 304 bound with the coil 200 and conveying the same to the sheet discharge stacker 8. The linear conveyance route is substantially horizontal. The discharging unit 7 is configured to convey the booklet 304 received from the sheet aligning unit 3 with being overturned.

The sheet discharge stacker 8 is arranged downstream of the discharging unit 7, and the booklet 304 conveyed from the discharging unit 7 is stacked thereon. The sheet discharge stacker 8 has a stacking surface having predetermined inclination. The sheet discharge stacker 8 is configured to erect and stack thereon the booklet 304 conveyed with being overturned from the discharging unit 5, in conformity to the inclination of the stacking surface.

Operation Example of Bookbinding Apparatus of Fourth Embodiment

Subsequently, an operation example of the bookbinding processing of binding the sheets with the bookbinding apparatus 1D is described with reference to each drawing.

The bookbinding apparatus 1D is connected to the image forming apparatus 500, and the sheets 300 on which predetermined processing such as printing has been performed are fed one by one from the feeder port 10*c*. During an operation of binding the sheets 300 with the coil 200, the conveying processing of conveying the sheet 300 to the punching unit 2 is performed, the hole forming processing is performed in the punching unit 2, and then the aligning processing is performed in the sheet aligning unit 3.

In the conveying processing of conveying the sheet 300 to the punching unit 2, the feed rollers 10*a* of the first conveyance path 10 are rotatively driven, so that the sheet 300 fed to the first conveyance path 10 is sandwiched between the feed rollers 10*a* and the guide rollers 10*b*, and is conveyed on the first conveyance path 10 in the conveying direction A from the feeder port 10*c* toward the discharge port 10*d*.

When it is determined that the sheet 300 being conveyed in the conveying direction A on the first conveyance path 10 has passed through the switching blade 10*f* and has been conveyed to the reversal holding unit 10*g*, the conveying of the sheet 300 is stopped. After stopping the conveying of the sheet 300, the switching blade 10*f* is driven to switch the conveyance route of the sheet 300 from the reversal holding unit 10*g* to the second conveyance path 11.

When the conveyance route is switched to the second conveyance path 11 by the switching blade 10*f*, the feed rollers 10*a* are rotated in a reverse direction in which the sheet 300 is to be conveyed in the conveying direction B. Also, the feed rollers 11*a* are rotated in a direction in which the sheet 300 on the second conveyance path 11 is to be conveyed to the punching unit 2.

Thereby, the conveying direction of the sheet 300 temporarily held with the reversal holding unit 10*g* is reversed, so that the sheet 300 is conveyed in the conveying direction B, and is sent from the first conveyance path 10 to the second conveyance path 11 with being guided by the switching blade 10*f*. The sheet 300 sent to the second conveyance path 11 is sandwiched between the feed rollers 11*a* and the guide rollers 11*b*, and is conveyed on the second conveyance path 11 toward the punching unit 2.

The sheet 300 conveyed to the punching unit 2 is positionally adjusted in the conveying direction of the sheet 300 and in the width direction perpendicular to the conveying direction of the sheet 300 by the hole-forming position adjustment mechanism (not shown).

When the sheet 300 is positionally adjusted, the punch blades 20 are reciprocally moved by the hole-forming drive mechanism 21, so that the sheet 300 is formed with the holes 301 with predetermined intervals.

The sheet 300 formed with the holes by the punching unit 2 is conveyed to the sheet aligning unit 3.

The leading end of the sheet 300 in the conveying direction is contacted against the contact shutter 30*a* protruding into the sheet aligning unit 3 by the paddle mechanism 30*c*, and side ends of the sheet 300 are contacted against the reference guide (not shown) of the width aligning mechanism 30*b*. Thereby, the sheet 300 being conveyed to the sheet aligning unit 3 is positionally adjusted.

The conveying processing, the hole forming processing and the aligning processing are repetitively performed until a predetermined number of the sheets 300 are aligned and accumulated in the sheet aligning unit 3. When the predetermined number of the sheets 300 are aligned, the series of the conveying processing, the hole forming processing and the aligning processing are stopped.

When the predetermined number of the sheets 300 are aligned in the sheet aligning unit 3, the contact shutter 30*a* is opened, and one coil 200 is separated from the coil holding sheet 100A stored in the coil storing unit selected from the first coil storing unit $\mathbf{50}_1$ or the second coil storing unit $\mathbf{50}_2$ of the coil supply unit 5D.

In the first coil storing unit 50, and the second coil storing unit $\mathbf{50}_2$, the same type of the coils 200 may be stored. In this case, the number of the coils 200 to be stored increases. Also, in the first coil storing unit 50, and the second coil storing unit $\mathbf{50}_2$, the different types of the coils 200 may be stored.

For example, as shown in FIG. 10, the coil holding sheet 100A to which the coils 200 having different outer diameters may be stored in the first coil storing unit $\mathbf{50}_1$ and the second coil storing unit $\mathbf{50}_2$. Thereby, it is possible to select the coil 200 in conformity to the thickness of the sheet bundles 302, which is different depending on the number of the sheets 300 to be bound, the sheet thickness of the sheets 300 to be bound, a basis weight and the like. Also, the coil holding sheet 100A having the coils 200 of different colors held thereto may be stored in the first coil storing unit $\mathbf{50}_1$ and the second coil storing unit $\mathbf{50}_2$.

The coil 200 separated from the coil holding sheet 100A is conveyed in the axial direction of the coil 200 and is sent to the coil conveyance path 6D by the coil feed unit 52. As shown in FIG. 119, the conveying direction of the coil 200 in the coil supply unit 5D and the conveying direction of the coil 200 in the binding unit 4 are different by 180°. In the coil conveyance path 6D, the conveyance route of the coil 200 is bent by 180°.

Thereby, the coil 200 being conveyed at the coil feed unit 52 from the coil supply unit 5D is sent to the binding unit 4. The coil 200 sent to the binding unit 4 is axially conveyed with being rotated in the circumferential direction by the coil rotation/insertion unit 41, so that the coil is inserted into the holes 301 of the sheet bundle 302 aligned and positionally adjusted in the sheet aligning unit 3 from one side end portion 303 of the sheets 300.

The booklet 304 bound with the coil 200 is dropped to the discharging unit 7. The discharging unit 7 overturns and conveys the booklet 304 received from the sheet aligning unit 3 to the sheet discharge stacker 8. The sheet discharge stacker 8 erects and stacks thereon the booklet 304 being conveyed with being overturned from the discharging unit 7.

Examples of Effect of Bookbinding Apparatus of Fourth Embodiment

In the bookbinding apparatus 1D, the conveying processing of the sheet 300, the hole forming processing of the sheet 300, the aligning processing of the sheet 300, the binding processing of the sheet bundle 302 by the coil 200 and the discharge processing of the booklet 304 bound with the coil 200 are automatically performed. Therefore, it is not necessary for a person to align the sheet 300, to place the sheet bundle 302, to place the coils 200 one by one, and to take out the booklet 304 with a hand. Thereby, it is possible to collectively perform the printing processing and the bookbinding processing by connecting the bookbinding apparatus 1D to the image forming apparatus 500 and the like.

In the bookbinding processing of using the coil 200, the coil 200 is axially conveyed with being rotated in the circumferential direction, and is inserted into the holes 301 from one side end portion 303 of the sheets 300. For this reason, it is necessary to secure a space for conveying the coil 200 at a side of the sheets 300.

In the meantime, in the case of the configuration where the plurality of coils 200 is stored, if a storing unit where the coils 200 are stored with an axial direction of the coils 200 facing toward an aligning direction of the holes 301 of the sheets 300 is provided at one side of the sheets 300 to be aligned in the sheet aligning unit 3, i.e., in front of the bookbinding apparatus 1D, the apparatus becomes large. Therefore, the coil supply unit 5D and the binding unit 4 are connected at the coil conveyance path 6D configured to bend the conveyance route of the coil 200 with respect to the axial direction of the coil 200, so that it is possible to improve a degree of freedom of arrangement of the coil supply unit 5D.

Also, the coil conveyance path 6D forms the curved conveyance path for conveying the coil 200 with being curved with respect to the axial direction of the coil 200 to one side end portion 303 of the sheets 300 aligned in the sheet aligning unit 3, at the position Pp that is distant from the side end portion 303 by a distance smaller than the length $L_{30}$ of one coil 200.

Thereby, it is not necessary to secure a space corresponding to an entire length of one coil 200 in the axial direction at one side of the sheets 300 to be aligned in the sheet aligning unit 3, i.e., in front of the bookbinding apparatus 1D, so that it is possible to avoid the apparatus from being enlarged.

Also, the coil supply unit 5D is configured so that the first coil storing unit 50, and the second coil storing unit $\mathbf{50}_2$ can be independently inserted and removed with respect to the bookbinding apparatus 1D. Therefore, while supplying the coil 200 from the first coil storing unit $\mathbf{50}_1$, it is possible to draw out the second coil storing unit $\mathbf{50}_2$ and to replace the coil holding sheet 100A. Also, while supplying the coil 200 from the second coil storing unit $\mathbf{50}_2$, it is possible to draw out the first coil storing unit 501 and to replace the coil holding sheet 100A.

Thereby, the same type of the coils 200 are stored in the first coil storing unit $\mathbf{50}_1$ and the second coil storing unit $\mathbf{50}_2$, so that it is possible to consecutively perform the bookbinding processing beyond the number of the coils 200 to be stored while replacing the coil holding sheet 100A.

Also, the coil holding sheets 100A having the coils 200 of different outer diameters held thereto are stored in the first coil storing unit $\mathbf{50}_1$ and the second coil storing unit $\mathbf{50}_2$, so that it is possible to select the coil 200 in conformity to the thickness of the sheet bundles 302, which is different depending on the number of the sheets 300 to be bound, the sheet thickness of the sheets 300 to be bound, a basis weight and the like, without replacing the coil holding sheet 100A.

Also, the coil holding sheets 100A having the coils 200 of different colors held thereto are stored in the first coil storing unit $\mathbf{50}_1$ and the second coil storing unit $\mathbf{50}_2$, so that it is possible to make the booklet 304 bound with the coil 200 of a desired color without replacing the coil holding sheet 100A.

Configuration Example of Bookbinding Apparatus of Fifth Embodiment

Figure 120:
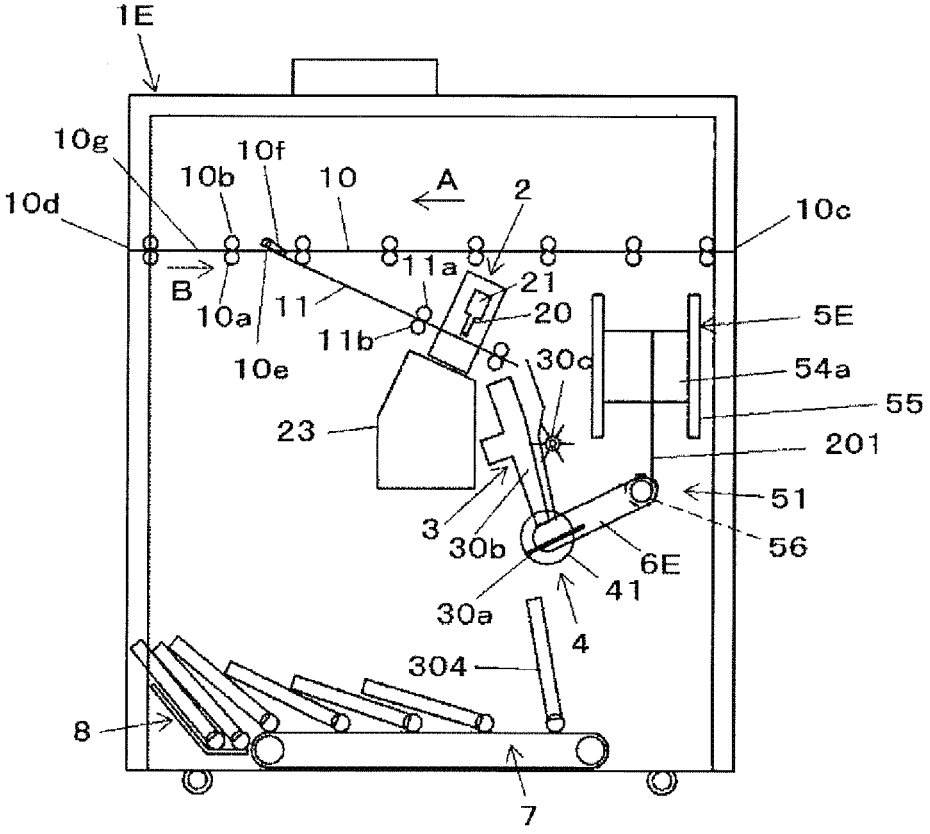
Figure 121:
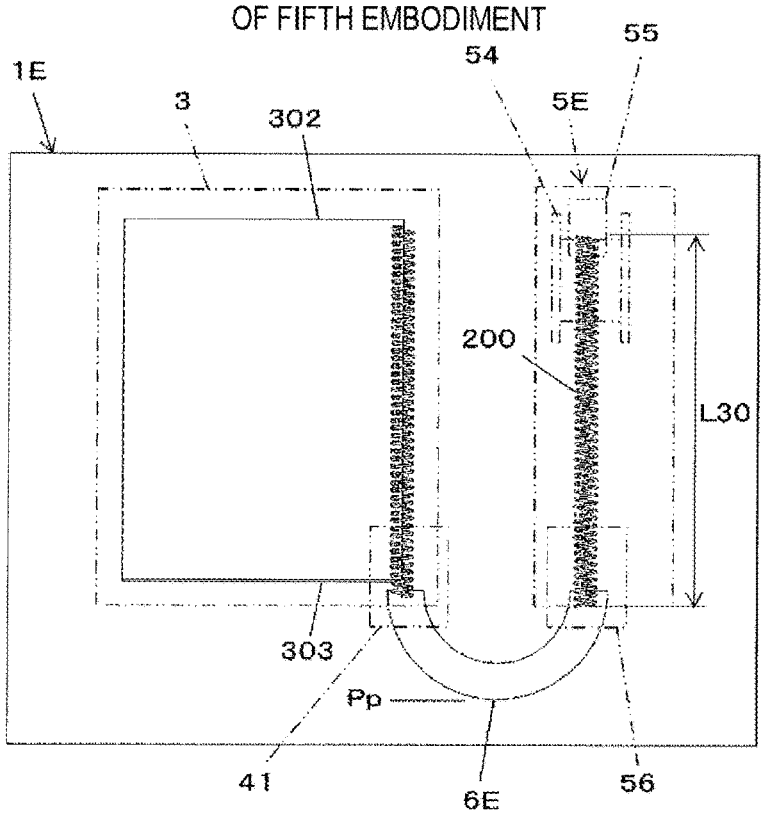

FIGS. 120 and 121 depict an example of the bookbinding apparatus of a sixth embodiment. FIG. 120 is a front view depicting an outline of an internal configuration of the bookbinding apparatus of the fifth embodiment. FIG. 121 is a plan view of main parts depicting an outline of the internal configuration of the fifth embodiment.

A bookbinding apparatus 1E of the fifth embodiment has the first conveyance path 10 configured to convey the sheet 300 and the second conveyance path 11 branched from the first conveyance path 10. The first conveyance path 10 and the second conveyance path 11 configure a switchback-type conveyance route configured to reverse a conveying direction of the sheet 300 on the way.

Also, the bookbinding apparatus 1E includes the punching unit 2 configured to form the holes 301 in a predetermined arrangement in the sheet 300, and the sheet aligning unit 3 configured to accumulate the sheets 300 having the holes 301 formed in the punching unit 2, to align the plurality of accumulated sheets 300, and to make the sheet bundle 302. In addition, the bookbinding apparatus 1E includes the binding unit 4 configured to bind the sheet bundle 302 aligned in the sheet aligning unit 3 with the coil 200 and to make the booklet 304, a coil supply unit 5E configured to supply the coil 200, and a coil conveyance path 6E configured to convey the coil 200 supplied from the coil supply unit 5E to the binding unit 4. Also, the bookbinding apparatus 1E includes the discharging unit 7 configured to discharge the booklet 304 bound in the binding unit 4.

The first conveyance path 10 and the second conveyance path 11 are configured by a plurality of pairs of rollers provided along the conveyance route of the sheet 300, pairs of belts extending along the conveyance route of the sheet 300, a guide member configured to guide conveyance of the sheet 300, and the like.

In the fifth embodiment, the first conveyance path 10 includes the plurality of feed rollers 10*a* configured to rotatively drive, and the plurality of guide rollers 10*b* configured to face the feed rollers 10*a*. The second conveyance path 11 includes the plurality of feed rollers 11*a* configured to rotatively drive, and the plurality of guide rollers 11*b* configured to face the feed rollers 11*a*.

The first conveyance path 10 is arranged at an upper side in the bookbinding apparatus 1E, and configures a linear conveyance route for conveying the sheet 300 between the feeder port 10*c* and the discharge port 10*d*. The conveyance route is substantially horizontal.

The first conveyance path 10 includes the switching blade 10*f* configured to switch the conveying direction at the branch portion 10*e* of the first conveyance path 10 and the second conveyance path 11. Also, the first conveyance path 10 includes the reversal holding unit 10*g* between the branch portion 10*e* and the discharge port 10*d*.

The second conveyance path 11 is branched downstream from the first conveyance path 10 at the branch portion 10*e*, and is configured to communicate with the reversal holding unit 10*g* by an operation of the switching blade 10*f*.

The switching blade 10*f* is rotatively driven to move between the position at which it is retracted from the first conveyance path 10 and the position at which it protrudes into the first conveyance path 10. When the switching blade 10*f* is moved to the position at which it is retracted from the first conveyance path 10, the sheet 300, which is conveyed on the first conveyance path 10 in the conveying direction A from the feeder port 10*c*, is moved through the switching blade 10*f* and is conveyed to the reversal holding unit 10*g*.

On the contrary, when the switching blade 10*f* is moved to the position at which it protrudes into the first conveyance path 10, the sheet 300, which is conveyed on the first conveyance path 10 in the conveying direction B from the reversal holding unit 10*g* while reversing the conveying direction, is sent to the second conveyance path 11 from the first conveyance path 10 by the guide of the switching blade 10*f*.

Thereby, the second conveyance path 11 configures a conveyance route where the conveying direction of the sheet 300, which is conveyed on the first conveyance path 10 in the conveying direction A from the feeder port 10*c* side to the discharge port 10*d* side, is reversed to the conveying direction B at the reversal holding unit 10*g* and the sheet 300 is switched back downward from the first conveyance path 10.

The punching unit 2 is provided to the second conveyance path 11. The punching unit 2 includes the punch blades 20 configured to form the holes 301 in the sheet 300, and the hole-forming drive mechanism 21 configured to drive the punch blades 20.

In the punching unit 2, a predetermined number of punch blades 20 are arranged in one row. The hole-forming drive mechanism 21 is configured to reciprocally move the punch blades 20 in the direction perpendicular to a surface of the sheet 300. The punching unit 2 is configured to form the holes 301 in one row with predetermined intervals in the sheet 300 by positionally adjusting the sheet 300 in the conveying direction and positionally adjusting the sheet 300 in the width direction perpendicular to the conveying direction with the hole-forming position adjustment mechanism (not shown) and reciprocally moving the punch blades 20.

In the meantime, in order to collect punch chad generated when forming the holes 301 in the sheet 300 by the punch blades 20, the punch chad stacker 23 is provided below the punching unit 2.

The sheet aligning unit 3 is arranged downstream of the punching unit 2 with respect to the conveying direction of the sheet 300. The sheet aligning unit 3 includes the contact shutter 30*a* configured to positionally adjust a leading end of the sheet 300 in the conveying direction, the width aligning mechanism 30*b* configured to positionally adjust the sheet 300 in the right and left direction, and the paddle mechanism 30*c* configured to cause the sheet 300 to contact against the contact shutter 30*a*.

The contact shutter 30*a* is configured to open and close the sheet aligning unit 3 by moving between the position at which the contact shutter protrudes into the sheet aligning unit 3 and the sheet 300 sent to the sheet aligning unit 3 is thus contacted against the contact shutter and the position at which the contact shutter is retracted from the sheet aligning unit 3 and the booklet 304 can pass therethrough.

The width aligning mechanism 30*b* includes the width aligning guide at one side of the right and the left with respect to the conveying direction of the sheet 300 and the reference guide at the other side. The width aligning mechanism 30*b* is configured to move in a direction in which the width aligning guide is to approach and separate with respect to the reference guide, thereby causing the sheet 300 sent to the sheet aligning unit 3 to be contacted against the reference guide.

The paddle mechanism 30*c* includes the paddle roller having a plurality of tongue pieces arranged in a circumferential direction and configured to rotatively drive. The paddle mechanism 30*c* is configured to cause the sheet 300 sent to the sheet aligning unit 3 to be contacted against the contact shutter 30*a* protruding into the sheet aligning unit 3. In the meantime, the rotary shaft of the paddle roller is inclined in the guide direction of the fixed side (not shown) of the width aligning mechanism 30*b*. The paddle roller is also configured to apply a force, which causes the sheet 300 sent to the sheet aligning unit 3 to be contacted in the guide direction of the fixed side of the width aligning mechanism 30*b*, to the sheet 300.

The binding unit 4 includes the coil rotation/insertion unit 41 configured to bind the sheet bundle 302 aligned in the sheet aligning unit 3 by the coil 200. The coil rotation/insertion unit 41 is an example of the binding mechanism, and is configured to insert the coil 200 into the holes 301 of the sheet bundle 302, which is aligned and positionally adjusted in the sheet aligning unit 3, from one side end portion 303 of the sheet 300 while rotating the coil 200 around an axis and conveying the same in the axial direction.

The coil supply unit 5E of the fifth embodiment includes a coil wire supply unit 54, a coil generation unit 55, and a coil feed unit 56 configured to feed the coil 200 generated in the coil generation unit 55. The coil wire supply unit 54 includes a reel 54*a* on which a wire rod 201 for generating the coil 200 is wound. The coil generation unit 55 is configured to wind the wire rod 201 drawn out from the reel 54*a* into a predetermined pitch and a predetermined outer diameter, thereby generating the coil 200. The coil feed unit 56 is configured to axially feed one coil 200 generated in the coil generation unit 55.

In the bookbinding apparatus 1E, a mounting position of the coil supply unit 5E is provided below the first conveyance path 10 and at a side of the sheet aligning unit 3. The coil supply unit 5E is mounted so that the axial direction of the coil 200 generated in the coil generation unit 55 faces toward a direction along a surface of the sheet bundle 302 aligned in the sheet aligning unit 3. The coil supply unit 5E is configured so that the reel 54*a* can be detachably mounted.

The coil conveyance path 6E of the fifth embodiment forms a curved conveyance path for conveying the coil 200 with being curved with respect to the axial direction of the coil 200 to the side end portion 303 of one side, which is a side at which the coil rotation/insertion unit 41 starts insertion of the coil 200, of the sheet bundle 302 aligned in the sheet aligning unit 3, at a position Pp that is distant from the side end portion 303 by a distance smaller than the length $L_{30}$ of one coil 200.

In the fifth embodiment, a feed direction of the coil 200 fed from the coil feed unit 56 and an introduction direction of the coil 200 into the coil rotation/insertion unit 41 are opposite to each other.

Therefore, the coil conveyance path 6E forms a conveyance route bent into a U-shape.

The discharging unit 7 is configured by at least a pair of rollers, an endless belt put on the rollers, and the like, and is arranged below the sheet aligning unit 3. The discharging unit 7 forms a linear conveyance route for receiving the booklet 304 bound with the coil 200 and conveying the same to the sheet discharge stacker 8. The linear conveyance route is substantially horizontal. The discharging unit 7 is configured to convey the booklet 304 received from the sheet aligning unit 3 with being overturned.

The sheet discharge stacker 8 is arranged downstream of the discharging unit 7, and the booklet 304 conveyed from the discharging unit 7 is stacked thereon. The sheet discharge stacker 8 has a stacking surface having predetermined inclination. The sheet discharge stacker 8 is configured to erect and stack thereon the booklet 304 conveyed with being overturned from the discharging unit 5, in conformity to the inclination of the stacking surface.

Operation Example of Bookbinding Apparatus of Fifth Embodiment

Subsequently, an operation example of the bookbinding processing of binding the sheets with the bookbinding apparatus 1E is described with reference to each drawing.

The bookbinding apparatus 1E is connected to the image forming apparatus 500, and the sheets 300 on which predetermined processing such as printing has been performed are fed one by one from the feeder port 10*c*. During an operation of binding the sheets 300 with the coil 200, the conveying processing of conveying the sheet 300 to the punching unit 2 is performed, the hole forming processing is performed in the punching unit 2, and then the aligning processing is performed in the sheet aligning unit 3.

In the conveying processing of conveying the sheet 300 to the punching unit 2, the feed rollers 10*a* of the first conveyance path 10 are rotatively driven, so that the sheet 300 fed to the first conveyance path 10 is sandwiched between the feed rollers 10*a* and the guide rollers 10*b*, and is conveyed on the first conveyance path 10 in the conveying direction A from the feeder port 10*c* toward the discharge port 10*d*.

When it is determined that the sheet 300 being conveyed in the conveying direction A on the first conveyance path 10 has passed through the switching blade 10*f* and has been conveyed to the reversal holding unit 10*g*, the conveying of the sheet 300 is stopped. After stopping the conveying of the sheet 300, the switching blade 10*f* is driven to switch the conveyance route of the sheet 300 from the reversal holding unit 10*g* to the second conveyance path 11.

When the conveyance route is switched to the second conveyance path 11 by the switching blade 10*f*, the feed rollers 10*a* are rotated in a reverse direction in which the sheet 300 is to be conveyed in the conveying direction B. Also, the feed rollers 11*a* are rotated in a direction in which the sheet 300 on the second conveyance path 11 is to be conveyed to the punching unit 2.

Thereby, the conveying direction of the sheet 300 temporarily held with the reversal holding unit 10*g* is reversed, so that the sheet 300 is conveyed in the conveying direction B, and is sent from the first conveyance path 10 to the second conveyance path 11 with being guided by the switching blade 10*f*. The sheet 300 sent to the second conveyance path 11 is sandwiched between the feed rollers 11*a* and the guide rollers 11*b*, and is conveyed on the second conveyance path 11 toward the punching unit 2.

The sheet 300 conveyed to the punching unit 2 is positionally adjusted in the conveying direction of the sheet 300 and in the width direction perpendicular to the conveying direction of the sheet 300 by the hole-forming position adjustment mechanism (not shown).

When the sheet 300 is positionally adjusted, the punch blades 20 are reciprocally moved by the hole-forming drive mechanism 21, so that the sheet 300 is formed with the holes 301 with predetermined intervals.

The sheet 300 formed with the holes by the punching unit 2 is conveyed to the sheet aligning unit 3.

The leading end of the sheet 300 in the conveying direction is contacted against the contact shutter 30*a* protruding into the sheet aligning unit 3 by the paddle mechanism 30*c*, and side ends of the sheet 300 are contacted against the reference guide (not shown) of the width aligning mechanism 30*b*. Thereby, the sheet 300 being conveyed to the sheet aligning unit 3 is positionally adjusted.

The conveying processing, the hole forming processing and the aligning processing are repetitively performed until a predetermined number of the sheets 300 are aligned and accumulated in the sheet aligning unit 3. When the predetermined number of the sheets 300 are aligned, the series of the conveying processing, the hole forming processing and the aligning processing are stopped.

When the predetermined number of the sheets 300 are aligned in the sheet aligning unit 3, in the coil generation unit 55, the rod wire 201 is drawn out from the reel 54*a* of the coil wire supply unit 54 and the rod wire is wound in the coil generation unit 55, so that the coil 200 is generated.

The coil 200 generated in the coil generation unit 55 is conveyed in the axial direction of the coil 200 and is sent to the coil conveyance path 6E by the coil feed unit 56. As shown in FIG. 121, the conveying direction of the coil 200 in the coil supply unit 5E and the conveying direction of the coil 200 in the binding unit 4 are different by 180°. In the coil conveyance path 6E, the conveyance route of the coil 200 is bent by 180°.

Thereby, the coil 200 being conveyed at the coil feed unit 56 from the coil supply unit 5E is sent to the binding unit 4. The coil 200 sent to the binding unit 4 is axially conveyed with being rotated in the circumferential direction by the coil rotation/insertion unit 41, so that the coil is inserted into the holes 301 of the sheet bundle 302 aligned and positionally adjusted in the sheet aligning unit 3 from one side end portion 303 of the sheets 300.

The booklet 304 bound with the coil 200 is dropped to the discharging unit 7 by opening the contact shutter 30*a*. The discharging unit 7 overturns and conveys the booklet 304 received from the sheet aligning unit 3 to the sheet discharge stacker 8. The sheet discharge stacker 8 erects and stacks thereon the booklet 304 being conveyed with being overturned from the discharging unit 7.

Examples of Effect of Bookbinding Apparatus of Fifth Embodiment

In the bookbinding apparatus 1E, the conveying processing of the sheet 300, the hole forming processing of the sheet 300, the aligning processing of the sheet 300, the binding processing of the sheet bundle 302 by the coil 200 and the discharge processing of the booklet 304 bound with the coil 200 are automatically performed. Therefore, it is not necessary for a person to align the sheet 300, to place the sheet bundle 302, to place the coils 200 one by one, and to take out the booklet 304 with a hand. Thereby, it is possible to collectively perform the printing processing and the bookbinding processing by connecting the bookbinding apparatus 1E to the image forming apparatus 500 and the like.

In the bookbinding processing of using the coil 200, the coil 200 is axially conveyed with being rotated in the circumferential direction, and is inserted into the holes 301 from one side end portion 303 of the sheets 300. For this reason, it is necessary to secure a space for conveying the coil 200 at a side of the sheets 300.

In the meantime, in the case of the configuration where the plurality of coils 200 is stored, if a storing unit where the coils 200 are stored with an axial direction of the coils 200 facing toward an aligning direction of the holes 301 of the sheets 300 is provided at one side of the sheets 300 to be aligned in the sheet aligning unit 3, i.e., in front of the bookbinding apparatus 1E, the apparatus becomes large. Therefore, the coil supply unit 5E and the binding unit 4 are connected at the coil conveyance path 6E configured to bend the conveyance route of the coil 200 with respect to the axial direction of the coil 200, so that it is possible to improve a degree of freedom of arrangement of the coil supply unit 5E.

Also, the coil conveyance path 6E forms the curved conveyance path for conveying the coil 200 with being curved with respect to the axial direction of the coil 200 to one side end portion 303 of the sheets 300 aligned in the sheet aligning unit 3, at the position Pp that is distant from the side end portion 303 by a distance smaller than the length $L_{30}$ of one coil 200.

Thereby, it is not necessary to secure a space corresponding to an entire length of one coil 200 in the axial direction at one side of the sheets 300 to be aligned in the sheet aligning unit 3, i.e., in front of the bookbinding apparatus 1E, so that it is possible to avoid the apparatus from being enlarged.

Also, since the coil supply unit 5E is configured to generate the coil 200 from the wire rod 201, it is not necessary to provide a space for storing a molded product of the coil 200. Also, it is possible to make the coil 200 with any diameter and any pitch.

Configuration Example of Bookbinding Apparatus of Sixth Embodiment

Figure 122:
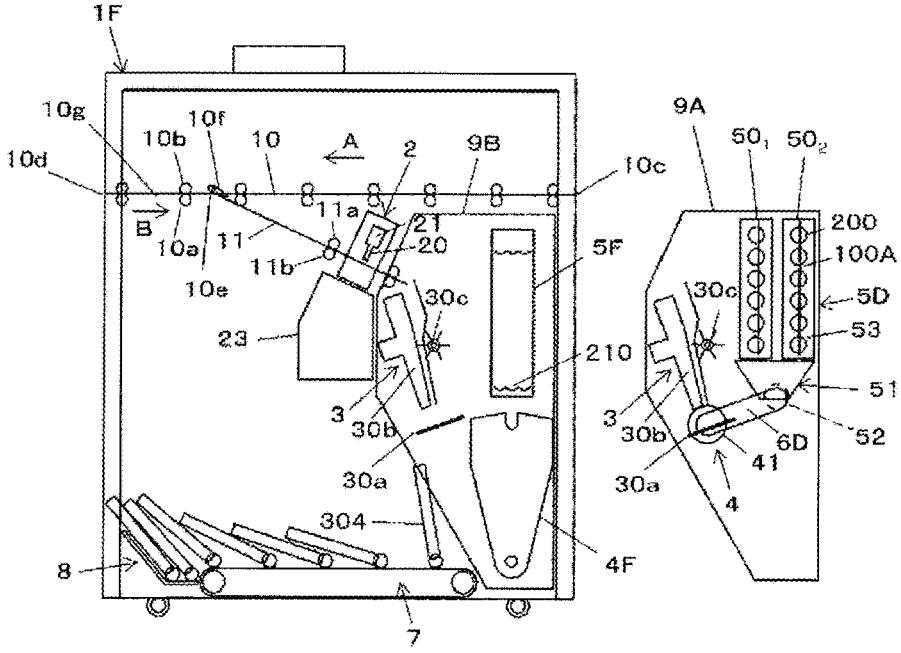

FIG. 122 is a front view depicting an outline of an internal configuration of the bookbinding apparatus of a sixth embodiment. A bookbinding apparatus 1F of the sixth embodiment has the first conveyance path 10 configured to convey the sheet 300 and the second conveyance path 11 branched from the first conveyance path 10. The first conveyance path 10 and the second conveyance path 11 configure a switchback-type conveyance route configured to reverse a conveying direction of the sheet 300 on the way.

Also, the bookbinding apparatus 1F includes the punching unit 2 configured to form the holes 301 in a predetermined arrangement in the sheet 300. The bookbinding apparatus 1F is configured so that a sheet binding unit 9A and a sheet binding unit 9B can be replaced. The sheet binding unit 9A includes the coil supply unit 5D of the fourth embodiment, for example.

That is, the sheet binding unit 9A includes the sheet aligning unit 3 configured to accumulate the sheets 300 having the holes 301 formed in the punching unit 2, to align the plurality of accumulated sheets 300, and to make the sheet bundle 302. In addition, the sheet binding unit 9A includes the binding unit 4 configured to bind the sheet bundle 302 aligned in the sheet aligning unit 3 with the coil 200 and to make the booklet 304, the coil supply unit 5D configured to supply the coil 200, and the coil conveyance path 6D configured to convey the coil 200 supplied from the coil supply unit 5D to the binding unit 4.

The sheet binding unit 9B includes the sheet aligning unit 3 configured to accumulate the sheets 300 having the holes 301 formed in the punching unit 2, to align the plurality of accumulated sheets 300, and to make the sheet bundle 302. In addition, the sheet binding unit 9B includes a binding unit 4F configured to bind the sheet bundle 302 aligned in the sheet aligning unit 3 with a binding component 201 and to make the booklet 304, and a binding component supply unit 5F configured to supply the binding component 210.

The bookbinding apparatus 1F includes the discharging unit 7 configured to discharge the booklet 304 bound in the binding unit 4 or binding unit 4F.

The first conveyance path 10 and the second conveyance path 11 are configured by a plurality of pairs of rollers provided along the conveyance route of the sheet 300, pairs of belts extending along the conveyance route of the sheet 300, a guide member configured to guide conveyance of the sheet 300, and the like.

In the sixth embodiment, the first conveyance path 10 includes the plurality of feed rollers 10*a* configured to rotatively drive, and the plurality of guide rollers 10*b* configured to face the feed rollers 10*a*. The second conveyance path 11 includes the plurality of feed rollers 11*a* configured to rotatively drive, and the plurality of guide rollers 11*b* configured to face the feed rollers 11*a*.

The first conveyance path 10 is arranged at an upper side in the bookbinding apparatus 1F, and configures a linear conveyance route for conveying the sheet 300 between the feeder port 10*c* and the discharge port 10*d*. The conveyance route is substantially horizontal.

The first conveyance path 10 includes the switching blade 10*f* configured to switch the conveying direction at the branch portion 10*e* of the first conveyance path 10 and the second conveyance path 11. Also, the first conveyance path 10 includes the reversal holding unit 10*g* between the branch portion 10*e* and the discharge port 10*d*.

The second conveyance path 11 is branched downstream from the first conveyance path 10 at the branch portion 10*e*, and is configured to communicate with the reversal holding unit 10*g* by an operation of the switching blade 10*f*.

The switching blade 10*f* is rotatively driven to move between the position at which it is retracted from the first conveyance path 10 and the position at which it protrudes into the first conveyance path 10. When the switching blade 10*f* is moved to the position at which it is retracted from the first conveyance path 10, the sheet 300, which is conveyed on the first conveyance path 10 in the conveying direction A from the feeder port 10*c*, is moved through the switching blade 10*f* and is conveyed to the reversal holding unit 10*g*.

On the contrary, when the switching blade 10*f* is moved to the position at which it protrudes into the first conveyance path 10, the sheet 300, which is conveyed on the first conveyance path 10 in the conveying direction B from the reversal holding unit 10*g* while reversing the conveying direction, is sent to the second conveyance path 11 from the first conveyance path 10 by the guide of the switching blade 10*f*.

Thereby, the second conveyance path 11 configures a conveyance route where the conveying direction of the sheet 300, which is conveyed on the first conveyance path 10 in the conveying direction A from the feeder port 10*c* side to the discharge port 10*d* side, is reversed to the conveying direction B at the reversal holding unit 10*g* and the sheet 300 is switched back downward from the first conveyance path 10.

The punching unit 2 is provided to the second conveyance path 11. The punching unit 2 includes the punch blades 20 configured to form the holes 301 in the sheet 300, and the hole-forming drive mechanism 21 configured to drive the punch blades 20.

In the punching unit 2, a predetermined number of punch blades 20 are arranged in one row. The hole-forming drive mechanism 21 is configured to reciprocally move the punch blades 20 in the direction perpendicular to a surface of the sheet 300. The punching unit 2 is configured to form the holes 301 in one row with predetermined intervals in the sheet 300 by positionally adjusting the sheet 300 in the conveying direction and positionally adjusting the sheet 300 in the width direction perpendicular to the conveying direction with the hole-forming position adjustment mechanism (not shown) and reciprocally moving the punch blades 20.

In the meantime, in order to collect punch chad generated when forming the holes 301 in the sheet 300 by the punch blades 20, the punch chad stacker 23 is provided below the punching unit 2.

The sheet aligning unit 3 is arranged downstream of the punching unit 2 with respect to the conveying direction of the sheet 300. The sheet aligning unit 3 includes the contact shutter 30*a* configured to positionally adjust a leading end of the sheet 300 in the conveying direction, the width aligning mechanism 30*b* configured to positionally adjust the sheet 300 in the right and left direction, and the paddle mechanism 30*c* configured to cause the sheet 300 to contact against the contact shutter 30*a*.

The contact shutter 30*a* is configured to open and close the sheet aligning unit 3 by moving between the position at which the contact shutter protrudes into the sheet aligning unit 3 and the sheet 300 sent to the sheet aligning unit 3 is thus contacted against the contact shutter and the position at which the contact shutter is retracted from the sheet aligning unit 3 and the booklet 304 can pass therethrough.

The width aligning mechanism 30*b* includes the width aligning guide at one side of the right and the left with respect to the conveying direction of the sheet 300 and the reference guide at the other side. The width aligning mechanism 30*b* is configured to move in a direction in which the width aligning guide is to approach and separate with respect to the reference guide, thereby causing the sheet 300 sent to the sheet aligning unit 3 to be contacted against the reference guide.

The paddle mechanism 30*c* includes the paddle roller having a plurality of tongue pieces arranged in a circumferential direction and configured to rotatively drive. The paddle mechanism 30*c* is configured to cause the sheet 300 sent to the sheet aligning unit 3 to be contacted against the contact shutter 30*a* protruding into the sheet aligning unit 3. In the meantime, the rotary shaft of the paddle roller is inclined in the guide direction of the fixed side (not shown) of the width aligning mechanism 30*b*. The paddle roller is also configured to apply a force, which causes the sheet 300 sent to the sheet aligning unit 3 to be contacted in the guide direction of the fixed side of the width aligning mechanism 30*b*, to the sheet 300.

The binding unit 4 includes the coil rotation/insertion unit 41 configured to bind the sheet bundle 302 aligned in the sheet aligning unit 3 by the coil 200. The coil rotation/insertion unit 41 is an example of the binding mechanism, and is configured to insert the coil 200 into the holes 301 of the sheet bundle 302, which is aligned and positioned in the sheet aligning unit 3, from one side end portion 303 of the sheet 300 while rotating the coil 200 around an axis and conveying the same in the axial direction.

The coil supply unit 5D includes the coil storing unit 50 in which any one of the coil holding sheets 100A, 100A1, 100A2, 100A3, 100A4 of the first embodiment, any one of the coil holding sheets 100B, 100B2, 100B3, 100B4 of the second embodiment, any one of the coil holding sheets 100C, 100C2, 100C3, 100C4 of the third embodiment, the coil holding sheet 100D of the fourth embodiment, the coil holding sheet 100E of the fifth embodiment or the coil holding sheet 100F of the sixth embodiment, to which the coils 200 are held, is stored. In the below, the coil holding sheet 100A is exemplified.

Also, the coil supply unit 5D includes the coil separating unit 51 configured to separate the coils 200 from the coil holding sheet 100A. In addition, the coil supply unit 5D includes the coil feed unit 52 configured to feed the coils 200 separated from the coil separating unit 51, and the sheet collection unit 53 configured to collect the coil holding sheet 100A from which the coils 200 have been separated.

In the bookbinding apparatus 1F, mounting positions of the sheet binding unit 9A and the sheet binding unit 9B are provided below the first conveyance path 10. Also, in a state where the sheet binding unit 9A is mounted to the bookbinding apparatus 1F, a mounting position of the coil supply unit 5D is provided below the first conveyance path 10 and at a side of the sheet aligning unit 3, like the bookbinding apparatus 1D of the fourth embodiment shown in FIG. 118. The coil supply unit 5D is mounted to the bookbinding apparatus 1F so that the axial direction of the coils 200 held to the coil holding sheet 100A faces toward a direction along a surface of the sheet bundle 302 aligned in the sheet aligning unit 3.

The coil supply unit 5D is provided with a plurality of coil storing units 50. In the sixth embodiment, the coil supply unit 5D is provided with the first coil storing unit 50, and the second coil storing unit $\mathbf{50}_2$ in parallel, so that two coil holding sheets 100A can be stored therein.

The coil supply unit 5D is provided so that the first coil storing unit $\mathbf{50}_1$ and the second coil storing unit $\mathbf{50}_2$ can be inserted and removed with respect to the bookbinding apparatus 1F. In the sixth embodiment, the first coil storing unit $\mathbf{50}_1$ and the second coil storing unit $\mathbf{50}_2$ can be inserted and removed forward from a front face side of the bookbinding apparatus 1F. Here, the front face side of the bookbinding apparatus 1F indicates one side of the first conveyance path 10 perpendicular to the conveying direction of the sheet 300. In order to insert and remove the first coil storing unit 50 and the second coil storing unit $\mathbf{50}_2$ forward from the front face side of the bookbinding apparatus 1F, a space through which the first coil storing unit $\mathbf{50}_1$ and the second coil storing unit $\mathbf{50}_2$ can pass is provided between the coil supply unit 5D and the bookbinding apparatus 1F.

When the first coil storing unit $\mathbf{50}_1$ and the second coil storing unit $\mathbf{50}_2$ of the coil supply unit 5D are drawn out from the bookbinding apparatus 1F, the coil holding sheet 100A having the coils 200 held thereto can be loaded into the first coil storing unit 501 or the second coil storing unit $\mathbf{50}_2$, the coil holding sheet 100A loaded in the first coil storing unit 50 or the second coil storing unit $\mathbf{50}_2$ can be replaced, and the coil holding sheet 100A from which the coils 200 have been separated can be taken out from the sheet collection unit 53, without drawing out the sheet binding unit 9A.

The coil supply unit 5D is configured so that the first coil storing unit $\mathbf{50}_1$ and the second coil storing unit $\mathbf{50}_2$ can be independently inserted and removed with respect to the bookbinding apparatus 1F. Thereby, for example, while supplying the coil 200 from the first coil storing unit $\mathbf{50}_1$, it is possible to draw out the second coil storing unit $\mathbf{50}_2$ and to replace the coil holding sheet 100A. Also, while supplying the coil 200 from the second coil storing unit $\mathbf{50}_2$, it is possible to draw out the first coil storing unit 501 and to replace the coil holding sheet 100A.

In the first coil storing unit 501 and the second coil storing unit $\mathbf{50}_2$, one coil holding sheet 100A capable of supporting the plurality of coils 200 is stored with an arranging direction of the coils 200 facing toward the vertical direction.

The coil separating unit 51 is configured to separate the coils 200 one by one from the coil holding sheet 100A by conveying the coil holding sheet 100A having the coils 200 held thereto.

The coil feed unit 52 is provided at a position at which the coil 200 separated from the coil holding sheet 100A and rolled radially is to enter, and is configured to axially convey one coil 200 separated from the coil separating unit 51. The sheet collection unit 53 is provided in parallel with the back surfaces of the first coil storing unit 501 and the second coil storing unit $\mathbf{50}_2$.

The coil conveyance path 6D forms a curved conveyance path for conveying the coil 200 with being curved with respect to the axial direction to the side end portion 303 of one side, which is a side at which the coil rotation/insertion unit 41 starts insertion of the coil 200, of the sheet bundle 302 aligned in the sheet aligning unit 3, at a position Pp that is distant from the side end portion 303 by a distance smaller than the length $L_{30}$ of one coil 200.

In the sixth embodiment, a feed direction of the coil 200 fed from the coil feed unit 52 and an introduction direction of the coil 200 into the coil rotation/insertion unit 41 are opposite to each other. Therefore, the coil conveyance path 6D forms a conveyance route bent into a U-shape.

In the sheet binding unit 9B, the binding component 210 having a configuration where a plurality of annular ring parts is coupled by a back part and each of the ring parts divided into multiple pieces is coupled by a flexible hinge portion so that the ring part can be opened and closed is stacked with being opened and is stored in the binding component supply unit 5F.

The binding unit 4F is configured to take out the binding component 210 from the binding component supply unit 5F at a position shown in FIG. 122, to move the same to the sheet aligning unit 3 and to bind the sheet bundle with the binding component 210.

The discharging unit 7 is configured by at least a pair of rollers, an endless belt put on the rollers, and the like, and is arranged below the sheet aligning unit 3. The discharging unit 7 forms a linear conveyance route for receiving the booklet 304 bound with the coil 200 and conveying the same to the sheet discharge stacker 8. The linear conveyance route is substantially horizontal. The discharging unit 7 is configured to convey the booklet 304 received from the sheet aligning unit 3 with being overturned.

The sheet discharge stacker 8 is arranged downstream of the discharging unit 7, and the booklet 304 conveyed from the discharging unit 7 is stacked thereon. The sheet discharge stacker 8 has a stacking surface having predetermined inclination. The sheet discharge stacker 8 is configured to erect and stack thereon the booklet 304 conveyed with being overturned from the discharging unit 5, in conformity to the inclination of the stacking surface.

Operation Example of Bookbinding Apparatus of Sixth Embodiment

Subsequently, an operation example of the bookbinding processing of binding the sheets with the bookbinding apparatus 1F is described with reference to each drawing.

The bookbinding apparatus 1F is connected to the image forming apparatus 500, and the sheets 300 on which predetermined processing such as printing has been performed are fed one by one from the feeder port 10*c*. During an operation of binding the sheets 300 with the coil 200, the conveying processing of conveying the sheet 300 to the punching unit 2 is performed, the hole forming processing is performed in the punching unit 2, and then the aligning processing is performed in the sheet aligning unit 3.

In the conveying processing of conveying the sheet 300 to the punching unit 2, the feed rollers 10*a* of the first conveyance path 10 are rotatively driven, so that the sheet 300 fed to the first conveyance path 10 is sandwiched between the feed rollers 10*a* and the guide rollers 10*b*, and is conveyed on the first conveyance path 10 in the conveying direction A from the feeder port 10*c* toward the discharge port 10*d*.

When it is determined that the sheet 300 being conveyed in the conveying direction A on the first conveyance path 10 has passed through the switching blade 10*f* and has been conveyed to the reversal holding unit 10*g*, the conveying of the sheet 300 is stopped. After stopping the conveying of the sheet 300, the switching blade 10*f* is driven to switch the conveyance route of the sheet 300 from the reversal holding unit 10*g* to the second conveyance path 11.

When the conveyance route is switched to the second conveyance path 11 by the switching blade 10*f*, the feed rollers 10*a* are rotated in a reverse direction in which the sheet 300 is to be conveyed in the conveying direction B. Also, the feed rollers 11*a* are rotated in a direction in which the sheet 300 on the second conveyance path 11 is to be conveyed to the punching unit 2.

Thereby, the conveying direction of the sheet 300 temporarily held with the reversal holding unit 10*g* is reversed, so that the sheet 300 is conveyed in the conveying direction B, and is sent from the first conveyance path 10 to the second conveyance path 11 with being guided by the switching blade 10*f*. The sheet 300 sent to the second conveyance path 11 is sandwiched between the feed rollers 11*a* and the guide rollers 11*b*, and is conveyed on the second conveyance path 11 toward the punching unit 2.

The sheet 300 conveyed to the punching unit 2 is positionally adjusted in the conveying direction of the sheet 300 and in the width direction perpendicular to the conveying direction of the sheet 300 by the hole-forming position adjustment mechanism (not shown).

When the sheet 300 is positionally adjusted, the punch blades 20 are reciprocally moved by the hole-forming drive mechanism 21, so that the sheet 300 is formed with the holes 301 with predetermined intervals.

The sheet 300 formed with the holes by the punching unit 2 is conveyed to the sheet aligning unit 3.

The leading end of the sheet 300 in the conveying direction is contacted against the contact shutter 30*a* protruding into the sheet aligning unit 3 by the paddle mechanism 30*c*, and side ends of the sheet 300 are contacted against the reference guide (not shown) of the width aligning mechanism 30*b*. Thereby, the sheet 300 being conveyed to the sheet aligning unit 3 is positionally adjusted.

The conveying processing, the hole forming processing and the aligning processing are repetitively performed until a predetermined number of the sheets 300 are aligned and accumulated in the sheet aligning unit 3. When the predetermined number of the sheets 300 are aligned, the series of the conveying processing, the hole forming processing and the aligning processing are stopped.

The bookbinding apparatus 1F having the sheet binding unit 9A mounted thereto has the same shape as the bookbinding apparatus 1D of the fourth embodiment described with reference to FIGS. 118 and 119. When the predetermined number of the sheets 300 are aligned in the sheet aligning unit 3, one coil 200 is separated from the coil holding sheet 100A stored in the coil storing unit selected from the first coil storing unit $\mathbf{50}_1$ or the second coil storing unit $\mathbf{50}_2$ of the coil supply unit 5D.

In the first coil storing unit 50 and the second coil storing unit $\mathbf{50}_2$, the same type of the coils 200 may be stored. In this case, the number of the coils 200 to be stored increases. Also, in the first coil storing unit 501 and the second coil storing unit $\mathbf{50}_2$, the different types of the coils 200 may be stored.

For example, as shown in FIG. 10, the coil holding sheet 100A to which the coils 200 having different outer diameters may be stored in the first coil storing unit 501 and the second coil storing unit $\mathbf{50}_2$. Thereby, it is possible to select the coil 200 in conformity to the thickness of the sheet bundles 302, which is different depending on the number of the sheets 300 to be bound, the sheet thickness of the sheets 300 to be bound, a basis weight and the like. Also, the coil holding sheet 100A having the coils 200 of different colors held thereto may be stored in the first coil storing unit 50, and the second coil storing unit $\mathbf{50}_2$.

The coil 200 separated from the coil holding sheet 100A is conveyed in the axial direction of the coil 200 and is sent to the coil conveyance path 6D by the coil feed unit 52. As shown in FIG. 119, the conveying direction of the coil 200 in the coil supply unit 5D and the conveying direction of the coil 200 in the binding unit 4 are different by 180°. In the coil conveyance path 6D, the conveyance route of the coil 200 is bent by 180°.

Thereby, the coil 200 being conveyed at the coil feed unit 52 from the coil supply unit 5D is sent to the binding unit 4. The coil 200 sent to the binding unit 4 is axially conveyed with being rotated in the circumferential direction by the coil rotation/insertion unit 41, so that the coil is inserted into the holes 301 of the sheet bundle 302 aligned and positionally adjusted in the sheet aligning unit 3 from one side end portion 303 of the sheets 300.

The booklet 304 bound with the coil 200 is dropped to the discharging unit 7 by opening the contact shutter 30*a*. The discharging unit 7 overturns and conveys the booklet 304 received from the sheet aligning unit 3 to the sheet discharge stacker 8. The sheet discharge stacker 8 erects and stacks thereon the booklet 304 being conveyed with being overturned from the discharging unit 7.

In the bookbinding apparatus 1F having the sheet binding unit 9B mounted thereto, the binding unit 4F takes out the binding component 210 from the binding component supply unit 5F at a position shown in FIG. 122, moves the same to the sheet aligning unit 3 and binds the sheet bundle with the binding component 210.

The booklet 304 bound with the coil 200 is dropped to the discharging unit 7 by opening the contact shutter 30*a*. The discharging unit 7 overturns and conveys the booklet 304 received from the sheet aligning unit 3 to the sheet discharge stacker 8. The sheet discharge stacker 8 erects and stacks thereon the booklet 304 being conveyed with being overturned from the discharging unit 7.

Examples of Effect of Bookbinding Apparatus of Sixth Embodiment

In the bookbinding apparatus 1F, the sheet binding unit 9A is mounted, so that the conveying processing of the sheet 300, the hole forming processing of the sheet 300, the aligning processing of the sheet 300, the binding processing of the sheet bundle 302 by the coil 200 and the discharge processing of the booklet 304 bound with the coil 200 are automatically performed. Therefore, it is not necessary for a person to align the sheet 300, to place the sheet bundle 302, to place the coils 200 one by one, and to take out the booklet 304 with a hand. Thereby, it is possible to collectively perform the printing processing and the bookbinding processing by connecting the bookbinding apparatus 1F to the image forming apparatus 500 and the like.

In the bookbinding processing of using the coil 200, the coil 200 is axially conveyed with being rotated in the circumferential direction, and is inserted into the holes 301 from one side end portion 303 of the sheets 300. For this reason, it is necessary to secure a space for conveying the coil 200 at a side of the sheets 300.

In the meantime, in the case of the configuration where the plurality of coils 200 is stored, if a storing unit where the coils 200 are stored with an axial direction of the coils 200 facing toward an aligning direction of the holes 301 of the sheets 300 is provided at one side of the sheet 300 to be aligned in the sheet aligning unit 3, i.e., in front of the bookbinding apparatus 1F, the apparatus becomes large. Therefore, the coil supply unit 5D and the binding unit 4 are connected at the coil conveyance path 6D configured to bend the conveyance route of the coil 200 with respect to the axial direction of the coil 200, so that it is possible to improve a degree of freedom of arrangement of the coil supply unit 5D.

Also, the coil conveyance path 6D forms the curved conveyance path for conveying the coil 200 with curved with respect to the axial direction of the coil 200 to one side end portion 303 of the sheets 300 aligned in the sheet aligning unit 3, at the position Pp that is distant from the side end portion 303 by a distance smaller than the length $L_{30}$ of one coil 200.

Thereby, it is not necessary to secure a space corresponding to an entire length of one coil 200 in the axial direction at one side of the sheets 300 to be aligned in the sheet aligning unit 3, i.e., in front of the bookbinding apparatus 1D, so that it is possible to avoid the apparatus from being enlarged.

Also, the coil supply unit 5D is configured so that the first coil storing unit 501 and the second coil storing unit $\mathbf{50}_2$ can be independently inserted and removed with respect to the bookbinding apparatus 1F. Therefore, while supplying the coil 200 from the first coil storing unit $\mathbf{50}_k$, it is possible to draw out the second coil storing unit $\mathbf{50}_2$ and to replace the coil holding sheet 100A. Also, while supplying the coil 200 from the second coil storing unit $\mathbf{50}_2$, it is possible to draw out the first coil storing unit $\mathbf{50}_1$ and to replace the coil holding sheet 100A.

Thereby, the same type of the coils 200 are stored in the first coil storing unit $\mathbf{50}_1$ and the second coil storing unit $\mathbf{50}_2$, so that it is possible to consecutively perform the bookbinding processing beyond the number of the coils 200 to be stored while replacing the coil holding sheet 100A.

Also, the coil holding sheets 100A having the coils 200 of different outer diameters held thereto are stored in the first coil storing unit $\mathbf{50}_1$ and the second coil storing unit $\mathbf{50}_2$, so that it is possible to select the coil 200 in conformity to the thickness of the sheet bundles 302, which is different depending on the number of the sheets 300 to be bound, the sheet thickness of the sheets 300 to be bound, a basis weight and the like, without replacing the coil holding sheet 100A.

Also, the coil holding sheets 100A having the coils 200 of different colors held thereto are stored in the first coil storing unit 50, and the second coil storing unit $\mathbf{50}_2$, so that it is possible to make the booklet 304 bound with the coil 200 of a desired color without replacing the coil holding sheet 100A.

Also, it is possible to perform the bookbinding processing, in which the binding component 210 different from the coil 200 is used, by replacing when the sheet binding unit 9A and the sheet binding unit 9B, like the coil 200.

Bookbinding Example of Booklets Having Different Thicknesses

Figure 123:
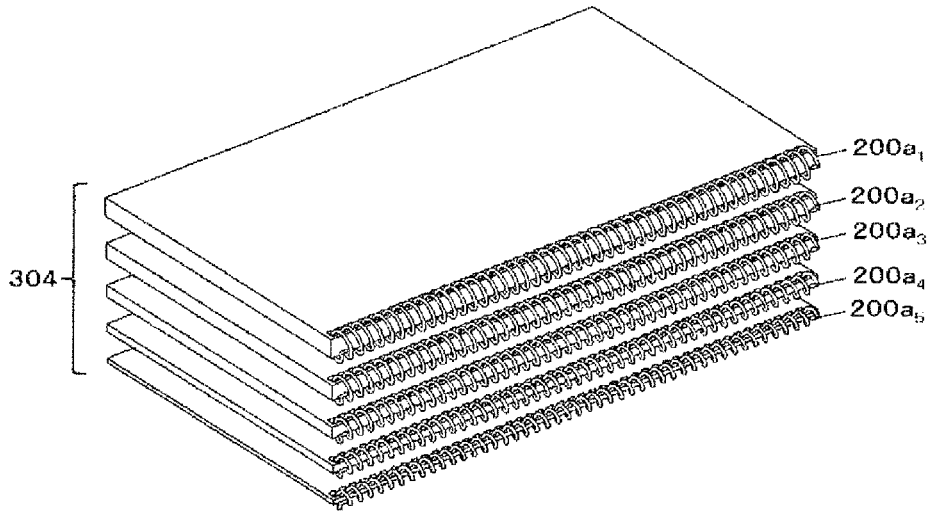

FIG. 123 illustrates a bookbinding example of booklets having different thicknesses. As shown in FIG. 10, the coils 200 having a plurality of different sizes of the outer diameters are prepared in correspondence to a thickness of a sheet bundle, which changes depending on the number of sheets to be bound, a sheet thickness, and the like. In this example, five types of a coil $\mathbf{200}a_1$, a coil $\mathbf{200}a_2$, a coil $\mathbf{200}a_3$, a coil $\mathbf{200}a\mathbf{4}$ and a coil $\mathbf{200}a_5$ in order from the larger outer diameter Ro can be used.

As described above with reference to FIGS. 103 to 106, the coil holding sheet 100A corresponding to the outer diameter of the coil 200 is prepared. Thereby, in the bookbinding apparatuses 1A to 1D, and the bookbinding apparatus 1F having the sheet binding unit 9A mounted thereto, when the coil holding sheet 100A is replaced, it is possible to make a booklet 304 by using any of the coil $\mathbf{200}a_1$ to the coil $\mathbf{200}a_5$ suitable for thicknesses of sheet bundles of which a sheet thickness, a basis weight and the like are different, as shown in FIG. 123.

Configuration Example of Coil Separating Unit of First Embodiment

Figure 124:
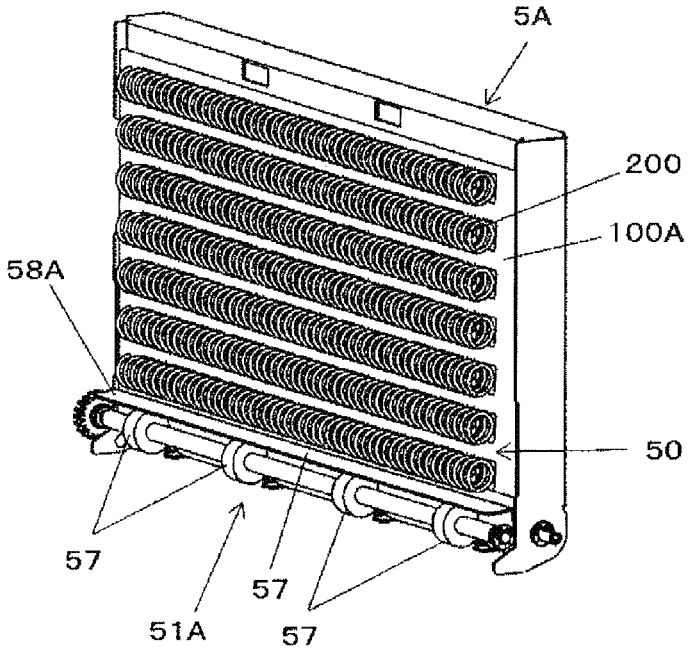
Figure 125:
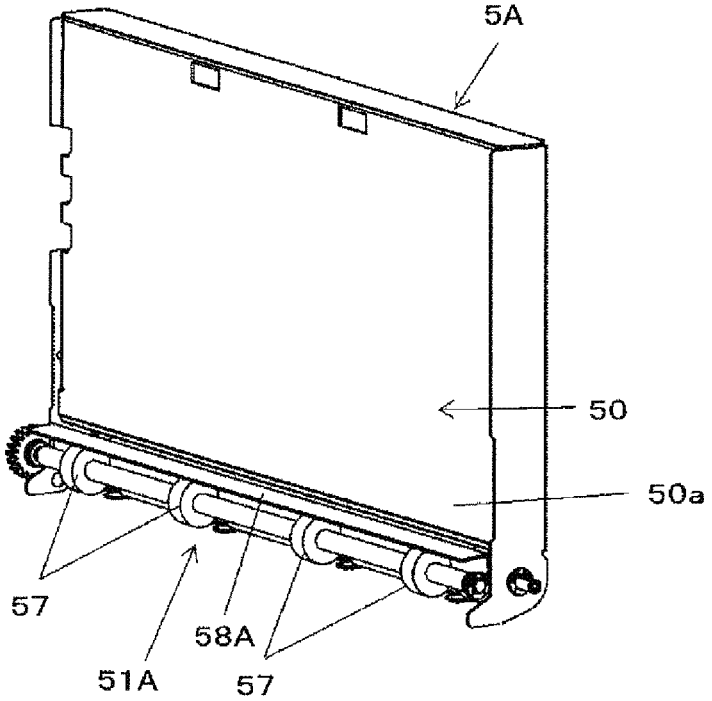
Figure 126:
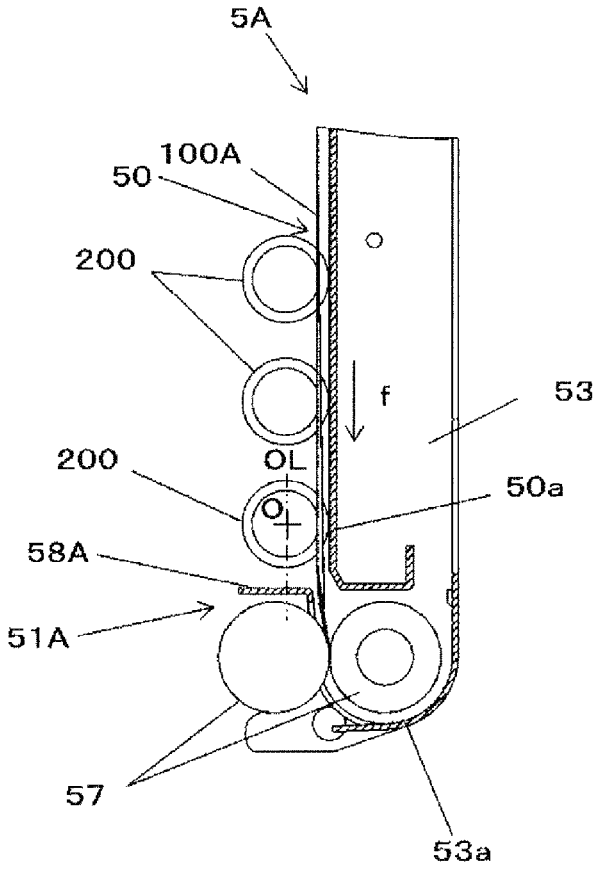

FIGS. 124 and 125 are perspective views depicting an example of the coil separating unit of a first embodiment, which is the binding component separation mechanism. FIG. 126 is a side view depicting an example of the coil separating unit of the first embodiment. In the below, the first embodiment of the coil separating unit is described with reference to the above-described first coil supply unit 5A.

The coil supply unit 5A includes the coil storing unit 50 in which any one of the coil holding sheets 100A, 100A1, 100A2, 100A3, 100A4 of the first embodiment, any one of the coil holding sheets 100B, 100B2, 100B3, 100B4 of the second embodiment, any one of the coil holding sheets 100C, 100C2, 100C3, 100C4 of the third embodiment, the coil holding sheet 100D of the fourth embodiment, the coil holding sheet 100E of the fifth embodiment or the coil holding sheet 100F of the sixth embodiment, to which the coils 200 are held, is stored. In the below, the coil holding sheet 100A is exemplified.

Also, the coil supply unit 5A includes a coil separating unit 51A of the first embodiment configured to separate the coil 200 from the coil holding sheet 100A. In addition, the coil supply unit 5A includes the sheet collection unit 53 configured to collect the coil holding sheet 100A from which the coils 200 have been separated.

The coil storing unit 50 has a coil guide plate 50*a* to which outer peripheral surfaces of portions, which protrude to the back surface side of the coil holding sheet 100A, of the coil 200 held to the coil holding sheet 100A are contacted. The coil guide plate 50*a* is an example of the pressing part. In the first embodiment, the coil guide plate 50*a* extends in the vertical direction. In the coil storing unit 50, one coil holding sheet 100A capable of supporting the plurality of coils 200 is stored in a space formed at one surface side of the coil guide plate 50*a* with the parallel direction of the coils 200 facing toward the vertical direction.

The coil separating unit 51A includes sheet conveying rollers 57 configured to convey the coil holding sheet 100A stored in the coil storing unit 50 and a contact part 58A against which the coil 200 held to the coil holding sheet 100A is to be contacted.

The sheet conveying rollers 57 are an example of the conveying unit and the sheet conveying unit and are provided downstream of the contact part 58A with respect to the conveying direction of the coil holding sheet 100A denoted with an arrow f. The sheet conveying rollers 57 are configured so that at least one of a pair of rollers arranged to face each other is rotatively driven, and are configured to sandwich and convey the coil holding sheet 100A.

The plurality of sheet conveying rollers 57 of the coil separating unit 51A is coaxially arranged, in conformity to the intervals of the holder forming places 103*a* of the coil holding sheet 100A shown in FIG. 1 and the like. Thereby, the sheet conveying rollers 57 are configured to convey the coil holding sheet 100A with being in contact with the holder forming places 103*a* of the coil holding sheet 100A.

As shown in FIG. 1 and the like, the holder forming places 103*a* of the coil holding sheet 100A are consecutive in the parallel direction of the coil holding rows 103. Thereby, while the coil holding sheet 100A is being conveyed by the sheet conveying rollers 57, the sheet conveying rollers 57 are contacted to the coil holding sheet 100A, so that it is possible to securely convey the coil holding sheet 100A.

The contact part 58A is provided on the conveyance route of the coil 200 held with the coil holding sheet 100A, and protrudes by a height at which it is in contact with the outer periphery of the coil 200 between a virtual line OL passing a center O of the coil 200 supported with the coil holding sheet 100A and the coil holding sheet 100A.

In the first embodiment, a length of the contact part 58A in the radial direction of the coil 200 is configured to be larger than a radius of the coil 200 so that the contact part 58A is in contact with the outer peripheral surface of the coil 200 at a position of the virtual line OL passing the center O of the coil 200, i.e., at a position of a maximum diameter of the coil 200. Also, the contact part 58A protrudes in a direction substantially perpendicular to the coil guide plate 50*a*. In addition, a length of the contact part 58A in the axial direction of the coil 200 is configured to be larger than an axial length of the coil 200.

The coil separating unit 51A is configured to cause the coil 200 held to the coil holding sheet 100A to contact against the contact part 58A by conveying the coil holding sheet 100A with the sheet conveying rollers 57, and to separate the coil 200 contacted against the contact part 58A from the coil holding sheet 100A.

In the first embodiment, the sheet collection unit 53 is arranged in parallel with the back surface side of the coil storing unit 50 with the coil guide plate 50*a* being interposed therebetween. The sheet collection unit 53 has a U-shaped sheet conveyance guide 53*a* configured to reverse the conveying direction of the coil holding sheet 100A to be conveyed with the sheet conveying rollers 57. Thereby, it is possible to implement a configuration of collecting the coil holding sheet 100A from which the coils 200 have been separated, without increasing a length of the coil holding sheet 100A in the conveying direction.

Figure 127:
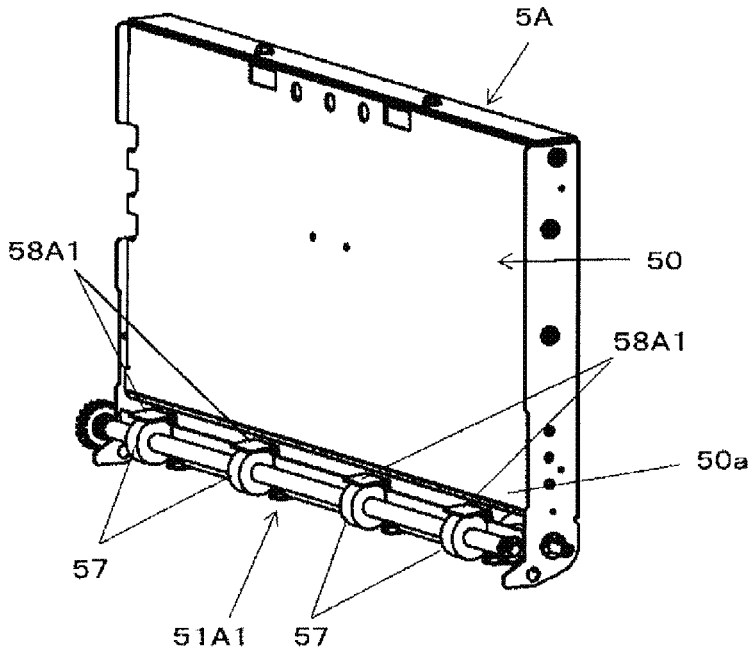

FIG. 127 is a perspective view depicting a modified embodiment of the coil separating unit of the first embodiment. The coil supply unit 5A includes the coil storing unit 50 in which any one of the coil holding sheets 100A, 100A1, 100A2, 100A3, 100A4 of the first embodiment, any one of the coil holding sheets 100B, 100B2, 100B3, 100B4 of the second embodiment, any one of the coil holding sheets 100C, 100C2, 100C3, 100C4 of the third embodiment, the coil holding sheet 100D of the fourth embodiment, the coil holding sheet 100E of the fifth embodiment or the coil holding sheet 100F of the sixth embodiment, to which the coils 200 are held, is stored. In the below, the coil holding sheet 100A described with reference to FIGS. 1 to 7 and the like is exemplified, although it is not shown in FIG. 127.

Also, the coil supply unit 5A includes a coil separating unit 51A1 of the modified embodiment of the first embodiment configured to separate the coil 200 from the coil holding sheet 100A. In addition, although not shown in FIG. 127, the coil supply unit 5A includes the sheet collection unit configured to collect the coil holding sheet 100A from which the coils 200 have been separated, as shown in FIG. 126.

The coil storing unit 50 has the coil guide plate 50*a* to which the outer peripheral surfaces of portions, which protrude to the back surface side of the coil holding sheet 100A, of the coil 200 held to the coil holding sheet 100A are contacted. In this modified embodiment, the coil guide plate 50*a* extends in the vertical direction. In the coil storing unit 50, one coil holding sheet 100A capable of supporting the plurality of coils 200 is stored in the space formed at one surface side of the coil guide plate 50*a* with the parallel direction of the coils 200 facing toward the vertical direction.

The coil separating unit 51A1 includes the sheet conveying rollers 57 configured to convey the coil holding sheet 100A stored in the coil storing unit 50 and a contact part 58A1 against which the coil 200 held to the coil holding sheet 100A is to be contacted.

The sheet conveying rollers 57 are an example of the sheet conveying unit, and are provided downstream of the contact part 58A1 with respect to the conveying direction of the coil holding sheet 100A. The sheet conveying rollers 57 are configured to sandwich and convey the coil holding sheet 100A.

The plurality of sheet conveying rollers 57 of the coil separating unit 51A1 is coaxially arranged, in conformity to the intervals of the holder forming places 103*a* of the coil holding sheet 100A shown in FIG. 1 and the like. Thereby, the sheet conveying rollers 57 are configured to convey the coil holding sheet 100A with being in contact with the holder forming places 103*a* of the coil holding sheet 100A.

As shown in FIG. 1 and the like, the holder forming places 103*a* of the coil holding sheet 100A are consecutive in the parallel direction of the coil holding rows 103. Thereby, while the coil holding sheet 100A is being conveyed by the sheet conveying rollers 57, the sheet conveying rollers 57 are contacted to the coil holding sheet 100A, so that it is possible to securely convey the coil holding sheet 100A.

The contact part 58A1 is provided on the conveyance route of the coil 200 held with the coil holding sheet 100A, and protrudes by the height at which it is in contact with the outer periphery of the coil 200 between the virtual line OL passing the center O of the coil 200 supported with the coil holding sheet 100A and the coil holding sheet 100A, like the contact part 58A shown in FIG. 126.

In this modified embodiment, a length of the contact part 58A1 in the radial direction of the coil 200 is configured to be larger than the radius of the coil 200 so that the contact part 58A1 is in contact with the outer peripheral surface of the coil 200 at the position of the virtual line OL passing the center O of the coil 200, i.e., at the position of the maximum diameter of the coil 200. Also, the contact part 58A1 protrudes in the direction substantially perpendicular to the coil guide plate 50*a*. In addition, the contact part 58A1 is arranged in conformity to the arrangement of the sheet conveying rollers 57, i.e., the intervals of the holder forming places 103*a* of the coil holding sheet 100A shown in FIG. 1 and the like.

The coil separating unit 51A1 is configured to cause the coil 200 held to the coil holding sheet 100A to contact against the contact part 58A1 by conveying the coil holding sheet 100A with the sheet conveying rollers 57, and to separate the coil 200 contacted against the contact part 58A1 from the coil holding sheet 100A.

Figure 128:
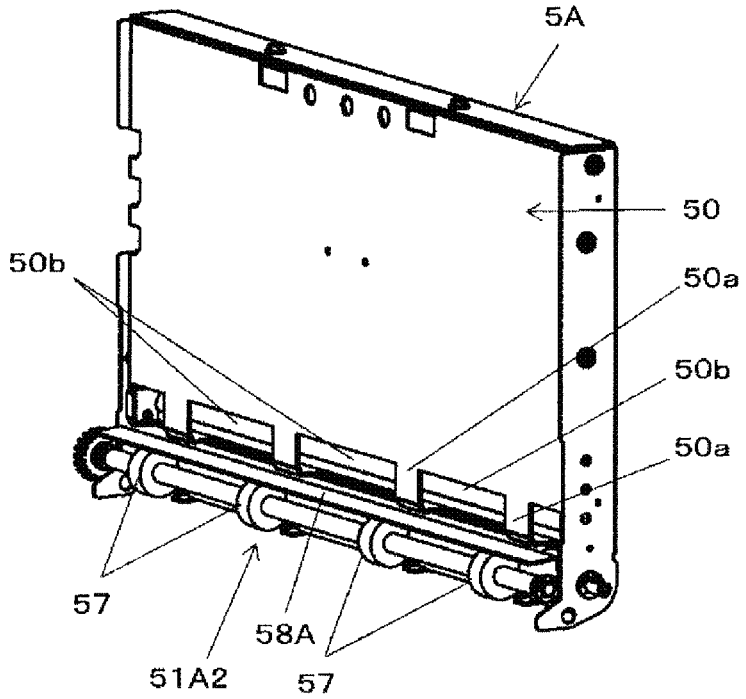

FIG. 128 is a perspective view depicting another modified embodiment of the coil separating unit of the first embodiment. As described above, the coil supply unit 5A includes the coil storing unit 50 in which any one of the coil holding sheets 100A, 100A1, 100A2, 100A3, 100A4 of the first embodiment, any one of the coil holding sheets 100B, 100B2, 100B3, 100B4 of the second embodiment, any one of the coil holding sheets 100C, 100C2, 100C3, 100C4 of the third embodiment, the coil holding sheet 100D of the fourth embodiment, the coil holding sheet 100E of the fifth embodiment or the coil holding sheet 100F of the sixth embodiment, to which the coils 200 are held, is stored. In the below, the coil holding sheet 100A described with reference to FIGS. 1 to 7 and the like is exemplified, although it is not shown in FIG. 128.

Also, the coil supply unit 5A includes a coil separating unit 51A2 of another modified embodiment of the first embodiment configured to separate the coil 200 from the coil holding sheet 100A. In addition, although not shown in FIG. 128, the coil supply unit 5A includes the sheet collection unit configured to collect the coil holding sheet 100A from which the coils 200 have been separated, as shown in FIG. 126.

The coil storing unit 50 has the coil guide plate 50*a* to which the outer peripheral surfaces of portions, which protrude to the back surface side of the coil holding sheet 100A, of the coil 200 held to the coil holding sheet 100A are contacted. In this modified embodiment, the coil guide plate 50*a* extends in the vertical direction. In the coil storing unit 50, one coil holding sheet 100A capable of supporting the plurality of coils 200 is stored in the space formed at one surface side of the coil guide plate 50*a*, in a state where the parallel direction of the coils 200 is set to face toward the vertical direction.

The coil storing unit 50 has openings 50*b* formed in the coil guide plate 50*a*. The openings 50*b* are formed between the holder forming places 103*a* of the coil holding sheet 100A shown in FIG. 1 and the like, i.e., are formed by providing openings penetrating the front and back of the coil guide plate 50*a*, in conformity to the arrangement of the escape holes 102.

The coil separating unit 51A2 includes the sheet conveying rollers 57 configured to convey the coil holding sheet 100A stored in the coil storing unit 50 and the contact part 58A against which the coil 200 held to the coil holding sheet 100A is to be contacted.

The sheet conveying rollers 57 are an example of the sheet conveying unit, and are provided downstream of the contact part 58A with respect to the conveying direction of the coil holding sheet 100A. The sheet conveying rollers 57 are configured to sandwich and convey the coil holding sheet 100A.

The plurality of sheet conveying rollers 57 of the coil separating unit 51A2 is coaxially arranged, in conformity to the intervals of the holder forming places 103*a* of the coil holding sheet 100A shown in FIG. 1 and the like. Thereby, the sheet conveying rollers 57 are configured to convey the coil holding sheet 100A with being in contact with the holder forming places 103*a* of the coil holding sheet 100A.

As shown in FIG. 1 and the like, the holder forming places 103*a* of the coil holding sheet 100A are consecutive in the parallel direction of the coil holding rows 103. Thereby, while the coil holding sheet 100A is being conveyed by the sheet conveying rollers 57, the sheet conveying rollers 57 are contacted to the coil holding sheet 100A, so that it is possible to securely convey the coil holding sheet 100A.

The contact part 58A is provided on the conveyance route of the coil 200 held with the coil holding sheet 100A, and protrudes by the height at which it is in contact with the outer periphery of the coil 200 between the virtual line OL passing the center O of the coil 200 supported with the coil holding sheet 100A and the coil holding sheet 100A, as shown in FIG. 126.

In this modified embodiment, a length of the contact part 58A in the radial direction of the coil 200 is configured to be larger than the radius of the coil 200 so that the contact part 58A is in contact with the outer peripheral surface of the coil 200 at the position of the virtual line OL passing the center O of the coil 200, i.e., at the position of the maximum diameter of the coil 200. Also, the contact part 58A protrudes in the direction substantially perpendicular to the coil guide plate 50*a*. In addition, the length of the contact part 58A in the axial direction of the coil 200 is configured to be larger than the axial length of the coil 200.

The coil separating unit 51A2 is configured to cause the coil 200 held to the coil holding sheet 100A to contact against the contact part 58A by conveying the coil holding sheet 100A with the sheet conveying rollers 57, and to separate the coil 200 contacted against the contact part 58A from the coil holding sheet 100A.

Figure 129:
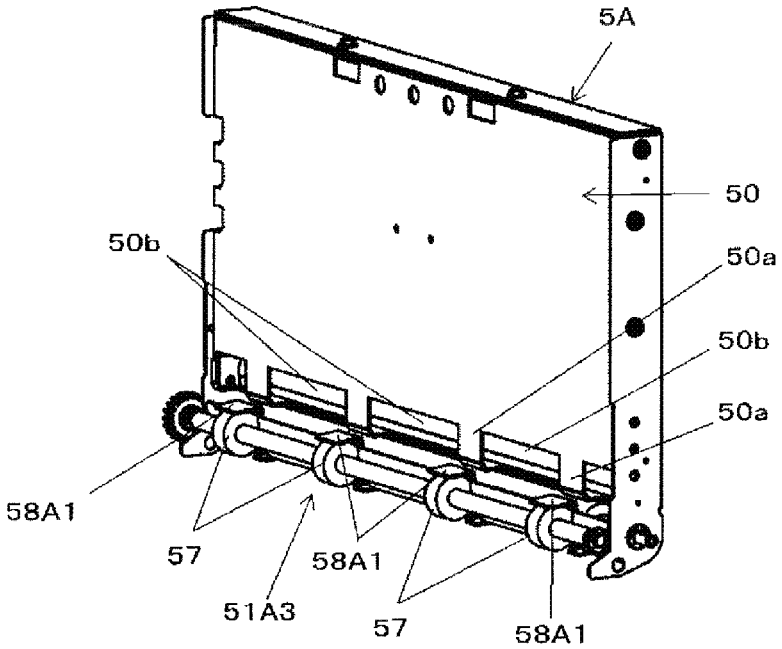

FIG. 129 is a perspective view depicting another modified embodiment of the coil separating unit of the first embodiment. The coil supply unit 5A includes the coil storing unit 50 in which any one of the coil holding sheets 100A, 100A1, 100A2, 100A3, 100A4 of the first embodiment, any one of the coil holding sheets 100B, 100B2, 100B3, 100B4 of the second embodiment, any one of the coil holding sheets 100C, 100C2, 100C3, 100C4 of the third embodiment, the coil holding sheet 100D of the fourth embodiment, the coil holding sheet 100E of the fifth embodiment or the coil holding sheet 100F of the sixth embodiment, to which the coils 200 are held, is stored. In the below, the coil holding sheet 100A described with reference to FIGS. 1 to 7 and the like is exemplified, although it is not shown in FIG. 129.

Also, the coil supply unit 5A includes a coil separating unit 51A3 of another modified embodiment of the first embodiment configured to separate the coil 200 from the coil holding sheet 100A. In addition, although not shown in FIG. 129, the coil supply unit 5A includes the sheet collection unit configured to collect the coil holding sheet 100A from which the coils 200 have been separated, as shown in FIG. 126.

The coil storing unit 50 has the coil guide plate 50*a* to which the outer peripheral surfaces of portions, which protrude to the back surface side of the coil holding sheet 100A, of the coil 200 held to the coil holding sheet 100A are contacted. In this modified embodiment, the coil guide plate 50*a* extends in the vertical direction. In the coil storing unit 50, one coil holding sheet 100A capable of supporting the plurality of coils 200 is stored in the space formed at one surface side of the coil guide plate 50*a* with the parallel direction of the coils 200 facing toward the vertical direction.

The coil storing unit 50 has openings 50*b* formed in the coil guide plate 50*a*. The openings 50*b* are formed between the holder forming places 103*a* of the coil holding sheet 100A shown in FIG. 1 and the like, i.e., are formed by providing openings penetrating the front and back of the coil guide plate 50*a*, in conformity to the arrangement of the escape holes 102.

The coil separating unit 51A3 includes the sheet conveying rollers 57 configured to convey the coil holding sheet 100A stored in the coil storing unit 50 and the contact part 58A 1 against which the coil 200 held to the coil holding sheet 100A is to be contacted.

The sheet conveying rollers 57 are an example of the sheet conveying unit, and are provided downstream of the contact part 58A1 with respect to the conveying direction of the coil holding sheet 100A. The sheet conveying rollers 57 are configured to sandwich and convey the coil holding sheet 100A.

The plurality of sheet conveying rollers 57 of the coil separating unit 51A3 is coaxially arranged, in conformity to the intervals of the holder forming places 103*a* of the coil holding sheet 100A shown in FIG. 1 and the like. Thereby, the sheet conveying rollers 57 are configured to convey the coil holding sheet 100A with being in contact with the holder forming places 103*a* of the coil holding sheet 100A.

As shown in FIG. 1 and the like, the holder forming places 103*a* of the coil holding sheet 100A are consecutive in the parallel direction of the coil holding rows 103. Thereby, while the coil holding sheet 100A is being conveyed by the sheet conveying rollers 57, the sheet conveying rollers 57 are contacted to the coil holding sheet 100A, so that it is possible to securely convey the coil holding sheet 100A.

The contact part 58A1 is provided on the conveyance route of the coil 200 held with the coil holding sheet 100A, and protrudes by the height at which it is in contact with the outer periphery of the coil 200 between the virtual line OL passing the center O of the coil 200 supported with the coil holding sheet 100A and the coil holding sheet 100A, like the contact part 58A shown in FIG. 126.

In this modified embodiment, the length of the contact part 58A1 in the radial direction of the coil 200 is configured to be larger than the radius of the coil 200 so that the contact part 58A1 is in contact with the outer peripheral surface of the coil 200 at the position of the virtual line OL passing the center O of the coil 200, i.e., at the position of the maximum diameter of the coil 200. Also, the contact part 58A1 protrudes in the direction substantially perpendicular to the coil guide plate 50*a*. In addition, the contact part 58A1 is arranged in conformity to the arrangement of the sheet conveying rollers 57, i.e., the intervals of the holder forming places 103*a* of the coil holding sheet 100A shown in FIG. 1 and the like.

The coil separating unit 51A1 is configured to cause the coil 200 held to the coil holding sheet 100A to contact against the contact part 58A1 by conveying the coil holding sheet 100A with the sheet conveying rollers 57, and to separate the coil 200 contacted against the contact part 58A1 from the coil holding sheet 100A.

Examples of Operational Effect of Coil Separating Unit of First Embodiment

Figure 130:
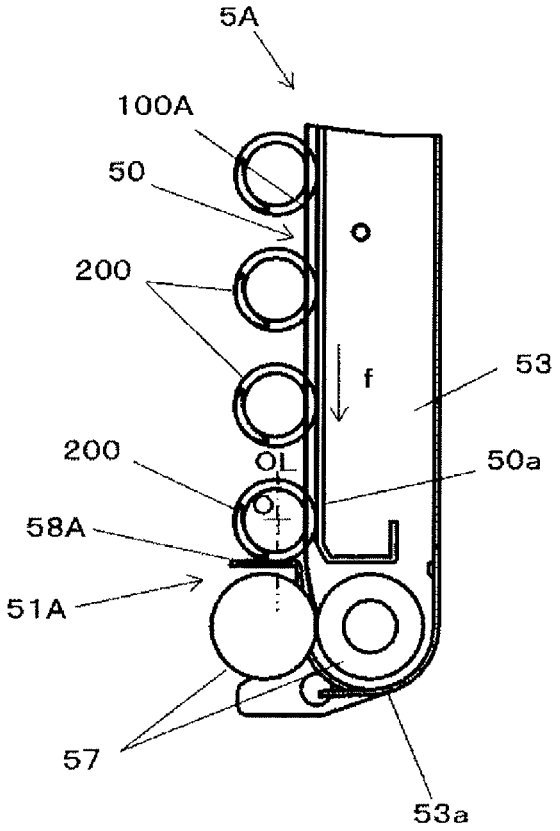
Figure 131:
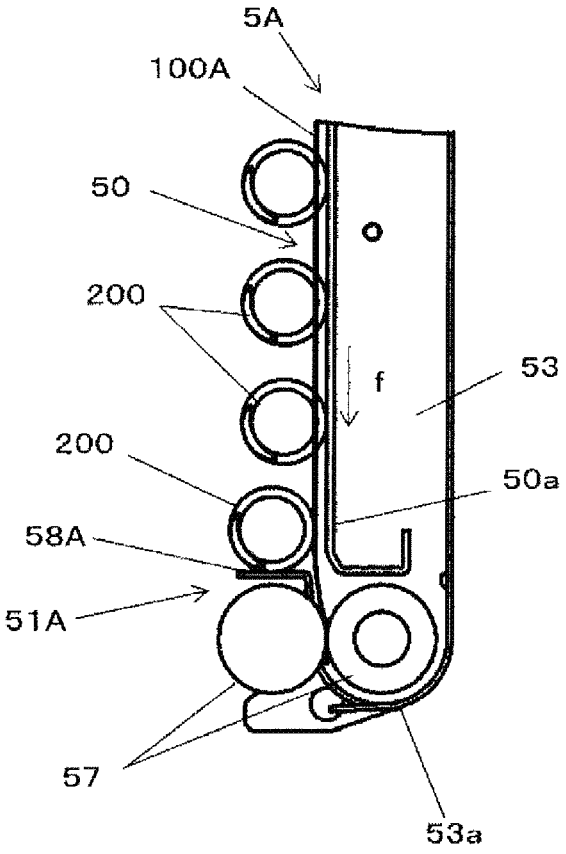

FIGS. 130 to 132 are side views depicting an example of an operation of the coil separating unit of the first embodiment. In the below, the operation of the coil separating unit of the first embodiment is described with reference to each drawing.

In the coil separating unit 51, when the coil holding sheet 100A is conveyed with the sheet conveying rollers 57 from a state shown in FIG. 126, the coil 200, which is positioned at the head in the conveying direction (refer to the arrow f) of the coil holding sheet 100A, of the coils 200 held to the coil holding sheet 100A is contacted against the contact part 58A, as shown in FIG. 130.

As described above with reference to FIGS. 8 and 9 and the like, the coil 200 is held to the coil holding sheet 100A in the state where the coil is offset with respect to the coil holding sheet 100A so that the protrusion height to the front surface side is greater than the protrusion height to the back surface side.

Thereby, during the operation of conveying the coil holding sheet 100A, the position of the maximum diameter of the coil 200 protruding to the front surface side of the coil holding sheet 100A is pressed to the contact part 58A, so that a force of releasing the coil 200 from the coil holding sheet 100A is generated to securely apply the force for detaching the coil 200 from the coil holding sheet 100A.

When the coil holding sheet 100A is further conveyed, the coil 200 is contacted to the coil guide plate 50*a*, as shown in FIG. 131, so that the coil 200 and the coil holding sheet 100A are not displaced in the direction of the coil guide plate 50*a* and the force of separating the coil 200 from the coil holding sheet 100A is applied.

Thereby, the holding pieces 101*f* are pressed and deformed by the coil 200 shown in FIG. 1 and the like and the width of the slit 101*b* is widened, so that the coil 200 is separated from the slit 101*b*. Therefore, when the coil holding sheet 100A is further conveyed, the coil 200 contacted against the contact part 58A is separated from the coil holding sheet 100A, as shown in FIG. 132.

The coil holding sheet 100A shown in FIG. 1 and the like does not hold the coil 200 in the escape holes 102. For this reason, during the operation of pushing up the coil 200 to the contact part 58A, the coil 200 and the coil holding sheet 100A are not displaced in the direction of the coil guide plate 50*a* at the portions at which the escape holes 102 are provided, although the coil guide plate 50*a* is not provided. Therefore, the coil guide plate 50*a* may be formed with the openings 50*b* penetrating the front and back of the coil guide plate 50*a* between the holder forming places 103*a* of the coil holding sheet 100A shown in FIG. 1 and the like, i.e., in conformity to the arrangement of the escape holes 102. Also, the coil holding sheet 100A shown in FIG. 1 and the like does not hold the coil in the escape holes 102. For this reason, at the portions at which the escape holes 102 are provided, even though the operation of pushing up the coil 200 to the contact part 58A is not performed, the coil 200 is separated from the coil holding sheet 100A. Therefore, instead of the contact part 58A, a shape such as the contact part 58A1 where the contact part is provided between the holder forming places 103*a* of the coil holding sheet 100A shown in FIG. 1 and the like, i.e., in conformity to the arrangement of the escape holes 102 may be used.

Configuration Example of Coil Separating Unit of Second Embodiment

FIG. 133 is a perspective view depicting an example of the coil separating unit of a second embodiment, and FIG. 134 is a side view depicting an example of the coil separating unit of the second embodiment. In the below, the second embodiment of the coil separating unit is described with reference to the above-described first coil supply unit 5A.

The coil supply unit 5A includes the coil storing unit 50 in which any one of the coil holding sheets 100A, 100A1, 100A2, 100A3, 100A4 of the first embodiment, any one of the coil holding sheets 100B, 100B2, 100B3, 100B4 of the second embodiment, any one of the coil holding sheets 100C, 100C2, 100C3, 100C4 of the third embodiment, the coil holding sheet 100D of the fourth embodiment, the coil holding sheet 100E of the fifth embodiment or the coil holding sheet 100F of the sixth embodiment, to which the coils 200 are held, is stored. In the below, the coil holding sheet 100A is exemplified.

Also, the coil supply unit 5A includes a coil separating unit 51B of the second embodiment configured to separate the coil 200 from the coil holding sheet 100A. In addition, the coil supply unit 5A includes the sheet collection unit 53 configured to collect the coil holding sheet 100A from which the coils 200 have been separated.

The coil storing unit 50 has the coil guide plate 50*a* to which the outer peripheral surfaces of portions, which protrude to the back surface side of the coil holding sheet 100A, of the coil 200 held to the coil holding sheet 100A are contacted. In the second embodiment, the coil guide plate 50*a* extends in the vertical direction. In the coil storing unit 50, one coil holding sheet 100A capable of supporting the plurality of coils 200 is stored in a space formed at one surface side of the coil guide plate 50*a* with the parallel direction of the coils 200 facing toward the vertical direction.

The coil separating unit 51B includes the sheet conveying rollers 57 configured to convey the coil holding sheet 100A stored in the coil storing unit 50 and a contact part 58B against which the coil 200 held to the coil holding sheet 100A is to be contacted.

The sheet conveying rollers 57 are an example of the sheet conveying unit, and are provided downstream of the contact part 58B with respect to the conveying direction of the coil holding sheet 100A denoted with the arrow f. The sheet conveying rollers 57 are configured so that at least one of a pair of rollers arranged to face each other is rotatively driven, and are configured to sandwich and convey the coil holding sheet 100A.

The plurality of sheet conveying rollers 57 of the coil separating unit 51B is coaxially arranged, in conformity to the intervals of the holder forming places 103*a* of the coil holding sheet 100A shown in FIG. 1 and the like. Thereby, the sheet conveying rollers 57 are configured to convey the coil holding sheet 100A with being in contact with the holder forming places 103*a* of the coil holding sheet 100A.

As shown in FIG. 1 and the like, the holder forming places 103*a* of the coil holding sheet 100A are consecutive in the parallel direction of the coil holding rows 103. Thereby, while the coil holding sheet 100A is being conveyed by the sheet conveying rollers 57, the sheet conveying rollers 57 are contacted to the coil holding sheet 100A, so that it is possible to securely convey the coil holding sheet 100A.

The contact part 58B is provided on the conveyance route of the coil 200 held with the coil holding sheet 100A, and protrudes by a height at which it is in contact with the outer periphery of the coil 200 between the virtual line OL passing the center O of the coil 200 supported with the coil holding sheet 100A and the coil holding sheet 100A.

The coil separating unit 51B is configured to cause the coil 200 held to the coil holding sheet 100A to contact against the contact part 58B by conveying the coil holding sheet 100A with the sheet conveying rollers 57, and to separate the coil 200 contacted against the contact part 58B from the coil holding sheet 100A.

In the second embodiment, the sheet collection unit 53 is arranged in parallel with the back surface side of the coil storing unit 50 with the coil guide plate 50*a* being interposed therebetween. The sheet collection unit 53 has a U-shaped sheet conveyance guide 53*a* configured to reverse the conveying direction of the coil holding sheet 100A to be conveyed with the sheet conveying rollers 57. Thereby, it is possible to implement a configuration of collecting the coil holding sheet 100A from which the coils 200 have been separated, without increasing a length of the coil holding sheet 100A in the conveying direction.

Examples of Operational Effect of Coil Separating Unit of Second Embodiment

FIGS. 135 to 137 are side views depicting an example of an operation of the coil separating unit of the second embodiment. In the below, the operation of the coil separating unit of the second embodiment is described with reference to each drawing.

In the coil separating unit 51, when the coil holding sheet 100A is conveyed with the sheet conveying rollers 57 from a state shown in FIG. 134, the coil 200, which is positioned at the head in the conveying direction (refer to the arrow f) of the coil holding sheet 100A, of the coils 200 held to the coil holding sheet 100A is contacted against the contact part 58B, as shown in FIG. 135.

As described above with reference to FIGS. 8 and 9 and the like, the coil 200 is held to the coil holding sheet 100A in the state where the coil is offset with respect to the coil holding sheet 100A so that the protrusion height to the front surface side is greater than the protrusion height to the back surface side.

Thereby, during the operation of conveying the coil holding sheet 100A, the position between the virtual line OL passing the center O of the coil 200 protruding to the front surface side of the coil holding sheet 100A and the coil holding sheet 100A is pressed to the contact part 58B, so that a force of releasing and separating the coil 200 from the coil holding sheet 100A is generated to securely apply the force for detaching the coil 200 from the coil holding sheet 100A.

When the coil holding sheet 100A is further conveyed, the coil 200 is contacted to the coil guide plate 50*a*, as shown in FIG. 136, so that the coil 200 and the coil holding sheet 100A are not displaced in the direction of the coil guide plate 50*a* and the force of separating the coil 200 from the coil holding sheet 100A is applied.

Thereby, the holding pieces 101*f* are pressed and deformed by the coil 200 shown in FIG. 1 and the like and the width of the slit 1010*b* is widened, so that the coil 200 is separated from the slit 101*b*. Therefore, when the coil holding sheet 100A is further conveyed, the coil 200 contacted against the contact part 58B is separated from the coil holding sheet 100A, as shown in FIG. 137.

Configuration Example of Coil Separating Unit of Third Embodiment

FIG. 138 is a perspective view depicting an example of the coil separating unit of a third embodiment, and FIG. 139 is a side view depicting an example of the coil separating unit of the third embodiment. In the below, the third embodiment of the coil separating unit is described with reference to the above-described first coil supply unit 5A.

The coil supply unit 5A includes the coil storing unit 50 in which any one of the coil holding sheets 100A, 100A1, 100A2, 100A3, 100A4 of the first embodiment, any one of the coil holding sheets 100B, 100B2, 100B3, 100B4 of the second embodiment, any one of the coil holding sheets 100C, 100C2, 100C3, 100C4 of the third embodiment, the coil holding sheet 100D of the fourth embodiment, the coil holding sheet 100E of the fifth embodiment or the coil holding sheet 100F of the sixth embodiment, to which the coils 200 are held, is stored. In the below, the coil holding sheet 100A is exemplified.

Also, the coil supply unit 5A includes a coil separating unit 51C of the third embodiment configured to separate the coil 200 from the coil holding sheet 100A. In addition, the coil supply unit 5A includes the sheet collection unit 53 configured to collect the coil holding sheet 100A from which the coils 200 have been separated.

The coil storing unit 50 has the coil guide plate 50*a* to which the outer peripheral surfaces of portions, which protrude to the back surface side of the coil holding sheet 100A, of the coil 200 held to the coil holding sheet 100A are contacted. In the third embodiment, the coil guide plate 50*a* extends in the vertical direction. In the coil storing unit 50, one coil holding sheet 100A capable of supporting the plurality of coils 200 is stored in a space formed at one surface side of the coil guide plate 50*a* with the parallel direction of the coils 200 facing toward the vertical direction.

The coil separating unit 51C includes the sheet conveying rollers 57 configured to convey the coil holding sheet 100A stored in the coil storing unit 50 and a contact part 58C against which the coil 200 held to the coil holding sheet 100A is to be contacted.

The sheet conveying rollers 57 are an example of the sheet conveying unit, and are provided downstream of the contact part 58C with respect to the conveying direction of the coil holding sheet 100A denoted with the arrow f. The sheet conveying rollers 57 are configured so that at least one of a pair of rollers arranged to face each other is rotatively driven, and are configured to sandwich and convey the coil holding sheet 100A.

The plurality of sheet conveying rollers 57 of the coil separating unit 51C is coaxially arranged, in conformity to the intervals of the holder forming places 103*a* of the coil holding sheet 100A shown in FIG. 1 and the like. Thereby, the sheet conveying rollers 57 are configured to convey the coil holding sheet 100A with being in contact with the holder forming places 103*a* of the coil holding sheet 100A.

As shown in FIG. 1 and the like, the holder forming places 103*a* of the coil holding sheet 100A are consecutive in the parallel direction of the coil holding rows 103. Thereby, while the coil holding sheet 100A is being conveyed by the sheet conveying rollers 57, the sheet conveying rollers 57 are contacted to the coil holding sheet 100A, so that it is possible to securely convey the coil holding sheet 100A.

The contact part 58C is provided on the conveyance route of the coil 200 held with the coil holding sheet 100A, and protrudes by a height at which it is in contact with the outer periphery of the coil 200 between the virtual line OL passing the center O of the coil 200 supported with the coil holding sheet 100A and the coil holding sheet 100A.

The contact part 58C is configured so that a length in the radial direction of the coil 200 is larger than the radius of the coil 200. Also, the contact part 58C is inclined in a direction in which a leading end side thereof is lowered along a direction of getting away from the coil guide plate 50*a*. In addition, the contact part 58C is configured so that a length in the axial direction of the coil 200 is larger than the axial length of the coil 200.

The coil separating unit 51C is configured to cause the coil 200 held to the coil holding sheet 100A to contact against the contact part 58C by conveying the coil holding sheet 100A with the sheet conveying rollers 57, and to separate the coil 200 contacted against the contact part 58C from the coil holding sheet 100A.

In the third embodiment, the sheet collection unit 53 is arranged in parallel with the back surface side of the coil storing unit 50 with the coil guide plate 50*a* being interposed therebetween. The sheet collection unit 53 has a U-shaped sheet conveyance guide 53*a* configured to reverse the conveying direction of the coil holding sheet 100A to be conveyed with the sheet conveying rollers 57. Thereby, it is possible to implement a configuration of collecting the coil holding sheet 100A from which the coils 200 have been separated, without increasing a length of the coil holding sheet 100A in the conveying direction.

Examples of Operational Effect of Coil Separating Unit of Third Embodiment

FIGS. 140 to 142 are side views depicting an example of an operation of the coil separating unit of the third embodiment. In the below, the operation of the coil separating unit of the third embodiment is described with reference to each drawing.

In the coil separating unit 51, when the coil holding sheet 100A is conveyed with the sheet conveying rollers 57 from a state shown in FIG. 139, the coil 200, which is positioned at the head in the conveying direction (refer to the arrow f) of the coil holding sheet 100A, of the coils 200 held to the coil holding sheet 100A is contacted against the contact part 58C, as shown in FIG. 140.

As described above with reference to FIGS. 8 and 9 and the like, the coil 200 is held to the coil holding sheet 100A in the state where the coil is offset with respect to the coil holding sheet 100A so that the protrusion height to the front surface side is greater than the protrusion height to the back surface side.

Thereby, during the operation of conveying the coil holding sheet 100A, the position between the virtual line OL passing the center O of the coil 200 protruding to the front surface side of the coil holding sheet 100A and the coil holding sheet 100A is pressed to the contact part 58C, so that a force of releasing and separating the coil 200 from the coil holding sheet 100A is generated to securely apply the force for detaching the coil 200 from the coil holding sheet 100A.

When the coil holding sheet 100A is further conveyed, the coil 200 is contacted to the coil guide plate 50*a*, as shown in FIG. 141, so that the coil 200 and the coil holding sheet 100A are not displaced in the direction of the coil guide plate 50*a* and the force of separating the coil 200 from the coil holding sheet 100A is applied.

Thereby, the holding pieces 101*f* are pressed and deformed by the coil 200 shown in FIG. 1 and the like and the width of the slit 101*b* is widened, so that the coil 200 is separated from the slit 101*b*. Therefore, when the coil holding sheet 100A is further conveyed, the coil 200 contacted against the contact part 58C is separated from the coil holding sheet 100A, as shown in FIG. 142.

Since the contact part 58C is inclined in the direction in which the leading end side thereof is lowered along the direction of getting away from the coil guide plate 50*a*, the coil 200 separated from the coil holding sheet 100A rolls in a direction of getting away from the coil holding sheet 100A by its own weight, and is securely sent to the coil feed unit 52 shown in FIG. 107 and the like.

Modified Embodiments of Coil Separating Unit of Embodiment

FIG. 143 is a side view depicting a modified embodiment of the coil separating unit as the binding component separation mechanism of the embodiment. In the below, other embodiments of the coil separating unit are described with reference to the above-described first coil supply unit 5A.

The coil supply unit 5A includes the coil storing unit 50 in which any one of the coil holding sheets 100A, 100A1, 100A2, 100A3, 100A4 of the first embodiment, any one of the coil holding sheets 100B, 100B2, 100B3, 100B4 of the second embodiment, any one of the coil holding sheets 100C, 100C2, 100C3, 100C4 of the third embodiment, the coil holding sheet 100D of the fourth embodiment, the coil holding sheet 100E of the fifth embodiment or the coil holding sheet 100F of the sixth embodiment, to which the coils 200 are held, is stored. In the below, the coil holding sheet 100A is exemplified.

Also, the coil supply unit 5A includes a coil separating unit 51D configured to separate the coil 200 from the coil holding sheet 100A.

The coil storing unit 50 has the coil guide plate 50*a* to which the outer peripheral surfaces of portions, which protrude to the back surface side of the coil holding sheet 100A, of the coil 200 held to the coil holding sheet 100A are contacted. In this modified embodiment, the coil guide plate 50*a* extends in the vertical direction. In the coil storing unit 50, one coil holding sheet 100A capable of supporting the plurality of coils 200 is stored in a space formed at one surface side of the coil guide plate 50*a* with the parallel direction of the coils 200 facing toward the vertical direction.

The coil separating unit 51D includes a contact part 58D against which the coil 200 held with the coil holding sheet 100A is to be contacted.

The contact part 58D is provided at a position at which it is to be contacted to the coil 200 held with the coil holding sheet 100A as it moves along the coil holding sheet 100A, and protrudes by a height at which it is in contact with the outer periphery of the coil 200 between the virtual line OL passing the center O of the coil 200 supported with the coil holding sheet 100A and the coil holding sheet 100A.

In this modified embodiment, a length of the contact part 58D in the radial direction of the coil 200 is configured to be larger than the radius of the coil 200 so that the contact part 58D is in contact with the outer peripheral surface of the coil 200 at the position of the virtual line OL passing the center O of the coil 200, i.e., at the position of the maximum diameter of the coil 200. Also, the contact part 58D protrudes in a direction substantially perpendicular to the coil guide plate 50*a*.

The coil separating unit 51D is configured to cause the contact part 58D to contact against the coil 200 held to the coil holding sheet 100A by conveying the contact part 58D with the conveying unit (not shown) in an arrow g direction along the coil holding sheet 100A, and to separate the coil 200 from the coil holding sheet 100A.

FIG. 144 is a side view depicting another modified embodiment of the coil separating unit of the embodiment. The coil supply unit 5A includes a coil separating unit 51E configured to separate the coil 200 from the coil holding sheet 100A.

The coil storing unit 50 has the coil guide plate 50*a* to which the outer peripheral surfaces of portions, which protrude to the back surface side of the coil holding sheet 100A, of the coil 200 held to the coil holding sheet 100A are contacted. In this modified embodiment, the coil guide plate 50*a* extends in the vertical direction. In the coil storing unit 50, one coil holding sheet 100A capable of supporting the plurality of coils 200 is stored in a space formed at one surface side of the coil guide plate 50*a* with the parallel direction of the coils 200 facing toward the vertical direction.

The coil separating unit 51E includes sheet conveying rollers 57E configured to convey the coil holding sheet 100A stored in the coil storing unit 50. The sheet conveying rollers 57E are an example of the sheet conveying unit, and are configured to sandwich and convey the coil holding sheet 100A with a pair of rollers.

The sheet conveying roller 57E has a diameter with which it is to be in contact with the coil 200 between the virtual line OL passing the center O of the coil 200 supported with the coil holding sheet 100A and the coil holding sheet 100A.

The coil separating unit 51E is configured to cause the coil 200 held to the coil holding sheet 100A to contact against the sheet conveying rollers 57E by conveying the coil holding sheet 100A with the sheet conveying rollers 57E, and to separate the coil 200 contacted against the sheet conveying rollers 57E from the coil holding sheet 100A. In this modified embodiment, the sheet conveying rollers 57E function as the contact part.

FIG. 145 is a side view depicting another modified embodiment of the coil separating unit as the binding component separation mechanism of the embodiment. The coil supply unit 5A includes a coil separating unit 51F configured to separate the coil 200 from the coil holding sheet 100A.

The coil separating unit 51F includes a first sheet conveying roller 57$F_1$ and a second sheet conveying roller 57$F_2$ configured to convey the coil holding sheet 100A stored in the coil storing unit 50. The first sheet conveying roller 57$F_1$ and the second sheet conveying roller 57$F_2$ are an example of the sheet conveying unit. The first sheet conveying roller 57$F_1$ and the second sheet conveying roller 57$F_2$ are configured to sandwich and convey the coil holding sheet 100A with a pair of rollers.

The first sheet conveying roller 57$F_1$ has a diameter with which it is in contact with the outer periphery of the coil 200, which is held to the coil holding sheet 100A in the state where the coil 200 is offset so that the protrusion height to the front surface side of the coil holding sheet 100A is greater than the protrusion height to the back surface side, between the virtual line OL passing to the center O of the coil 200 protruding to the front surface side of the coil holding sheet 100A and the coil holding sheet 100A.

The second sheet conveying roller 57$F_2$ has a diameter with which it is in contact with the outer periphery of the coil 200 protruding to the back surface side of the coil holding sheet 100A, at a more upstream side than the first sheet conveying roller 57$F_1$ with respect to the conveying direction. For this reason, the second sheet conveying roller 57$F_2$ is configured to have a diameter greater than the first sheet conveying roller 57$F_1$.

The coil separating unit 51F is configured to cause the coil 200 held to the coil holding sheet 100A to contact against the first sheet conveying roller 57$F_1$ by conveying the coil holding sheet 100A with the first sheet conveying roller 57$F_1$ and the second sheet conveying roller 57$F_2$.

Also, when the coil holding sheet 100A is conveyed, the coil 200 protruding to the back surface side of the coil holding sheet 100A is contacted to the second sheet conveying roller 57$F_2$, so that the coil 200 and the coil holding sheet 100A are not displaced in a direction of the second sheet conveying roller 57$F_2$ and a force is applied in a direction of separating the coil 200 from the coil holding sheet 100A. Thereby, the coil 200 contacted against the first sheet conveying roller 57$F_1$ is separated from the coil holding sheet 100A. Therefore, it is possible to support the coil 200 by the second sheet conveying roller 57$F_2$, without the coil guide plate 50*a* shown in FIG. 126 and the like. That is, in this modified embodiment, the first sheet conveying roller 57$F_1$ functions as the contact part to be contacted against the outer peripheral surface of the coil 200, which is the binding component, and the second sheet conveying roller 57$F_2$ functions as the restricting part configured to restrict displacements of the coil 200, which is the binding component, and the coil holding sheet 100A, which is the binding component holding sheet.

Example of Control Function of Bookbinding Apparatus of Each Embodiment

FIG. 146 is a block diagram depicting an example of a control function of the bookbinding apparatus of each embodiment. In the below, the control function is described with reference to the bookbinding apparatus 1D of the fourth embodiment shown in FIG. 118.

The respective configurations (refer to FIG. 118) of the bookbinding apparatus 1D are controlled by a controller 502 of the image forming apparatus 500 and a controller 700, in accordance with settings and operations on the operation unit 600 and settings and operations on the operation unit 501 of the image forming apparatus 500, so that the bookbinding processing of using the coil 200 is performed in conjunction with the image forming processing in the image forming apparatus 500.

The bookbinding apparatus 1D includes the operation unit 600 configured to receive a user's operation, as a configuration not shown in FIG. 118. The operation unit 600 includes a display unit 601 and an input unit 602. Also, the bookbinding apparatus 1D includes a sheet conveying unit 603 having a motor configured to convey a sheet on the first conveyance path 10 and the second conveyance path 11, a sensor configured to detect a position of the sheet, and the like.

The bookbinding apparatus 1D includes a booklet thickness detector 604 configured to detect a thickness of the sheet bundle 302 shown in FIG. 111 in the sheet aligning unit 3. Also, the bookbinding apparatus 1D includes a door opening/closing detector 605 configured to detect whether a door (not shown) provided at a front face of the apparatus is opened or closed. The maintenance and inspection can be performed for an inside of the bookbinding apparatus 1D by opening the door.

The bookbinding apparatus 1D includes a loading detector 606$_1$ configured to detect whether the first coil storing unit 50$_1$ is loaded in the coil supply unit 5D. Also, the bookbinding apparatus 1D includes a coil information detector 607$_1$ configured to detect coil information such as a diameter, a color and the like of the coil 200 stored in the first coil storing unit 50$_1$. In addition, the bookbinding apparatus 1D includes a sheet conveying unit 608$_1$ configured to drive the sheet conveying rollers 57 shown in FIG. 126 and the like, thereby conveying the coil holding sheet 100A and the like.

Also, the bookbinding apparatus 1D includes a locking unit 609$_1$ configured to set a lock state in which the first coil storing unit 50$_1$ cannot be mounted and demounted with respect to the coil supply unit 5D and a lock release state. In addition, the bookbinding apparatus 1D includes a display unit 610$_1$ configured to display coil information such as a diameter, a color and the like of the coil 200 stored in the first coil storing unit 50$_1$, and the like.

The bookbinding apparatus 1D includes a loading detector 606$_2$ configured to detect whether the second coil storing unit 50$_2$ is loaded in the coil supply unit 5D. Also, the bookbinding apparatus 1D includes a coil information detector 607$_2$ configured to detect coil information such as a diameter, a color and the like of the coil 200 stored in the second coil storing unit 50$_2$. In addition, the bookbinding apparatus 1D includes a sheet conveying unit 608$_2$ configured to drive the sheet conveying rollers 57 shown in FIG. 126 and the like, thereby conveying the coil holding sheet 100A and the like.

Also, the bookbinding apparatus 1D includes a locking unit 609$_2$ configured to set a lock state in which the second coil storing unit 50$_2$ cannot be mounted and demounted with respect to the coil supply unit 5D and a lock release state in which the second coil storing unit 50$_2$ can be mounted and demounted with respect to the coil supply unit 5D. In addition, the bookbinding apparatus 1D includes a display unit 610$_2$ configured to display coil information such as a diameter, a color and the like of the coil 200 stored in the second coil storing unit 50$_2$, and the like.

In the above, the example where the two sets of the coil storing units are provided has been described. However, the same configuration is adopted even when three or more sets of the coil storing units are provided.

The image forming apparatus 500 includes a display unit 503 and an input unit 504, as the operation unit 501. Also, the image forming apparatus 500 includes a sheet thickness detector 505 configured to detect a thickness of the sheet bundle, for which the bookbinding processing is to be performed by the bookbinding apparatus 1D, on the basis of settings such as a type of a sheet, a basis weight of a sheet, the number of sheets on which images are to be formed, and the like. The image forming apparatus 500 may be connected to an external PC 800.

In the bookbinding apparatus 1D, when the door opening/closing detector 605 detects that the door (not shown) is opened, the controller 700 stops the conveying processing of the sheet 300, the hole forming processing of the sheet 300, the aligning processing of the sheet 300, the binding processing of the sheet bundle 302 in which the coil 200 is used, and the discharge processing of the booklet 304 bound with the coil 200, if the bookbinding processing is being executed.

On the contrary, when any one of the plurality of coil storing units is mounted to the coil supply unit 5D, in this example, when one of the first coil storing unit 50$_1$ and the second coil storing unit 50$_2$ is mounted, the bookbinding processing is continuously performed even though the other coil storing unit is drawn out.

For example, in the case that the same type of the coils 200 are stored in the first coil storing unit 50$_1$ and the second coil storing unit 50$_2$, when the loading detector 606$_1$ detects that the first coil storing unit 50$_1$ is demounted, the controller 700 stops the supply of the coil 200 from the first coil storing unit 50$_1$, and drives the sheet conveying unit 608$_2$ of the second coil storing unit 50$_2$ to supply the coil 200 from the second coil storing unit 50$_2$.

While the coil 200 is being supplied from the second coil storing unit $\mathbf{50}_2$, the locking unit $\mathbf{609}_2$ sets the lock state so that the second coil storing unit $\mathbf{50}_2$ cannot be drawn out, so as to prevent the second coil storing unit $\mathbf{50}_2$ from being drawn out. Also, the display unit $\mathbf{610}_2$ displays that the coil 200 is being supplied from the second coil storing unit $\mathbf{50}_2$. The lock release by the locking unit $\mathbf{609}_2$ can be made by a predetermined operation when the bookbinding processing is not executed. In the meantime, a configuration where an in-use status is output with the display unit $\mathbf{610}_2$ and the locking unit $\mathbf{609}_2$ is not provided may also be adopted.

When the loading detector $\mathbf{606}_2$ detects that the second coil storing unit $\mathbf{50}_2$ is demounted, the controller 700 stops the supply of the coil 200 from the second coil storing unit $\mathbf{50}_2$, and drives the sheet conveying unit $\mathbf{608}_1$ of the first coil storing unit $\mathbf{50}_1$ to supply the coil 200 from the first coil storing unit $\mathbf{50}_1$.

While the coil 200 is being supplied from the first coil storing unit 50, the locking unit $\mathbf{609}_1$ sets the lock state so that the first coil storing unit $\mathbf{50}_1$ cannot be drawn out, so as to prevent the first coil storing unit $\mathbf{50}_1$ from being drawing out. Also, the display unit $\mathbf{610}_1$ displays that the coil 200 is being supplied from the first coil storing unit $\mathbf{50}_1$. The lock release by the locking unit $\mathbf{609}_1$ can be made by a predetermined operation when the bookbinding processing is not executed. In the meantime, a configuration where an in-use status is output with the display unit $\mathbf{610}_1$ and the locking unit $\mathbf{609}_1$ is not provided may also be adopted. Thereby, it is possible to consecutively perform the bookbinding processing beyond the number of the coils 200 that can be stored in the first coil storing unit $\mathbf{50}_1$ and the second coil storing unit $\mathbf{50}_2$.

The type of the coils 200 stored in the first coil storing unit $\mathbf{50}_1$ and the second coil storing unit $\mathbf{50}_2$ is detected by sensors (not shown) configuring the coil information detector $\mathbf{607}_1$ and the coil information detector $\mathbf{607}_2$, and is stored in a storage of the controller 700. Also, as the coil information detector $\mathbf{607}_1$ and the coil information detector $\mathbf{607}_2$, the type of the coil may be acquired from coil information that is to be input with the operation unit 600 of the bookbinding apparatus 1D or the operation unit 501 of the image forming apparatus 500.

When it is determined from the coil information detector $\mathbf{607}_1$ and the coil information detector $\mathbf{607}_2$ that the same type of the coils 200 are stored in both the coil storing units, the controller 700 executes processing of switching the supply source of the coil 200 between the first coil storing unit $\mathbf{50}_1$ and the second coil storing unit $\mathbf{50}_2$, as described above.

Also, when it is determined that the types of the coils 200 stored in the first coil storing unit $\mathbf{50}_1$ and the second coil storing unit $\mathbf{50}_2$ are different such as coils of different diameters, different colors and the like, the controller 700 presents an operation guide for urging replacement of the coil on the display unit 601, and temporarily stops the bookbinding processing.

Also, when it is determine that any one of the first coil storing unit $\mathbf{50}_1$ and the second coil storing unit $\mathbf{50}_2$ gets out of order, the controller 700 stops the supply of the coil from the coil storing unit having trouble while supplying the coil 200 from the operable coil storing unit. Also, the controller 700 notifies the user of information of specifying the coil storing unit having trouble through the display unit 601 of the bookbinding apparatus 1D and the display unit 503 of the image forming apparatus 500. Also, the controller 700 may be configured to output the information indicative of whether or not the trouble, through the display unit $\mathbf{610}_1$, $\mathbf{610}_2$ provided to the respective coil storing units.

The controller 700 is configured to acquire the numbers and remaining numbers of the coils 200 stored in the first coil storing unit 50 and the second coil storing unit $\mathbf{50}_2$, from sensors (not shown) configuring the coil information detector $\mathbf{607}_1$ and the coil information detector $\mathbf{607}_2$, the number of the binding processing, and the like. Thereby, the controller 700 is configured to determine that there is no coil 200 stored in the first coil storing unit $\mathbf{50}_1$ and the second coil storing unit $\mathbf{50}_2$ and the remaining number thereof is reduced.

As described above, in the processing of switching the supply source of the coil 200 between the first coil storing unit $\mathbf{50}_1$ and the second coil storing unit $\mathbf{50}_2$, when it is determined that there is no coil 200 stored in one coil storing unit, the controller 700 switches the supply source of the coil to the other coil storing unit.

Also, when it is determined that the remaining number of the coil 200 is equal to or smaller than a predetermined number, the controller 700 determines whether the number of booklets to be prepared, i.e., the remaining number of the bookbinding processing is greater than the remaining number of the coils 200.

When it is determined that the remaining number of the bookbinding processing is greater than the remaining number of the coils 200, the controller 700 ends the image forming processing of one turn and temporarily stops the image forming processing in the image forming apparatus 500. Also, when the bookbinding processing of one turn is over, the controller 700 temporarily stops the bookbinding processing. When it is determined that the coil 200 is replenished and the remaining number of the coils 200 is thus greater than the remaining number of the bookbinding processing, the controller 700 resumes the image forming processing and the bookbinding processing. Thereby, it is possible to prevent the sheet, for which the printing has been completed, from being wasted.

The controller 700 is configured to acquire the coil information such as diameters, colors and the like of the coils 200 stored in the first coil storing unit $\mathbf{50}_1$ and the second coil storing unit $\mathbf{50}_2$ from the coil information detector 607, and the coil information detector $\mathbf{607}_2$. Thereby, the bookbinding processing in which the coil 200 having a color designated on the operation unit 600 by the user is selected can be performed. Also, the bookbinding processing in which the coil 200 corresponding to a thickness of the sheet bundle, which is acquired from the booklet thickness detector 604 on the basis of a type of sheet, a basis weight of a sheet, the number of sheets and the like, is selected can be performed.

That is, the controller 700 is configured to determine the optimal coil thickness on the basis of the information about the number of sheets, the thickness information of the sheet bundle after the sheets are aligned, and the diameter information of the coil 200, and to compare the same with the diameter information of the coil 200 stored in the coil storing unit, which is acquired from the coil information detectors $\mathbf{607}_1$ and $\mathbf{607}_2$ and the like, thereby selecting a predetermined coil 200 and performing the bookbinding processing. In a case where there is a single coil storing unit, when it is determined that the coil 200 having an appropriate diameter is not stored therein, the controller 700 temporarily stops the bookbinding processing, and urges the user to replace the coil 200.

Also, the controller 700 is configured to display an appropriate diameter of the coil 200 on the display unit 601 so that the user can check it. When it is determined that the coil 200 having an appropriate diameter is stored, the controller 700 executes the bookbinding processing, and when it is determined that the coil 200 having an appropriate diameter is not stored, the controller 700 temporarily stops the bookbinding processing, and urges the user to replace the coil 200.

Also, when it is determined that the coil 200 having an appropriate diameter is not stored, the controller 700 determines whether there is a coil having a replaceable diameter. When it is determined that a coil having a replaceable diameter is stored, the controller 700 temporarily stops the bookbinding processing, and presents an operation guide so as to check whether the user intends to continuously perform the processing.

Also, when it is determined that the coil 200 having an appropriate diameter is not stored, the controller 700 may determine whether there is a coil having a replaceable diameter, and when it is determined that a coil having a replaceable diameter is stored, the controller 700 may continue the bookbinding processing in which a coil having a replaceable diameter is used, without the user's confirmation.

Similarly, also for the color of the coil, the controller 700 is configured to compare a color of the coil selected by the user and the color information of the coil 200 stored in the coil storing unit, which is acquired from the coil information detector $\mathbf{607}_1$ and $\mathbf{607}_2$ and the like, to select the coil 200 of a predetermined color and to perform the bookbinding processing. In a case where there is a single coil storing unit, when it is determined that the coil 200 of an appropriate color is not stored, the controller temporarily stops the bookbinding processing, and urges the user to replace the coil 200.

When a plurality of jobs is continuously performed in the image forming apparatus 500, the controller 700 determines a thickness of the sheet bundle and a diameter of the coil 200 in the bookbinding processing of a first booklet, and performs the bookbinding processing by using the coil having the same diameter for a second booklet and thereafter. Also, when the booklets have different thicknesses, the controller 700 temporarily stops the bookbinding processing.

As the coil information, a diameter and a pitch of the coil 200, a color of the coil 200, a size of sheet to be bound, and a remaining number of the coils 200 may be acquired. The diameter of the coil is acquired through detection by a sensor, detection by identification information provided to the coil holding sheet, an input on the operation unit of the bookbinding apparatus, an input on the operation unit of the image forming apparatus, and the like. The color of the coil is acquired through detection by a sensor, detection by identification information provided to the coil holding sheet, an input on the operation unit of the bookbinding apparatus, an input on the operation unit of the image forming apparatus, and the like. The coil information is recorded by code information such as a barcode, a magnetic card, an RFID tag, and the like. The information about the number of sheets to be bound is acquired through the information about the number of sheets, which is recognized by the image forming apparatus, detection of a thickness of the sheet bundle in the sheet aligning unit 3, counting of the number of sheets to be conveyed, and the like.

The subject application is based on Japanese Patent Application No. 2015-214636 filed on Oct. 30, 2015, the contents of which are incorporated herein by reference.

DESCRIPTION OF REFERENCE NUMERALS

1A to 1F . . . bookbinding apparatus, 2 . . . punching unit, 3 . . . sheet aligning unit, 4 . . . binding unit, 5A to 5E . . . coil supply unit, 5F . . . binding component supply unit, 6A to 6E . . . coil conveyance path, 7 . . . discharging unit, 100A . . . coil holding sheet, 101 . . . holder, 101*a* . . . push-up piece, 101*b* . . . slit, 101*c* . . . cut, 101*d* . . . bent portion, 101*f* . . . holding piece, 102 . . . escape hole, 103 . . . coil holding row, 103*a* . . . holder forming place, 103*b* . . . coupling portion, 200 . . . coil

The invention claimed is:

1. A bookbinding apparatus in combination with a plurality of binding components held, on a holding sheet, wherein the bookbinding apparatus is configured to bind sheets with the plurality of binding components by separating the binding components one by one from the holding sheet, wherein the holding sheet has a first surface and a second surface on an opposite side from the first surface and holds the binding components, and the bookbinding apparatus is configured to insert the binding components into a plurality of holes formed in the sheets, the binding components each including a spirally wound wire rod having a plurality of circumference areas which are continuous with each other, the plurality of circumference areas together forming a total circumference area, the circumference areas including a first part which is greater than a half of the total circumference area, wherein the first part protrudes from the first surface of the holding sheet as the holding sheet holds the binding components, the plurality of circumference areas further including a second part which is less than half of the total circumference area, wherein the second part protrudes from the second surface of the holding sheet as the holding sheet holds the binding components, the bookbinding apparatus comprising:

a sheet conveyance path configured to convey the sheets;

a hole forming unit configured to form the plurality of holes at an end portion of the sheets to be conveyed on the sheet conveyance path;

a sheet aligning unit configured to stack and align sheets after having the plurality of holes formed therein in the hole forming unit;

a binding component storing unit configured to store therein the holding sheet holding the binding components;

a binding component separating unit configured to separate the binding components, one at a time, from the holding sheet stored in the binding component storing unit;

a coil feed unit configured to feed the binding components after being separated from the holding sheet by the binding component separating unit; and a binding component rotation/insertion unit configured to insert the binding components into the plurality of holes formed in the sheets by conveying the binding components fed by the coil feed unit while rotating the binding components in a circumferential direction;

wherein the binding component separating unit includes a contact part configured to separate the binding components from the holding sheet by contacting the first part of each binding component protruding from the first surface of the holding sheet.

2. The bookbinding apparatus according to claim 1, wherein the binding component storing unit stores the holding sheet such that the binding components are arranged in parallel, and the binding components are spaced from each other in a first direction, and wherein the contact part comes into contact with the first part of one of the binding components which is at an end position with respect to the first direction.

3. The bookbinding apparatus according to claim 1, wherein the contact part is a part of a holding sheet conveyance roller which sandwiches and conveys the holding sheet stored in the binding component storing unit.

4. The bookbinding apparatus according to claim 1, further comprising:

a binding component conveyance path which connects the coil feed unit and the binding component rotation/insertion unit, wherein the binding component conveyance path includes a curved conveyance path for conveying one of the binding components in a curved state, with respect to an axial direction of said one of the binding components, toward a location at which the binding component rotation/insertion unit starts insertion of the binding component into the sheets, wherein an end of the curved conveyance path is spaced from said location by a distance smaller than a length of one binding component.

5. The bookbinding apparatus according to claim 4, wherein the curved conveyance path is configured so that a feed direction of the binding component fed from the coil feed unit toward the curved conveyance path and an introduction direction of the binding component into the binding component rotation/insertion unit are opposite to each other.

6. The bookbinding apparatus according to claim 1, wherein the apparatus includes a plurality of the binding component storing units, and wherein each of the binding component storing units is configured so that the holding sheet is independently detachable thereto.

7. The bookbinding apparatus according to claim 1, wherein the binding component storing unit is configured to store a plurality of the holding sheets, each holding the plurality of binding components.

8. A bookbinding apparatus in combination with a plurality of binding components held on a holding sheet, wherein the bookbinding apparatus is configured to bind sheets with the plurality of binding components by separating the binding components one by one from the holding sheet, wherein the holding sheet has a first surface and a second surface on an opposite side from the first surface and holds the binding components, and the bookbinding apparatus is configured to insert the binding components into a plurality of holes formed in the sheets, the binding components each including a spirally wound wire rod having a plurality of circumference areas which are continuous with each other, the plurality of circumference areas together forming a total circumference area, the circumference areas including a first part which is greater than half of the total circumference area, wherein the first part protrudes from the first surface of the holding sheet, as the holding sheet holds the binding components, the plurality of circumference areas further including a second part which is less than half of the total circumference area, wherein the second part protrudes from the second surface of the holding sheet, as the holding sheet holds the binding components, the bookbinding apparatus comprising:

a sheet aligning unit configured to stack and align a plurality of sheets having a plurality of holes formed therein;

a binding component storing unit configured to store therein the holding sheet holding the plurality of binding components;

a binding component separating unit configured to separate the binding components, one at a time, from the holding sheet stored in the binding component storing unit;

a coil feed unit configured to feed the binding components separated by the binding component separating unit; and a binding component rotation/insertion unit configured to insert the binding components into the plurality of holes formed in the sheets by conveying the binding components fed by the coil feed unit while rotating the binding components in a circumferential direction;

wherein the binding component separating unit includes a contact part configured to separate the binding components from the holding sheet by contacting the first part of each binding component protruding from the first surface of the holding sheet.

* * * * *